US006563067B2

(12) United States Patent
Ohtsuka et al.

(10) Patent No.: US 6,563,067 B2
(45) Date of Patent: May 13, 2003

(54) CONTROL DEVICE FOR MAKE BREAK SWITCH

(75) Inventors: Kyouichi Ohtsuka, Tokyo (JP); Nobuya Nakajima, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/878,926

(22) Filed: Jun. 13, 2001

(65) Prior Publication Data

US 2002/0056631 A1 May 16, 2002

(30) Foreign Application Priority Data

Jun. 14, 2000 (JP) ..... 2000-177671
Nov. 15, 2000 (JP) ..... 2000-347371

(51) Int. Cl.[7] ..... F16H 55/00; H01H 33/02

(52) U.S. Cl. ..... 200/400; 200/501

(58) Field of Search ..... 200/17 R, 400, 200/401, 500, 501, 318, 320, 323, 324–326

(56) References Cited

U.S. PATENT DOCUMENTS 4,839,476 A 6/1989 Okuno ..... 200/17 R
5,901,838 A * 5/1999 Nakatani et al. ..... 200/400
6,232,569 B1 * 5/2001 Nakajima et al. ..... 200/17 R
6,316,739 B1 * 11/2001 Ohtsuka et al. ..... 200/400
6,348,847 B1 * 2/2002 Nakajima et al. ..... 200/17 R

* cited by examiner

*Primary Examiner*—Michael Friedhofer
(74) *Attorney, Agent, or Firm*—Leydig, Voit & Mayer, Ltd.

(57) ABSTRACT

A make break switchgear includes a first breaking lever receiving a torque in a counterclockwise direction, a second breaking lever connected through a linkage to the first breaking lever, and a making lever receiving a torque in a clockwise direction. These elements are supported by a main shaft and are rotatable. When a circuit is completely opened by the switchgear, a guide guiding a rotor on an arched surface is engaged with a first releasing latch. It is unnecessary to wait for engagement between the first releasing latch and the guide after the circuit is closed for opening the switchgear, and a subsequent opening can be immediately started. Therefore, it is possible to reduce the time from the closing of a make break contact to starting of the next opening.

22 Claims, 73 Drawing Sheets

CONTROL DEVICE FOR MAKE BREAK SWITCH

BACKGROUND OF THE INVENTION

1. Field of the Invention

The present invention relates to a control device for make break switches, such as breakers, installed in, for example, transforming stations and switchyards.

2. Discussion of Background

As an operating force for a control device for breakers, as a make break switch, a spring force is practically used. FIGS. 70 through 73 illustrate a conventional control device for breakers, which is disclosed in Japanese Unexamined Patent Publication JP-A-63-304542. FIG. 70 is a perspective view illustrating a structure of the control device for the breaker. FIG. 71 illustrates an important portion of the structure of the control device for the breaker, wherein the breaker is in a state of closing a circuit, and breaking torsion bars and closing torsion bars are prestressed.

FIG. 72 illustrates an important portion of the structure of the control device for the breaker, wherein the breaker is in a state of opening the circuit, an opening torsion bar is released, and a closing torsion bar is prestressed. FIG. 73 illustrates an important portion of the structure of the control device for the breaker, wherein the breaker is in a state of closing the circuit, the opening torsion bar is prestressed, and the closing torsion bar is released.

In these figures, numerical reference 1 designates a case; numerical reference 24 designates a cylinder, fixed to the case 1; and numerical references 26 and 27 respectively designate rotatable levers, which are engaged with pins (not shown), formed on end surfaces of the cylinder 24. Numerical references 28 and 34 designate the opening torsion bars; and numerical references 29 and 35 designate the closing torsion bars. The opening torsion bar 28 is fixed to the case 1 at one end and also fixed to the lever 26 at the other end. The opening torsion bar 34 is fixed to a rotational shaft 32 at one end as illustrated in FIG. 71, and fixed to the lever 26 at the other end.

The closing torsion bar 29 is fixed to the case 1 at one end and fixed to the lever 27 at the other end. The closing torsion bar 35 is fixed to a rotational shaft 33 at one end, as illustrated in FIG. 71, and fixed to the lever 27 at the other end. Although, details will be described in this specification, because the closing torsion bars 29 and 35 are released when the opening torsion bars 28 and 34 are prestressed, prestressing energy of the closing torsion bars 29 and 35 is larger than prestressing energy of the opening torsion bars 28 and 34.

Numerical reference 37 designates a making lever fixed to the rotational shaft 33, wherein the making lever is applied with a counterclockwise rotational force in FIG. 71 by the closing torsion bars 29 and 35. Numerical reference 2 designates a camshaft, supported by the case 1; numerical reference 3 designates a cam, mounted on the camshaft; numerical reference 13 designates a second pin, formed in the cam; and numerical reference 14 designates a making latch, engaged with the second pin 13. Numerical reference 15 designates a making trigger, engaged with the making latch 14; and numerical reference 16 designates a making electromagnet having a plunger 17.

Numerical reference 38 designates a rotational shaft, supported by the case 1, whereby the rotational shaft is driven by a motor (not shown) in a counterclockwise direction. Numerical reference 39 designates a pinion, fixed to the rotational shaft 38; and numerical reference 40 designates a gear, engaged with the pinion 39 and fixed to the camshaft 2, wherein teeth are partly removed so that the engagement with the pinion 39 is released when the closing torsion bars 29 and 35 are prestressed. Numerical reference 41 designates a link, connecting the making lever 37 with the gear 40.

Numerical reference 36 designates a breaking lever, fixed to the rotational shaft 32, wherein the breaking lever is applied with a rotational force in a counterclockwise direction by the opening torsion bars 28 and 34. Numerical references 8 and 9 respectively designate a first pin and a rotor, both of which are located in the breaking lever 36. Numerical reference 18 designates a releasing latch, which is engaged with the first pin 8 and applied with rotational force in a clockwise direction by a spring 43.

Numerical reference 19 designates a releasing trigger, engaged with the releasing latch 18. Numerical reference 20 designates a releasing electromagnet having a plunger 21. Numerical reference 22 designates a movable contact of the breaker, wherein the movable contact is connected to the breaking lever 36 through a linkage mechanism 23. Numerical reference 42 designates a buffer, connected to the breaking lever 36 to relax an impact applied at time of opening and closing the movable contact 22.

In the next, an operation of opening the circuit will be described. The breaking lever 36 is constantly applied with a rotational force in a counterclockwise direction by the opening torsion bars 28 and 34, and the rotational force is retained by the releasing latch 18 and the releasing trigger 19. When the releasing electromagnet 20 is excited in this state, the plunger 21 is moved in a rightward direction; the releasing trigger 19 is rotated in a clockwise direction; and the releasing latch 18 is rotated in a counterclockwise direction by a counter force, applied from the first pin 8. When the releasing latch 18 is released from the first pin 8, the breaking lever 36 is rotated in a counterclockwise direction, and the movable contact 22 is driven in a direction of opening the circuit. A state that the operation of opening the circuit is completed is illustrated in FIG. 72.

An operation of closing the circuit will be described. In FIG. 72, the cam 3 is connected to the making lever 37 through the camshaft 2, the gear 40, and the linkage 41, wherein a rotational force in a clockwise direction is applied by the closing torsion bars 29 and 35. The rotational force is retained by the making latch 14 and the making trigger 15.

When the making electromagnet 16 is excited to drive the plunger 17 in the rightward direction, the making trigger 15 is rotated in the clockwise direction; and the making latch 14 is rotated in the counterclockwise direction by a counterforce applied from the second pin 13. Because the making latch 14 is released from the second pin 13 to rotate the cam 3 in the clockwise direction so that the rotor 9 located in the breaking lever 36 is pushed up, the breaking lever 36 twists the opening torsion bars 28 and 34 in the clockwise direction.

When the breaking lever 36 is rotated by a predetermined angle and the movable contact 22 is driven in the direction of closing the circuit, the releasing latch 18 is engaged with the first pin 8, and the releasing trigger 19 is engaged with the releasing latch 18. The cam 3 is rotated while holding the breaking lever 36 through the rotor 9 until an engagement between the releasing latch 18 and the first pin 8 and an engagement between the releasing trigger 19 and the releasing latch 18 are stabilized. Thereafter, the cam 3 is disconnected from the rotor 9. FIG. 73 illustrates a state that the operation of closing the circuit is completed and the first pin 8 is held by the releasing latch 18. The control device for breaker should be operated to reopen the circuit immediately after closing the circuit, wherein the operation of reopening the circuit is to open the circuit from the state illustrated in FIG. 73.

The closing torsion bars 29 and 35 are prestressed as follows. As illustrated in FIG. 73, immediately after completing to close the circuit, the closing torsion bars 29 and 35 are in a releasing state. By rotating the pinion 39 in the counterclockwise direction by the motor (not shown), the gear 40 is rotated in the clockwise direction, and the closing torsion bars 29 and 35 are prestressed through the linkage 41, the making lever 37, and the rotational shaft 33.

After exceeding a dead point where a direction of pulling the linkage 41 crosses a center of the camshaft 2, the camshaft 2 is applied with a rotational force in the clockwise direction through the linkage 41 by a force of the closing torsion bars 29 and 35. Simultaneously, since the teeth of the gear 40 are partly removed, the engagement between the pinion 39 and the gear 40 is released. The making latch 14 is engaged with the second pin 13, and the rotational force of the gear 40 in the clockwise direction, caused by the force of the closing torsion bars 29 and 35, is retained, whereby the prestressing operation is completed. Thereafter, the state illustrated in FIG. 71 is realized.

In the above-mentioned conventional control device for breaker, the breaking lever 36 is rotated in the clockwise direction by the cam 3, illustrated in FIG. 72, and the movable contact 22 is driven in the direction of closing the circuit. When the breaking lever 36 is rotated by the predetermined angle, the releasing latch 18 is engaged with the first pin 8, and the releasing trigger 19 is engaged with the releasing latch 18. The cam 3 is further rotated and holds the breaking lever 36 through the rotor 9 until the engagement between the releasing latch 18 and the first pin 8, and the engagement between the releasing trigger 19 and the releasing latch 18 are stabilized. Thereafter, the contact between the cam and the rotor 9 is released.

Thus, a reactive motion is apt to occur when the releasing latch 18 and the first pin 8 are engaged, and the releasing trigger 19 and the releasing latch 18 are engaged, and further the cam 3 should hold the engagement while the reactive motion is ceased and the engagements are stabilized. Since the operation of opening the circuit cannot be performed while the cam 3 holds the breaking lever 36, there is a problem that this feature prevents a time for starting next operation of opening the circuit from being sufficiently shortened.

It is an object of the present invention to solve the above-mentioned problems inherent in the conventional technique and to provide a control device for make break switches, which can reduce the time from closing of a circuit to opening the circuit.

Another object of the present invention is to provide a control device for breakers, wherein the number of the parts of the control device is reduced, mechanical impact is prevented, and the size of the control device is reduced.

SUMMARY OF THE INVENTION

According to the present invention, to achieve the above-mentioned problems, there is provided a control device for a make break switch comprising: a first breaking lever, supported by a supporting structural member so as to be rotatable and connected to a contact; a prestressing means for opening a circuit urging the first breaking lever so that the first breaking lever is rotated in a predetermined direction; a linkage having first and second links and a connecting portion connecting the first linkage with the second linkage so as to be collapsible and connected to the first breaking lever through the first link; a second breaking lever, supported by the supporting structural member so as to be rotatable and connected to the second link; a making lever, supported by the supporting structural member so as to be rotatable and connected to and disconnected from the second breaking lever; a prestressing means for closing the circuit, which urges the making lever so as to be rotated in a direction adverse to the predetermined direction; a making latch for securing the making lever; a guide having a guiding surface for guiding a connecting portion while keeping a contact with the connecting portion and supported by the supporting structural member so that the guide is movable; a first releasing latch for securing the guide; and a second releasing latch for securing the second breaking lever and interlocked with the guide, wherein when an engagement of the guide by the first releasing latch is released, the guide is pushed by the connecting portion and moved, the engagement between the second releasing latch, interlocked with the guide, and the second breaking lever is released, and the first breaking lever is rotated and driven in a predetermined direction by releasing the prestressing means for opening the circuit to open the contact, the guide is engaged again with the first releasing latch after the first breaking lever is rotated by a predetermined angle in a predetermined direction, the second breaking lever is rotated and driven in a direction adverse to the predetermined direction through the making lever when the prestressing means for closing the circuit is released by disengagement between the making latch and the making trigger, the connecting portion is guided by a guiding surface of the guide, engaged with the first releasing latch, to close the contact by rotating the first breaking lever in the direction adverse to the predetermined direction, simultaneously the prestressing means for opening the circuit is prestressed, and a prestressed state of the prestressing means for opening the circuit and a state of closing the contact are maintained by engagement between the second breaking lever and the second releasing latch.

Because the guide is engaged with the first releasing latch when the first breaking lever is rotated by the predetermined angle in the predetermined direction at time of opening the contact, namely, the guide is engaged with the first releasing latch before next operation of closing the circuit, the operation of opening the circuit can be immediately started before the guide is engaged with the first releasing latch when the circuit is completely closed.

Further, an aspect is that a circuit opening motion preventing member, stopping a motion of a first releasing latch during an operation of closing a circuit by a make break contact in association with a rotation of a making lever or a first breaking lever, is located.

By preventing a release of an engagement of a guide upon an erroneous operation of a first releasing latch in course of a close of the circuit, the circuit opening motion preventing member prevents the release, whereby it is possible to avoid a generation of a large impact caused by a collision between the first breaking lever, which is rotated in a predetermined direction by a prestressing means for opening the circuit when the engagement of the guide is released and a support by the connecting portion is lost in the course of the closing operation, and the second breaking lever, rotated in a direction adverse to the predetermined direction by the making lever in course of the closing operation.

Another aspect is that, by locating a releasing trigger so as to be rotatable in a supporting structural member and rotating the releasing trigger, an engagement of a guide by a first releasing latch is released, and a circuit opening motion preventing member moves along with a rotation of a making lever or a first breaking lever to stop a rotation of the releasing trigger in a course of the closing operation of a make break contact. In use of the simple structure, it is possible to avoid a release of the engagement of the guide by the first releasing latch as a result of a rotation of the first releasing latch in the course of the closing operation.

Another aspect is that a circuit closing motion preventing means is located to stop an operation of a making latch along with a rotation of a first breaking lever in a state that a make break contact is closed. By making a circuit closing motion preventing means mechanically interlocked with a rotation of the first breaking lever, it is possible to stop an operation of the making latch. Accordingly, when both of a prestressing means for opening the circuit and a prestressing means for closing the circuit are prestressed, it is possible to prevent a large impact, caused by a collision of a making lever and a second breaking lever upon a release of an engagement of the making lever by the making latch, from being generated.

Another aspect is that a making trigger is located in a supporting structural member so as to be rotatable, an engagement of a making lever by a making latch is released by a rotation of the making trigger, a circuit making and opening motion preventing member is moved along with a rotation of a first breaking lever, and a rotation of the making trigger is stopped in a state that a make break contact is closed.

By such simple structure, it is possible to prevent a release of the engagement of the making lever by the making trigger upon a rotation of the making trigger in the state that the make break contact is closed.

Another aspect is that a circuit opening motion preventing member for stopping an operation of a first releasing latch along with a rotation of a making lever or a first breaking lever during a closing operation of a make break contact and a circuit closing motion preventing means for stopping an operation of the making latch along with a rotation of a first breaking lever in a state that the make break contact is closed. By preventing an erroneous release of an engagement of a guide upon an operation of the first releasing latch, it is possible to prevent a danger that a large impact is generated by a collision of the first breaking lever, rotated in a predetermined direction by the prestressing means for opening the circuit when the engagement of the guide is released and a support of the connecting portion is canceled, and a second breaking lever, which is rotated in a direction adverse to the predetermined direction by the making lever, during the operation of closing the circuit.

Another aspect is that, it is possible to stop an operation of a making latch by a mechanical interlock between a rotation of the first breaking lever and a circuit closing motion preventing member. Accordingly, when both of a prestressing means for opening a circuit and a prestressing means for closing the circuit are prestressed, it is possible to prevent a large impact, caused by a collision between the making lever, of which engagement is released from a making latch, and a second breaking lever.

Another aspect is that a releasing trigger and a making trigger are located in a supporting structural member so as to be rotatable. By rotating the releasing trigger, an engagement of a guide by a first releasing latch is released. Simultaneously, by rotating a making trigger, an engagement of a making lever by the making trigger is released, a circuit opening motion preventing member moves along with a rotation of the making lever or a first breaking lever to stop a rotation of the releasing trigger during a closing operation of a make break contact, and a circuit closing motion preventing member moves along with a rotation of the first breaking lever to stop a rotation of the making trigger in a state that the make break contact is closed.

By such simple structure, it is possible to prevent a release of the engagement of the guide by the first releasing latch upon a rotation of the first releasing latch during the closing operation and a release of the engagement of the making lever by the making trigger upon a rotation of the making trigger in the state that the make break contact is closed, whereby a large impact can be prevented from occurring.

Another aspect is that a stopper is further located for receiving a releasing force of a prestressing means for closing a circuit when an engagement of a guide by a first releasing latch is canceled when the prestressing means for closing the circuit is released or the prestressing means for closing the circuit is in a released state.

Even though a limiter is located, it is possible to open the circuit immediately after completing to close the circuit. Therefore, when the circuit is opened immediately after completing to close the circuit, it is possible to prevent an excessive impact, caused by a collision, from occurring by receiving the releasing force of the prestressing means for closing the circuit, left after an operation of closing the circuit, by the stopper.

Another aspect is that a prestressing means for opening a circuit and a prestressing means for closing the circuit are torsion bars. In use of the torsion bars, efficiency of energy is improved, and concentration of stress is avoided.

Another aspect is that a prestressing means for opening a circuit and a prestressing means for closing the circuit are coil springs. In use of the coil springs, the prestressing means becomes compact.

Another aspect is that a first breaking lever and a second breaking lever are commonly supported by a supporting shaft, located in a supporting structural member so as to be rotatable. Because it is unnecessary to individually support the breaking levers, the number of components is reduced, and a structure is simplified.

Another aspect is that a second breaking lever and a making lever are commonly supported by a supporting shaft, located in a supporting structural member, so as to be rotatable. Because it is unnecessary to individually support the second breaking lever and the making lever, the number of components is reduced, and a structure is simplified.

Another aspect is that a first breaking lever, a second breaking lever, and a making lever are commonly supported by a supporting shaft, located in a supporting structural member, so as to be rotatable. Because it is unnecessary to individually support the first breaking lever, the second breaking lever, and the making lever, the number of components is reduced, and a structure is simplified.

Another aspect is that a guide and a second releasing latch are commonly supported by a supporting shaft, located in a supporting structural member, so as to be rotatable. Because it is unnecessary to individually support the second releasing latch and the making lever, the number of components is reduced, and a structure is simplified.

Another aspect is that a first breaking lever and a second breaking lever are commonly supported by a supporting shaft, located in a supporting structural member, so as to be rotatable, and a guiding surface of a guide forms an arch, and the center of the arch of an arch surface is positioned in a middle of the supporting shaft when the guide is engaged with the first releasing latch. Therefore, it is possible to control a locus of movement of a connecting portion by a simple structure.

Another aspect is that a first breaking lever and a second breaking lever are commonly supported by a supporting shaft, located in a supporting structural member, so as to be rotatable, and a guiding surface of a guide is flat, whereby the guiding surface is easily processed, and a torque of a prestressing means for closing a circuit, transmitted to a first breaking lever at a time of starting to close the circuit or at a time of completing to close the circuit, is increased.

Another aspect is that a rotor of a linkage, being in contact with a guiding surface of a guide and guided by its rotation, is located in a connecting portion, whereby a frictional resistance, caused when the connecting portion is guided by the guide, is reduced, and a prestressed energy of a prestressing means for closing a circuit is effectively transferred to a first breaking lever at a time of closing a contact and prestressing a prestressing means for opening the circuit.

Another aspect is that a prestressing means for closing a circuit is prestressed by a prestressing device, which drives a making lever by a cam, driven by a motor, whereby a shape of the cam is determined to control a load of a torque of the motor at a time of prestressing the prestressing means for closing the circuit, and a maximum torque, applied to components of a prestressing device, is reduced.

Another aspect is that a prestressing device has a breaking member, which breaks a cam by a sliding motion on the cam so as to be elastically deformed, whereby the cam, rotating by inertia, is rapidly stopped by the break.

Another aspect is that a cam and a making latch are commonly located in a shaft so as to be rotatable, a prestressing means for closing a circuit is held to be in a prestressing state by an engagement between the making latch and the making lever, and the prestressing means for closing the circuit is released by canceling an engagement between the making latch and the making lever, whereby it is unnecessary to prepare a shaft for supporting the making latch, and the number of components is reduced.

Another aspect is that a make break switch is a breaker, wherein a control device is suitable for a breaker.

BRIEF DESCRIPTION OF THE DRAWINGS

A more complete appreciation of the invention and many of the attendant advantages thereof will be readily obtained as the same becomes better understood by reference to the following detailed description when considered in connection with the accompanied drawings, wherein.

DETAILED DESCRIPTION OF THE PREFERRED EMBODIMENTS

A detailed explanation will be given of preferred embodiments of the present invention in reference to the following figures, wherein the same numerical references are used for the same or similar portions and description of these portions is omitted.

Embodiment 1

Figure 1:
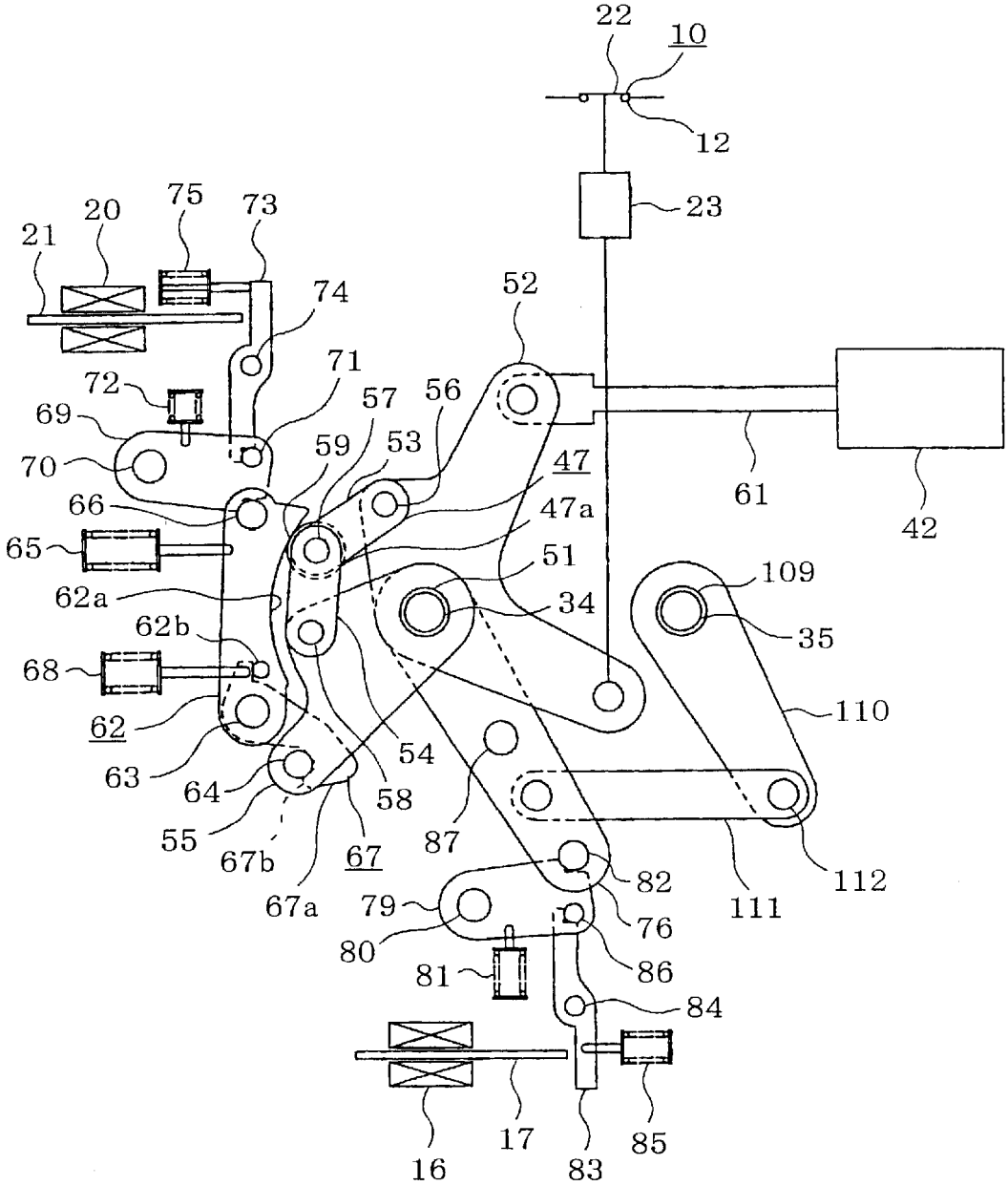
FIG. 1 illustrates an important portion of a control device for a breaker according to Embodiment 1 of the present invention, wherein the breaker is in a state of closing a circuit, and both of torsion bars for making and opening the circuit are prestressed.
Figure 2:
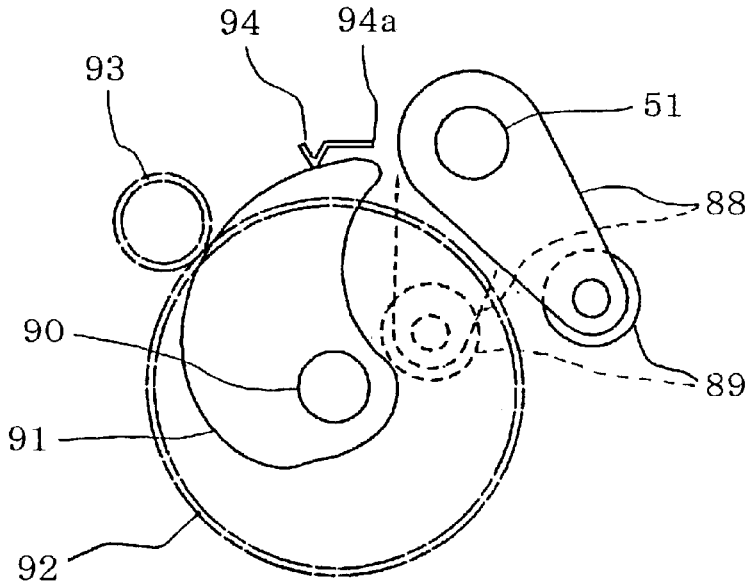
FIG. 2 illustrates a structure of an important portion of a prestressing device, which prestresses the torsion bars for closing the circuit, according to Embodiment 1 of the present invention.

A control device for a breaker according to Embodiment 1 will be described in reference of the figures. FIGS. 1 through 9 illustrate the control device for breaker according to Embodiment 1, wherein FIG. 1 illustrates a structure of an important portion of the control device for breaker, wherein the breaker is in a state of closing a circuit, and both of making and opening torsion bars are prestressed. FIG. 2 illustrates a structure of the important portion of the control device for breaker, wherein a structure of an important portion of a prestressing device for prestressing the torsion bars for closing the circuit is shown.

Figure 3:
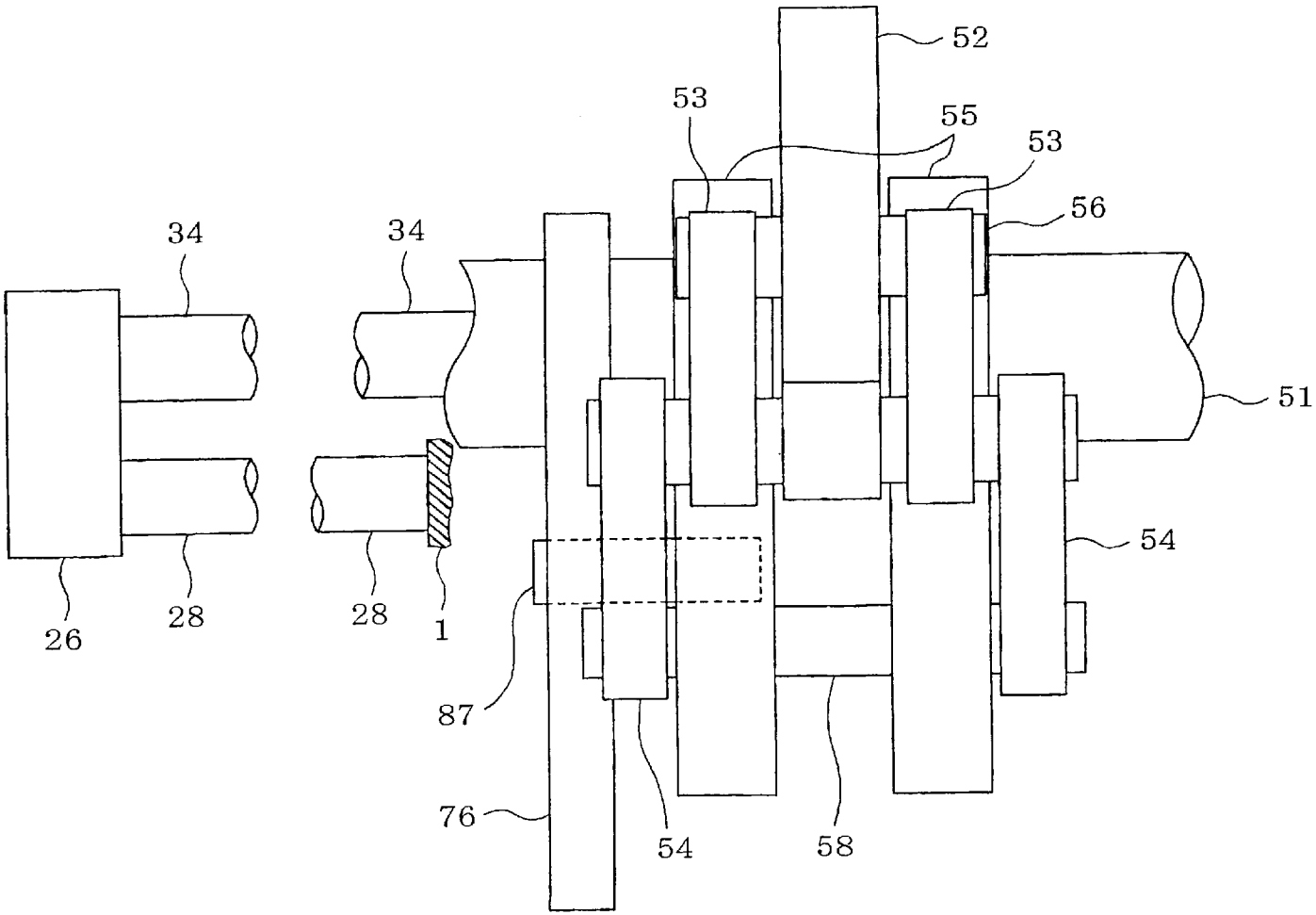
FIG. 3 is a side view of a structure around the torsion bars for opening the circuit and a first breaking lever according to Embodiment 1 of the present invention, wherein the structure is viewed from the left side of FIG. 1.
Figure 4:
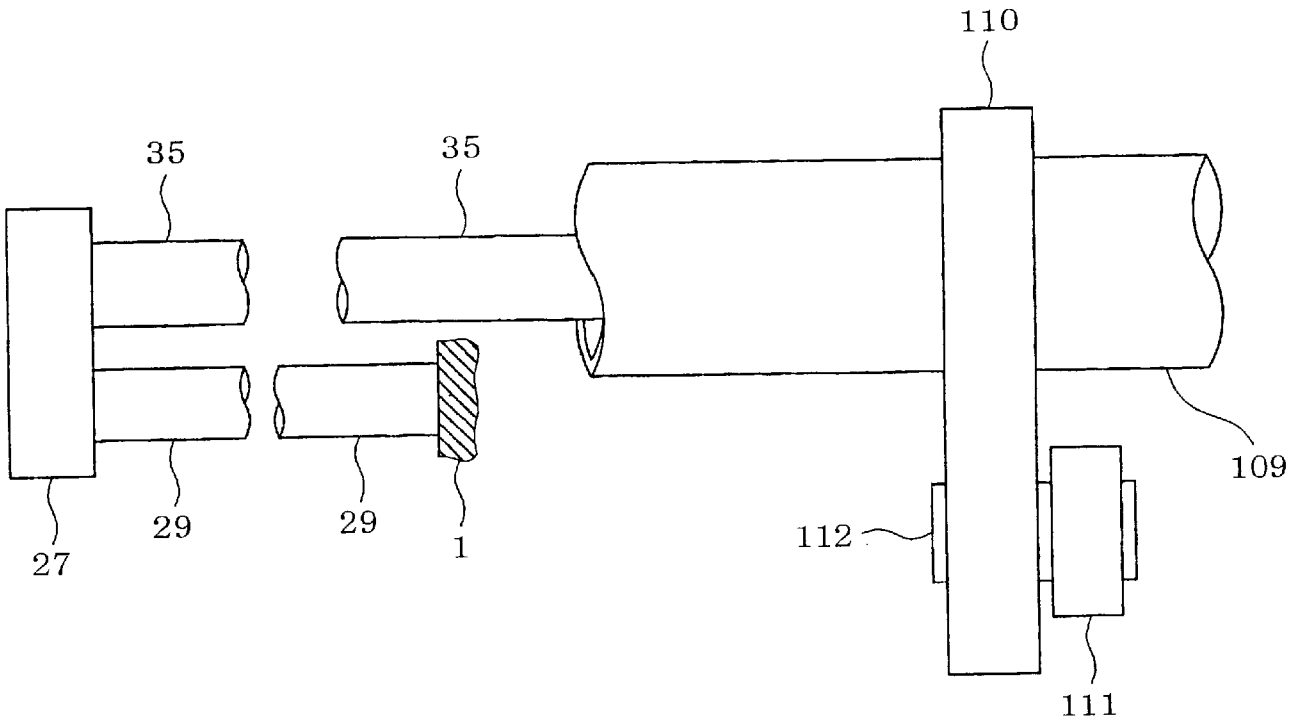
FIG. 4 is a side view of a structure around the torsion bars for closing the circuit and a making lever according to Embodiment 1, wherein the structure is viewed from the left side of FIG. 1.
Figure 5:
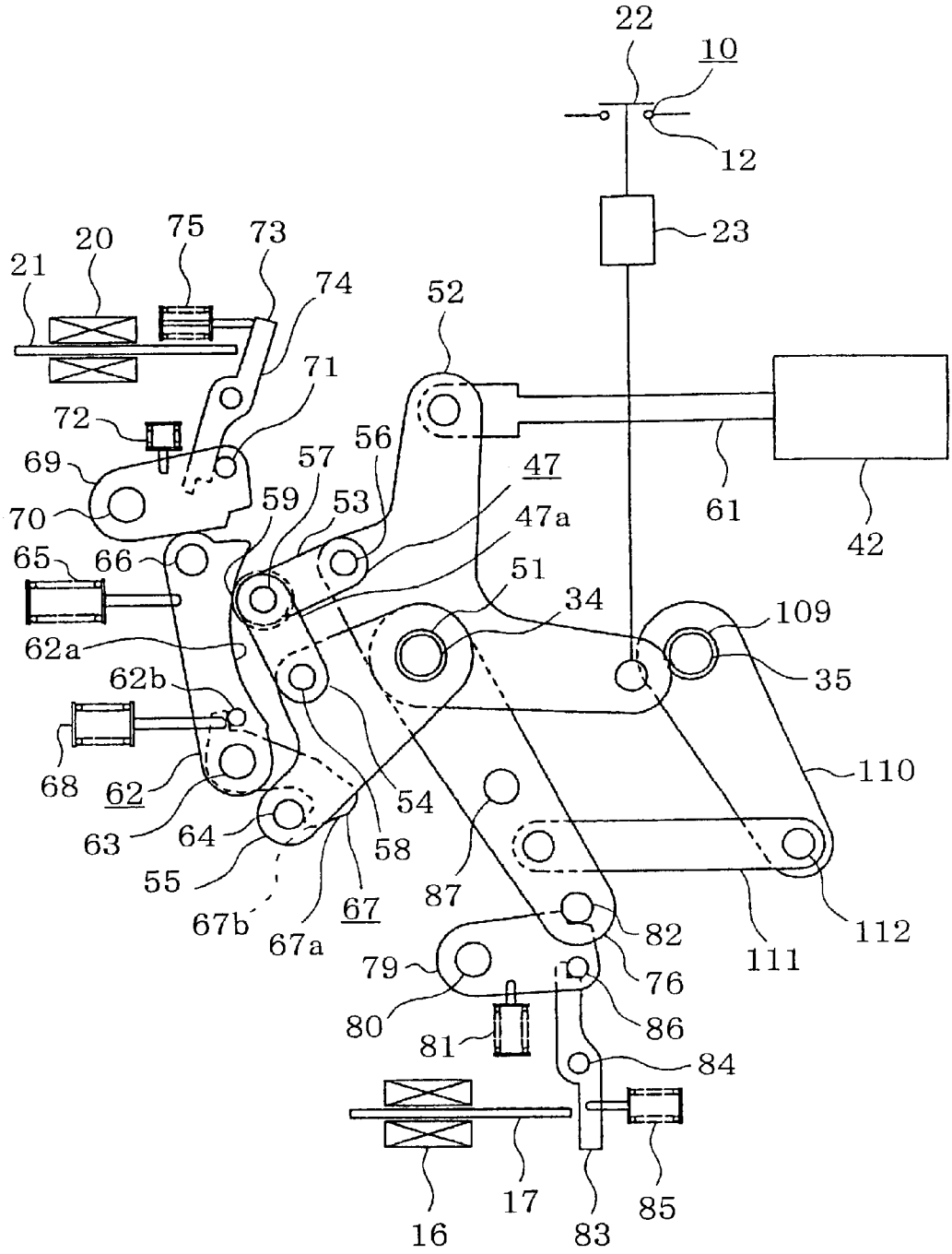
FIG. 5 illustrates a structure of the important portion of the control device for breaker according to Embodiment 1 in course of an operation of opening the circuit from the state illustrated in FIG. 1.
Figure 6:
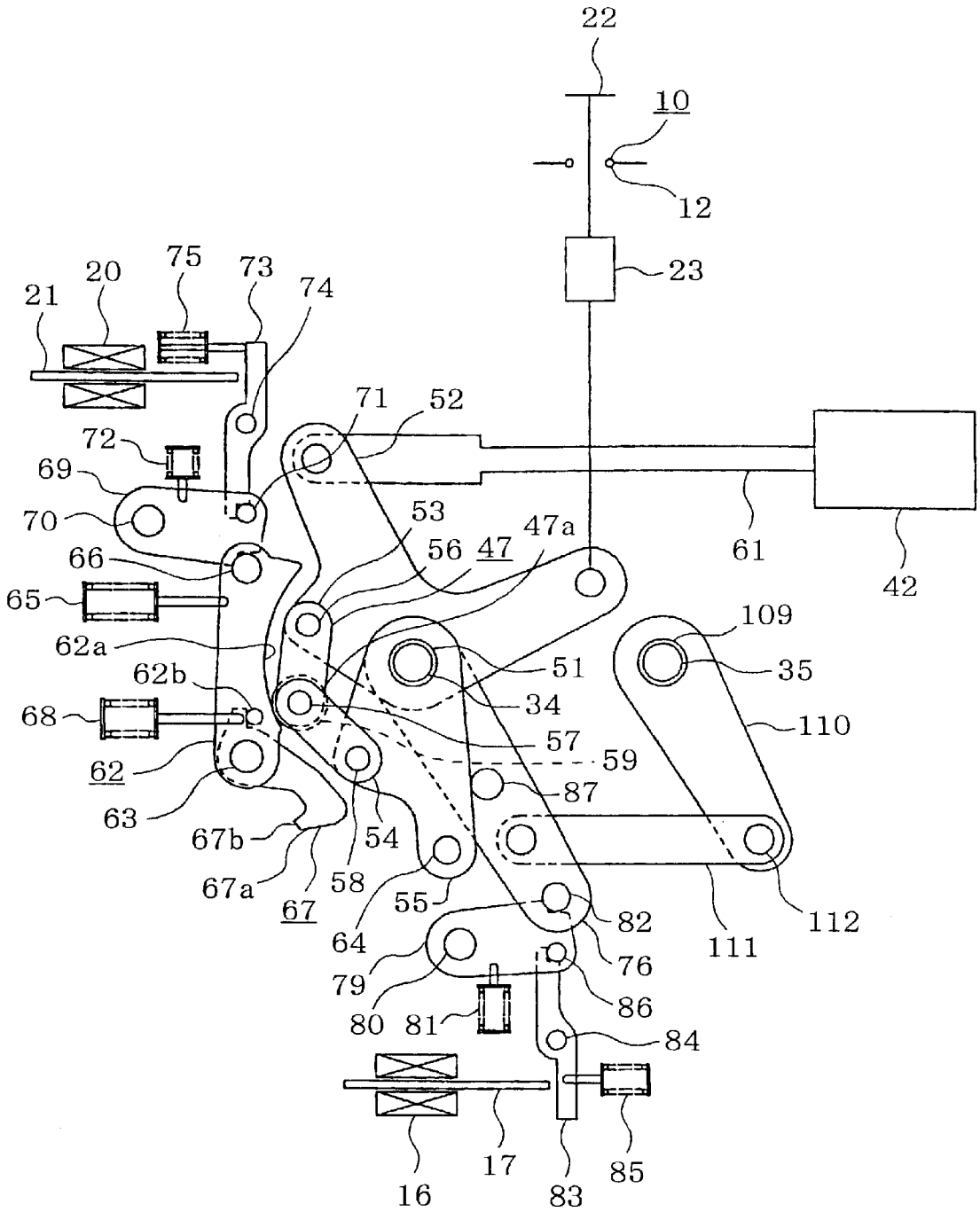
FIG. 6 illustrates a structure of the important portion of the control device for breaker according to Embodiment 1, wherein the operation of opening the circuit is completed after the state illustrated in FIG. 1, the torsion bars for closing the circuit are prestressed, and the torsion bars for opening the circuit are released.

FIG. 3 is a side view of a structure around the torsion bars for opening the circuit and a first breaking lever, viewed from a left side of FIG. 1. FIG. 4 is a side view, illustrating a structure around the torsion bars for closing the circuit and a lever, viewed from the left side of FIG. 1. FIG. 5 illustrates a structure of the important portion of the control device for breaker, wherein a state in course of an operation of opening the circuit from the state illustrated in FIG. 1 is shown. FIG. 6 illustrates a structure of the important portion of the control device for breaker, wherein the operation of opening the circuit is completed after the state illustrated in FIG. 5, the torsion bars for closing the circuit are prestressed, and the torsion bars for opening the circuit are released.

Figure 7:
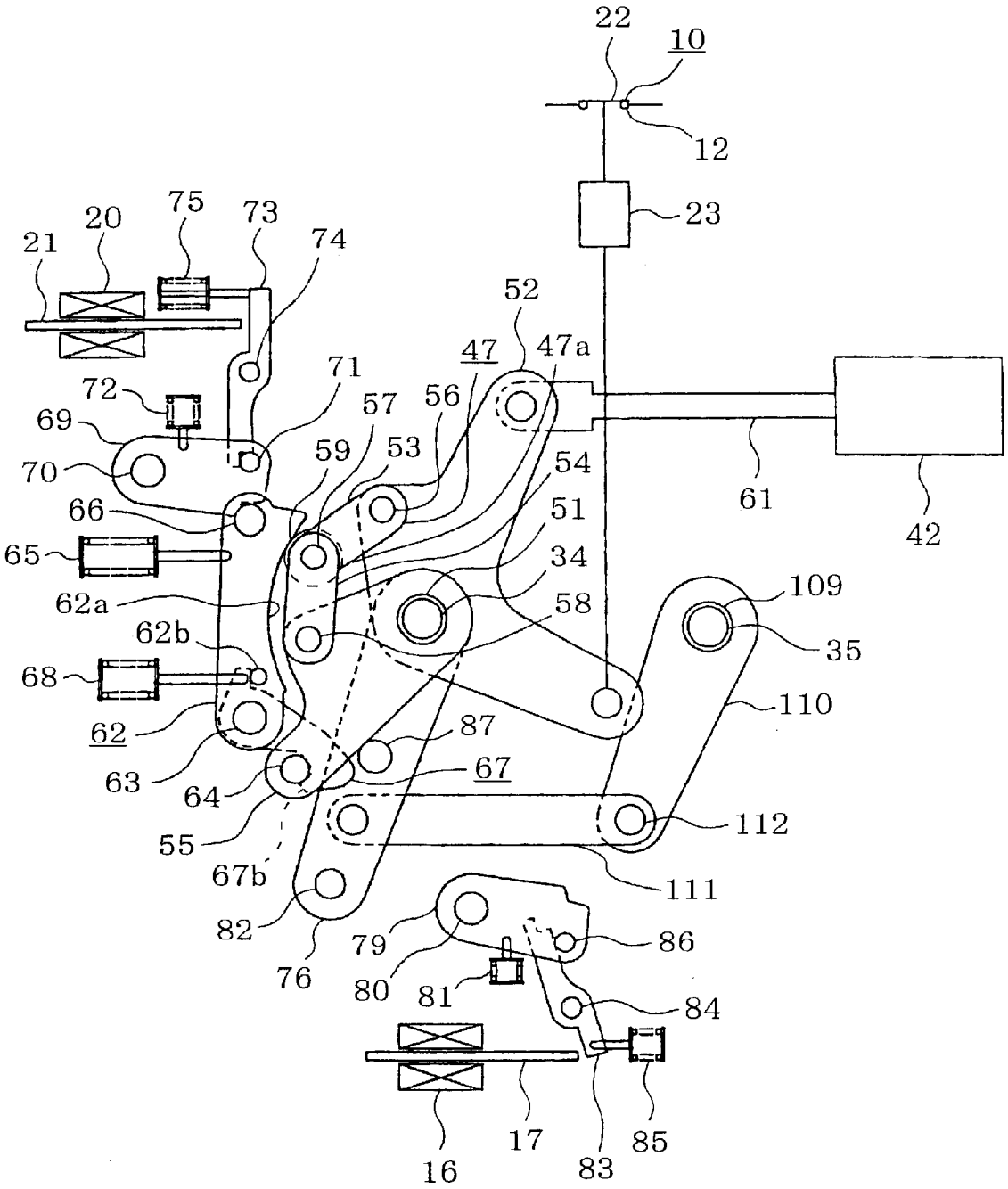
FIG. 7 illustrates a structure of the important portion of the control device for breaker according to Embodiment 1, wherein the breaker is in a state of closing the circuit, the torsion bars for closing the circuit are released, and the torsion bars for opening the circuit are prestressed.
Figure 8:
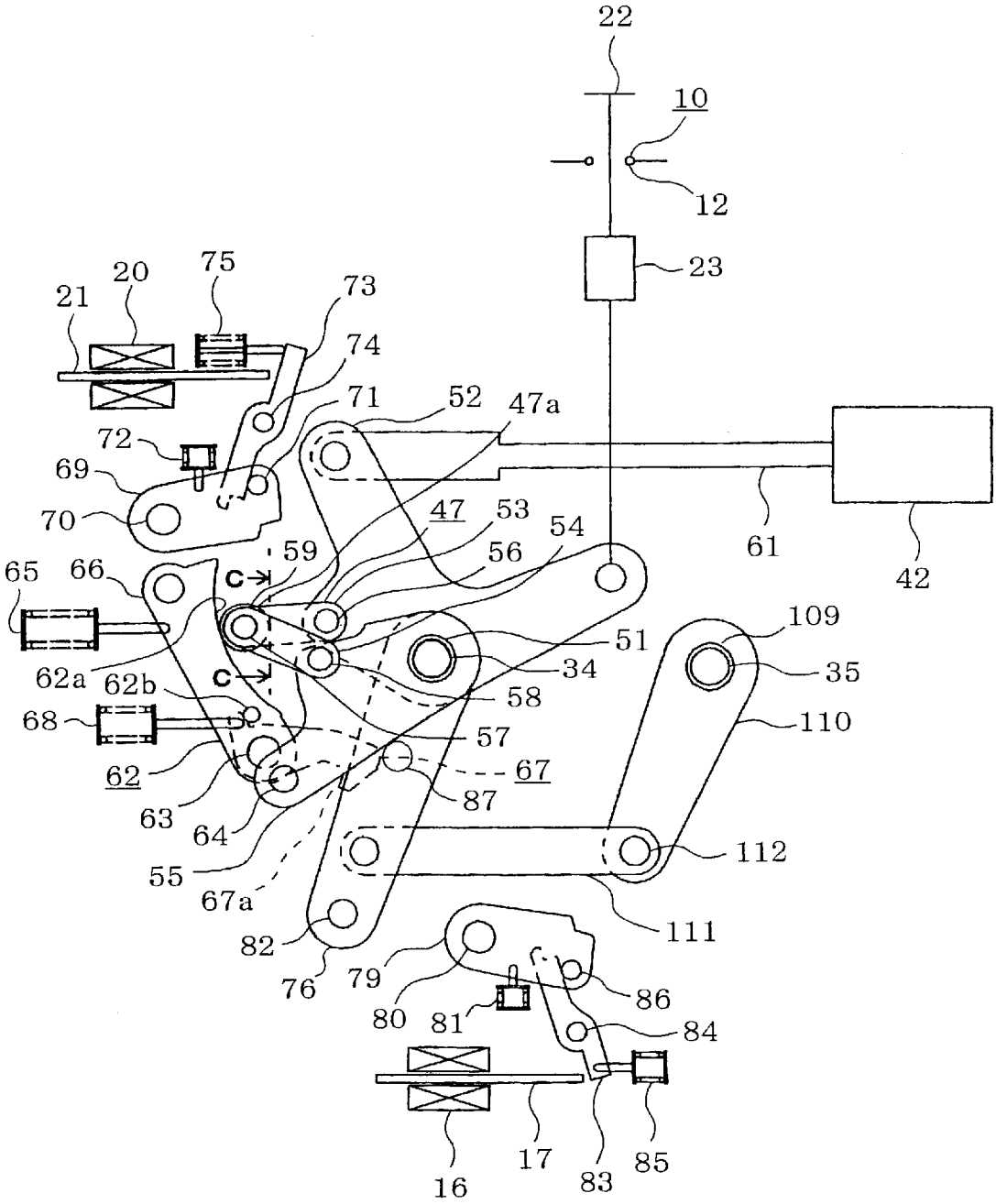
FIG. 8 illustrates a state that a second operation of opening the circuit is completed immediately after rapidly reclosing the circuit according to Embodiment 1, wherein the breaker is in a state of opening the circuit, and both of the torsion bars for making and opening the circuit are released.
Figure 9:
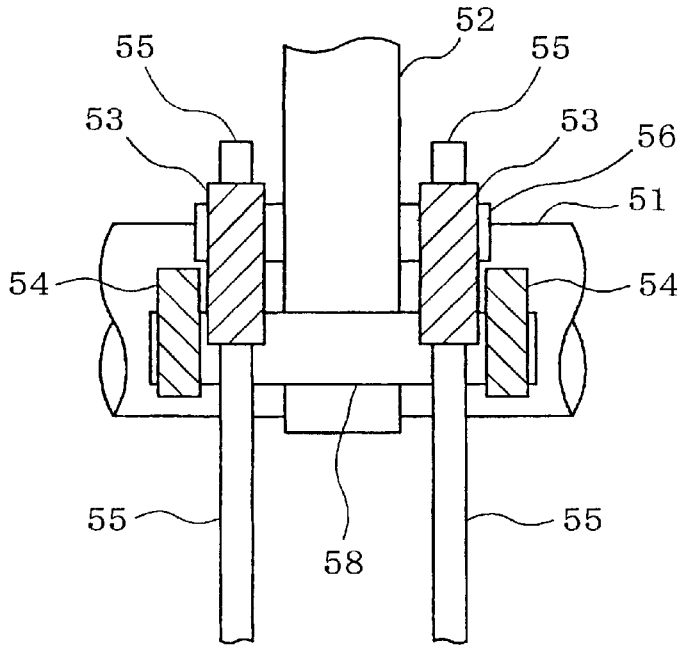
FIG. 9 is a cross-sectional view of FIG. 8 taken along a line IX—IX of FIG. 8.

FIG. 7 illustrates a structure of the important portion of the control device for a breaker, wherein the breaker is in the state of closing the circuit, the torsion bars for closing the circuit are released, and the torsion bars for opening the circuit are prestressed. FIG. 8 illustrates a structure of the important portion of the control device for a breaker, wherein a second operation of opening the circuit is completed immediately after an operation of rapidly reclosing the circuit, the breaker is in a state of opening the circuit, and the torsion bars for making and the torsion bars for opening the circuit are released. FIG. 9 is a cross-sectional view of FIG. 8 taken along a line IX—IX of FIG. 8.

Figure 70:
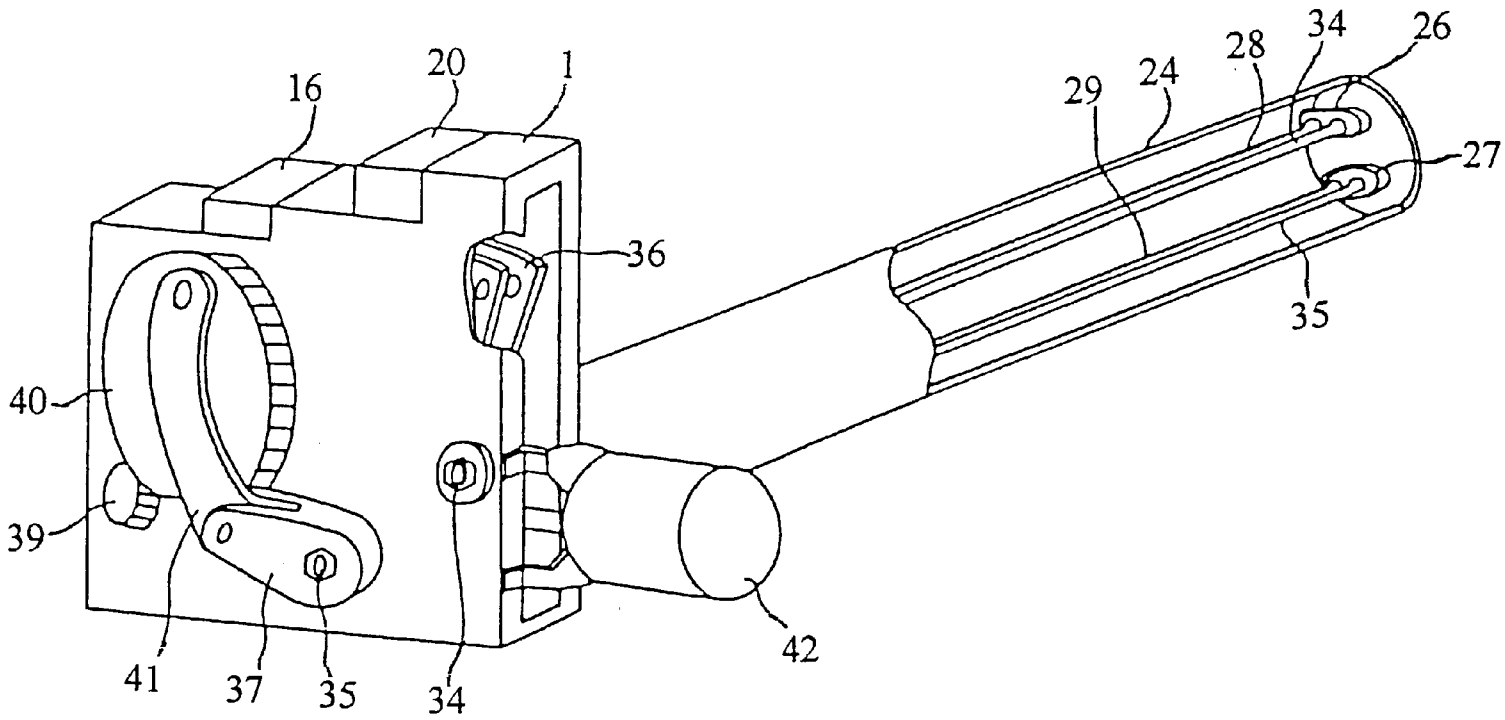
FIG. 70 is a perspective view illustrating a structure of a conventional control device for a breaker.
Figure 71:
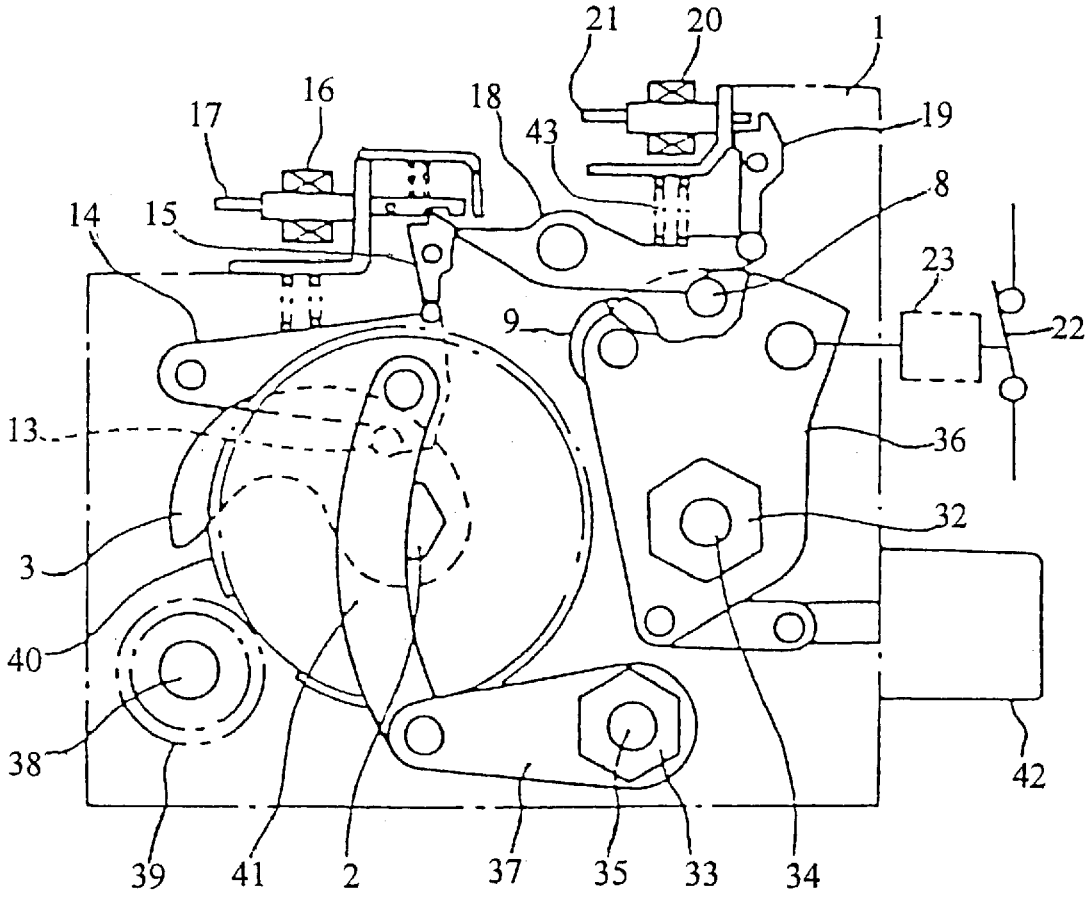
FIG. 71 illustrates a structure of an important portion of the conventional control device for breaker, wherein the breaker is in a state of closing a circuit, and both of torsion bars for breaking and torsion bars for closing the circuit are prestressed.
Figure 72:
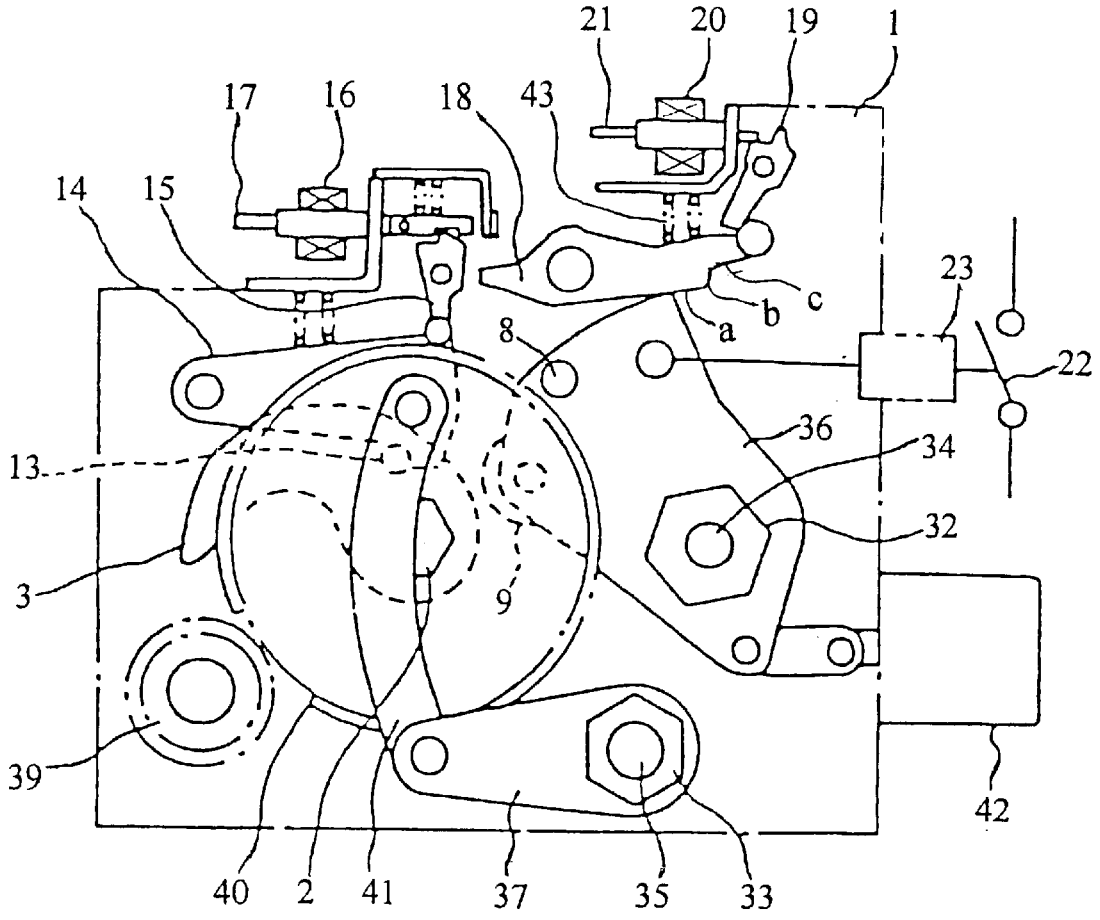
FIG. 72 illustrates a structure of an important portion of the conventional control device for breaker, wherein the breaker is in a state of opening the circuit, the torsion bars for opening the circuit are released, and the torsion bars for closing the circuit are prestressed.
Figure 73:
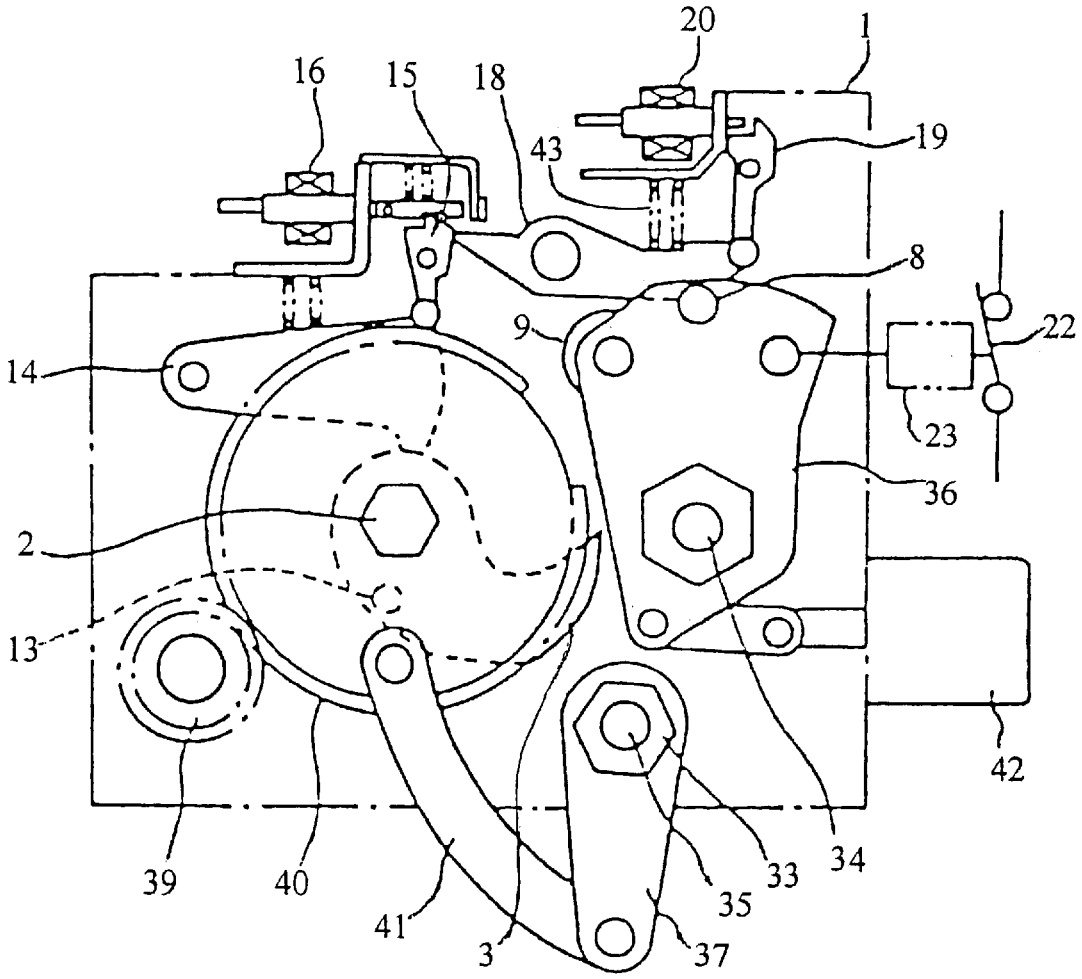
FIG. 73 illustrates a structure of the important portion of the conventional control device for breaker, wherein the breaker is in the state of closing the circuit, the torsion bars for opening the circuit are prestressed, and the torsion bars for closing the circuit are released.

At first, in reference of FIG. 3, a structure of the torsion bars as a prestressing means for opening the circuit will be described. Numerical reference 26 designates a lever, engaged with a pin (not shown), which is located on an end surface of a cylinder 24, illustrated in FIG. 70, so as to be rotatable. Numerical references 28 and 34 designate the torsion bars for opening the circuit. One end of the torsion bar 28 for opening the circuit is fixed to a case 1, and the other end of the torsion bar 28 is fixed to the lever 26. One end of the torsion bar 34 for opening the circuit is fixed to an inside of the main shaft 51, and the other end of the torsion bar 34 for opening the circuit is fixed to the lever 26.

In the next, the torsion bars as a prestressing means for closing the circuit will be described in reference of FIG. 4. Numerical reference 27 designates a lever, engaged with a pin (not shown), which is located on an end surface of the cylinder 24, illustrated in FIG. 69, so as to be rotatable. Numerical references 29 and 35 designate the torsion bars for closing the circuit. One end of the torsion bar 29 for closing the circuit is fixed to the case 1, and the other end of the torsion bar 29 is fixed to the lever 27. One end of the torsion bar 35 for closing the circuit is fixed to an inside of a making shaft 109 to be described below, and the other end of the torsion bar 35 is fixed to the lever 27.

The torsion bars 28 and 34 for opening the circuit are prestressed by a releasing force of the torsion bars 29 and 35 for closing the circuit as described below. Therefore, a prestressing energy of the torsion bars 29 and 35 for closing the circuit is larger than that of the torsion bars 28 and 34 for opening the circuit.

The control device for breaker will be described in its entirety in reference of FIGS. 1 through 9. In these figures, numerical reference 51 designates a main shaft, which is supported by the case 1 illustrated in FIG. 70, so as to be rotatable. One end of the torsion bar 34 for opening the circuit is fixed to the main shaft 51 by welding inside the main shaft 51, particularly in reference of FIG. 3. Numerical reference 52 designates the first breaking lever, fixed to the main shaft 51. The first breaking lever is applied with the torque by the torsion bars 34 and 28 for opening the circuit in a counterclockwise direction in FIG. 1. Hereinbelow, rotational directions and directions of up, down, right and left are expressed based on the figures.

Numerical reference 53 designates a first link; and numerical reference 54 designates a second link. Numerical reference 55 designates a second breaking lever, located around the main shaft 51 so as to be rotatable, particularly in reference of FIG. 3. Numerical reference 56 designates a pin, connecting the first breaking lever 52 to the first linkage 53. Numerical reference 57 designates a pin, connecting the first linkage 53 to the second linkage 54. Numerical reference 58 designates a pin, connecting the second linkage 54 to the second breaking lever 55. Numerical reference 59 designates a rotor, located in the pin 57. The first linkage 53 and the second linkage 54 are connected by the pin 57 so as to form a collapsible connecting portion 47a. Thus, a linkage 47 is formed by the first linkage 53, the second linkage 54, the pin 57, and the rotor 59 located in the pin 57.

Numerical reference 10 designates a make break contact of a main circuit of the breaker; numerical reference 12 designates a fixed contactor of the breaker; and numerical reference 22 designates a movable contactor, wherein the make break contact 10 is formed by the contactors 12 and 22. Numerical reference 23 designates a linking mechanism, wherein the movable contactor 22 is connected to the first breaking lever 52 through a linking mechanism 23. Numerical reference 42 designates a buffer; and numerical reference 61 designates a rod, wherein the buffer 42 is connected to the first breaking lever 52 through the rod 61.

Numerical reference 62 designates a guide, having an arch surface 62*a* as a guiding surface and a pin 62*b*, fixed to a main body of the guide 62, wherein the pin 62*b* is engaged with the second releasing latch 67 described below. Numerical reference 63 designates a rotational shaft, which supports the guide 62 so as to be rotatable. A center of an arch of the arch surface 62*a* is on an axis of the main shaft 51 when the guide 62 is engaged with a first releasing latch 69. Numerical reference 64 designates a pin, located in the second breaking lever 55.

Numerical reference 65 designates a spring, which urges the guide 62 so as to rotate in a clockwise direction around the rotational shaft 63. Numerical reference 66 designates a pin formed in the guide 62. Numerical reference 67 designates a second releasing latch having a tip slant 67*a* and a corner 67*b*, wherein the second releasing latch is located around the rotational shaft 63 so as to be rotatable, and engaged with the pin 64, located in the second breaking lever 55. Numerical reference 68 designates a spring, which urges the second releasing latch 67 in a clockwise direction around the rotational shaft 63. Numerical reference 69 designates a first releasing latch; and numerical reference 70 designates a rotational shaft. The first releasing latch 69 is located around the rotational shaft 70 so as to be rotatable, and engaged with the pin 66.

Numerical reference 71 designates a pin located in the first releasing latch 69; numerical reference 72 designates a spring; numerical reference 73 designates a releasing trigger; and numerical reference 74 designates a rotational shaft. The spring 72 urges the first releasing latch 69 so as to rotate around the rotational shaft in a clockwise direction. The releasing trigger 73 is located in the rotational shaft 74 so as to be rotatable, and engaged with the pin 71. Numerical reference 75 designates a spring, which urges the releasing trigger 73 around the rotational shaft 74 in a counterclockwise direction. Numerical reference 20 designates a releasing electromagnet having a plunger 21.

Numerical reference 76 designates a making lever, located around the main shaft 51 so as to be rotatable, and supported by the case through the main shaft 51. Numerical reference 109 designates a making shaft, which is supported by the case so as to be rotatable. An end of the torsion bar 35 for closing the circuit is fixed to an inside of the making shaft 109, as illustrated in FIG. 4. Numerical reference 110 designates a lever, fixed to the making shaft 109. Numerical reference 111 designates a making link; and numerical reference 112 designates a pin. The making linkage 111 is connected to the making lever 76, and connected to the lever 110 through the pin 112. The lever 110 receives a torque from the torsion bars 35 and 29 for closing the circuit in a clockwise direction, and the making lever 76 also receives a torque in a clockwise direction through the linkage 111.

Numerical reference 79 designates a making latch; and numerical reference 80 designates a rotational shaft, wherein the making latch 79 is located around the rotational shaft 80 so as to be rotatable. Numerical reference 81 designates a spring, which urges the making latch 79 so as to be rotatable around the rotational shaft 80 in a counterclockwise direction. Numerical reference 82 designates a pin, located in the making lever 76, and engaged with the making latch 79. Numerical reference 83 designates a making trigger; and numerical reference 84 designates a rotational shaft, wherein the making trigger 83 is located around the rotational shaft so as to be rotatable. Numerical reference 85 designates a spring, which urges the making trigger 83 around the rotational shaft 84 in a clockwise direction. Numerical reference 86 designates a pin, located in the making latch 79, and engaged with the making trigger 83. Numerical reference 87 designates a pin, fixed to the making lever 76, and is in contact with or separated from the second breaking lever 55 along with a rotation of the making lever 76. Numerical reference 16 designates a making electromagnet having a plunger 17.

Next, a structure of the prestressing device for prestressing the torsion bars 29 and 35 for closing the circuit will be described. In FIG. 2, illustrating the structure of the important portion of the prestressing device, numerical reference 88 designates a lever, located around the main shaft 51 and fixed to the making lever 76 so as to rotate along with the making lever 76. Numerical reference 89 designates a second rotor, located in the lever 88. When the torsion bars 29 and 35 for closing the circuit are prestressed, positions of the lever 88 and the second rotor 89 are illustrated by solid lines. When the torsion bars 29 and 35 for closing the circuit are released, the positions of the lever 88 and the second rotor 89 are moved to positions, respectively illustrated by broken lines.

Numerical reference 90 designates a camshaft; and numerical reference 91 designates a cam, which is in contact with the second rotor 89 when the cam 91 is rotated around the camshaft 90. Numerical reference 92 designates a gear, fixed to the cam. Numerical reference 93 designates a pinion, formed so as to be engaged with the gear 92, which is rotated in a clockwise direction through a speed reduction gear (not shown) by a motor (not shown). Numerical reference 94 designates an elastic member, one end 94*a* of which is fixed, wherein the elastic member breaks a rotation of the cam 91 by 15 sliding on a part of an outer peripheral portion of the cam 91 by its elastic deformation when the cam 91 is rotated around the camshaft 90.

A relationship of positions of the first breaking lever 52 and the pin 57 will be further described in reference of FIG. 9. FIG. 9 is a cross-sectional view of FIG. 8 taken along the line IX—IX of FIG. 8, wherein only an important portion is illustrated and other portions are omitted. The first breaking lever 52 and the first links 53, located on both sides of the first breaking lever 52 and shaped like a plate, are connected by the pin 56 so as to be rotatable. The two second breaking levers 55, shaped like a plate, are supported by the main shaft 51 so as to be rotatable, and connected to the second links 54 by the pin 58 so as to be rotatable. In a state that the torsion bars 28 and 34 for breaking and the torsion bars 29 and 35 for closing the circuit, illustrated in FIG. 8, are released, the pin 58 is in contact with the first breaking lever 52 and stopped. An operation of the pin 58 will be described.

The above-described control device for breaker should open the circuit from the state of closing the circuit, reclose the circuit, and reopen the circuit within a predetermined time. Hereinbelow, this procedure will be described.

FIG. 1 illustrates the state that the breaker is closed, wherein the first breaking lever 52 is applied with a rotational force in the counterclockwise direction by the torsion bars 28 and 34 for opening the circuit. On the other hand, the second breaking lever 55 is secured by an engagement between the pin 64 and the second releasing latch 67.

Therefore, the first links 53 and the second links 54 receive a force from both of the first breaking lever 52 and the second breaking levers 55. Thus, the rotor 59, located in the connecting portion 47*a* of the linkage 47, is applied with a force in a direction of pushing the arch surface 62*a* of the guide 62. At this time, the guide 62 receives a rotational force in a counterclockwise direction around the rotational shaft 63. However, the guide 62 is secured by the engagement between the first releasing latch 69 and the pin 66, and the first releasing latch 69 is retained by the engagement between the releasing trigger 73 and the pin 71, wherein the guide 62 is not rotated.

The operation of opening the circuit will be described. In the state of closing the circuit illustrated in FIG. 1, when the releasing electromagnet 20 is excited by an instruction of opening the circuit, the plunger 21 is rightward moved, and the releasing trigger 73 is rotated in the clockwise direction around the rotational shaft 74 against the spring 75. Then, the engagement between the releasing trigger 73 and the pin 71 is canceled, and the first releasing latch 69 is rotated in the counterclockwise direction by a counterforce, applied from the pin 66 of the guide 62. When the first releasing latch 69 is rotated in the counterclockwise direction and disengaged from the pin 66, because the rotor 59 pushes the arch surface 62*a*, the guide 62 is rotated in the counterclockwise direction against the spring 65, and the first breaking lever 52, applied with a torque from the torsion bars 28 and 34 for opening the circuit, is rotated in the counterclockwise direction.

At this time, the pin 62*b* of the guide 62 pushes the second releasing latch 67 to make the second releasing latch 67 rotate in a counterclockwise direction against the spring 68, whereby the pin 64, formed in the second breaking lever 55, is disengaged from the second releasing latch 67 to release the second breaking lever 55 from the engagement. FIG. 5 illustrates this state.

Hereinbelow, a process until the operation of opening the circuit is completed will be described. When the second breaking lever 55 is disengaged from the second releasing latch 67, the second breaking lever 55 becomes rotatable, and simultaneously the guide 62 is rotated in the clockwise direction by the spring 65 to push back the rotor 59. Because the first breaking lever 52 continues to rotate in the counterclockwise direction, the rotatable second breaking lever 55 starts to rotate in the counterclockwise direction.

The second breaking lever is finally in contact with the pin 87 of the making lever 76 and stopped, wherein a relationship of positions of the second breaking lever 55 and the pin 87 is as illustrated in FIG. 6. In other words, the first breaking lever 52 is stopped at a predetermined rotational angle, and the movable contact 22 is apart from the fixed contact 12, wherein the operation of opening the circuit is completed.

Since the guide 62 is pushed in the clockwise direction by the spring 65, when the second breaking lever 55 is rotated in the counterclockwise direction, the guide 62 is rotated in the clockwise direction until the pin 66 is engaged with the first releasing latch 69 while keeping in contact with the rotor 59. Thereafter, the guide 62 is in contact with a stopper (not shown) and stopped. Simultaneously, the first releasing latch 69 is rotated in the clockwise direction by a function of the spring 72 and engaged with the pin 66, and the releasing trigger 73 is rotated in the counterclockwise direction by the function of the spring 75, whereby the releasing trigger 73 is engaged with the pin 71 of the first releasing latch 69. Thus, the guide 62 is secured. In other words, when the closing operation is completed, the guide 62 is maintained to be engaged with the first releasing latch 69. This state is illustrated in FIG. 6.

Next, the operation of reclosing the circuit will be described. FIG. 6 illustrates a state that the operation of opening the circuit is completed, the torsion bars 29 and 35 for closing the circuit are prestressed, and the torsion bars 28 and 34 for opening the circuit are released, wherein the making lever 76 is constantly applied with a rotational force in the clockwise direction by the torsion bars 29 and 35 for closing the circuit through the linkage 111. The making lever 76 is secured by an engagement between the pin 82 and the making latch 79, and the making latch 79 is secured by an engagement between the making trigger 83 and the pin 86, whereby the torsion bars 29 and 35 for closing the circuit are maintained to be in the prestressed state.

When the making electromagnet 16 is excited by an instruction of closing the circuit, the plunger 17 is rightward moved, the making trigger 83 is rotated in the counterclockwise direction around the rotational shaft 84 against the spring 85, the making trigger 83 is disengaged from the pin 86, and the making latch 79 is rotated in the clockwise direction by a counterforce, applied from the pin 82. When the making latch 79 is rotated in the clockwise direction and released from the pin 82, the making lever 76 receiving a torque from the torsion bars 29 and 35 for closing the circuit is rotated in the clockwise direction, and simultaneously, the pin 87 is in contact with the second breaking lever 55, and the second breaking lever 55 is rotated in the clockwise direction by a push of the pin 87.

The guide 62 is engaged with the first releasing latch 69, and therefore the rotor 59 rotates and moves while being in contact with the arch surface 62*a* of the guide 62, whereby the rotor 59 moves along a locus of an arch with center of the main shaft 51 of the main shaft 51. The second linkage 54, the rotor 59, the first linkage 53 and the first breaking lever 52 are integrally rotated in the clockwise direction around the main shaft in association with a rotation of the second breaking lever 55, and the movable contact 22 is driven in a direction of closing the circuit. Simultaneously, the torsion bars 28 and 34 for opening the circuit, one end of which is fixed to the first breaking lever 52, are twisted in the clockwise direction so as to be prestressed.

Meanwhile, when the making lever 76 is rotated in the clockwise direction, the spring 81 pushes the making latch 79 to prevent the making latch from rotating in the counterclockwise direction by the pin 82 while the pin slides on the making latch 79. When the making lever is rotated in the clockwise direction by a predetermined angle to be disengaged from the making latch 79, the making latch 79 is in contact with a stopper (not shown) and prevented from rotating in the counterclockwise direction from the state illustrated in FIG. 7.

The second breaking lever 55 is further rotated. The pin 64, located in the second breaking lever 55, is in contact with the tip slant 67*a* of the second releasing latch 67, whereby the second releasing latch 67 is rotated in the counterclockwise direction. After the pin 64 exceeds the corner 67*b*, the second releasing latch 67 is rotated in the clockwise direction by a function of the spring 68, and engaged with the pin 64, located in the second breaking lever 55. Simultaneously, the first breaking lever 52 reaches a predetermined rotational angle by a push of the pin 87, located in the making lever 76, wherein the prestressing operation of the torsion bars 28 and 34 for opening the circuit is completed. This state is illustrated in FIG. 7.

Further, even though the making lever 76 is rotated in the counterclockwise direction when the torsion bars 29 and 35 for closing the circuit are prestressed as described below, to make the pin 87 apart from the second breaking lever 55, since the pin 64 is engaged with the second releasing latch 67, the torsion bars 28 and 34 for opening the circuit are maintained to be in the prestressed state.

Next, the operation of reopening the circuit will be described. Under the state of closing the circuit illustrated in FIG. 7, when the releasing electromagnet 20 is excited by an instruction of opening the circuit, the plunger 21 is rightward moved, and the releasing trigger 73 is rotated in the clockwise direction around the rotational shaft 74 against the spring 75. When the releasing trigger 73 is rotated, the releasing trigger 73 is disengaged from the pin 71, and the first releasing latch 69 is rotated in the counterclockwise direction by a counterforce, applied from the pin 66 of the guide 62.

When the first releasing latch 69 is rotated in the counterclockwise direction so as to be disengaged from the pin 66, since the rotor 59 pushes the arch surface 62*a*, the guide 62 is rotated in the counterclockwise direction against the spring 65. When the guide 62 is rotated in the counterclockwise direction, the rotor 59 is not supported by the guide 62, the first breaking lever 52, applied with a torque from the torsion bars 28 and 34 for opening the circuit, is rotated in the counterclockwise direction, and the movable contact 22 is driven in a direction of opening the circuit.

Simultaneously, the pin 62*b* of the guide 62 pushes the second releasing latch 67 to rotate the second releasing latch 67 in the counterclockwise direction against the spring 68, whereby the second releasing latch 67 is disengaged from the pin 64, located in the second breaking lever 55. When the second releasing latch 67 is disengaged from the pin 64, the second breaking lever 55 becomes rotatable. However, different from the case that the circuit is opened from the state that the torsion bars for closing the circuit are prestressed as in FIG. 1, the second breaking lever 55 is stopped without rotating because the second breaking lever 55 is in contact with the pin 87, located in the making lever 76.

Because the first breaking lever 52 is rotated in the counterclockwise direction, the connecting portion 47*a* of the linkage 47, connecting the first breaking lever 52 with the second breaking lever 55, is tilted, whereby the first breaking lever 52 is finally in contact with and stopped by the pin 58. At this time, the movable contact 22 is completely separated from the fixed contact 12, wherein the operation of opening the circuit is completed. This state is illustrated in FIG. 8.

Specifically, in the state illustrated in FIG. 7, because a torque generated by the torsion bars 29 and 35 for closing the circuit are received by a stopper (not shown), located in the buffer 42, through the making lever 76, the second breaking lever 55, the linkage 47, the first breaking lever 52, and so on, when the pin 66 is disengaged from the first releasing latch 69, the guide 62 is rotated in a counterclockwise direction. When the rotor 59 is not supported by the guide 62, the second breaking lever 55 is stopped in a state that the second breaking lever 55 is pushed back a little in the clockwise direction through the pin 87 by the prestressing force, generated by the torsion bars 29 and 35 for closing the circuit. Under this state, because the first breaking lever 52 is rotated in the counterclockwise direction, the connecting portion 47*a* of the linkage 47 is tilted, whereby the first breaking lever 52 is stopped by a contact with the pin 58.

In the next, the prestressing operation of the torsion bars 29 and 35 for closing the circuit will be described. The torsion bars 29 and 35 for closing the circuit are prestressed from the state that the torsion bars are released as in FIG. 7 or 8. Broken lines in FIG. 2 show positions of the lever 88 and the second rotor 89 in the state that the torsion bars 29 and 35 for closing the circuit are released. Upon an instruction of prestressing, the pinion 93 is rotated in the clockwise direction through a speed reduction gear (not shown) by a motor (not shown), and the gear 92 and the cam 91 are rotated in the counterclockwise direction.

Although, at the beginning, the cam 91 pushes the elastic member 94 to elastically deform the elastic member 94, the cam 91 is separated from the elastic member 94, makes the lever 88 rotate in the counterclockwise direction around the main shaft 51 by pushing the second rotor 89, positioned at the broken line, and simultaneously makes the making lever 76, integrally connected with the lever 88, rotate in the counterclockwise direction around the main shaft 51. When the making lever 76 is rotated in the counterclockwise direction, the torsion bars 29 and 35 for closing the circuit, one end of which is fixed to the making shaft 109 through the making linkage 111 and the lever 110, are twisted in the counterclockwise direction so as to be prestressed.

Meanwhile, when the pin 82 slides on an end surface of the making latch 79 in course of the rotation of the making lever 76 in the counterclockwise direction, and the second rotor 89 reaches a position shown by a solid line from the position shown by the broken line in FIG. 2, the making latch 79 is rotated in the counterclockwise direction by the spring 81 so as to be engaged with the pin 82, located in the making lever 76. Further, the making trigger 83 is rotated in the clockwise direction by the spring 85 so as to be engaged with the pin 86, whereby the making lever 76 is retained, and the torsion bars 29 and 35 for closing the circuit are maintained in the prestressing state.

Further, because the pin 87 is moved when the making lever 76 is rotated in the counterclockwise direction, the second breaking lever 55 becomes rotatable in the counterclockwise direction. When the torsion bars 29 and 35 for closing the circuit are prestressed from the state illustrated in FIG. 7, because the second breaking lever 55 is engaged with the second releasing latch 67, the second breaking lever 55 is slightly rotated in the counterclockwise direction and stopped. When the torsion bars 29 and 35 for closing the circuit are prestressed from the state illustrated in FIG. 8, the second breaking lever 55 is rotated in the counterclockwise direction by a pushing motion of the spring 65 against the rotor 59 through the guide 62 toward the main shaft 51.

Meanwhile, when the torsion bars 29 and 35 for closing the circuit are prestressed from the state, illustrated in FIG. 8, because the making lever 76 and the pin 87 are rotated in the counterclockwise direction along with prestress of the torsion bars 29 and 35 for closing the circuit, the second breaking lever 55 is rotated in the counterclockwise direction. Further, the guide 62, pushed by the rotor 59, is rotated in the clockwise direction by a force of the spring 65 to return to its original position and engaged by the first releasing latch 69 and the releasing trigger 73.

Thereafter, although driving by the motor is stopped, the cam 91 continues to rotate by this inertia force. A part of an outer peripheral portion of the cam 91 slides on the elastic member 94 while elastically deforming this so as to be broken, whereby the rotation of the cam 91 is stopped, the prestressing operation of the torsion bars 29 and 35 for closing the circuit is completed. When the torsion bars are prestressed from the state, illustrated in FIG. 7, the state is changed to that in FIG. 1. When the torsion bars are prestressed from the state illustrated in FIG. 8, the state is changed to that illustrated in FIG. 6. Under the state illustrated in FIG. 6, as for the prestressing device, the lever 88, the second rotor 89, and the cam 91 are arranged at positions, shown by the solid lines in FIG. 2.

When the engagement of the pin 82 with the making latch 79 is released in the state illustrated in FIG. 6, and the torsion bars 29 and 35 for closing the circuit are released to close the circuit, the torsion bars 28 and 34 for opening the circuit are prestressed, and the movable contact 22 is in contact with the fixed contact 12 to close the breaker. Further, by prestressing the torsion bars 29 and 35 for closing the circuit by the motor (not shown), as illustrated in FIG. 1, the breaker is in the state of closing the circuit and the torsion bars 29 and 35 for closing the circuit and the torsion bars 28 and 34 for opening the circuit are returned to the prestressed state.

Since the control device for breaker according to Embodiment 1 is constructed as described above, the first releasing latch 69 is engaged with the guide 62 before the operation of closing the circuit. Therefore, it is unnecessary to delay starting of the operation of reopening the circuit until a repulsion, caused by the engagement between the guide 62 and the first releasing latch 69 and the engagement between the first releasing latch 69 and the releasing trigger 73, is converged and stabilized, whereby an operating capability of the make break switch can be improved.

When the engagement between the first releasing latch 69 and the guide 62 is released, the rotor 59 is leftward moved irrespective of a position of a making lever 76 and a state of the engagement between the second releasing latch 67 and the second breaking lever 55, and the first breaking lever 52 is rotated in the counterclockwise direction. Therefore, it is possible to transit the operation of opening the circuit at any time when the circuit is during the closing operation.

Further, if the engagement between the first releasing latch 69 and the pin 66 is released, even though the making trigger 83 is erroneously excited, the engagement between the making latch and the making lever 76 is released, and the second breaking lever 55 is driven in the clockwise direction by the torsion bars for closing the circuit, the first breaking lever 52 is not rotated enough to close the circuit, whereby there is no danger that the breaker is instantaneously closed.

Further, the first breaking lever 52, the second breaking lever 55, and the making lever 76 are supported by the same main shaft 51 so as to be rotatable, and the second releasing latch 67 and the guide 62 are supported by the same rotational shaft 63, whereby the number of parts is reduced, the structure is simplified, and the device is miniaturized.

Further, since the connecting portion 47*a* is guided by the arch surface 62*a* of the guide 62, the structure of controlling the locus of the connecting portion 47*a* can be simplified. Further, when the connecting portion 47*a* is guided by the guide 62, the rotor is rotated to reduce the friction resistance. When the breaker is closed and the torsion bars 28 and 34 for opening the circuit are prestressed, a torque, generated by the torsion bars 29 and 35 for closing the circuit, can be effectively transmitted to the first breaking lever 52. Meanwhile, because the torsion bars have only their own moments of inertia, there are advantages that efficiency of energy is good, and concentration of stress does not exist. Accordingly, the torsion bars are especially suitable for a control device for relatively large breakers, requiring a large energy.

Further, since the prestressing device is constructed such that the second rotor 89, connected to the lever 88, is driven by the cam 91, a torque of load, applied to the motor at a time of prestressing the torsion bars 29 and 35 for closing the circuit, is made constant, and a maximum torque, applied to parts of the prestressing device, can be reduced, whereby the parts of the prestressing device and the prestressing device itself can be miniaturized. Further, since the cam 91 is broken by the elastic member 94, sliding on the cam 91 and elastically deformed, a rotation of the cam 91 by an inertia can be rapidly stopped.

Embodiment 2

Figure 10:
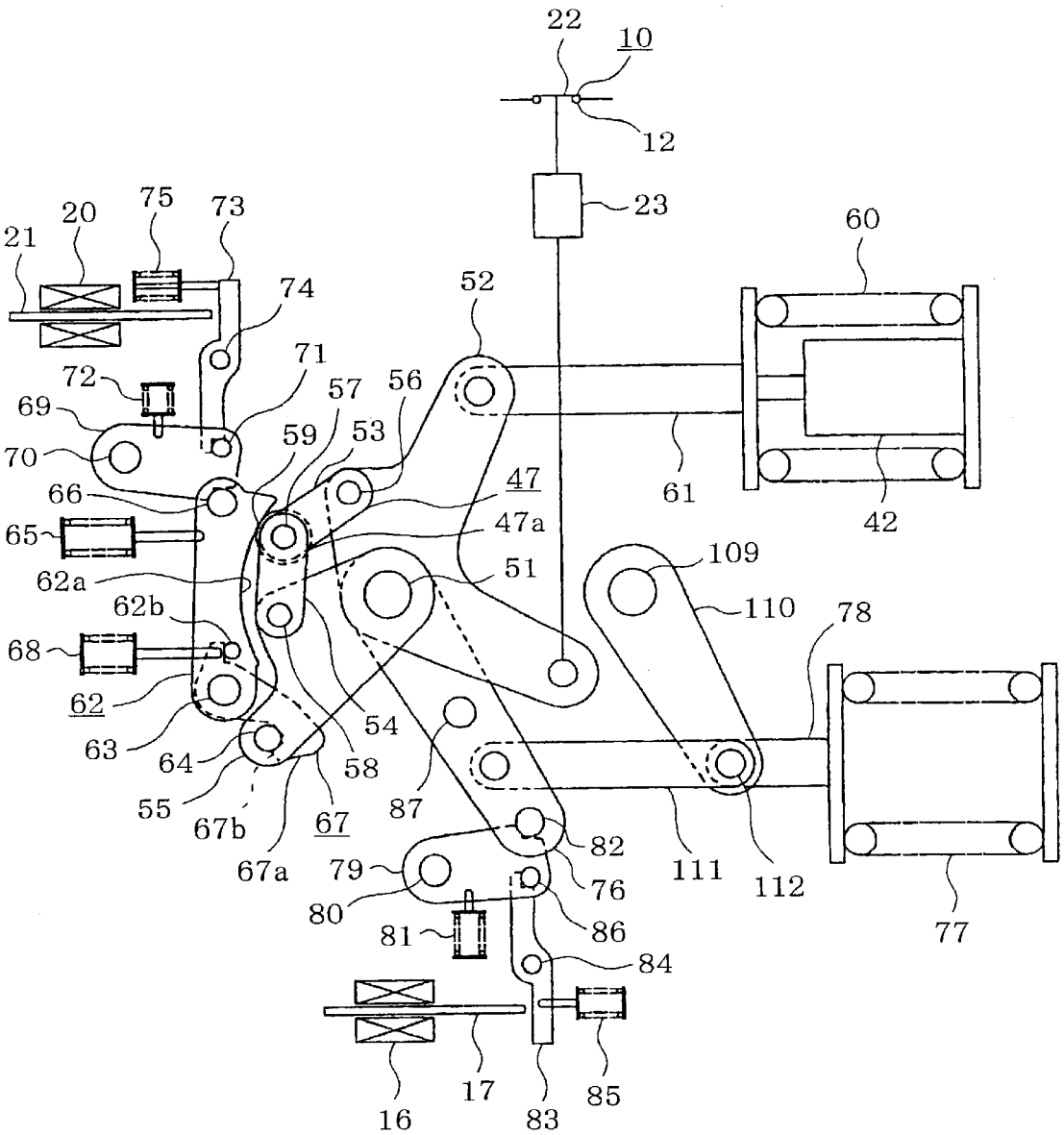
FIG. 10 illustrates a structure of an important portion of a control device for a breaker according to Embodiment 2, wherein the breaker is in a state of closing the circuit, and both of a closing coil spring and an opening coil spring are prestressed.
Figure 11:
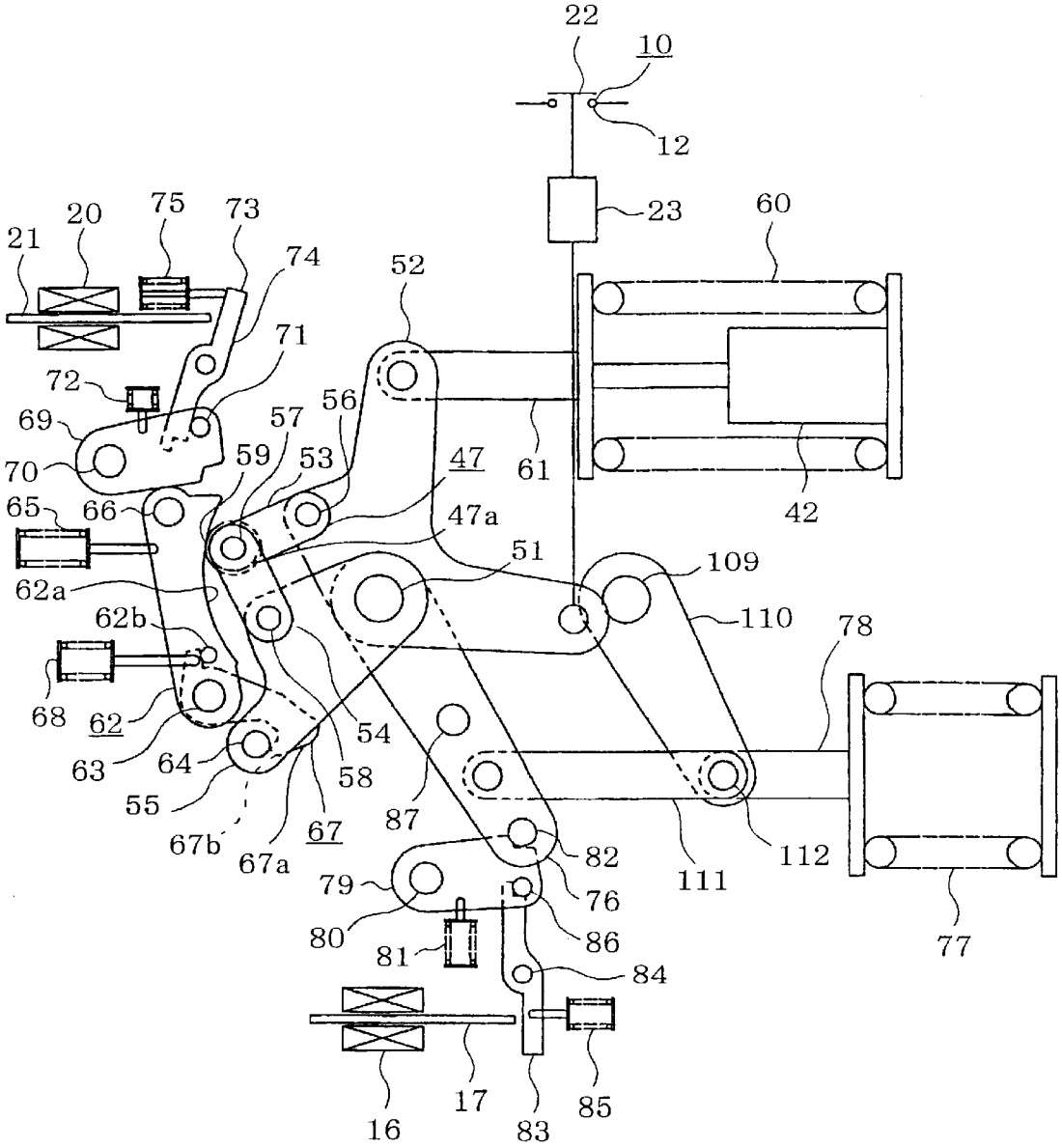
FIG. 11 illustrates a structure of the important portion of the control device for breaker according to Embodiment 2, wherein a state in course of an operation of opening the circuit from the state illustrated in FIG. 10 is shown.

Further, a control device for a breaker according to Embodiment 2 of the present invention will be described in reference of FIGS. 10 through 14. FIG. 10 illustrates a structure of an important portion of the control device for a breaker, wherein the breaker is closed, and a coil spring for closing the circuit and a coil spring for opening the circuit are prestressed. FIG. 11 illustrates a structure of the important portion of the control device for breaker, wherein a state in course of an operation of opening the circuit is shown.

Figure 12:
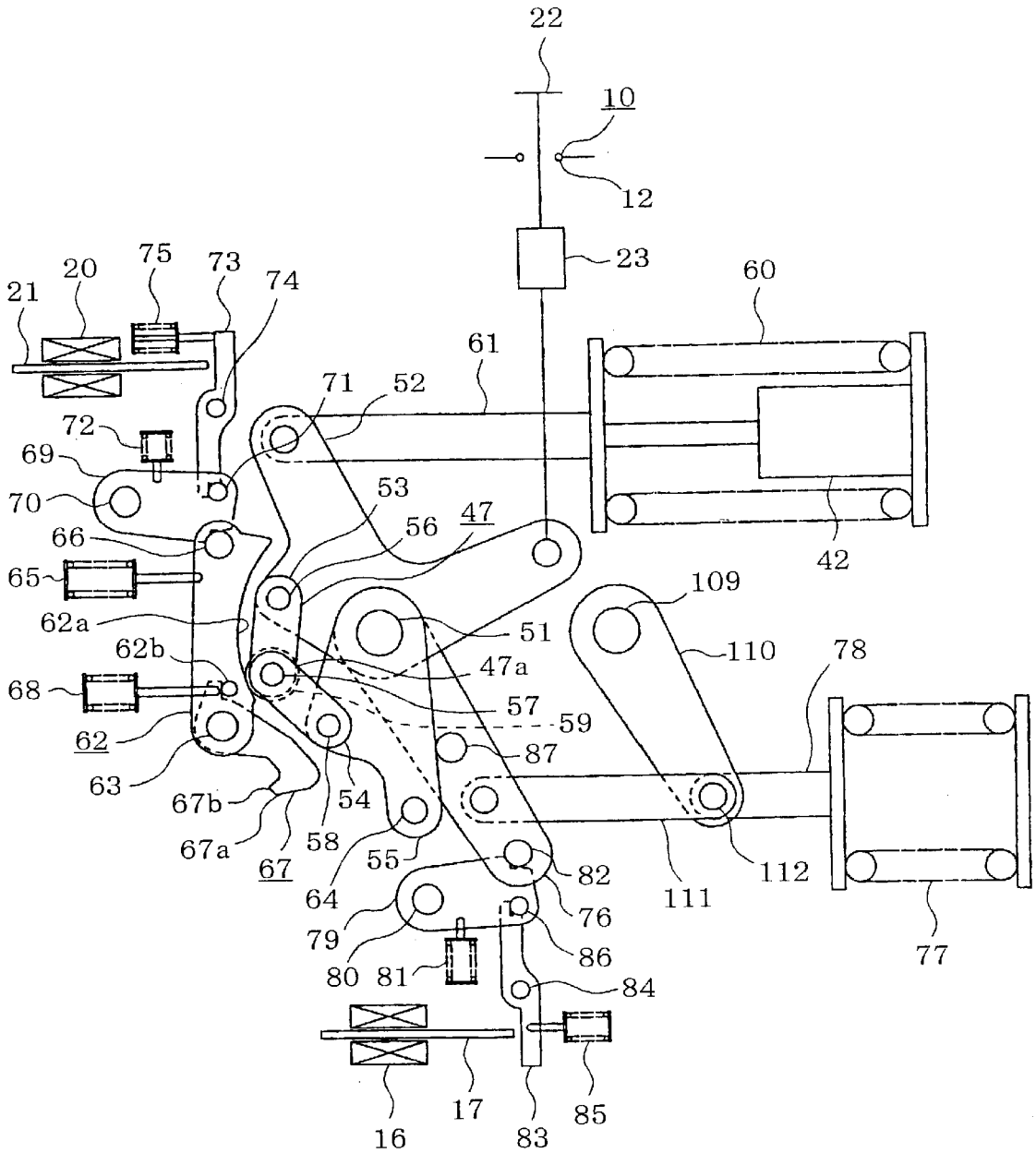
FIG. 12 illustrates a structure of the important portion of the control device for breaker according to Embodiment 2, wherein the operation of opening the circuit is completed after the state illustrated in FIG. 11, the closing coil spring is prestressed, and the opening coil spring is released.
Figure 13:
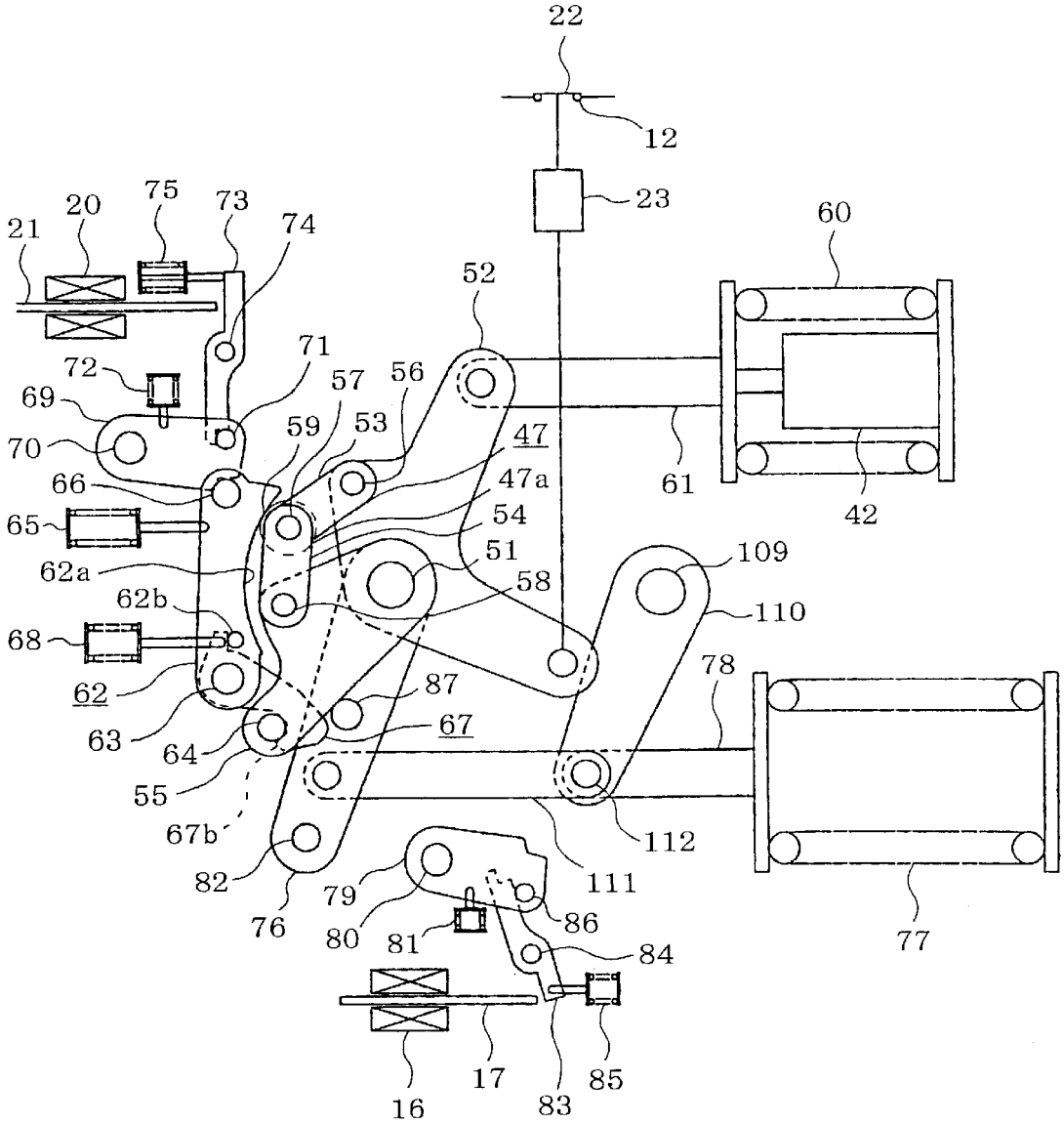
FIG. 13 illustrates a structure of the important portion of the control device for breaker according to Embodiment 2, wherein the breaker is in a state of closing the circuit, the closing coil spring is released, and the opening coil spring is prestressed.
Figure 14:
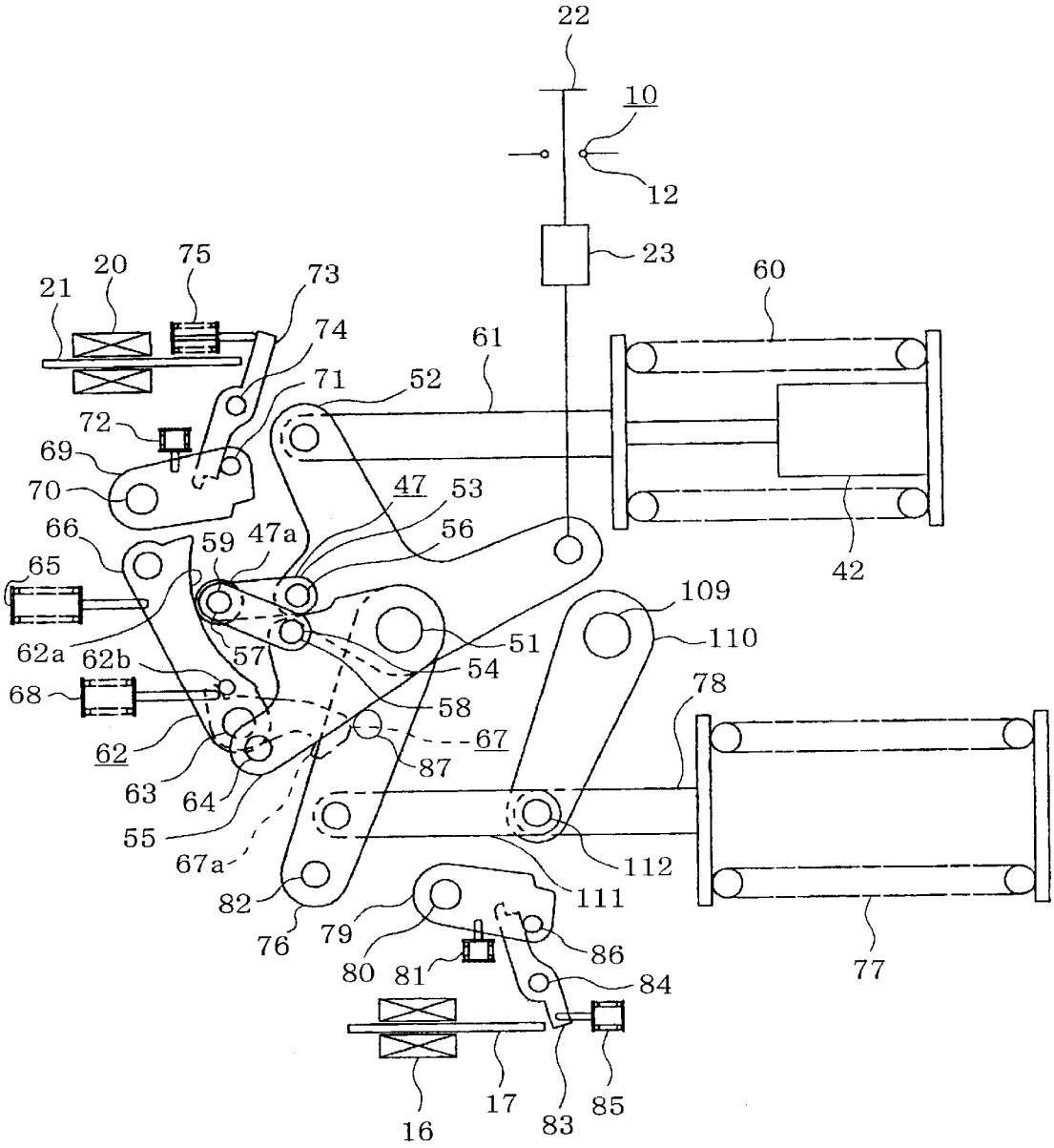
FIG. 14 illustrates a structure of the important portion of the control device for breaker according to Embodiment 2, wherein the breaker is in the state of opening the circuit, and the closing coil spring and the opening coil spring are released.

FIG. 12 illustrates a structure of the important portion of the control device for breaker, wherein the operation of opening the circuit is completed from the state illustrated in FIG. 11, the spring for closing the circuit is prestressed, and the spring for opening the circuit is released. FIG. 13 illustrates a structure of the important portion of the control device for breaker, wherein the breaker is in the state of closing the circuit, the coil spring for closing the circuit is released, and the coil spring for opening the circuit is prestressed. FIG. 14 illustrates a structure of the important portion of the control device for breaker, wherein a second operation of opening the circuit is completed immediately after an operation of rapidly reclosing the circuit, wherein the breaker is in the state of opening the circuit, and the coil spring for closing the circuit and the coil spring for opening the circuit are released.

In Embodiment 2, a coil spring 60 for opening the circuit is used instead of the torsion bars 28 and 34 for opening the circuit, illustrated in FIG. 1, and a coil spring 77 for closing the circuit is used instead of the torsion bars 29 and 35 for closing the circuit.

In these figures, numerical reference 51 designates a main shaft, fixed to a case (not shown); and numerical reference 52 designates a first breaking lever, located around the main shaft 51 so as to be rotatable. Numerical reference 53 designates a first link; numerical reference 54 designates a second link; and numerical reference 55 designates a second breaking lever, located around the main shaft 51 so as to be rotatable. Numerical reference 56 designates a pin, connecting the first breaking lever 52 to the first linkage 53. Numerical reference 57 designates a pin, connecting the first linkage 53 to the second linkage 54.

Numerical reference 58 designates a pin, connecting the second linkage 54 to the second breaking lever 55; and numerical reference 59 designates a rotor, located around the pin 57. The first linkage 53 and the second linkage 54 are connected by the pin 57 so as to form a collapsible connecting portion 47*a*. A linkage 47 is formed by the first linkage 53, the second linkage 54, the pin 57, and the rotor 59 located in the pin 57.

Numerical reference 10 designates a make break contact of a main circuit of the breaker; numerical reference 12 designates a fixed contact of the breaker; and numerical reference 22 designates a movable contact, wherein the make break contact 10 is formed by the contacts 12 and 22. Numerical reference 23 designates a linking mechanism, wherein the movable contact 22 is connected to the first breaking lever 52 through the linking mechanism 23. Numerical reference 42 designates a buffer; numerical reference 60 designates the coil spring for opening the circuit as a prestressing means for opening the circuit; and numerical reference 61 designates a rod, wherein the coil spring for opening the circuit 60 and the buffer 42 are connected to the first breaking lever through the rod 61. In order to prestress the coil spring 60 for opening the circuit by the coil spring 77 for closing the circuit, a prestressing energy of the coil spring 77 for closing the circuit is made larger than that of the coil spring 60 for opening the circuit.

Numerical reference 62 designates a guide having an arch surface 62*a* as a guiding surface and a pin 62*b* fixed to a main body of the guide 62, wherein the pin 62*b* is engaged with the second releasing latch 67 described below. Numerical reference 63 designates a rotational shaft, supporting the guide 62 so as to be rotatable. A center of an arch of the arch surface 62*a* is on an axis center of the main shaft 51 when the guide 62 is engaged with a first releasing latch 69, described below. Numerical reference 64 designates a pin, located in the second breaking lever 55.

Numerical reference 65 designates a spring, urging the guide 62 so as to rotate in a clockwise direction around the rotational shaft 63. Numerical reference 66 designates a pin, located in the guide 62. Numerical reference 67 designates a second releasing latch having a tip slant 67*a* and a corner 67*b*. The second releasing latch is located around the rotational shaft 63 so as to be rotatable, wherein the second releasing latch is engaged with a pin 64, located in the second breaking lever 55. Numerical reference 68 designates a spring, urging the second releasing latch 67 so as to rotate around the rotational shaft 63 in the clockwise direction. Numerical reference 69 designates the first releasing latch; and numerical reference 70 designates a rotational shaft. The first releasing latch 69 is located around the rotational shaft 70 so as to be rotatable, and engaged with the pin 66.

Numerical reference 71 designates a pin, located in the first releasing latch 69; numerical reference 72 designates a spring; numerical reference 73 designates a releasing trigger; and numerical reference 74 designates a rotational shaft. The spring 72 urges the first releasing latch 69 so as to rotate in a clockwise direction around the rotational shaft 70. The releasing trigger 73 is located around the rotational shaft 74 so as to be rotatable, and engaged with the pin 71. Numerical reference 75 designates a spring, urging the releasing trigger 73 so as to rotate in a counterclockwise direction around the rotational shaft 74. Numerical reference 20 designates a releasing electromagnet having a plunger 21.

Numerical reference 76 designates a making lever, located around the main shaft so as to be rotatable. Numerical reference 77 designates a coil spring for closing the circuit, being a prestressing means for opening the circuit. Numerical reference 78 designates a rod. The coil spring 77 for closing the circuit is connected to the making lever 76 through the rod 78 and so on, wherein the making lever 76 is urged by the rod 78 to rotate in a clockwise direction around the main shaft 51.

Further, although it is not illustrated, a lever similar to a lever 88, located around the main shaft 51 of the prestressing device so as to be rotatable, is integrally fixed to the making lever 76 and located around the main shaft 51 so as to be rotatable. Numerical reference 109 designates a making shaft, fixed to the case (not shown); and numerical reference 110 designates a lever, supported the making shaft 109 so as to be rotatable. Numerical reference 111 designates a making link, connected to the making lever 76. Numerical reference 112 designates a pin, connecting the making linkage 111 with the lever 110 and the rod 78. The lever 110 works as a guide when the coil spring 77 for closing the circuit drives the making lever 76 through the making linkage 111.

Numerical reference 81 designates a spring, urging the making latch 79 so as to rotate in a counterclockwise direction around a rotational shaft. Numerical reference 82 designates a pin, located in the making lever 76, wherein the making latch 79 is engaged with a pin 82. Numerical reference 83 designates a making trigger; and numerical reference 84 designates a rotational shaft, wherein the making trigger 83 is located around the rotational shaft 84 so as to be rotatable. Numerical reference 85 designates a spring, urging the making trigger so as to rotate in a clockwise direction around the rotational shaft 84. Numerical reference 86 designates a pin, located in the making latch 79, wherein the making trigger 83 is engaged with the pin 86. Numerical reference 87 designates a pin, located in the making lever 76, wherein the pin 87 is in contact with or separated from the second breaking lever 55 along with rotation of the making lever 76. Numerical reference 16 designates a making electromagnet having a plunger 17.

Hereinbelow, operations of opening the circuit from the state of closing the circuit, of reclosing the circuit, and of reopening the circuit will be sequentially described.

FIG. 10 illustrates a state that the breaker is closed, wherein the first breaking lever 52 is applied with a rotational force in a counterclockwise direction by the prestressed coil spring 60 for opening the circuit. Meanwhile, the second breaking lever 55 is secured by an engagement between the pin 64 and the second releasing latch 67.

Therefore, the first linkage 53 and the second linkage 54 are applied with a force from both of the first breaking lever 52 and the second breaking lever 55. The rotor 59, located in the connecting portion 47*a* of the linkage 47, generates a force in a direction of pushing the arch surface 62*a* of the guide 62. At this time, the guide 62 is applied with a rotational force in a counterclockwise direction around the rotational shaft 63, the guide 62 is secured by an engagement between the first releasing latch 69 and the pin 66, and the first releasing latch 69 is retained by an engagement between the releasing trigger 73 and the pin 71.

An operation of opening the circuit will be described. In the state of closing the circuit illustrated in FIG. 10, upon an instruction of opening the circuit, a releasing electromagnet 20 is excited to move a plunger 21 in a rightward direction to rotate the releasing trigger 73 in a clockwise direction around the rotational shaft 74 against a spring 75. Thus the engagement between the releasing trigger 73 and the pin 71 is canceled, and the first releasing latch 69 is rotated in a counterclockwise direction by a counterforce from a pin 66 of the guide 62. When the first releasing latch 69 is released from the pin 66 by rotating in the counterclockwise direction, since the rotor 59 pushes the arch surface 62*a*, the guide 62 is rotated in the counterclockwise direction against the coil spring 65, whereby the first breaking lever 52, applied with a torque from the coil spring 60 for opening the circuit, is rotated in a counterclockwise direction.

Simultaneously, the pin 62*b* of the guide 62 pushes the second releasing latch 67 to rotate the second releasing latch 67 in a counterclockwise direction against the spring. The engagement between the second releasing latch 67 and the pin 64, located in the second breaking lever 55, is canceled, and the engagement of the second breaking lever 55 is also released. This state is illustrated in FIG. 11.

Hereinbelow, a process until the operation of closing the circuit is completed will be described mainly in reference of FIG. 11. When the engagement between the second releasing latch 67 and the pin 64, namely the engagement of the second breaking lever 55, is released, the second breaking lever 55 becomes rotatable. Further, the guide 62 is rotated in the clockwise direction by the coil spring 65 to push back the rotor 59. At this time, because the first breaking lever 52 is rotated in the counterclockwise direction, the second breaking lever 55 is rotated in the counterclockwise direction.

Finally, the second breaking lever 55 is in contact with the pin 87 of the making lever 76 and stopped, wherein a relationship of positions of the second breaking lever 55 and the pin 87 is as illustrated in FIG. 12. In other words, the first breaking lever 52 is stopped after reaching a predetermined rotational angle, the movable contact 22 is separated from the fixed contact 12, and therefore the operation of opening the circuit is completed.

Further, because the guide 62 is pushed by the spring 65 in the clockwise direction, when the second breaking lever is rotated in the counterclockwise direction, the pin 66 is rotated in the clockwise direction until it is engaged with the first releasing latch 69, and thereafter is in contact with a stopper (not shown) so as to be stopped. Simultaneously, the first releasing latch 69 is rotated in the clockwise direction by a function of the coil spring 72 so as to be engaged with the pin 66, and the releasing trigger 73 is rotated in the counterclockwise direction by the function of the coil spring 75 so as to be engaged with the pin 71 of the first releasing latch 69. Thus, the guide 62 is engaged. In other words, when the operation of opening the circuit is completed, the guide 62 is in a state of being engaged with the first releasing latch 69. This state is illustrated in FIG. 12.

In the next, the operation of reclosing the circuit will be described. FIG. 12 illustrates a state that the operation of opening the circuit is completed, the coil spring 77 for closing the circuit is prestressed, and the coil spring 60 for opening the circuit is released. Under this state, the making lever 76 is constantly applied with a rotational force in a clockwise direction by the coil spring 77 for closing the circuit. The making lever 76 is secured by an engagement between the pin 82 and the making latch 79. The making latch 79 is secured by an engagement between the making trigger 83 and the pin 86, whereby the coil spring 77 for closing the circuit is retained to be prestressed.

When the making electromagnet 16 is excited by an instruction of closing the circuit, the plunger 17 is rightward moved, the making trigger 83 is rotated in the counterclockwise direction around the rotational shaft 84 against the spring 85, the engagement between the making trigger 83 and the pin 86 is released, and the making latch 79 is rotated in the clockwise direction by a counterforce applied from the pin 82 of the making lever 76. When the making latch 79 is rotated in the clockwise direction and released from the pin 82, the making lever 76, applied with a torque from the coil spring 77 for closing the circuit, is rotated in the clockwise direction. Simultaneously, the pin 87 is in contact with the second breaking lever 55, and the second breaking lever 55 is rotated in the clockwise direction by a push from the pin 87.

When the making lever 76 is rotated in the clockwise direction, at first, the pin 82 slides on the making latch 79 to prevent a rotation of the making latch 79 in the counterclockwise direction by a push of the spring 81. When the making lever 76 is rotated in the clockwise direction by a predetermined angle, and the engagement between the making lever 76 and the making latch 79 is released, the making latch 79 is in contact with a stopper (not shown) so as not to rotate in the counterclockwise direction to the state illustrated in FIG. 7.

The guide 62 is engaged with the first releasing latch 69, and the rotor 59 is in contact with the arch surface 62*a* of the guide 62 and is moved by rotating. Therefore, the rotor 59 is moved along an arch locus with center of the main shaft 51, whereby the second linkage 54, the rotor 59, the first linkage 53, and the first breaking lever 52 are integrally rotated in the clockwise direction around the main shaft 51 in association with a rotation of the second breaking lever 55. Therefore, the movable contact 22 is driven in the direction of closing the circuit. Simultaneously, the coil spring 60 for opening the circuit, connected to the first breaking lever 52, is compressed and prestressed.

The second breaking lever 55 is further rotated, and the pin 64, located in the second breaking lever 55, is in contact with a tip slant 67*a* of the second releasing latch 67, and the second releasing latch 67 is rotated in the counterclockwise direction. Further, when the pin 64 exceeds a corner 67*b*, the second releasing latch 67 is rotated in the clockwise direction by a function of a spring 68, whereby the second releasing latch 67 is engaged with the pin 64, located in the second breaking lever 55. Simultaneously, the first breaking lever 52 is pushed by the pin 87, located in the making lever 76, to reach a predetermined rotational angle, wherein the operation of closing the circuit and a prestressing operation of the coil spring 60 for opening the circuit are completed. This state is illustrated in FIG. 13.

Further, the making lever 76 is rotated in the counterclockwise direction when the coil spring 77 for closing the circuit is prestressed. Therefore, even though the pin 87 is apart from the second breaking lever 55, the pin 64 is secured by the second releasing latch 67. Therefore, the coil spring 60 for opening the circuit is maintained to be in a prestressed state.

In the next, the operation of reopening the circuit will be described. Under the state of closing the circuit illustrated in FIG. 13, the plunger 21 is rightward moved when the releasing electromagnet 20 is excited by the instruction of opening the circuit. Accordingly, the releasing trigger 73 is rotated in the clockwise direction around the rotational shaft 74 against the spring 75. When the releasing trigger 73 is rotated, the engagement between the releasing trigger 73 and the pin 71 is released, and the first releasing latch 69 is rotated in a counterclockwise direction by a counterforce applied from the pin 66 of the guide. When the first releasing latch 69 is rotated in a counterclockwise direction and released from the pin 66, since the rotor 59 pushes the arch surface 62*a*, the guide 62 is rotated in a counterclockwise direction against the spring 65. When the guide 62 is rotated in the counterclockwise direction, because the rotor 59 is not supported by the guide 62, the first breaking lever 52, applied with a torque from the coil spring 60 for opening the circuit is rotated in a counterclockwise direction, and the movable contact 22 is driven in a direction of opening the circuit.

Simultaneously, the pin 62*b* of the guide 62 pushes the second releasing latch 67 to rotate the second releasing latch 67 in the counterclockwise direction against the spring 68, whereby the engagement between the second releasing latch 67 and the pin 64, located in the second breaking lever 55, is released. When the second releasing latch 67 is disengaged from the pin 64, the second breaking lever 55 becomes rotatable. However, unlike the case that the circuit is opened from the state that the coil spring 77 for closing the circuit is prestressed as in FIG. 10, because the second breaking lever 55 is in contact with the pin 87, located in the making lever 76, the second breaking lever 55 is stopped so as not to rotate.

Because the first breaking lever 52 is rotated in the counterclockwise direction, the connecting portion 47*a* of the linkage 47, connecting the first breaking lever 52 to the second breaking lever 55, is buckled, and finally, the first breaking lever 52 is in contact with the pin 58 so as to be stopped. At this time, the movable contact 22 is completely separated from the fixed contact 12, wherein the operation of opening the circuit is completed. This state is illustrated in FIG. 14.

Specifically, under the state illustrated in FIG. 13, because a torque applied by the coil spring 77 for closing the circuit is received by a stopper (not shown) inside the buffer 42 through the making lever 76, the second breaking lever 55, the linkage 47, the first breaking lever 52, and so on, the engagement between the first releasing latch 69 and the pin 66 is canceled, and the guide 62 is rotated in a counterclockwise direction. When the rotor 59 is not supported by the guide 62, the second breaking lever 55 is stopped in a state that the second breaking lever 55 is slightly pushed back in a clockwise direction through the pin 87 by a prestressing force of the coil spring 77 for closing the circuit. Under this state, the first breaking lever 52 is rotated in the counterclockwise direction, whereby the connecting portion 47*a* of the linkage 47 is buckled, and the first breaking lever 52 is in contact with the pin 58 so as to be stopped.

In the next, the coil spring 77 for closing the circuit is prestressed by compressing the coil spring 77 by a device similar to the prestressing device, illustrated in FIG. 2. An operation of prestressing the coil spring 77 is also similar to that of the prestressing device, illustrated in FIG. 2. When the coil spring 77 for closing the circuit is completely prestressed, the making lever 76 is engaged with the making latch 79, whereby the lever 88 and the second rotor 89 are in positions, illustrated by solid lines in FIG. 2.

When the engagement between the pin 82 and the making latch 79 is released from the state, illustrated in FIG. 12, and the operation of closing the circuit is performed by releasing the coil spring 77 for closing the circuit, the coil spring 60 for opening the circuit is prestressed as illustrated in FIG. 13, and the movable contact 22 is driven in the direction of closing the circuit. Further, when the coil spring 77 for closing the circuit is prestressed by a motor (not shown) as illustrated in FIG. 10, the state that the breaker is closed and the coil spring 60 for opening the circuit and the coil spring 77 for closing the circuit are prestressed is realized again.

In the control device for breaker according to Embodiment 2 of the present invention, the coil springs are used instead of the torsion bars as the prestressing means for breaking and the prestressing means for closing the circuit. A coil spring has a moment of inertia of a bare wire and an inertial mass of the coil spring itself, effected when one end of the coil spring is fixed and the other end is activated as much as about one third of a total mass of the coil spring. Therefore, although an energy efficiency is deteriorated in comparison with that of a torsion bar, compactness of the prestressing means is achieved. Thus a coil spring is suitable for the control device for breaker having a relatively middle or small size, which does not require a very large energy.

Further, since the lever 110 is provided to guide the making lever 76 through the making linkage 111 when the coil spring 77 for closing the circuit drives the making lever 76, it is possible to stably drive the making lever 76 even though a distance between the coil spring 77 for closing the circuit and the making lever 76 is increased, and a degree of freedom of a position of the coil spring 77 for closing the circuit with respect to the making lever 76 is increased.

Embodiment 3

Figure 15:
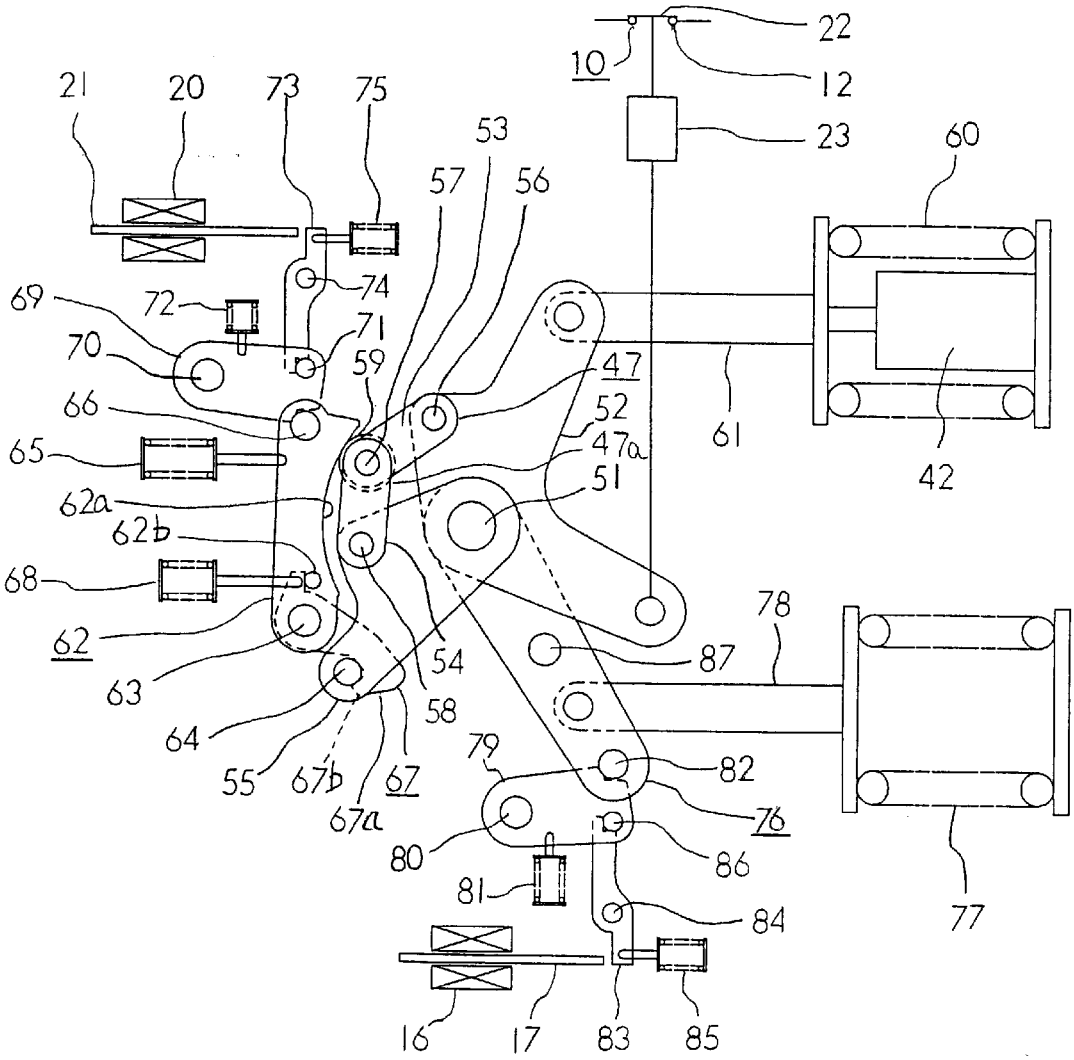
FIG. 15 illustrates a structure of an important portion of a control device for a breaker according to Embodiment 3, wherein the breaker is in a state of closing the circuit, and both of a making coil spring and an opening coil spring are prestressed.
Figure 16:
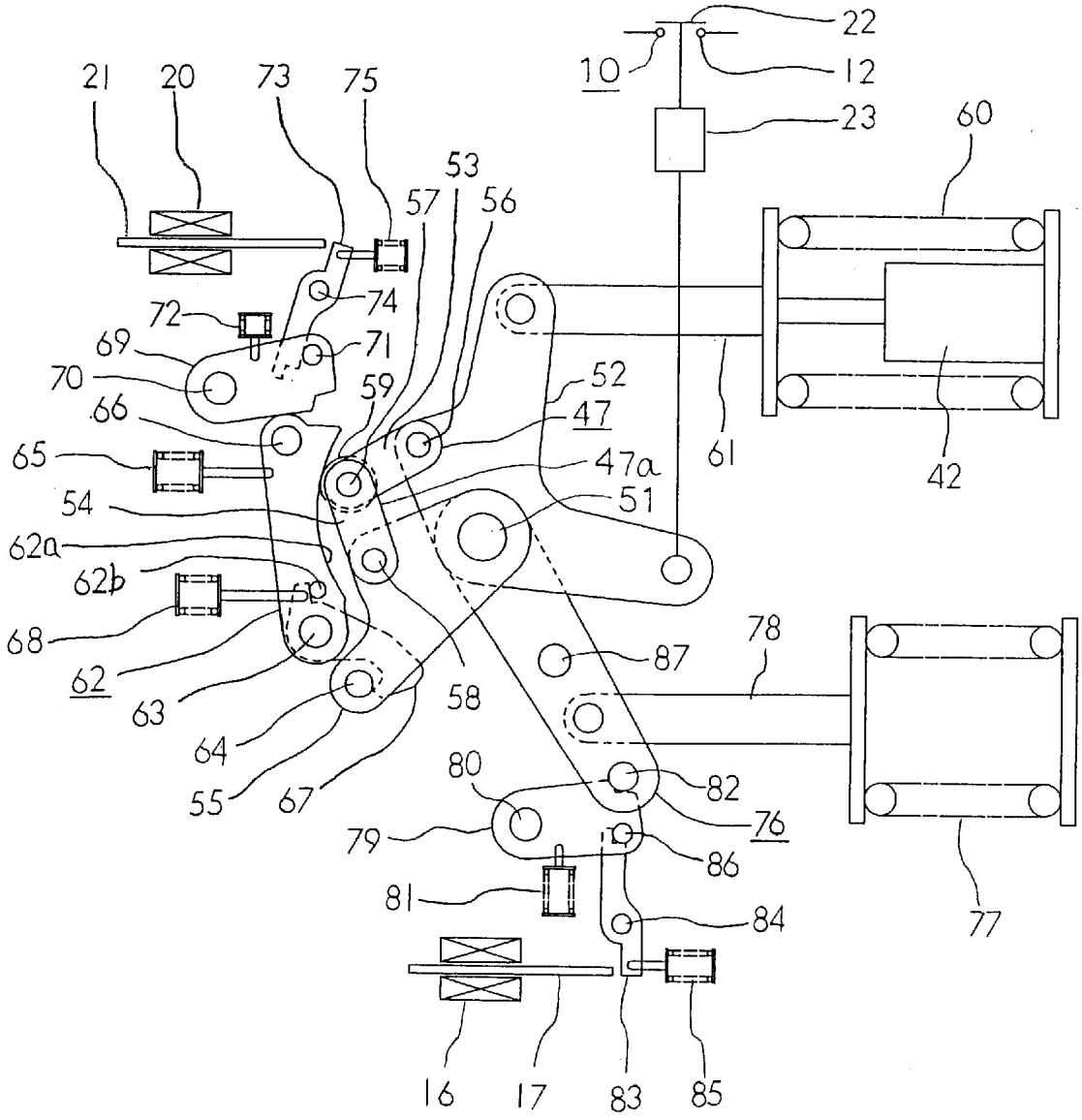
FIG. 16 illustrates a structure of the important portion of the control device for breaker according to Embodiment 3, wherein a state in course of an operation of opening the circuit from the state illustrated in FIG. 15 is shown.

A control device for a breaker according to Embodiment 3 of the present invention will be described in reference of figures. FIGS. 15 through 19 illustrate the control device for a breaker according to Embodiment 3 of the present invention. FIG. 15 illustrates a structure of an important portion of the control device for a breaker, wherein the breaker is in a state of closing the circuit, and a coil spring for closing the circuit and a coil spring for opening the circuit are prestressed. FIG. 16 illustrates a structure of the important portion of the control device for the breaker, wherein a state in course of an operation of opening the circuit from the state illustrated in FIG. 15 is shown.

Figure 17:
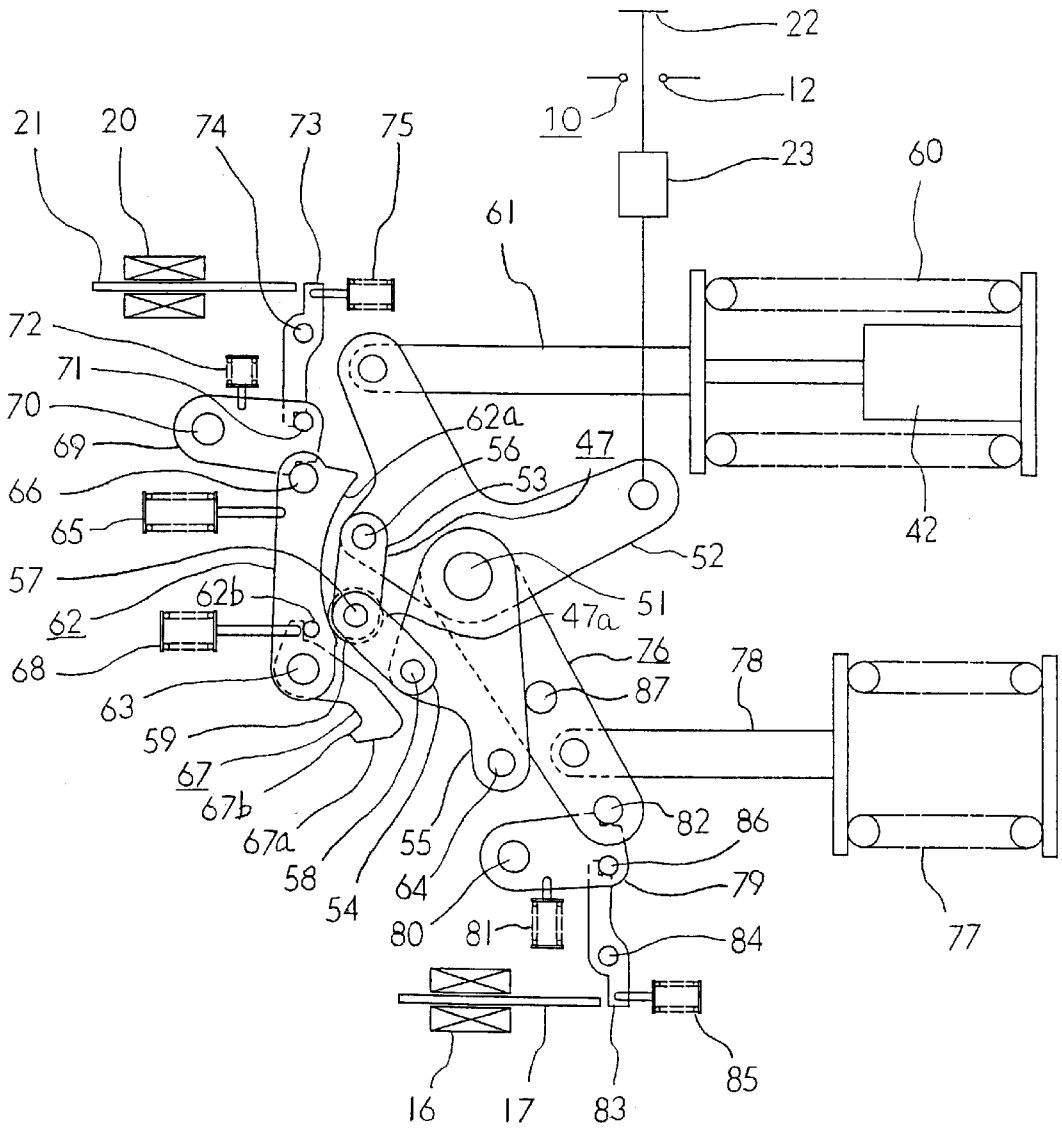
FIG. 17 illustrates a structure of the important portion of the control device for breaker according to Embodiment 3, wherein the operation of opening the circuit is completed from the state illustrated in FIG. 16, the closing coil spring is prestressed, and the opening coil spring is released.
Figure 18:
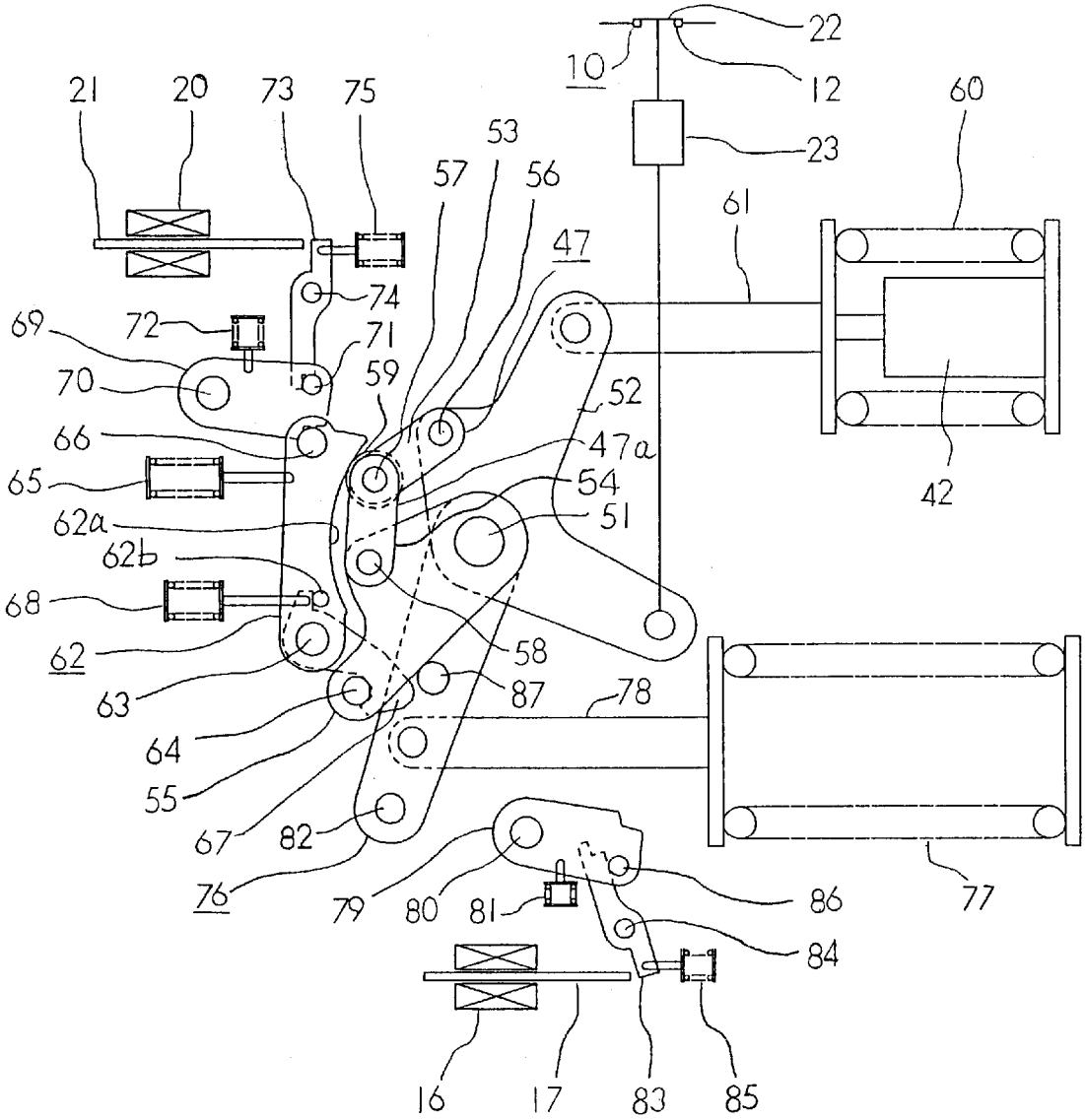
FIG. 18 illustrates a structure of the important portion of the control device for breaker according to Embodiment 3, wherein the breaker is in a state of closing the circuit, the closing coil spring is released, and the opening coil spring is prestressed.
Figure 19:
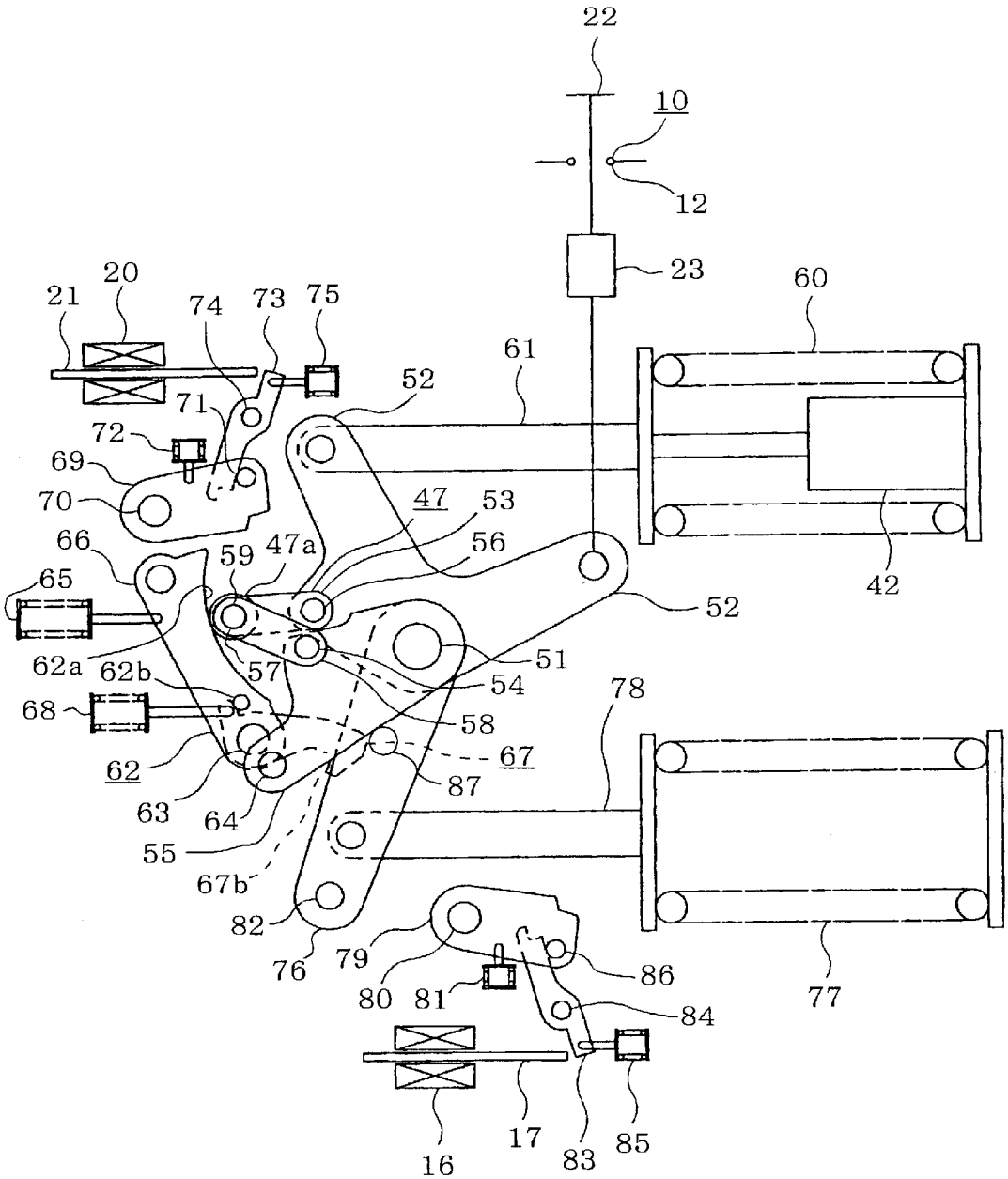
FIG. 19 illustrates a structure of the important portion of the control device for breaker according to Embodiment 3, wherein a second operation of opening the circuit is completed immediately after an operation of rapidly reclosing the circuit, the breaker is in a state of opening the circuit, and both of the making coil spring and the opening coil spring are released.

FIG. 17 illustrates a structure of the important portion of the control device for breaker, wherein the operation of opening the circuit is completed from the state illustrated in FIG. 16, the coil spring for closing the circuit is prestressed, and the coil spring for opening the circuit is released. FIG. 18 illustrates a structure of the important portion of the control device for breaker, wherein the breaker is in a state of closing the circuit, the coil spring for closing the circuit is released, and the coil spring for opening the circuit is prestressed. FIG. 19 illustrates a structure of the important portion of the control device for breaker, wherein a second operation of opening the circuit is completed immediately after an operation of rapidly reclosing the circuit, wherein the breaker is in the state of opening the circuit, and the coil spring for is closing the circuit and the coil spring for opening the circuit are released.

In Embodiment 3, in comparison with the control device illustrated in Embodiment 2, the making shaft 109, the lever 110, the making linkage 111, the pin 112 and so on are omitted to reduce the number of parts.

In these figures, numerical reference 75 designates a spring, urging a releasing trigger 73 in a counterclockwise direction around a rotational shaft 74, wherein the spring 75 is located in a direction adverse to the spring 75, described in Embodiment 2, wherein the releasing trigger 73 is urged to rotate in a counterclockwise direction by an expanding force of the compressed spring 75, wherein a function of the spring 75 is similar to that in Embodiment 2. Numerical reference 76 designates a making lever, located around the main shaft 51 so as to be rotatable; numerical reference 77 designates a coil spring for closing the circuit; and numerical reference 78 designates a rod, wherein the coil spring 77 for closing the circuit urges the making lever 76 through the rod 78 so as to rotate the making lever 76 around the main shaft 51.

Because the other portions of the structure are similar to those in Embodiment 2, the same numerical reference are used for corresponding portions, and description of these portions is omitted.

A procedure of operations of opening the circuit from closing of the circuit, reclosing of the circuit, and reopening of the circuit is also similar to that in Embodiment 2, and description of the procedure is omitted.

Meanwhile, when the breaker is closed by releasing of the coil spring 77 for closing the circuit, the making lever 76 is driven through the rod 78 by the coil spring 77 for closing the circuit, and the circuit is closed. Further, as for an operation of prestressing the coil spring 77 for closing the circuit, the making lever 76 is driven in the counterclockwise direction by a device similar to the prestressing device, illustrated in FIG. 2, whereby the coil spring 77 for closing the circuit is compressed and prestressed through the rod 78.

Since the control device for breaker according to Embodiment 3 is constructed as described above, effects similar to those described in Embodiment 2 are demonstrated, and the number of parts are further reduced.

Embodiment 4

Figure 20:
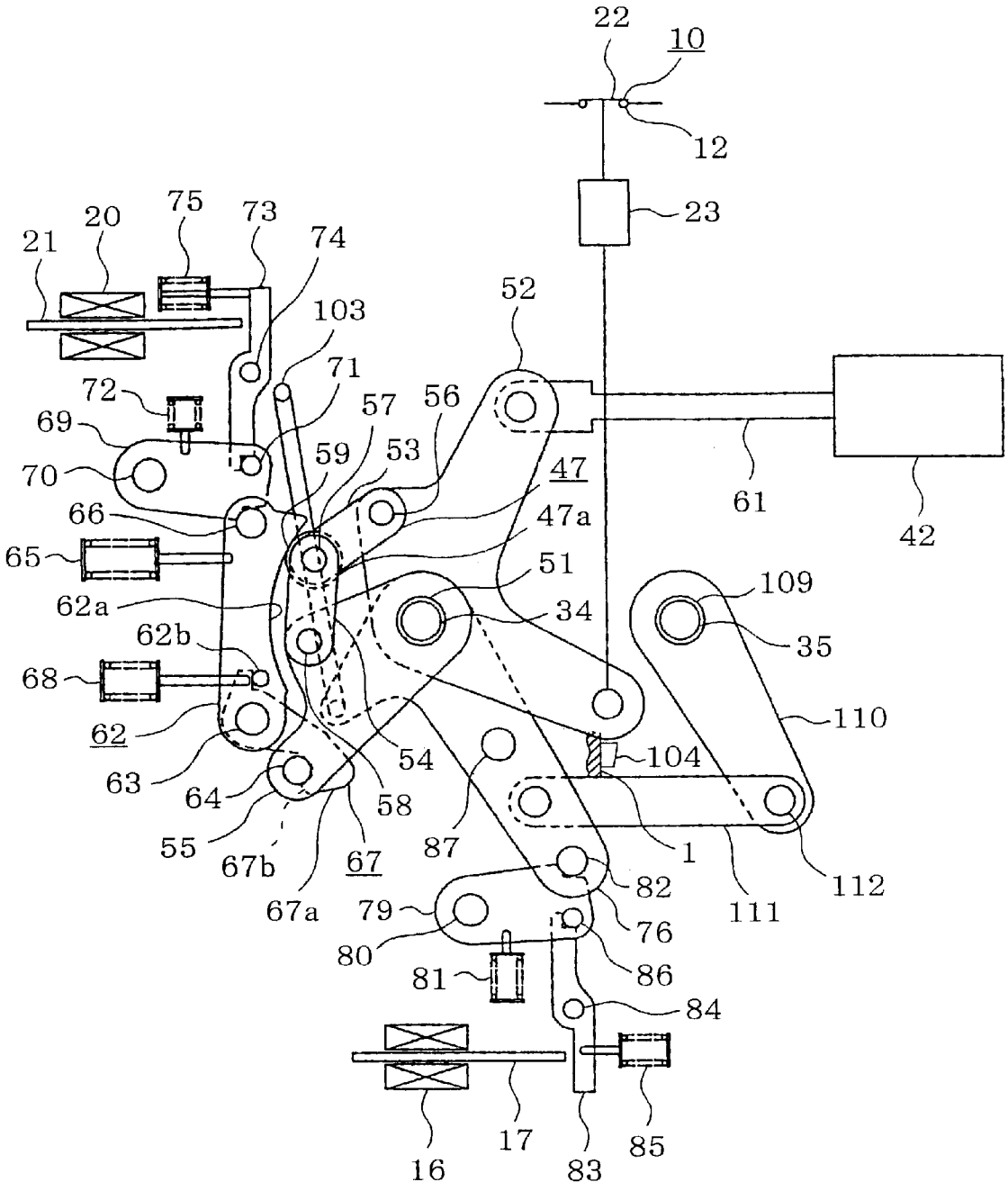
FIG. 20 illustrates a structure of an important portion of a control device for a breaker according to Embodiment 4 of the present invention, wherein a breaker is in a state of closing a circuit, and torsion bars for making and torsion bars for opening are prestressed.
Figure 21A:
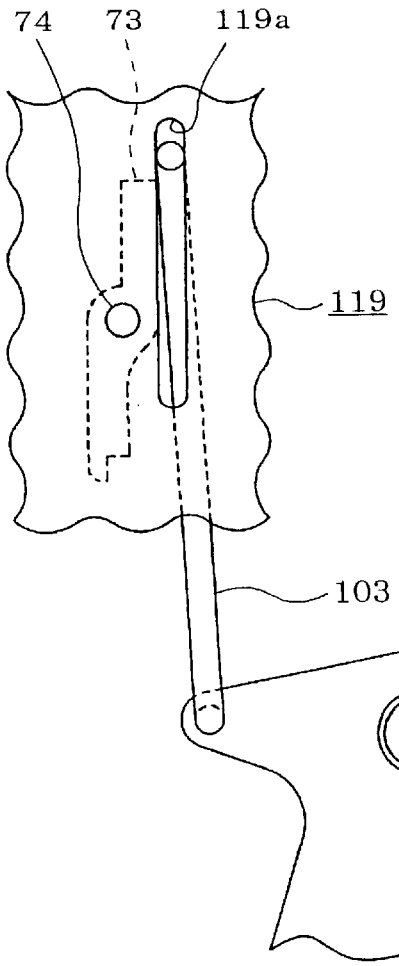
FIG. 21 illustrates a structure around a locking member of the control device for breaker according to Embodiment 4 of the present invention.
Figure 21B:
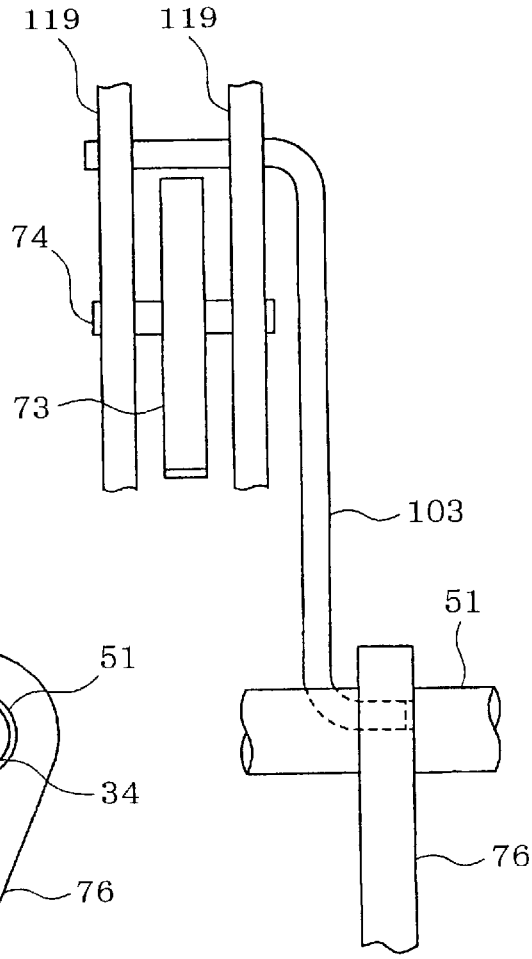

A control device for a breaker according to Embodiment 4 of the present invention will be described in reference of figures. FIGS. 20 through 25 illustrate the control device for a breaker according to Embodiment 4 of the present invention. FIG. 20 illustrates a structure of an important portion of the control device for breaker, wherein the breaker is in a state of closing a circuit, and torsion bars for making and torsion bars for opening a circuit are prestressed. FIGS. 21*a* and 21*b* illustrate a structure around a locking member, wherein FIG. 21*a* is a front view of FIG. 20, and FIG. 21*b* is a right side view of FIG. 20.

Figure 22:
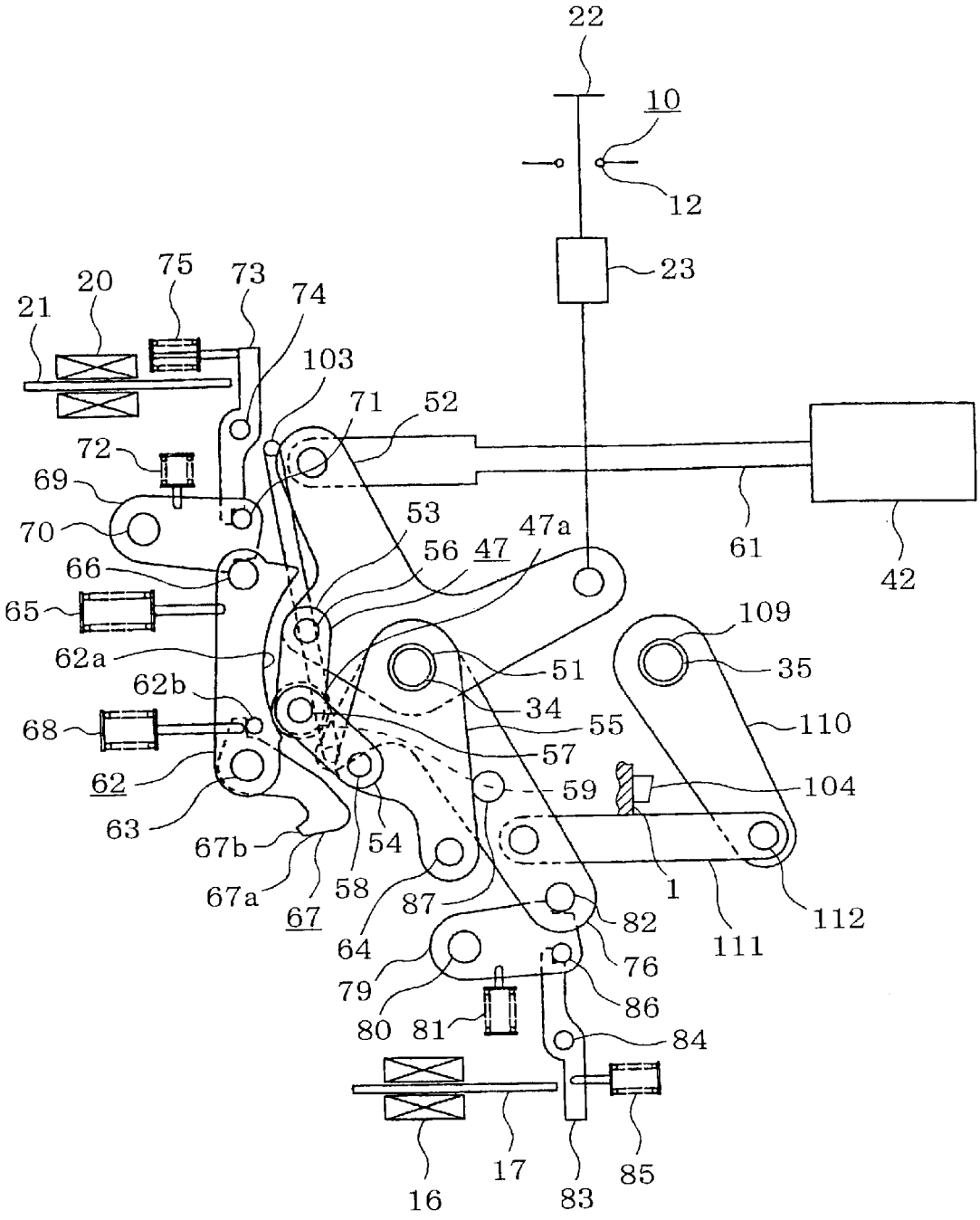
FIG. 22 illustrates a structure of the important portion of the control device for breaker according to Embodiment 4 of the present invention, wherein an operation of opening the circuit is completed, the torsion bars for closing the circuit are prestressed, and the torsion bars for opening the circuit are released.
Figure 23:
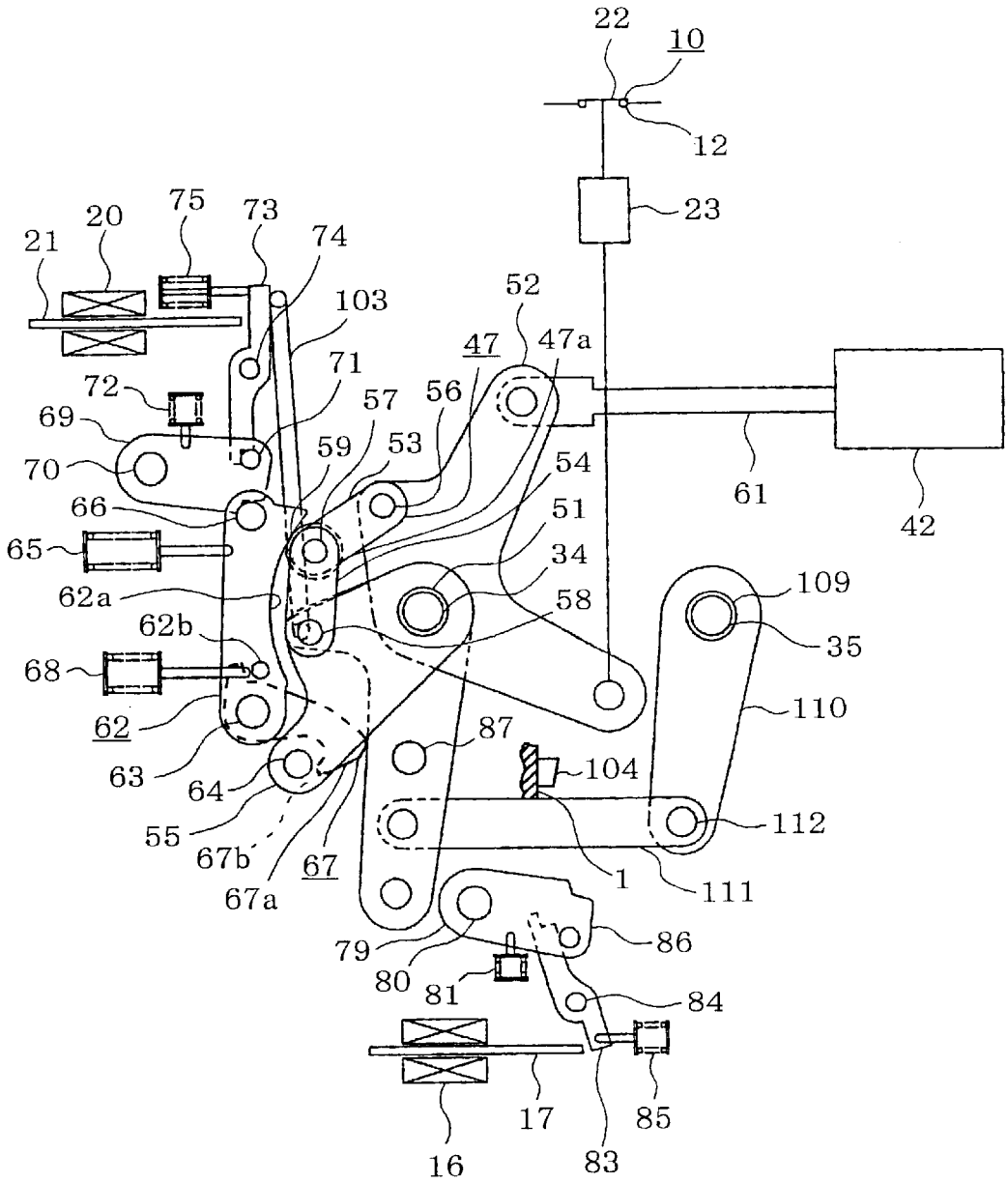
FIG. 23 illustrates a structure of the important portion of the control device for breaker according to Embodiment 4 of the present invention, wherein a state in course of an operation of closing the circuit is shown.
Figure 24:
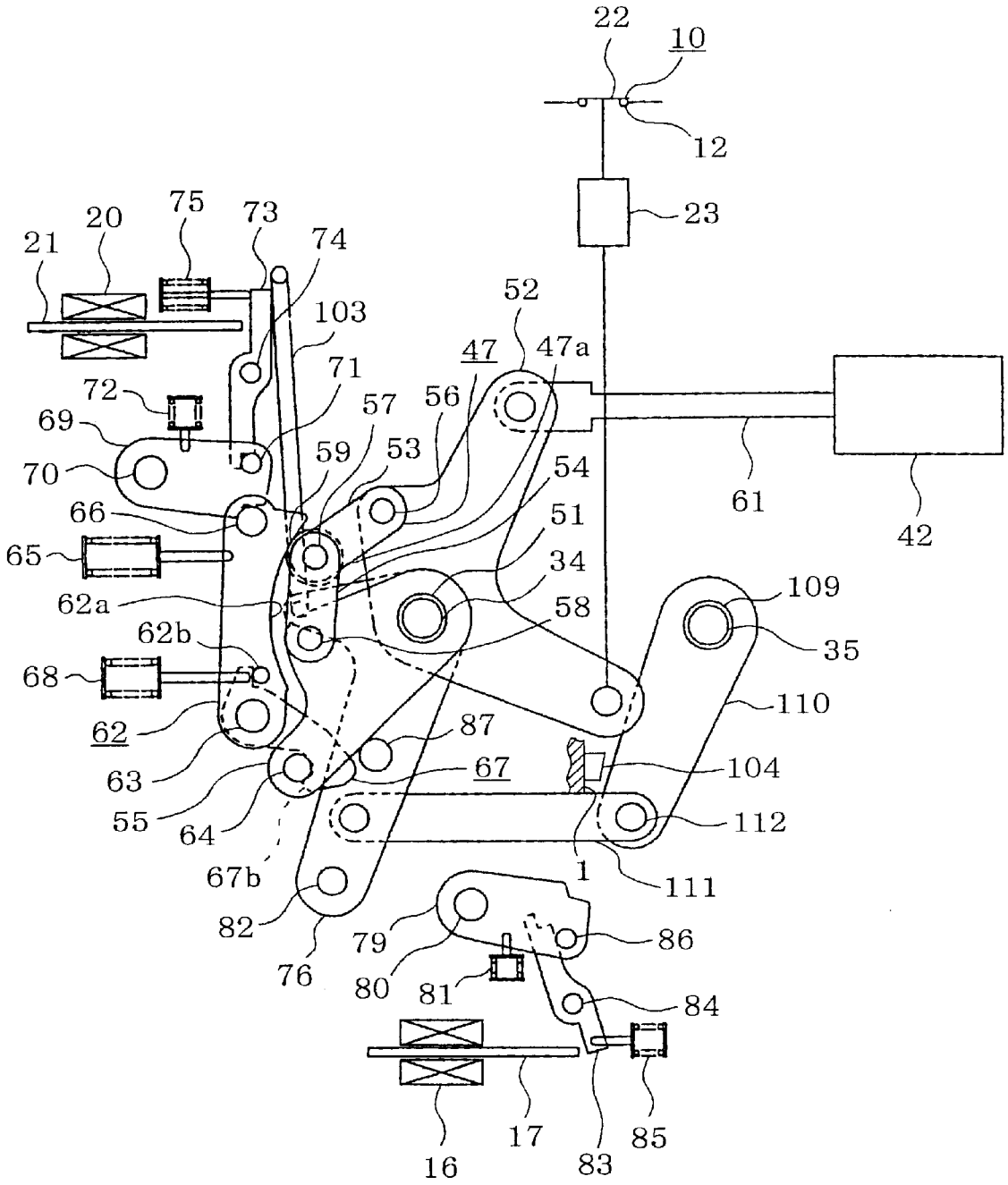
FIG. 24 illustrates a structure of the important portion of the control device for breaker according to Embodiment 4 of the present invention, wherein the breaker is in a state that the circuit is closed, the torsion bars for closing the circuit are released, and the torsion bars for opening the circuit are prestressed.
Figure 25:
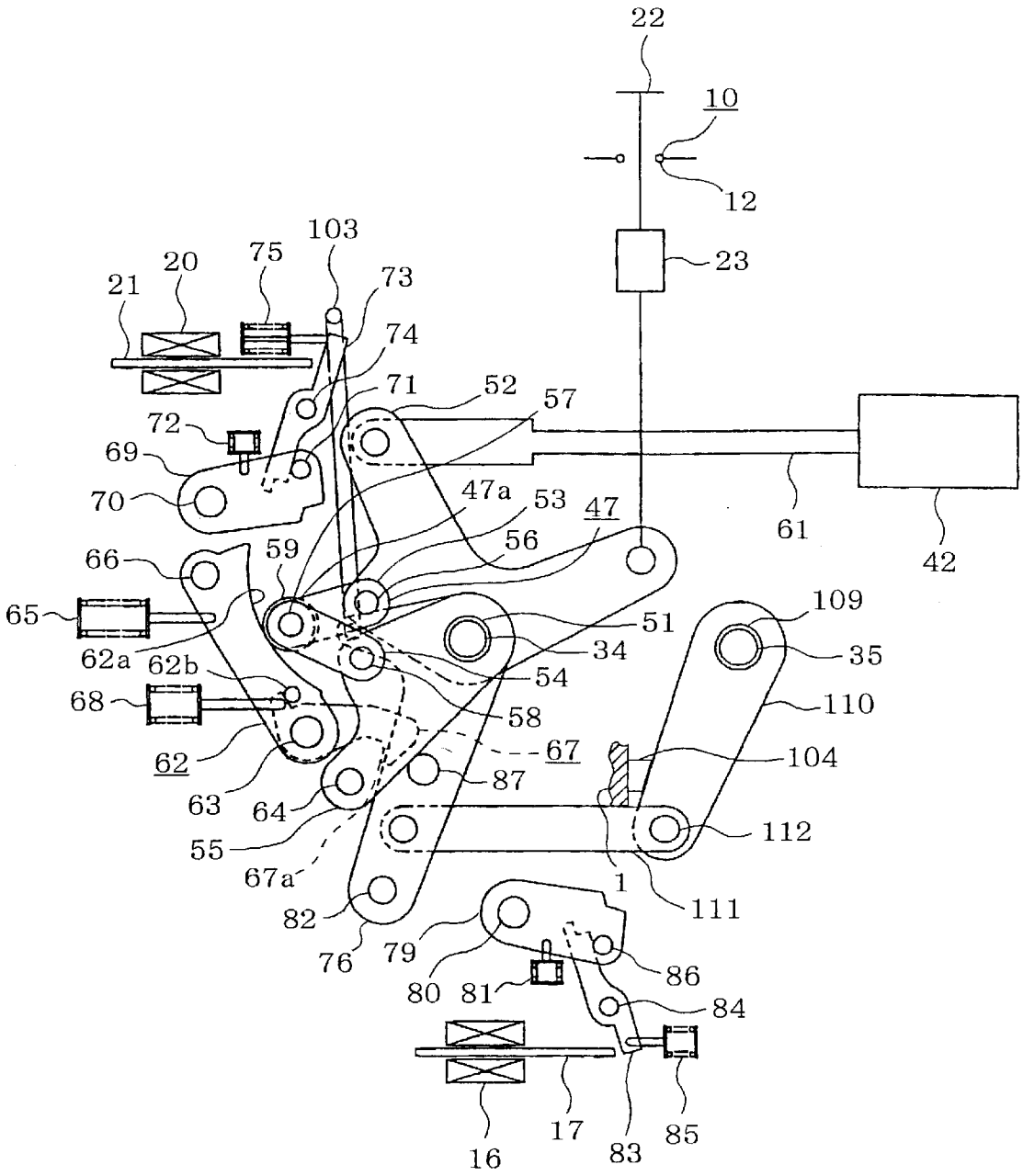
FIG. 25 illustrates a structure of the important portion of the control device for breaker according to Embodiment 4 of the present invention, wherein a second operation of opening the circuit of an operation of rapidly reclosing the circuit is completed, and the breaker is in the state of opening the circuit, and both of the torsion bars for making and opening the circuit are released.

FIG. 22 illustrates a structure of the important portion of the control device for breaker, wherein the breaker is in a state of opening the circuit, the torsion bars for closing the circuit are prestressed, and the torsion bars for opening the circuit are released. FIG. 23 illustrates a structure of the important portion of the control device for breaker, wherein a state in course of an operation of closing the circuit is shown. FIG. 24 illustrates a structure of the important portion of the control device for breaker, wherein an operation of closing the circuit is completed, the torsion bars for closing the circuit are released, and the torsion bars for opening the circuit are prestressed. FIG. 25 illustrates a structure of the important portion of the control device for breaker, wherein a second operation of opening the circuit is completed immediately after an operation of rapidly reclosing the circuit, wherein the breaker is in a state of opening the circuit, and the torsion bars for making and the torsion bars for opening the circuit are released.

In Embodiment 4, a locking member for binding a making lever 76 is located to prevent the breaker from opening even though a releasing electromagnet 20 is erroneously excited upon an instruction of opening the circuit in course of closing of the circuit, and a plunger 21 is operated. Further, a stopper having a predetermined elasticity is provided to absorb a releasing energy of the torsion bars for closing the circuit.

In the control device for the breaker illustrated in FIG. 1, although the operation of closing the circuit is started from the state, illustrated in FIG. 6, the releasing trigger 73 is operated when the releasing electromagnet 20 is operated in the operation of closing the circuit, an engagement between the first releasing latch 69 and the guide 62 is released, and the guide 62 is rotated in the counterclockwise direction by a push by the rotor 59. In other words, the rotor 59 is not supported by the guide 62, and the linkage 47 is buckled. When the linkage 47 is buckled, the torsion bars 29 and 35 for closing the circuit and the making lever 76, as a system for making, are in an unloaded state without a counterforce from the torsion bars 28 and 34 as a system for opening the circuit, the buffer 42, the second breaking lever 55, and the first breaking lever 52.

Therefore, the making lever 76, the second breaking lever 55, the pin 58, the second linkage 54, and so on are rapidly rotated in a clockwise direction, and the pin 58 collides with the first breaking lever 52, rotating in the counterclockwise direction in the operation of opening the circuit. (Please refer to a positional relationship between the pin 58 and the first breaking lever 52, illustrated in FIGS. 8 and 9.) At this time, a large impact is applied to the pin 58, the first breaking lever 52, and so on. Accordingly, it is necessary to make a mechanism of the control device firm so as to endure the impact described above, whereby sizes and weights of equipments are increased. In Embodiment 4, the above-mentioned problems are improved, and miniaturization and a light weight are pursued.

In FIGS. 20 through 25, numerical reference 103 designates a locking member. In FIG. 21 illustrating a detail of the locking member 103 and adjacent portions thereof, numerical reference 119 designates a supporting plates oppositely arranged interposing a releasing trigger 73, which is fixed to and supported by a case (not shown). The releasing trigger 73 is supported by the supporting plates 119 on both sides through a rotational shaft 74 so as to be rotatable. Numerical reference 119*a* designates a linear guide groove, formed in a supporting member 119, illustrated in FIG. 21*a*. Although a detail will be described below, FIG. 21 illustrate a state that the locking member 103 is positioned in an upper portion of the guide groove 119*a*, and the releasing trigger 73 is freely rotatable.

The locking member 103 is formed by bending a bar, having a circular crosssection, at a right angle on both ends as illustrated in FIG. 21*b*. One of the bent ends is engaged with the making lever 76 so as to be rotatable, and the other end is inserted in the guide grooves 119*a*, formed in the two supporting plates 119, wherein the end is upward and downward moved in the guide grooves 119*a* along a rotation of the making lever 76. Numerical reference 104 designates a stopper, made of a rubber having a predetermined elasticity, fixed to the case 1 illustrated in FIG. 20, and absorbing an energy, which is generated when a lever is in contact with the stopper at a final stage of releasing the torsion bars 29 and 35 for closing the circuit.

Other structures are similar to those described in Embodiment 1 in reference of FIG. 1. Therefore, description of these portions is omitted by giving the same numerical references to the corresponding portions.

In the next, an operation will be described. FIG. 22 illustrates a state that the breaker is opened, the torsion bars for closing the circuit are prestressed, and the torsion bars for opening the circuit are released. In FIG. 22, the torsion bars 29 and 35 for closing the circuit constantly apply a rotational force in the clockwise direction through a making linkage 111 and a lever 110 to the making lever 76. The making lever 76 is secured by an engagement between a pin 82 and the making latch 79, the making latch 79 is secured by an engagement between a making trigger 83 and a pin 86, and the torsion bars 29 and 35 for closing the circuit are maintained in a prestressing state. The locking member 103, interlocked with the making lever 76, is positioned in a lower portion and is not in contact with the releasing trigger 73, whereby the trigger 73 is freely rotatable.

In the state illustrated in FIG. 22, when the making electromagnet 16 is excited by an instruction of closing the circuit, the plunger 17 is rightward operated, the making trigger 83 is rotated in the counterclockwise direction around a rotational shaft 84 against a spring 85, the engagement between the making trigger 83 and the in 86 is released, and the making latch 79 is rotated in a clockwise direction by a counterforce applied from the pin 82 of the making lever 76. When the making latch 79 is rotated in the clockwise direction and released from the pin 82, the making lever 76, applied with a torque from the torsion bars 29 and 35 for closing the circuit, is rotated in a clockwise direction, and simultaneously, a pin 87 is in contact with a second breaking lever 55, whereby the second breaking lever 55 is rotated in the clockwise direction by a push by the pin 87.

Because a guide 62 is engaged with a first releasing latch 69, and a rotor 59 keeps a contact with an arch surface 62*a* of the guide 62 and is moved by rotating, the rotor 59 is moved along an arch locus with center of the main shaft 51. Therefore, a second linkage 54, the rotor 59, a first linkage 53, and a first breaking lever 52 are integrally interlocked with a rotation of the second breaking lever 55 and rotated in the clockwise direction around a main shaft 51. When the movable contact 22 is driven in a direction of closing the circuit, the torsion bars 28 and 34 for opening the circuit are prestressed.

The second breaking lever 55 continues to rotate, and a pin 64, located in the second breaking lever 55, is in contact with a tip slant 67*a* of the second releasing latch 67, whereby a second releasing latch 67 is rotated in the counterclockwise direction. When the pin 64 exceeds a corner 67*b*, the second releasing latch 67 is rotated in the clockwise direction by function of a spring 68, whereby the second releasing latch 67 is engaged with the pin 64. Simultaneously, the first breaking lever 52 reaches a predetermined rotational angle, wherein the operation of closing the circuit and a prestressing operation of the torsion bars 28 and 34 for opening the circuit are completed. A state in course of this operation is illustrated in FIG. 23, and FIG. 24 illustrates a state that the circuit is completely closed.

As illustrated in FIG. 23, the locking member 103, connected to the making lever 76, is guided by the guide groove 119*a* illustrated in FIG. 21*a* along with a start of close of the circuit, and the locking member 103 is upward moved while keeping a contact with the releasing trigger 73. Accordingly, even though a releasing electromagnet 20 is excited, the releasing trigger 73 is bound so as not to rotate. The locking member 103 is upward moved while maintaining a state of being in contact with the releasing trigger 73 just before completing to close the circuit, the locking member is separated from the releasing trigger 73 in the state of completely closing the circuit, and positioned in an upper position as illustrated in FIG. 24.

From the state illustrated in FIG. 24, in use of a prestressing device similar to the prestressing device illustrated in FIG. 2, the torsion bars 29 and 35 for closing the circuit are prestressed by a motor (not shown) through a speed reduction gear. At this time, the making lever 76, with which one end of the torsion bar 35 for closing the circuit is connected through the lever 110 and the making linkage 111, is rotated in a counterclockwise direction. At a time of completely prestressing, the making lever 76 is engaged with the making trigger 83 through the making latch 79 to maintain a spring force for closing the circuit. Because the making lever 76 is rotated in a counterclockwise direction, the locking member 103 is downward moved in the figure, and reaches the position same as that of FIG. 20.

In the next, an operation of reopening the circuit will be described. In the state of closing the circuit illustrated in FIG. 24, when the releasing electromagnet 20 is excited by an instruction of opening the circuit, the plunger 21 is rightward moved, and the releasing trigger 73 is rotated in the clockwise direction around the rotational shaft 74 against the spring. When the releasing trigger 73 is rotated, an engagement between the releasing trigger 73 and the pin 71 is released, and the first releasing latch 69 is rotated in the counterclockwise direction by a counterforce applied from the pin 66 of the guide 62.

When the first releasing latch 69 is rotated in a counterclockwise direction so as to be disengaged from the pin 66, since the rotor 59 pushes the arch surface 62*a*, the guide 62 is rotated in a counterclockwise direction against the spring 65. When the guide 62 is rotated in the counterclockwise direction, because the rotor 59 is not supported by the guide 62, the first breaking lever 52, applied with a torque from the torsion bars 28 and 34 for opening the circuit, is rotated in the counterclockwise direction, and the movable contact 22 is driven in the direction of opening the circuit.

Simultaneously, a pin 62*b* of the guide 62 pushes the second releasing latch 67, whereby the second releasing latch 67 is rotated in the counterclockwise direction against a spring 68, and the engagement between the second releasing latch 67 and the pin 64, located in the second breaking lever 55, is released. When the pin 64 is disengaged from the second releasing latch 67, the second breaking lever 55 becomes rotatable. However, not like a case that the circuit is opened from the state that the torsion bars for closing the circuit are prestressed as in FIG. 20, the second breaking lever 55 is in contact with the pin 87, located in the making lever 76, to stop a rotation of the second breaking lever 55.

In the state illustrated in FIG. 24, the torque generated by the torsion bars 29 and 35 for closing the circuit is received by a stopper (not shown), located inside a buffer 42, through the making lever 76, the second breaking lever 55, a linkage 47, the first breaking lever 52, and so on. Therefore, when a pin 66 is not engaged by the first releasing latch 69, the guide 62 is rotated in the counterclockwise direction. When the rotor 59 is not supported by the guide 62, the making lever 76, applied with a torque in a clockwise direction by the prestressing force by the torsion bars 29 and 35 for closing the circuit, starts to rotate in the clockwise direction. However, because the lever 110 is in contact with the stopper 104, the making lever 76 is not further rotated in the clockwise direction, and therefore the second breaking lever 55 is not rotated.

Under this state, the first breaking lever 52 is rotated in a counterclockwise direction, and the guide 62 is rotated in a counterclockwise direction and is in contact with a stopper (not shown) so as to be stopped. Therefore, a collapsible portion 47*a* of the linkage 47, connecting the first breaking lever 52 to the second breaking lever 55, is tilted, and finally the first breaking lever 52 is stopped just before a contact with a pin 58. At this time, a movable contact 22 is completely separated from a fixed contact 12, whereby the operation of opening the circuit is completed.

Meanwhile, when the rotor 59 is not supported by the guide 62, because the lever 110 is stopped by the stopper 104, namely the making lever 76 and the second breaking lever 55 are not rotated in the clockwise direction by more than predetermined angles, the first breaking lever 52 does not collide with the pin 58, located in the second breaking lever 55, not like Embodiment 1. This state is illustrated in FIG. 25.

The other operations are similar to those of the control device for the breaker described in Embodiment 1.

Since the control device for the breaker according to Embodiment 4 is constructed as described above, even though the releasing electromagnet 20 is excited upon an input of an instruction of opening the circuit in course of an operation of closing the circuit, the releasing trigger 73 is stopped by the locking member 103 so as not to rotate, whereby an engagement of the releasing latch 69 is not released, and an operation of opening the circuit is allowed in a state of closing the circuit. Further, when an engagement of the guide 62 is released immediately after closing the circuit, since the rotor 59 is not supported, the second breaking lever 55, the making lever 76, the lever 110, and so on are rotated in the clockwise direction by a prestressing energy, which is left in the torsion bars 29 and 35 for closing the circuit. However, by receiving the lever 110 by the stopper 104, it is possible to prevent an impact, and to stop the lever 110, the making lever 76, and the second breaking lever 55. Further, since the first breaking lever 52 is stopped so as not to be in contact with the pin 58, it is possible to prevent an impact from occurring.

Further, the locking member 103 is moved along with the rotation of the making lever 76 to lock the releasing trigger 73. Therefore, even though the releasing electromagnet 20 is excited by an instruction of opening the circuit in course of closing of the circuit, the releasing trigger 73 is not operated, and the circuit is opened after a state of closing the circuit is established. Accordingly, it is possible to prevent the first breaking lever 52, driven in the counterclockwise direction by the torsion bars 28 and 34 for opening the circuit upon an disengagement of the guide 62 in course of closing the circuit, and the pin 58, located in the second breaking lever 55, which is driven in the clockwise direction by the making lever 76 in order to close the circuit, from colliding, whereby a large impact does not occur.

Further, when the circuit is opened immediately after completing to close the circuit, because a spring force, left after the operation of closing the circuit by the torsion bars 29 and 35 for closing the circuit, is received by the stopper, which has a predetermined elasticity, it is possible to prevent an excessive impact caused by a collision, and to secure mechanical reliability.

Even though any one of the locking member 103 and the stopper 104 is provided, an effect of relaxing the impact is correspondingly obtainable. Especially, by providing the locking member 103 to prevent an erroneous operation of the releasing trigger 73 while the prestressing energy of the torsion bars 29 and 35 for closing the circuit is large, a most amount of the prestressing energy of the torsion bars 29 and 35 for closing the circuit is released for closing the circuit when the circuit is erroneously opened immediately after closing the circuit. Because a residual prestressing energy is relatively small, a substantially large impact does not occur without providing the stopper 104.

Embodiment 5

Figure 26:
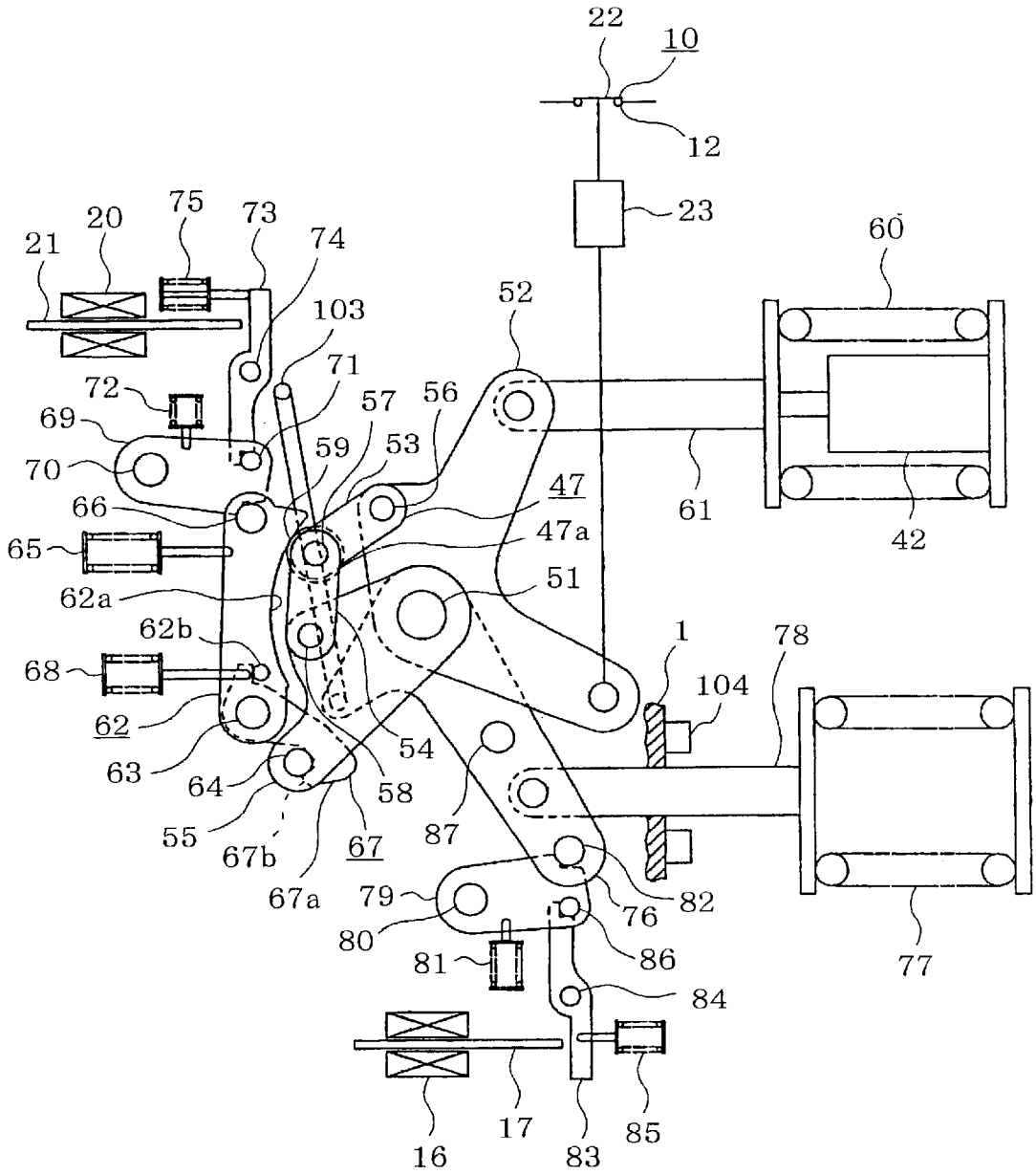
FIG. 26 illustrates a structure of an important portion of a control device for a breaker according to Embodiment 5, wherein the breaker is in a state of closing a circuit, and both of a coil spring for making and a coil spring for opening the circuit are prestressed.
Figure 27:
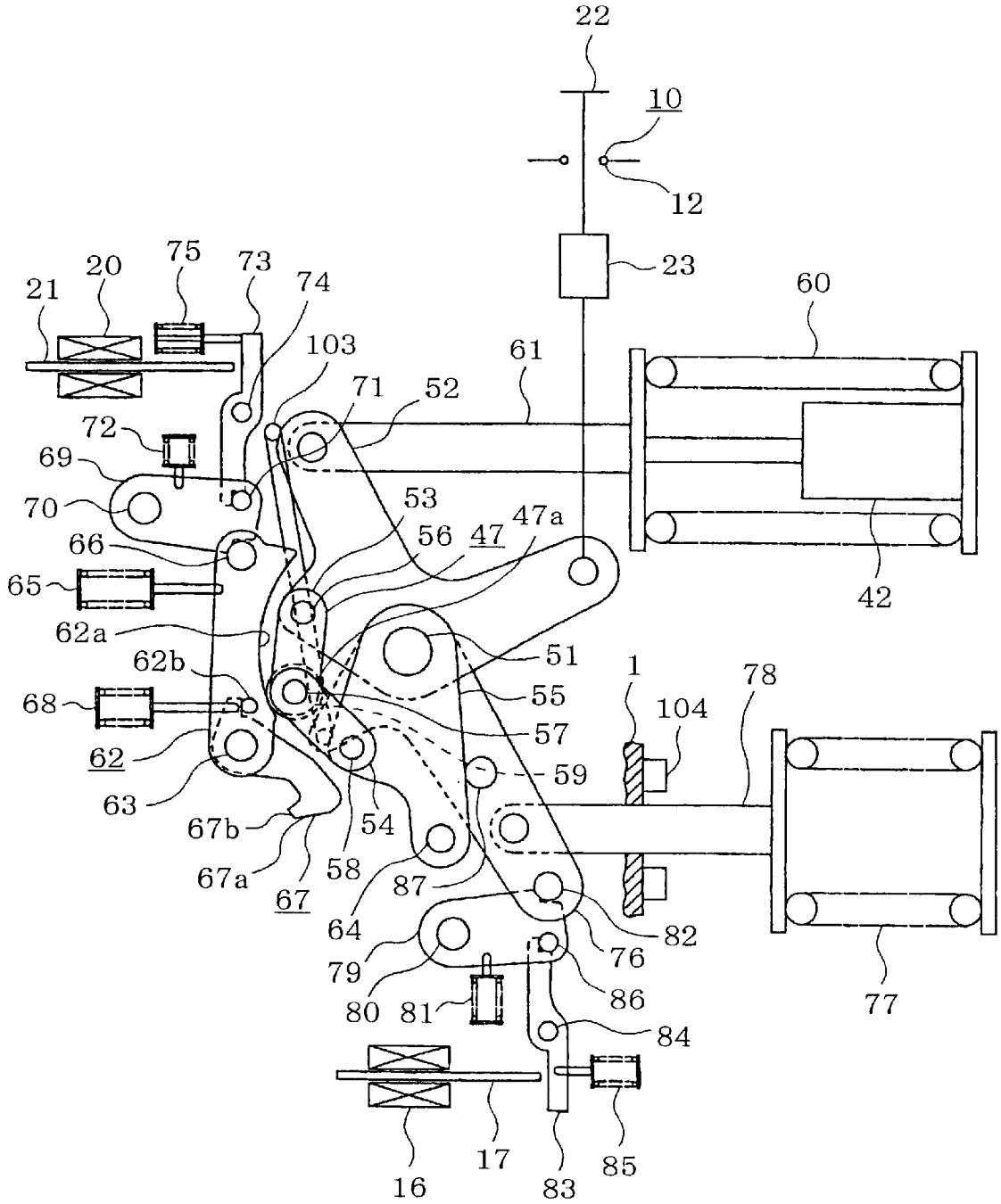
FIG. 27 illustrates a structure of the important portion of the control device for breaker according to Embodiment 5 of the present invention, wherein the breaker is in a state of opening the circuit, the coil spring for closing the circuit is prestressed, and the coil spring for opening the circuit is released.

A control device for a breaker according to Embodiment 5 of the present invention will be described in reference of figures. FIGS. 26 through 30 illustrate the control device for the breaker according to Embodiment 5 of the present invention. FIG. 26 illustrates a structure of an important portion of the control device for a breaker, wherein the breaker is in a state of closing the circuit, and a coil spring for closing the circuit and a coil spring for opening the circuit are prestressed. FIG. 27 illustrates a structure of the important portion of the control device for breaker, wherein the breaker is in a state of opening the circuit, the coil spring for closing the circuit is prestressed, and the coil spring for opening the circuit is released.

Figure 28:
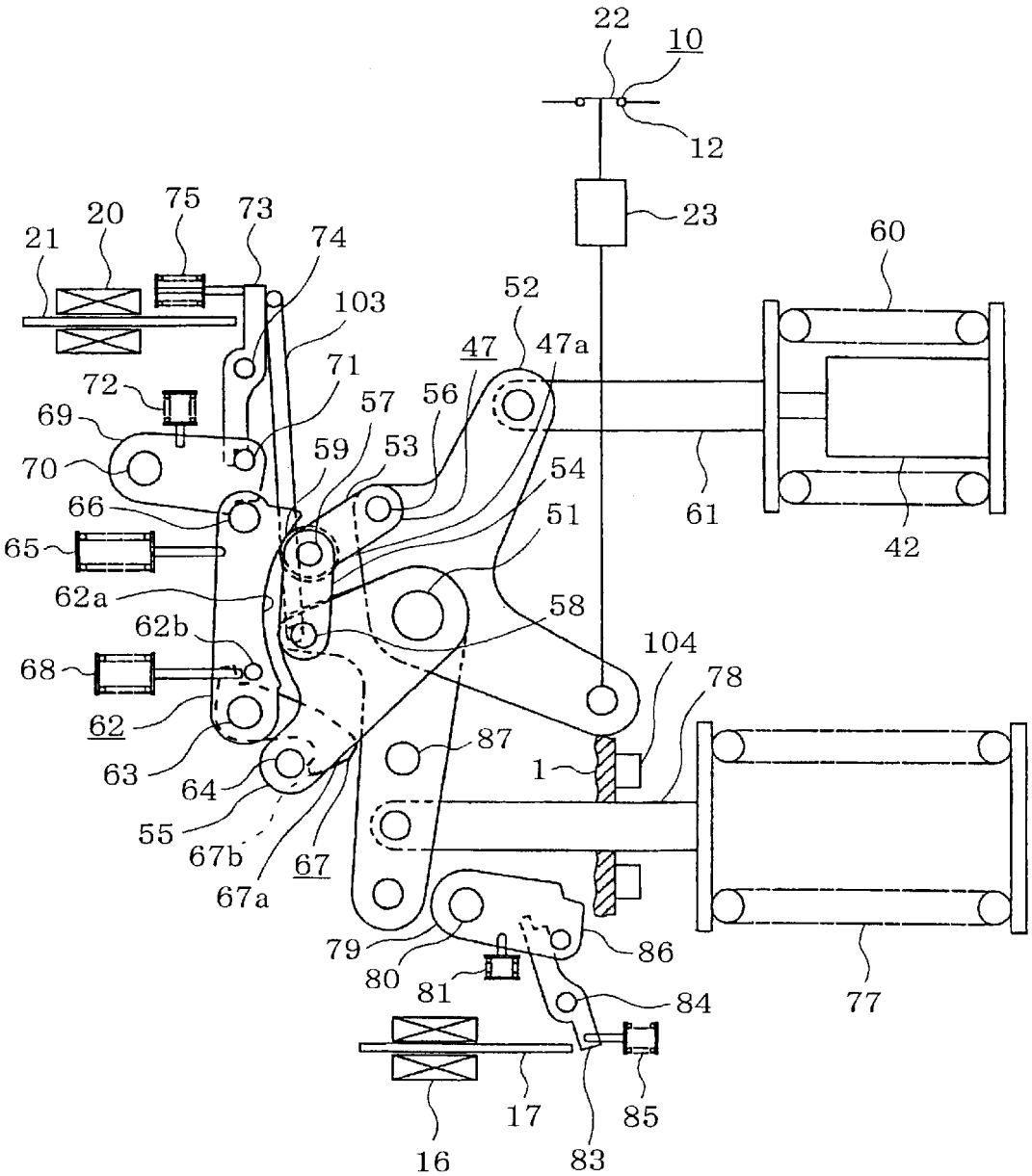
FIG. 28 illustrates a structure of the important portion of the control device for breaker according to Embodiment 5 of the present invention, wherein a state in course of an operation of closing the circuit is shown.
Figure 29:
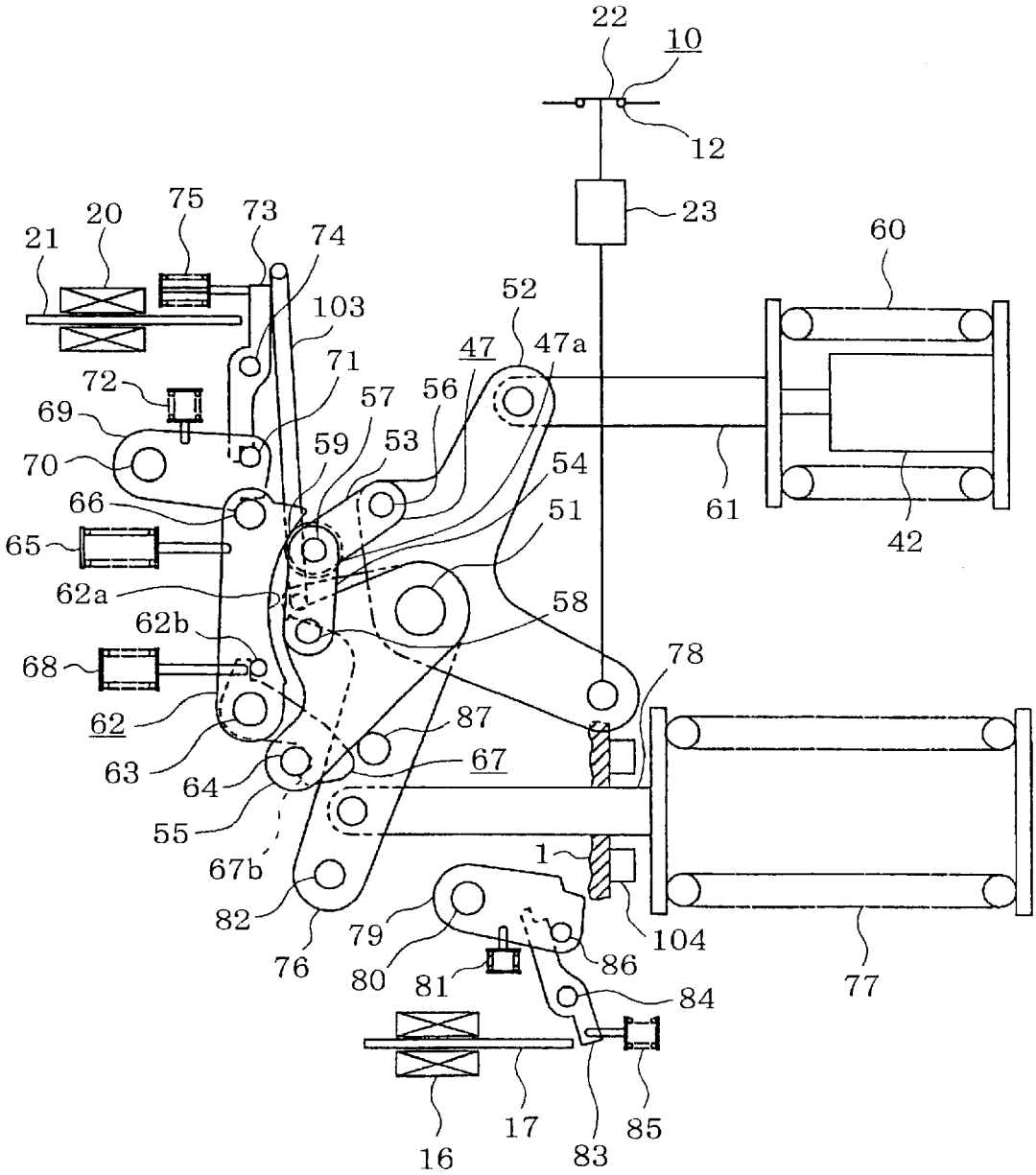
FIG. 29 illustrates a structure of the important portion of the control device for breaker according to Embodiment 5 of the present invention, wherein the operation of closing the circuit is completed, the coil spring for closing the circuit is released, and the coil spring for opening the circuit is prestressed.
Figure 30:
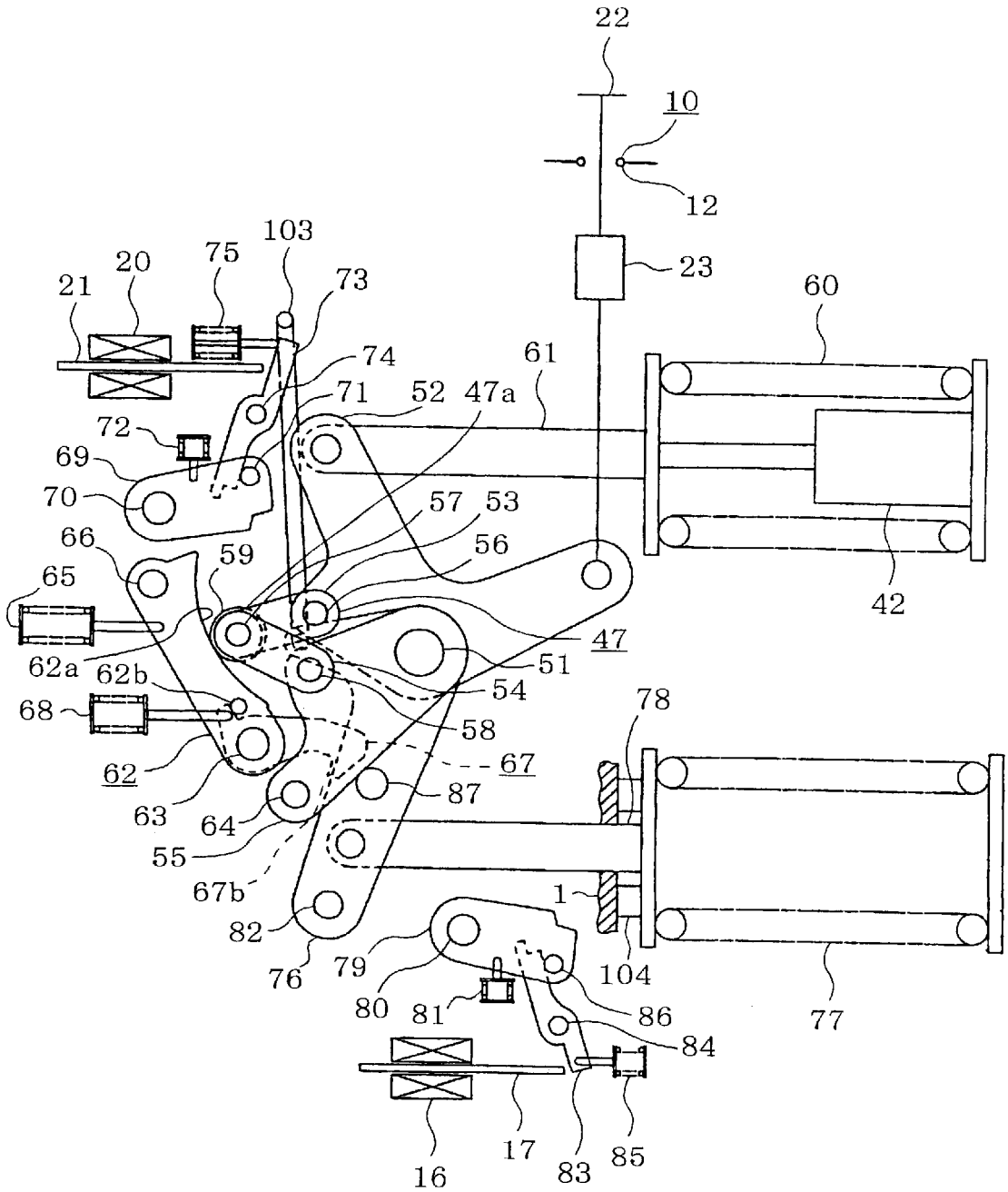
FIG. 30 illustrates a structure of the important portion of the control device for breaker according to Embodiment 5 of the present invention, wherein a second operation of opening the circuit of an operation of rapidly reclosing the circuit is completed, the breaker is in a state of opening the circuit, and both of the coil spring for making and the coil spring for opening the circuit are released.

FIG. 28 illustrates a structure of the important portion of the control device for breaker, wherein a state in course of the operation of closing the circuit is shown. FIG. 29 illustrates a structure of the important portion of the control device for breaker, wherein an operation of closing the circuit is completed, the coil spring for closing the circuit is released, and the coil spring for opening the circuit is prestressed. FIG. 30 illustrates a structure of the important portion of the breaker, wherein an second operation of opening the circuit is completed immediately after an operation of rapidly reclosing the circuit, the breaker is in the state of opening the circuit, and the coil spring for closing the circuit and the coil spring for opening the circuit are released.

In Embodiment 5, a locking member and a stopper, respectively similar to the locking member 103 and the stopper 104 described in Embodiment 4, are located in the control device described in Embodiment 3.

In these figures, numerical reference 103 designates the locking member for binding a making lever 76. The locking member 103 is similar to that described in Embodiment 4, wherein an end of one of bent portions is engaged with the making lever 76 so as to be rotatable, and the other bent end is inserted in guiding grooves (not shown), formed in two supporting plates so as to upward and downward move inside the guide grooves along with rotation of the making lever 76. Numerical reference 104 designates a stopper, made of a rubber having a predetermined elasticity, wherein the stopper is fixed to a case 1 and absorbs a releasing energy when a coil spring 77 for closing the circuit is in contact with a stopper in a final stage of releasing.

The other portions of the structure is similar to those in Embodiment 3. Therefore, the same numerical references are used for corresponding portions, and description of these portions is omitted.

A function and an operation are similar to the locking member 103 and the stopper 104, described in Embodiment 4. FIG. 27 illustrates a state that a breaker is opened, a coil spring 60 for closing the circuit is prestressed, and the coil spring 77 for opening the circuit is released. The locking member 103, interlocked with the making lever 76, is not in contact with a releasing trigger 73, and the releasing trigger 73 is freely rotatable. Under this state, the operation of closing the circuit is conducted by rotating a making trigger 83 by an electromagnet 16 to be disengaged from a making latch 79. FIG. 28 illustrates a state in course of the operation of closing the circuit, wherein the locking member 103 is upward moved while being in contact with the releasing trigger 73 along with a rotation of the making lever 76 in a making operation. At this time, even though a releasing electromagnet 20 is excited, movement of the releasing trigger 73 is prevented.

FIG. 29 illustrates a state that the operation of closing the circuit is completed, the coil spring 77 for closing the circuit is released, and the coil spring 60 for opening the circuit is prestressed. Because the locking member 103 is positioned in an upper portion of the releasing trigger 73 and separated from the releasing trigger 73, the releasing trigger 73 is rotatable. When the coil spring 77 for closing the circuit is prestressed by a prestressing device from the state illustrated in FIG. 29, the making lever 76 is rotated in the counterclockwise direction, and the locking member 103, interlocked with the making lever 76, is downward moved, whereby a state illustrated in FIG. 26 is established.

In the next, an operation of reopening the circuit will be described. Under the state of closing the circuit illustrated in FIG. 29, when the releasing electromagnet 20 is excited upon an instruction of opening the circuit, a plunger 21 is rightward moved, and the releasing trigger is rotated in a clockwise direction around a rotational shaft 74 because the releasing trigger 73 is not bound by the locking member 103. When the releasing trigger 73 is rotated, an engagement between the releasing trigger 73 and a pin 71 is released, and the first releasing latch 69 is rotated in a counterclockwise direction by a counterforce, applied from a pin 66 of a guide 62.

When a first releasing latch 69 is disengaged from a pin 66, because a rotor 59 pushes an arch surface 62*a*, a guide 62 is rotated in a counterclockwise direction against a spring 65. When the guide 62 is rotated in the counterclockwise direction, because the rotor 59 is not supported by the guide 62, a first breaking lever 52, applied with a torque from the coil spring 60 for opening the circuit, is rotated in a counterclockwise direction, and a movable contact 22 is driven in a direction of opening the circuit.

Simultaneously, a pin 62*b* of the guide 62 pushes a second releasing latch 67, whereby the second releasing latch 67 is rotated in a counterclockwise direction against a spring 68, whereby an engagement between the second releasing latch 67 and a pin 64, located in a second breaking lever 55, is canceled. When the pin 64 is disengaged from the second releasing latch 67, the second breaking lever 55 becomes rotatable. However, not like a case that the circuit is opened from the state that the coil spring 77 for closing the circuit is prestressed as illustrated in FIG. 26, because the second breaking lever 55 is in contact with a pin 87, located in the making lever 76, the second breaking lever 55 is stopped without rotating.

Further, under a state illustrated in FIG. 29, because a torque generated by the coil spring 77 for closing the circuit is received by a stopper (not shown) inside a buffer 42 through the making lever 76, the second breaking lever 55, a linkage 47, the first breaking lever 52, and so on, when the guide 62 is disengaged from the first releasing latch 69, and the rotor 59 is not supported by the guide 62, the coil spring 77 for closing the circuit, a rod 78, and the making lever 76 forming a making system, are made free. Thereafter, the making lever 76, connected to the coil spring 77 for closing the circuit, is further rotated in a clockwise direction. However, the making lever 76 is stopped when the coil spring 77 for closing the circuit is in contact with a stopper 104 having elasticity without causing an impact. Therefore, the making lever 76 and the second breaking lever 55 do not further rotate in the clockwise direction.

Because the first breaking lever 52 is rotated in the counterclockwise direction under this state, and the guide 62 is rotated in the counterclockwise direction so as to be stopped by being in contact with a stopper (not shown), a connecting portion 47*a* of the linkage 47, connecting the first breaking lever 52 to the second breaking lever 55, is buckled, and finally the first breaking lever 52 is stopped just before being in contact with the pin 58. At this time, a movable contact 22 is completely separated from a fixed contact 12, whereby the operation of opening the circuit is completed.

Meanwhile, when the rotor 59 is not supported by the guide 62, the coil spring 77 for closing the circuit is in contact with the stopper 104. In other words, the making lever 76 and the second breaking lever 55 are prevented from rotating in the clockwise direction by more than a predetermined angle. Therefore, not like the structure described in Embodiment 3, the first breaking lever 52 does not collide with the pin 58, located in the second breaking lever 55. This state is illustrated in FIG. 30.

Because the control device for the breaker according to Embodiment 5 of the present invention is constructed as described above, effects similar to those in Embodiment 4 are demonstrated.

Embodiment 6

Figure 31:
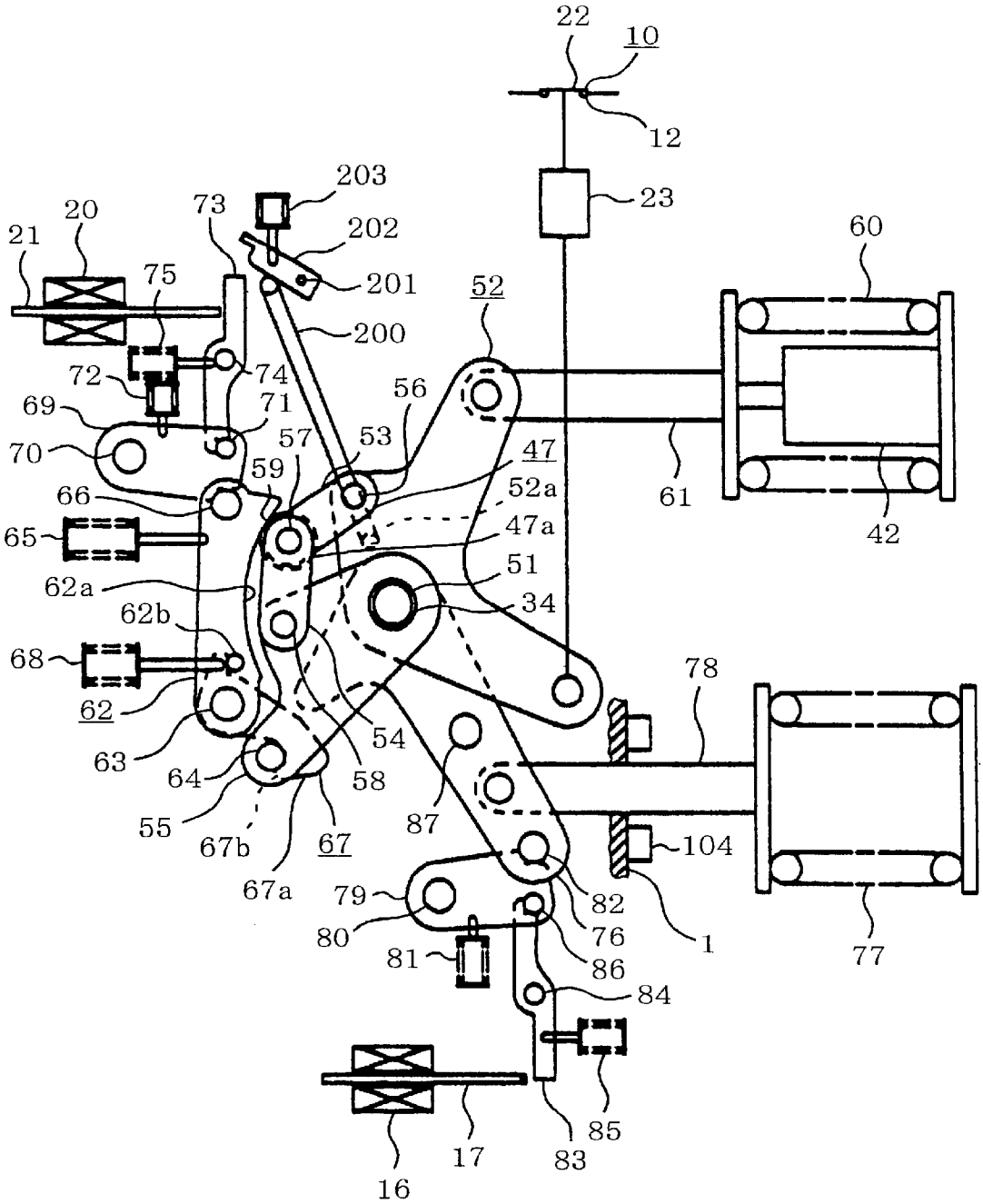
FIG. 31 illustrates a structure of an important portion of a control device for a breaker according to Embodiment 6 of the present invention, wherein the breaker is in a state of closing the circuit, and both of a closing coil spring and an opening coil spring are prestressed.
Figure 32:
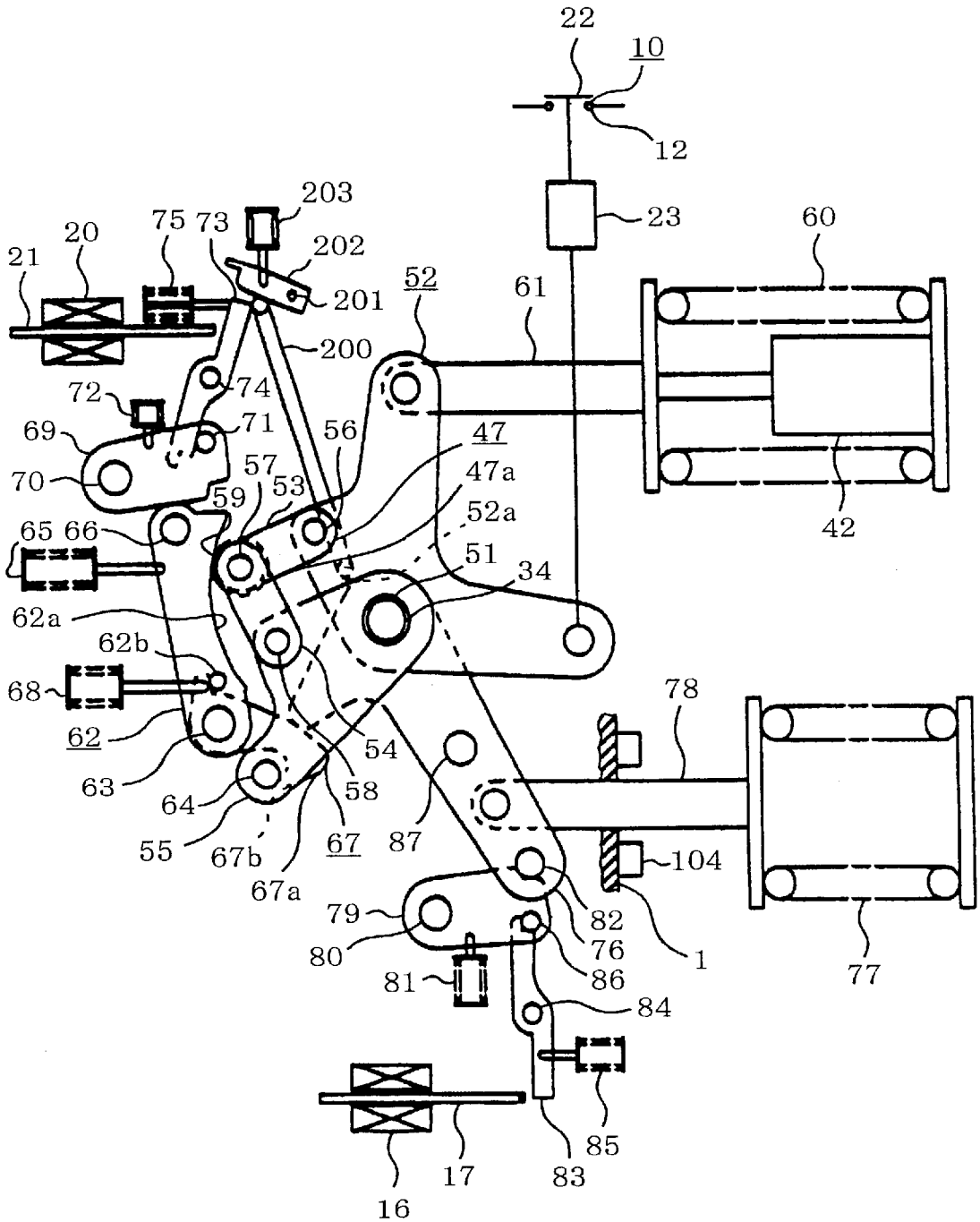
FIG. 32 illustrates a structure of the important portion of the control device for breaker according to Embodiment 6 of the present invention, wherein a state in course of an opening operation from a state illustrated in FIG. 31 is shown.
Figure 33:
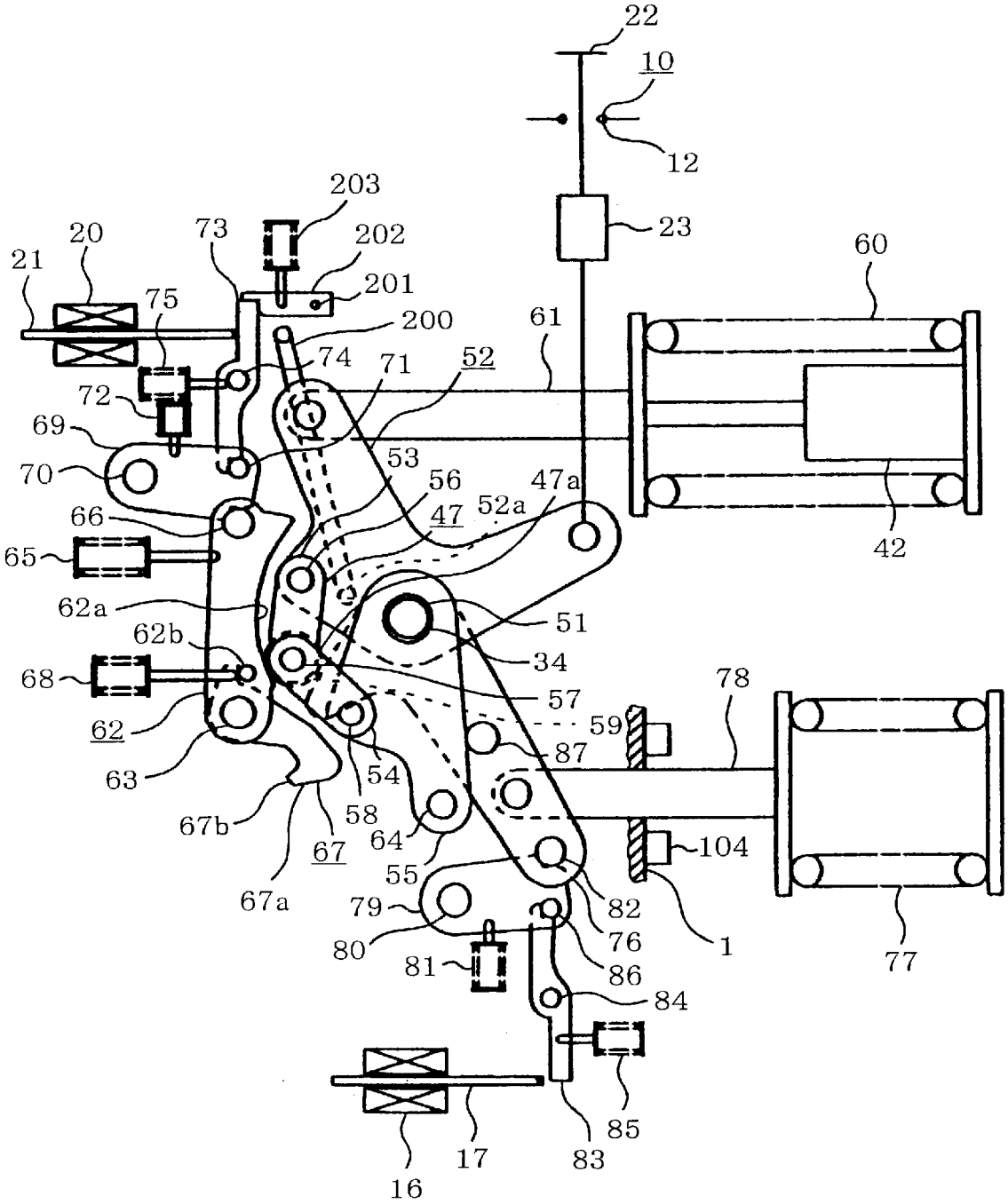
FIG. 33 illustrates a structure of the important portion of the control device for breaker according to Embodiment 6 of the present invention, wherein the breaker is in a state of opening the circuit, the closing coil spring is prestressed, and the opening coil spring is released.

A control device for a breaker according to Embodiment 6 of the present invention will be described in reference of figures. FIGS. 31 through 36 illustrate the control device for breaker according to Embodiment 6 of the present invention. FIG. 31 illustrates a structure of the important portion of the control device for breaker, wherein the breaker is in a state of closing a circuit, and both of a closing coil spring and an opening coil spring are prestressed. FIG. 32 illustrates a structure of the important portion of the control device for breaker, wherein a state in course of an operation of opening the circuit from the state illustrated in FIG. 31 is shown. FIG. 33 illustrates a structure of the important portion of the control device for breaker, wherein the breaker is in a state of opening the circuit, the closing coil spring is prestressed, and the opening coil spring is released.

Figure 34:
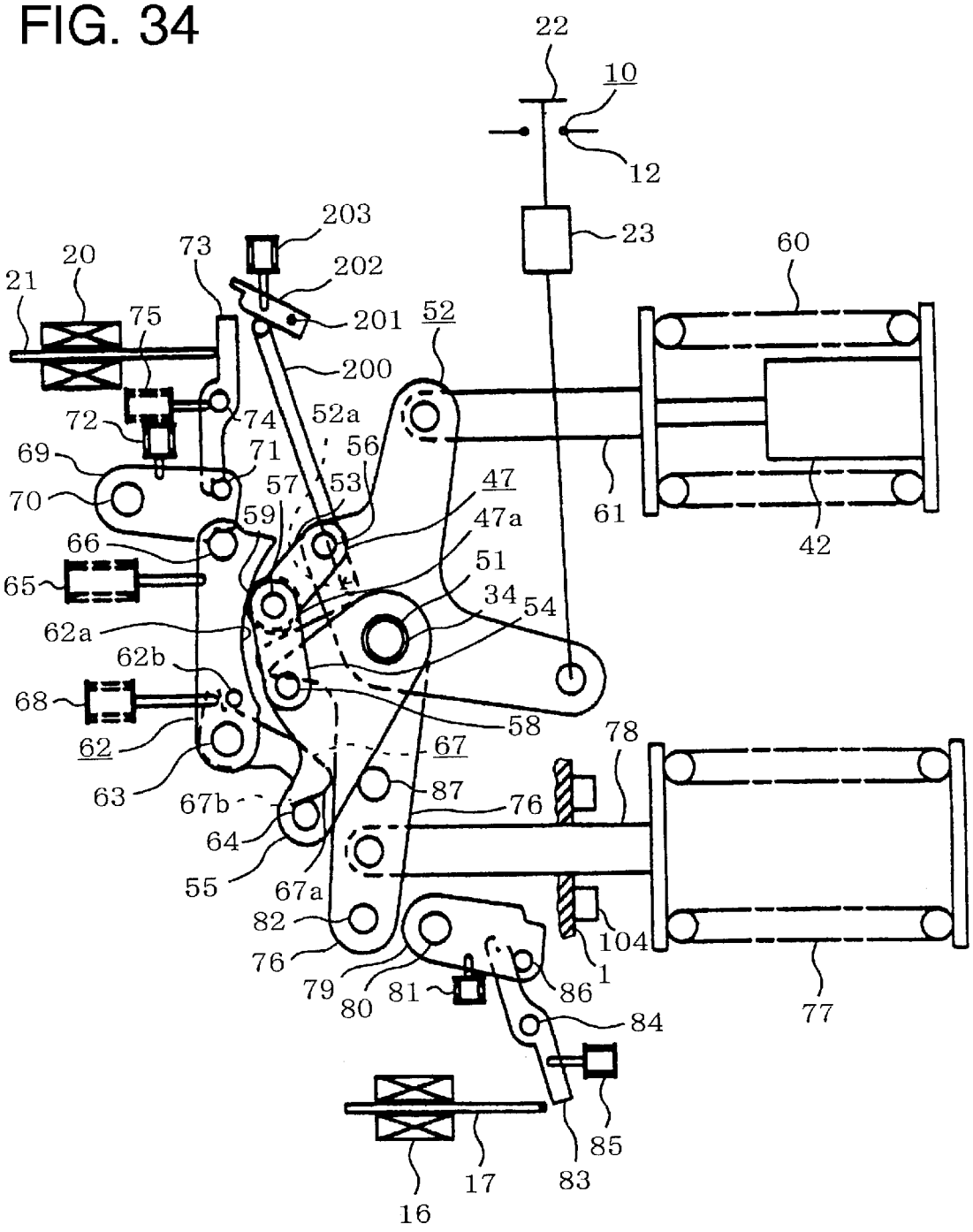
FIG. 34 illustrates a structure of the important portion of the control device for breaker according to Embodiment 6 of the present invention, wherein a state in course of a closing operation from a state illustrated in FIG. 33 is shown.
Figure 35:
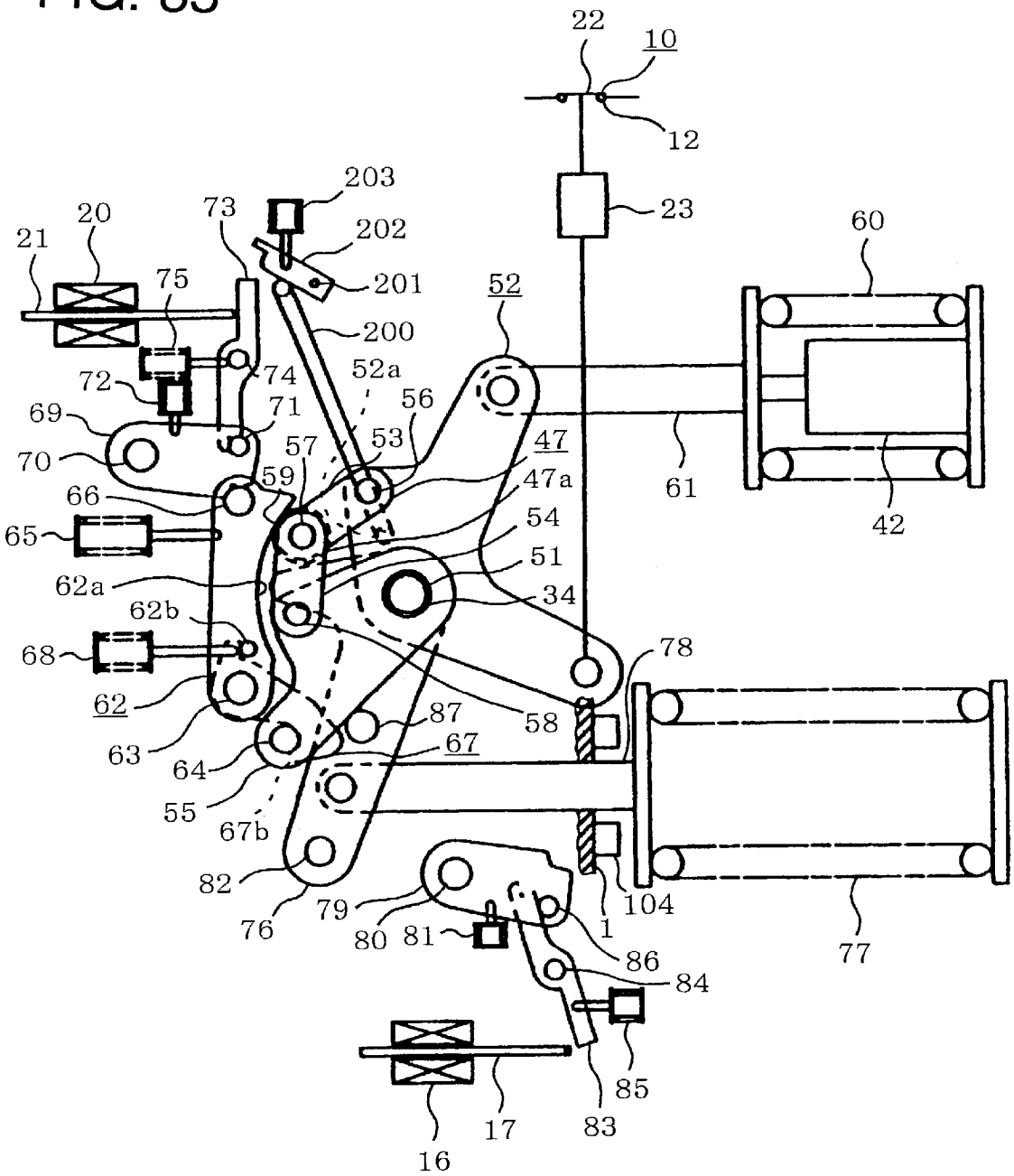
FIG. 35 illustrates a structure of the important portion of the control device for breaker according to Embodiment 6 of the present invention, wherein the closing operation is completed, the closing coil spring is released, and the opening coil spring is prestressed.
Figure 36:
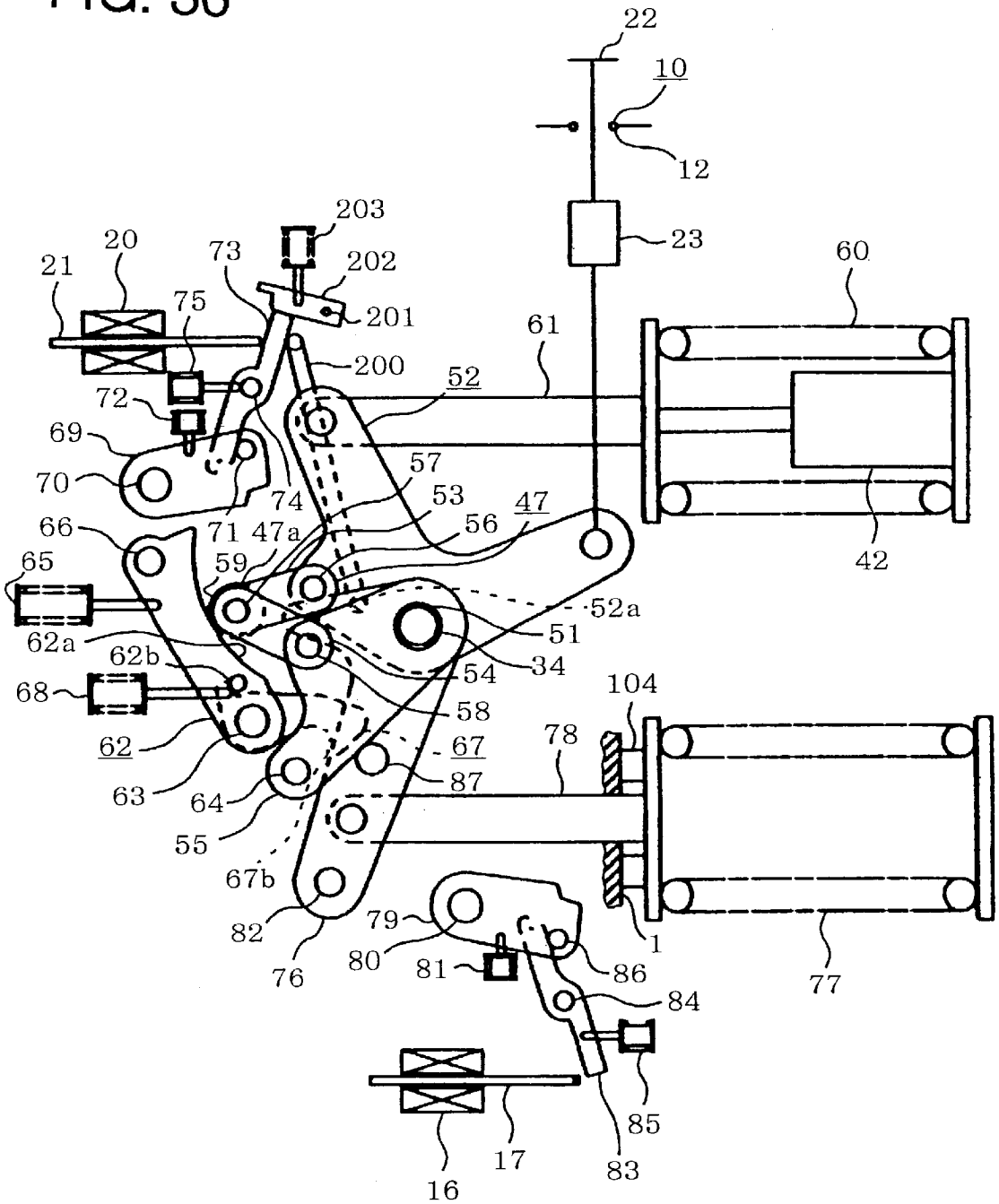
FIG. 36 illustrates a structure of the important portion of the control device for breaker according to Embodiment 6 of the present invention, which is a state that a second opening operation is completed immediately after an operation of rapidly reclosing the circuit, wherein the breaker is in a state of opening the circuit, and both of the closing coil spring and the opening coil spring are released.

FIG. 34 illustrates a structure of the important portion of the control device for breaker, wherein a state in course of an operation of opening the circuit from the state illustrated in FIG. 33 is shown. FIG. 35 illustrates a structure of the important portion of the control device for breaker, wherein the closing operation is completed, the closing coil spring is released, and the opening coil spring is prestressed. FIG. 36 illustrates a structure of the important portion of the control device for breaker, where a state that a second opening operation is completed immediately after an operation of rapidly reclosing the circuit, wherein the breaker is in the state of opening the circuit, and both of the closing coil spring and the opening coil spring are released.

In Embodiment 4 illustrated in FIG. 20 and Embodiment 5 illustrated in FIG. 26, the locking member 103 is connected to the making lever 76 so as to be rotatable, and is moved in vertical directions along with the rotation of the making lever 76, whereby the releasing electromagnet 20 is excited upon the input of an instruction of opening the circuit in course of the closing operation and the plunger 21 is erroneously pushed, the releasing trigger 73 is prevented from rotating.

In Embodiment 6, by locating a first locking member 200, connected to a first breaking lever 52 so as to be rotatable, upon a movement of the first locking member 200 along with a rotation of the first breaking lever 52, a releasing trigger 73 is rotated to prevent an operation of opening the circuit even through the releasing electromagnet is excited or a plunger 21 is erroneously pushed as a result of an input of an instruction of opening the circuit in course of an operation of closing the circuit.

Although a detail will be described below, by locating the first locking member 200 connected to the first breaking lever 52, not only in the operation of closing the circuit as in Embodiment 4 or 5 and but also in a state that the breaker in FIG. 33 is in a state of opening the circuit, the closing coil spring 77 is prestressed, and the opening coil spring 60 is released, the releasing trigger 73 is prevented from rotating even in a case that a releasing electromagnet 20 is excited or the plunger 21 is erroneously pushed upon an input of the instruction of opening the circuit when the making lever 76 is started to move after a start of the operation of closing the circuit. Accordingly, it is possible to prevent incapability of closing the circuit when a securement of the guide 62 by the first releasing latch 69 is released, and a linkage 47 loses a support.

Hereinbelow, an explanation will be described in reference of figures. In FIGS. 31 through 36, numerical reference

200 designates the first locking member shaped like a rod, wherein both ends of a rod material having a circular cross-sectional shape are perpendicularly bent, and one end of the bent portions is rotatably inserted in a hole 52*a*, formed in the first breaking lever 52. The other end of the first locking member 200 is inserted in a guide groove of a supporting plate (not shown), similar to the supporting plate 119 illustrated in FIG. 21 so as to move in vertical directions within the guide groove along with a rotation of the first breaking lever 52.

Numerical reference 201 designates a rotational shaft, and numerical reference 202 designates a locking plate, which is supported around the rotational shaft 201 so as to be rotatable. Numerical reference 203 designates a spring for urging the locking plate 202 so as to counterclockwise rotate around the rotational shaft 201. The other structure is the same as that in Embodiment 5 illustrated in FIG. 26, and the same numerical references are used for corresponding portions and description of these portions is omitted.

In the next, an operation will be described. FIG. 31 illustrates a state that the breaker is closed, the closing coil spring 77 and the opening coil spring 60 are prestressed. In this state, the first locking member 200, connected to the first breaking lever 52 through the hole 52*a*, is guided by the supporting plate (not shown) and upward moves to upward push the locking plate 202.

The upward pushed locking plate 202 rotates around the rotational shaft 201 in a clockwise direction and stops in a state that an engagement with the releasing trigger 73 is released. Because the engagement of the releasing trigger 73 by the locking member 202 is released, the releasing electromagnet 20 operates the plunger 21 to rotate the releasing trigger 73 in a clockwise direction to enable a release of the engagement between the first releasing latch 69 and the guide 62. In other words, in FIG. 31, the breaker is in a state that the circuit can be opened. FIG. 32 illustrates that the breaker is in a state that the circuit is in course of an open from the state illustrated in FIG. 31 when the releasing electromagnet 20 is excited by the instruction of opening the circuit from the state in FIG. 31, the plunger 21 is rightward moved, the releasing trigger 73 is rotated in the clockwise direction, the engagement between the first releasing latch 69 and the guide 62 is released, and the first breaking lever 52 is started to rotate in a counterclockwise direction.

Along with a rotation of the first breaking lever 52 in the counterclockwise direction, the first locking member 200 is downward moved by being guided by the supporting plate (not shown). Along with the downward movement of the first locking member 200, the locking member 202 is pushed by the spring 203 and rotates around the rotational shaft 201 in a counterclockwise direction. Thereafter, the first locking member 200 further downward moves, is released from the locking plate 202, and is engaged with the releasing trigger 73. A completion of the engagement between the locking plate 202 and the releasing trigger 73 is after a separation of the locking member 200 from the locking plate 202. Then the opening operation by the breaker is completed, the closing coil spring 77 is prestressed, and the opening coil spring 60 is released as illustrated in FIG. 33. In this state, the locking plate 202 is engaged with the releasing trigger 73, whereby the releasing trigger 73 can not rotate around the rotational shaft 74 in the clockwise direction, whereby the engagement between the releasing latch 69 and the guide 62 can not be released.

In the next, a state in course of a closing operation from the state in FIG. 33 is illustrated in FIG. 34, wherein when a making electromagnet 16 is excited, a making trigger 83 is pushed by a plunger 17 to rotate in a counterclockwise direction to release an engagement between the making trigger 83 and a making latch 79, whereby a making lever 76 rotates around a rotational shaft 51 in a clockwise direction by a releasing force of the closing coil spring 77. When a pin 87, fixed to the making lever 76, pushes a second breaking lever 55, the second breaking lever 55 is rotated around the rotational shaft 51 in a clockwise direction along with a linkage 47 and the first breaking lever 52, and a rotor 59 of the linkage 47 is in contact with an arch surface 62*a* of the guide 62 and moves.

Along with the rotation of the first breaking lever 52 in the clockwise direction, the first locking member 200 upward moves again, upward pushes the locking plate 202 just before completion of the operation of closing the circuit to make the locking plate 202 rotate around a rotational shaft 201 in a clockwise direction, whereby the engagement of the releasing trigger 73 by the locking plate 202 is released. A state that the operation of closing the circuit is completed is illustrated in FIG. 35. In this state, because the engagement of the releasing trigger 73 by the locking plate 202 is released, a next operation of opening the circuit is enabled.

In the next, when an instruction of opening the circuit is sent out from a state of closing the circuit illustrated in FIG. 35, the plunger 21 of the releasing electromagnet 20 rightward pushes the releasing trigger 73, and the releasing trigger 73 is rotated around the rotational shaft 74 in a clockwise direction. By the rotation of the releasing trigger 73, the engagement of the guide 62 by the first releasing latch 69 is released, and the guide 62 is rotated in a counterclockwise direction around a rotational shaft 63 by a push of the rotor 59, receiving a force from the opening coil spring 60.

The second breaking lever 55 can not move because it is pushed by the pin 87, formed in the making lever 76, to which a rotational force in the clockwise direction is applied by the closing coil spring 77, the first breaking lever 52 receiving a force from the opening coil spring 60 is rotated in a counterclockwise direction around the rotational shaft 51 when the linkage 47 is buckled, wherein a state illustrated in FIG. 36 is established.

A prestressing operation by the closing coil spring 77 is similar to that in Embodiment 5 illustrated in FIG. 26. A brief explanation will be given thereto. The closing coil spring 77 is prestressed from a state that the closing coil spring 77 is released as in FIG. 35 or 36. At first, a case that the closing coil spring 77 is prestressed from the state illustrated in FIG. 35 will be described. A lever 88, illustrated in FIG. 2, is rotated in a counterclockwise direction around a main shaft 51. Then the making lever 86, integrally formed with the lever 88 is rotated in a counterclockwise direction around the main shaft 51.

The pin 82, located in the making lever 76, is in contact with and slides on an end surface of the making latch 79 in course of a counterclockwise rotation of the making lever 76. When the making lever 76 reaches a predetermined position, the making latch 79 rotates in a counterclockwise direction by a spring 81 and is engaged with the pin 82. Simultaneously, the making trigger 83 is rotated in a clockwise direction by the spring 85, is engaged with a pin 86 to hold the making lever 76, and the closing coil spring 77 is maintained in a prestressed state as illustrated in FIG. 31.

In the state illustrated in FIG. 35, the guide 62 returns and is engaged by the first releasing latch 69, and the second breaking lever 55 is engaged with the second releasing latch 67. Accordingly, even though the making lever 76 is rotated in the counterclockwise direction, the second breaking lever 55 and the first breaking lever 52 do not move. Accordingly, the first locking member 200, connected to the first breaking lever 52, maintains a state illustrated in FIG. 35, the engagement between the locking plate 202 and the releasing trigger 73 is released as in FIG. 31.

Further, when the closing coil spring 77 is prestressed from the state illustrated in FIG. 36, along with the counterclockwise rotation of the making lever 76 by the prestressing device, the spring 65 pushes the rotor 59 through the guide 62 toward the main shaft 51, the second breaking lever 55 is in contact with the pin 87 located in the making lever 76 and is rotated in a counterclockwise direction. Then the guide 62 is rotated in the clockwise direction while pushing the rotor 59 by a force of the spring 65 to gain reconstitution, and is engaged with the first releasing latch 69 and the releasing trigger 73.

The pin 82 of the making lever 76 is in contact with and slides on the end surface of the making latch 79 in course of the counterclockwise rotation of the making lever 76. When the making lever 76 reaches a predetermined position, the making latch 79 is rotated in a counterclockwise direction by the spring 81, and engaged with the pin 82 located in the making lever 76 after rotating in a counterclockwise direction. Further, the making trigger 83 is rotated in a clockwise direction by the spring 85 and engaged with the pin 86 to hold the making lever 76, whereby the closing coil spring 77 is maintained in the prestressed state as illustrated in FIG. 33.

When the second breaking lever 55 and the making lever 76 are rotated in the counterclockwise direction as described above, the opening coil spring 60 is in the released state. Therefore, the first breaking lever 52 and the first locking member 200 do not move from a position, illustrated in FIG. 36, and is in the same state as FIG. 33. The other operation is similar to that in Embodiment 5 in reference of FIG. 26, and a description thereof is omitted.

Since the control device for breaker according to Embodiment 6 of the present invention is constructed as described above, effects similar to those described in Embodiments 4 and 5 are demonstrated.

In the above described Embodiments 4 and 5, a movement of the releasing trigger 73 is bound by the locking member 103, interlocked with the making lever 76, as illustrated in FIGS. 22 and 27, the locking member 103 does not bind the releasing trigger 73 in a state that opening torsion bars or the opening coil spring 60 is released, and closing torsion bars or the closing coil spring 77 is compressed and prestressed to enable an operation of closing the circuit.

Accordingly, when the circuit is closed by driving the making trigger 83 from this state and the releasing trigger 73 is accidentally operated, the engagement between the first releasing latch 69 and the guide 62 is released, and the linkage 47 becomes unsupported, whereby the circuit can not be closed.

On the contrary, in accordance with this Embodiment 6, since the first locking member 200, interlocked with the first breaking lever 52, is formed, in a state that the opening coil spring 60 is released and the closing coil spring 77 is prestressed to enable the operation of closing the circuit as in FIG. 33, the locking plate 202 binds the releasing trigger 73, whereby the releasing trigger 73 can not be operated.

Accordingly, when the making lever 76 starts to move after a start of the operation of closing the circuit in the state that the breaker is in the state of opening the circuit, the closing coil spring 77 is prestressed, and the opening coil spring 60 is released as in FIG. 33, even though the releasing electromagnet 20 is excited or the plunger 21 is erroneously pushed as a result of a timely input of the instruction of opening the circuit, it is possible to prevent the engagement between the first releasing latch 69 and the guide 62 from being released, there is no danger that the linkage 47 loses its support and the circuit can not be closed. In Embodiment 4 using the torsion bars as the prestressing means in reference of FIG. 20, effects similar to described above can be demonstrated even though the first locking member 200 is connected to the first breaking lever 52.

Embodiment 7

Figure 37:
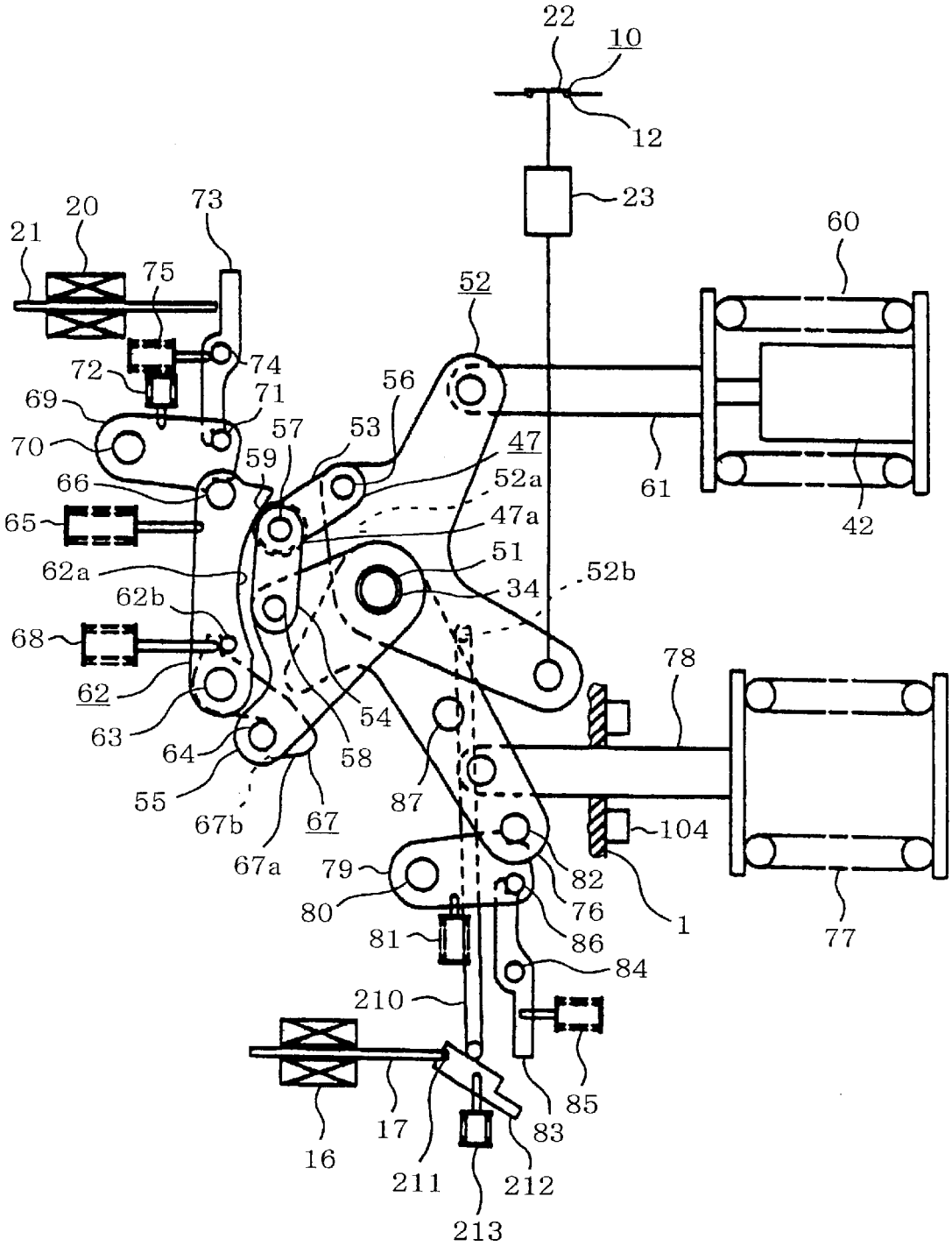
FIG. 37 illustrates a structure of an important portion of a control device for a breaker according to Embodiment 7 of the present invention, wherein a breaker is in a state of closing a circuit, and both of a closing coil spring and an opening coil spring are prestressed.
Figure 38:
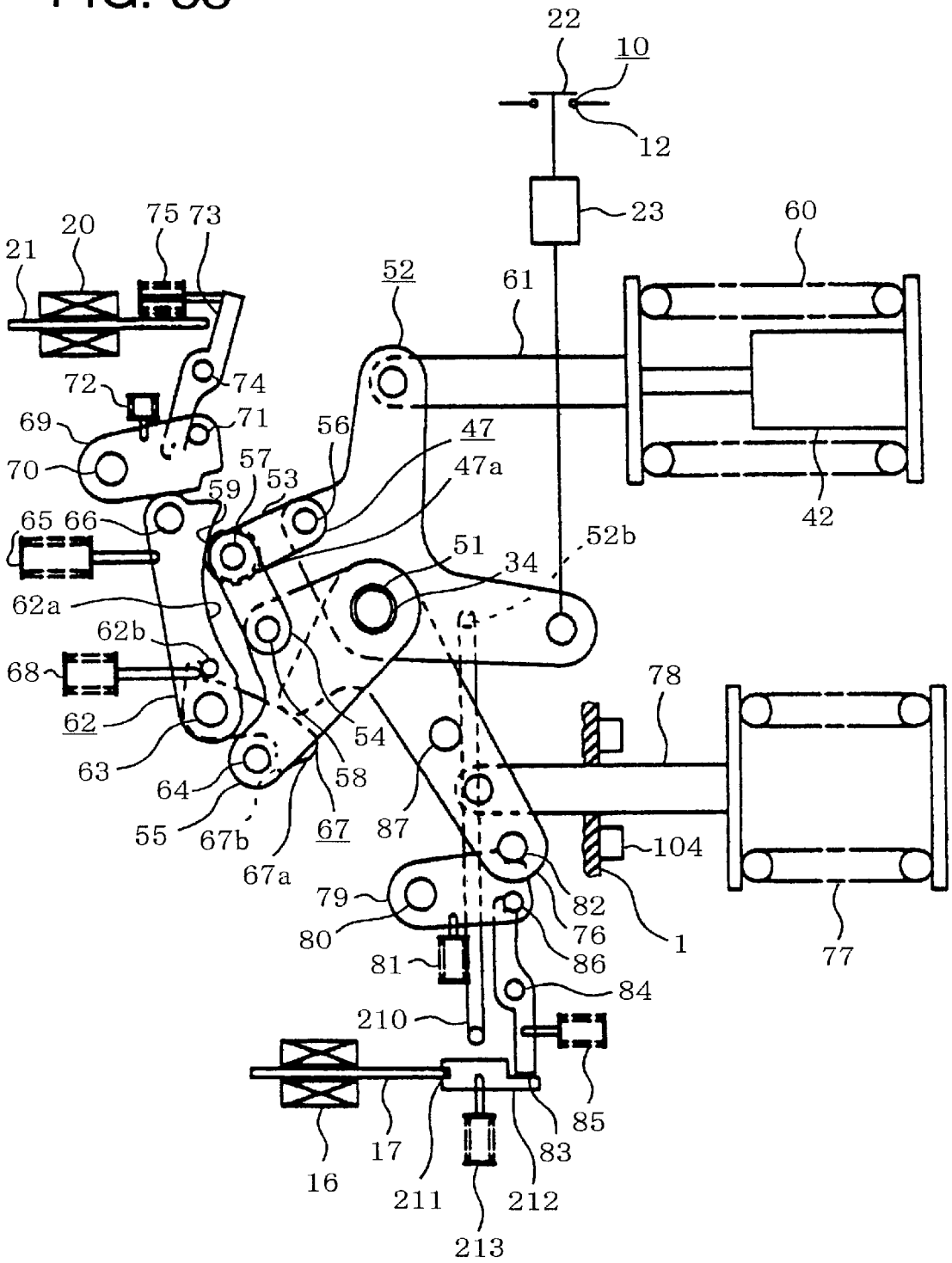
FIG. 38 illustrates a structure of the important portion of the control device for a breaker according to Embodiment 7 of the present invention, wherein a state in course of an operation of opening the circuit from the state illustrated in FIG. 37 is shown.
Figure 39:
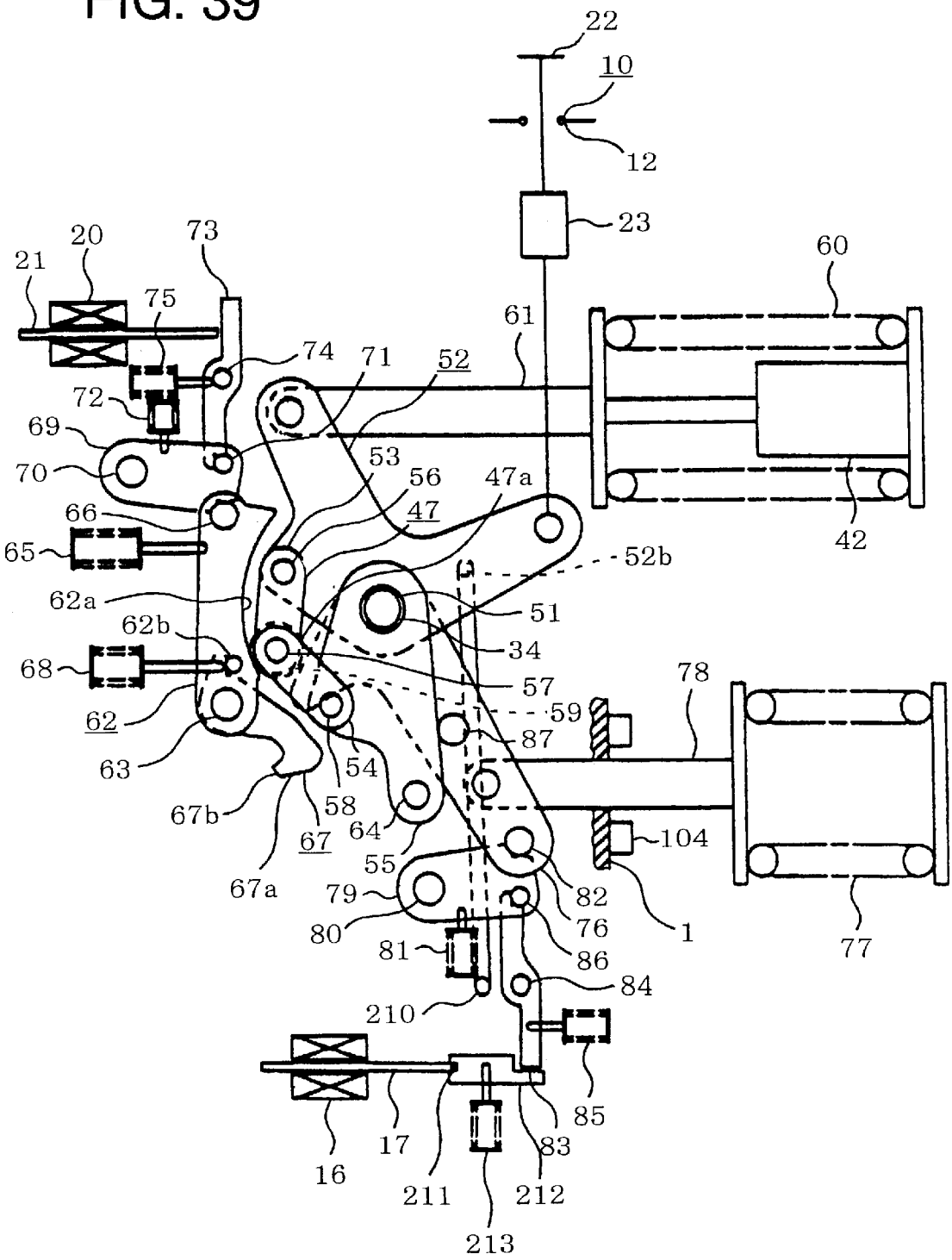
FIG. 39 illustrates a structure of the important portion of the control device for breaker according to Embodiment 7 of the present invention, wherein the breaker is in a state of opening the circuit, the closing coil spring is prestressed, and the opening coil spring is released.

A control device for a breaker according to Embodiment 7 of the present invention will be described in reference of figures. FIGS. 37 through 42 illustrate the control device for breaker according to Embodiment 7 of the present invention. FIG. 37 illustrates a structure of the important portion of the control device for breaker, wherein the breaker is in a state of closing a circuit, and both of a closing coil spring and an opening coil spring are prestressed. FIG. 38 illustrates a structure of the important portion of the control device for breaker, wherein a state in course of an operation of opening the circuit is illustrated. FIG. 39 illustrates a structure of the important portion of the control device for breaker, wherein the breaker is in a state of opening the circuit, the closing coil spring is prestressed, and the opening coil spring is released.

Figure 40:
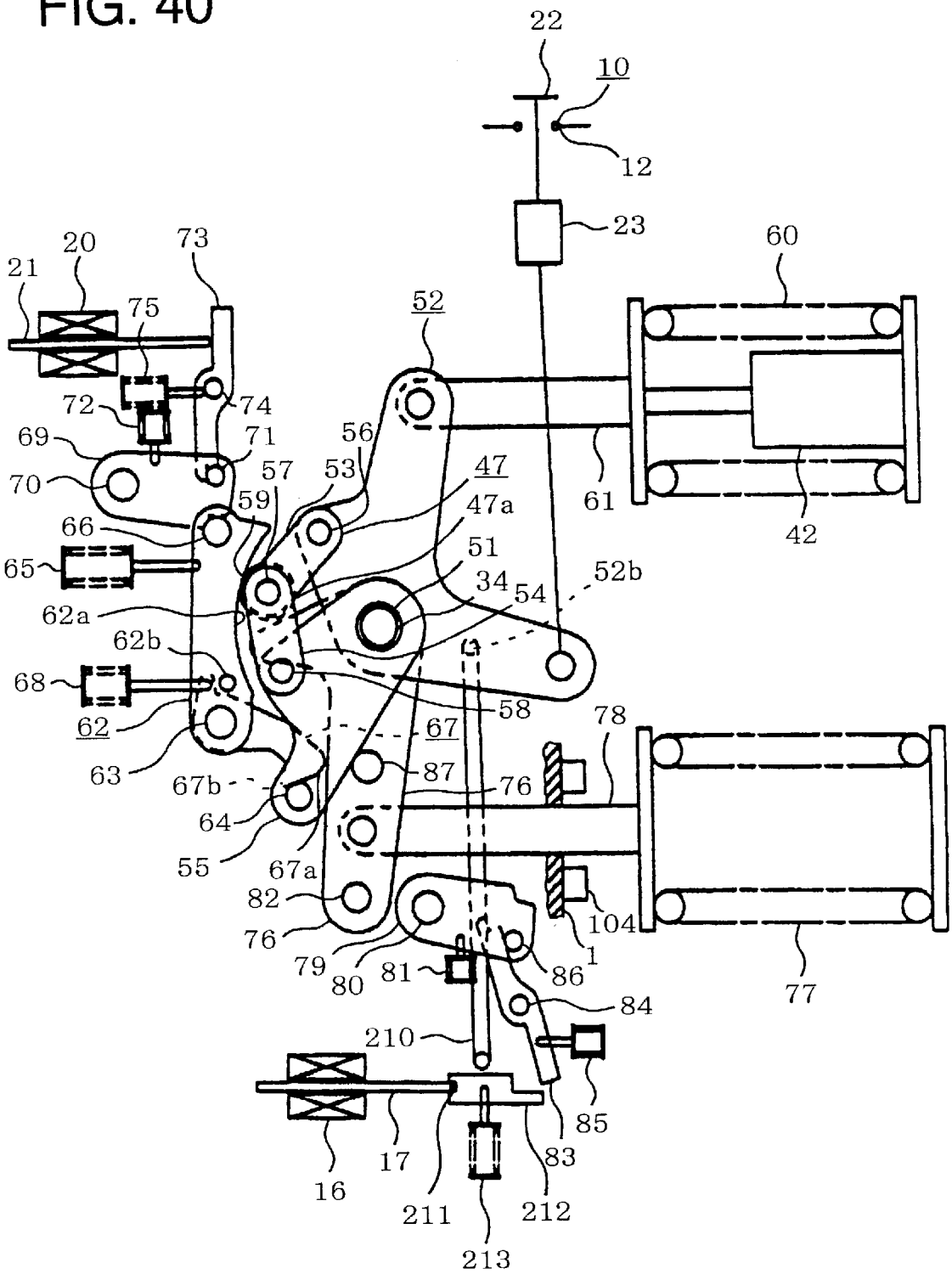
FIG. 40 illustrates a structure of the important portion of the control device for breaker according to Embodiment 7 of the present invention, wherein a state in course of an operation of closing the circuit from the state illustrated in FIG. 39 is shown.
Figure 41:
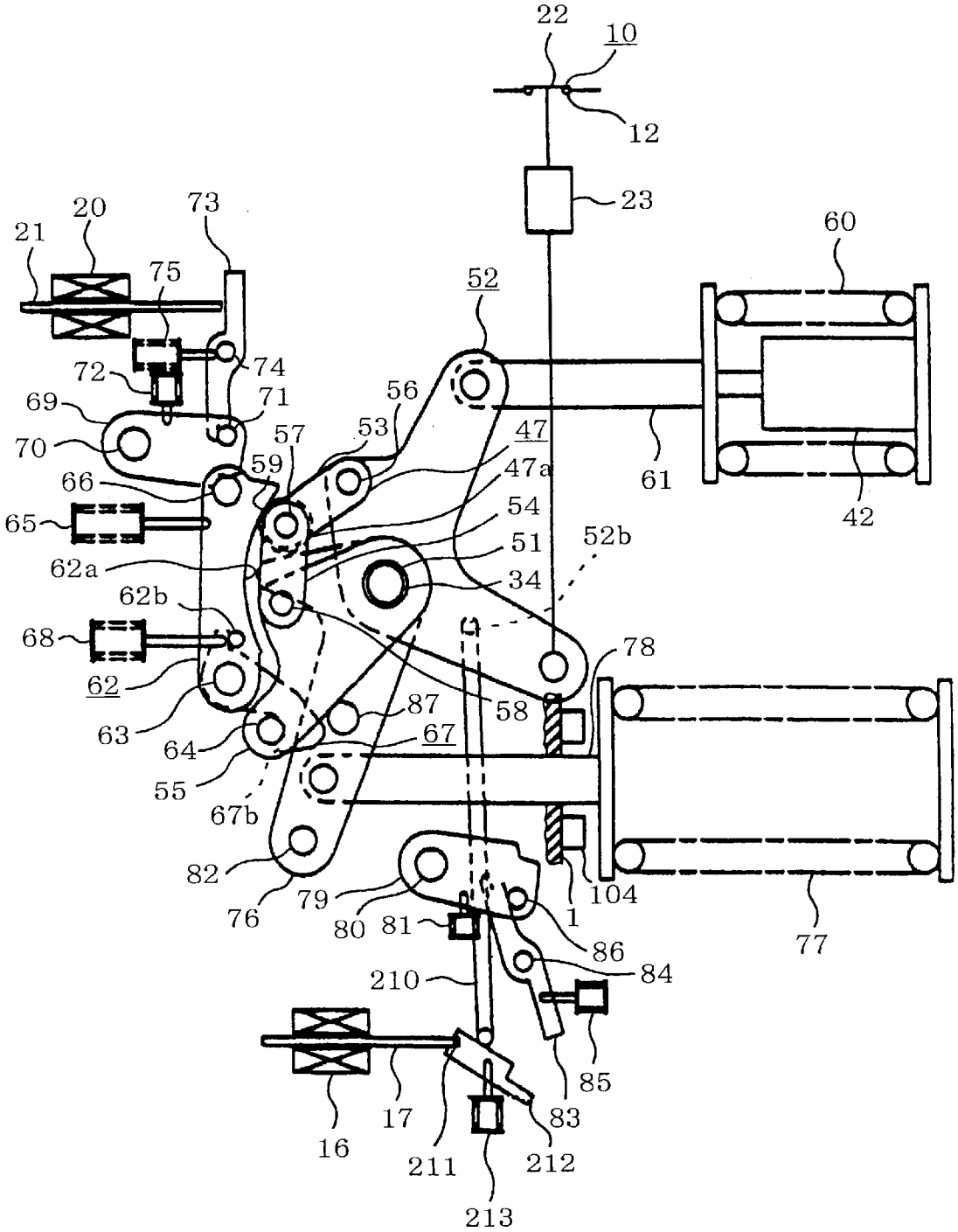
FIG. 41 illustrates a structure of the important portion of the control device for breaker according to Embodiment 7 of the present invention, wherein the operation of closing the circuit is completed, the closing coil spring is released, and the opening coil spring is prestressed.
Figure 42:
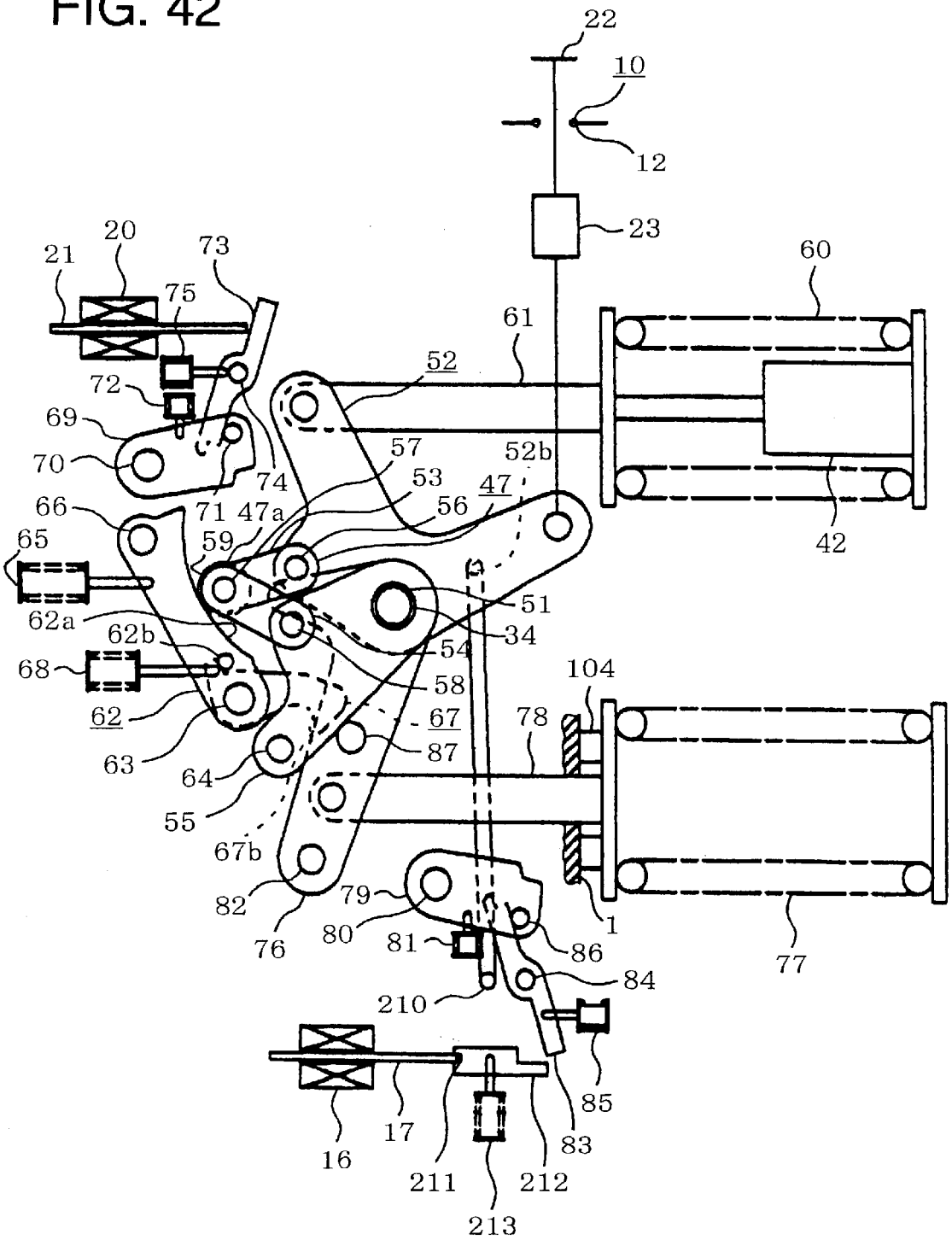
FIG. 42 illustrates a structure of the important portion of the control device for breaker according to Embodiment 7 of the present invention, which is a state that a second opening operation is completed immediately after an operation of rapidly reclosing the circuit, wherein the breaker is in a state of opening the circuit, and both of the closing coil spring and the opening coil spring are released.

FIG. 40 illustrates a structure of the important portion of the control device for breaker, wherein a state in course of an operation of closing the circuit from the state illustrated in FIG. 39 is shown. FIG. 41 illustrates a structure of the important portion of the control device for breaker, wherein the closing operation is completed, the closing coil spring is released, and the opening coil spring is prestressed. FIG. 42 illustrates a structure of the important portion of the control device for breaker, where a state that a second opening operation is completed immediately after an operation of rapidly reclosing the circuit, wherein the breaker is in the state of opening the circuit, and both of the closing coil spring and the opening coil spring are released.

In the control devices for breaker described in the above Embodiments, for example in FIG. 26, the make break contact 10 is in the state of closing the circuit, and the opening coil spring is prestressed to conduct a next operation of opening the circuit. Further, for the operation of reopening after opening the circuit, the closing coil spring 77 is prestressed. In this state, the pin 87 located in the making lever 76 is rightward separated from the second breaking lever 55 as illustrated in FIG. 26. When the plunger 17 of the making electromagnet 16 is erroneously moved by a manual operation, the engagement between the making trigger and the making latch 79 is released.

Then, the making lever 76, receiving a rotational force in the clockwise direction from the closing coil spring 77 through the rod 78, rapidly rotates in a clockwise direction without any load, whereby the pin 87 located in the making lever 76 collides with the second breaking lever 55, whereby a large impact force is generated. Accordingly, it is necessary to make components of a making system including the making lever 76 and the second breaking lever 55 rigid so as to withstand this impact, wherein miniaturization and a reduction of a weight are restricted.

In Embodiment 7, a second locking member 210, connected to the first breaking lever, is located, wherein when the breaker is in the state of closing the circuit and both of the opening coil spring 60 and closing coil spring 77 are prestressed, even though a plunger 17 of a making electromagnet is erroneously moved, a rotation of a making lever 76 is prevented. Accordingly, it is possible to prevent a generation of an impact caused by a collision between a pin 87, located in the making lever 76, and a second breaking lever 55 as a result of a clockwise rotation of the making lever 76, and miniaturization and a reduction of a weight of the control device is enabled.

Hereinbelow, a detailed explanation will be given in reference of figures. In FIGS. 37 through 42, numerical reference 210 designates a second locking member shaped like a rod, wherein both ends of a rod material having a circular cross-sectional shape are bent at right angles, and one of the bent ends is inserted in a hole 52*b*, formed in a first breaking lever 52 so as to be rotatable. The other end of the second locking member 210 is inserted in a guide groove of a supporting plate (not shown), similar to the supporting plate 119 illustrated in FIG. 21, and moves in vertical directions inside the guide groove along with a rotation of the first breaking lever 52.

Numerical reference 211 designates a connecting pin, and numerical reference 212 designates a trigger lever, which is connected to the plunger 17 through a connecting pin 211 so as to be rotatable. Numerical reference 213 designates a spring for urging the trigger lever 212 in a counterclockwise direction around the connecting pin 211.

The other portions of the structure are the similar to those in Embodiment 3 in reference of FIG. 15 and Embodiment 5 in reference of FIG. 26, the same numerical references are used for corresponding portions and description of these is omitted.

In the next, an operation will be described. FIG. 37 illustrates a state that the breaker is in a state of closing the circuit, and the closing coil spring 77 and the opening coil spring 60 are prestressed. In this state, the second locking member 210, connected to the first breaking lever 52 through the hole 52*b* so as to be rotatable, downward moves by being guided by the supporting plate (not shown) to downward push the trigger lever. The downward pushed trigger lever 212 is stopped in a state that it is clockwisely rotated around the connecting pin 211.

Accordingly, even though the plunger 17 of the making electromagnet 16 moves, the trigger lever 212 is not in contact with a making trigger 83. Therefore, an engagement of a making latch 79 by a making trigger 83 is not released, and the closing coil spring 77 is not released. In other words, even though the plunger 17 is erroneously operated from this state, there is no danger that the pin 87 located in the making lever 76 collides with a second breaking lever 55 when the closing coil spring 77 is released.

FIG. 38 illustrates a state that the breaker is being opened from a state illustrated in FIG. 37. When a releasing electromagnet 20 is excited by an instruction of opening the circuit from the state in FIG. 37, a plunger 21 is rightward driven, and a releasing trigger 73 is clockwisely rotated, whereby an engagement of a guide 62 by a first releasing latch 69 is released, and the first breaking lever 52 is counterclockwise rotated. Along with a rotation of the first breaking lever 52 in the counterclockwise direction, the second locking member 210 upward moves by being guided by the supporting plate (not shown).

Along with the upward movement of the second locking member 210, the trigger lever 212 is rotated in a counterclockwise direction around the connecting pin 211 by the spring 213, whereby the trigger lever 212 and the plunger 17 are linearly aligned. Thereafter, the second locking member 210 is further upward moved, and separated from the trigger lever 212. Then a state illustrated in FIG. 39 that the breaker has finished the operation of opening the circuit, the closing coil spring 77 is prestressed, and the opening coil spring 60 is released, illustrated in FIG. 39, is established.

In this state, the trigger lever 212 and the plunger 17 are linearly aligned. By driving the plunger 17 in a rightward direction, the making trigger 83 is rotated in a counterclockwise direction around a rotational shaft 84, whereby an operation of closing the circuit is enabled.

In the next, a state that the circuit is being closed from the state illustrated in FIG. 39 is illustrated in FIG. 40. When a making electromagnet 16 is excited, the trigger lever 212 rotates the making trigger 83 in the counterclockwise direction. When the making trigger 83 is rotated in the counterclockwise direction, the engagement of the making latch 79 by the making trigger 83 is released, and the making lever 76 is rotated in a clockwise direction around a rotational shaft by a releasing force of the closing coil spring 77.

When a pin, fixed to the making lever 76, pushes the second breaking lever 55, the second breaking lever 55 rotates in a clockwise direction around the rotational shaft 51 along with a linkage 47 and the first breaking lever 52, and a rotor 59 of the linkage 47 moves while maintaining a contact with an arch surface 62*a* of a guide 62.

Along with the clockwise rotation of the first breaking lever 52, the second locking member 210 downward moves again, and downward pushes the trigger lever 212 when the operation of closing the circuit is completed to clockwise rotate the releasing trigger 73 around a rotational shaft 74. By the rotation of the releasing trigger 73, an engagement of the guide 62 by the first releasing latch is released, and the guide 62 is counterclockwise rotated around a rotational shaft 63 by being pushed by the rotor 59 receiving a force from the opening coil spring 60.

Although the second breaking lever 55 can not move because it is pushed by the pin 87 located in the making lever 76, applied with the clockwise rotational force by the closing coil spring 77, the first breaking lever 52, receiving a force from the opening coil spring 60, is counterclockwise rotated around the rotational shaft 51 when the linkage 47 is buckled. When the first breaking lever 52 is counterclockwise rotated, the second locking member 210 connected to the first breaking lever 52 is guided by the supporting plate and upward moved again. The trigger lever 212 is rotated in a clockwise direction around the connecting pin 211 by being pushed by the spring 213, wherein the trigger lever 212 and the plunger 17 are linearly aligned. The second locking member 210 is further upward moved and separated from the trigger lever 212. This state is illustrated in FIG. 42.

A prestressing operation of the closing coil spring 77 is similar to that in Embodiment 3 in reference of FIG. 15. However, a brief explanation is added. The closing coil spring 77 is prestressed from a state that the closing coil spring 77 is released as in FIG. 41 or 42. At first, a case that the closing coil spring 77 is prestressed from the state illustrated in FIG. 41 will be described. The lever 88 illustrated in FIG. 2 is counterclockwise rotated around the main shaft 51 by the prestressing device illustrated in FIG. 2. The making lever 76, integrally formed with the lever 88, is rotated in a counterclockwise direction around the main shaft 51.

A pin 82 located in the making lever 76 is in contact with and sliding on an end surface of the making latch 79 in course of a counterclockwise rotation. When the making lever 76 reaches a predetermined position, the making latch 79 is counterclockwise rotated by a spring 81 and engaged with the pin 82 located in the making lever 76. Simultaneously, the making trigger 83 is rotated in a clockwise direction and engaged with a pin 86 to hold the making lever 76, and the closing coil spring 77 is maintained in a prestressed state, wherein a state illustrated in FIG. 37 is established.

In the state illustrated in FIG. 41, the guide 62 returns so as to be engaged with the first releasing latch 69, and the second breaking lever 55 is engaged with the second releasing latch 67. Accordingly, even though the making lever 76 is counterclockwise rotated, the second breaking lever 55 and the first breaking lever 52 do not move. Accordingly, the second locking member 210 connected to the first breaking lever 52 is maintained in the state illustrated in FIG. 41.

In other words, the trigger lever 212 is downward pushed by the second locking member 210, the trigger lever 212 is not in contact with the making trigger 83 even though the plunger 17 is moved, whereby a state that the engagement of the making latch 79 is not released and the closing coil spring 77 is not released is maintained as in FIG. 37.

Further, when the closing coil spring 77 is prestressed from the state illustrated in FIG. 42, along with a counterclockwise rotation of the making lever 76 by a prestressing device, a spring 65 pushes the rotor 59 toward the main shaft 51 through the guide 62, whereby the second breaking lever 55 is counterclockwise while being in contact with the pin 87 located in the making lever 76. The guide 62 returns by being clockwise rotated while pushing the rotor 59 by a force of the spring 65 and is engaged with the first releasing latch 69 and the releasing trigger 73.

The pin 82 of the making lever 76 is in contact with and slides on the end surface of the making latch 79 in a course of a counterclockwise rotation of the making lever 76. When the making lever 76 reaches a predetermined position, the making latch 79 is rotated in a counterclockwise direction by the spring 81, and engaged with the pin 82, located in the making lever 76. Further, the making trigger 83 is rotated in a clockwise direction by the spring 85, engaged with the pin 86 to hold the making lever 76, whereby the closing coil spring 77 is in a prestressed state, whereby a state illustrated in FIG. 39 is established.

Further, when the making trigger 83 is rotated in a clockwise direction and engaged with the pin 86, the making trigger 83 returns to a position that the making trigger 83 is driven by the trigger lever 212, arranged on a straight line with respect to the plunger 17. The other operation is similar to that in Embodiment 3.

According to this Embodiment 7, in use of a simple structure that the first breaking lever 52 is connected to the second locking member 210 to mechanically interlock the second locking member 210 with a rotation of the first breaking lever 52, it is possible to prevent a release of the engagement between the making trigger 83 and the making latch 79 as a result of a drive of the making trigger 83 by the trigger lever 212. Accordingly, when the breaker is in the state of closing the circuit, and both of the opening coil spring 60 and the closing coil spring 77 are prestressed, even though the plunger 17 of the making electromagnet is erroneously moved, it is possible to prevent a rotation of the making lever 76..

Accordingly, the pin 87 does not collide with the second breaking lever 55 to prevent a generation of an impact, whereby it is possible to decrease a mechanical strength of component such as the making lever 76, the pin 87, the second breaking lever 55 and reduce a size and a weight of the control device.

Embodiment 8

Figure 43:
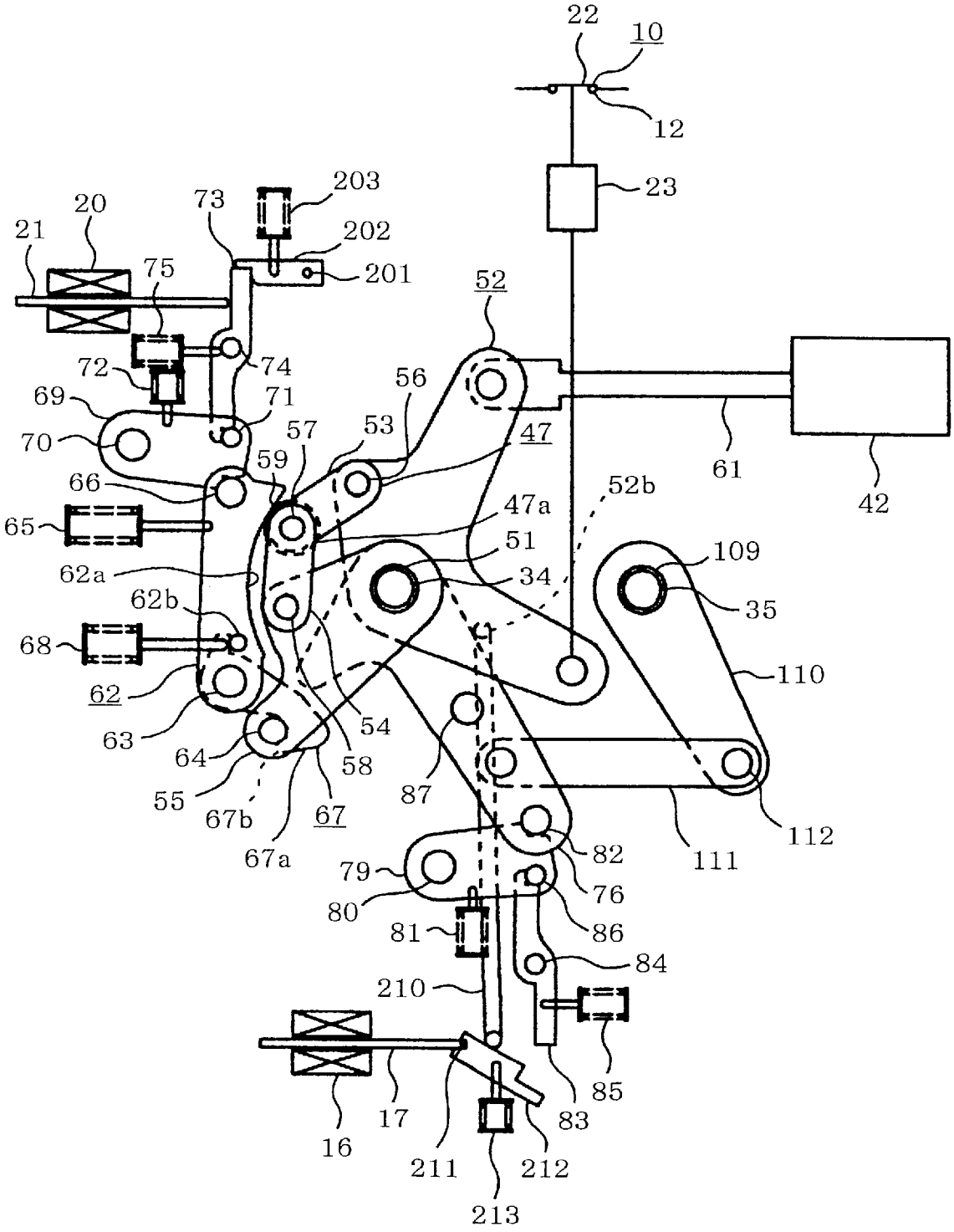
FIG. 43 illustrates a structure of an important portion of a control a device for breaker according to Embodiment 8 of the present invention, wherein the breaker is in a state of closing the circuit, and both of the closing torsion bars and the opening torsion bars are prestressed.
Figure 44:
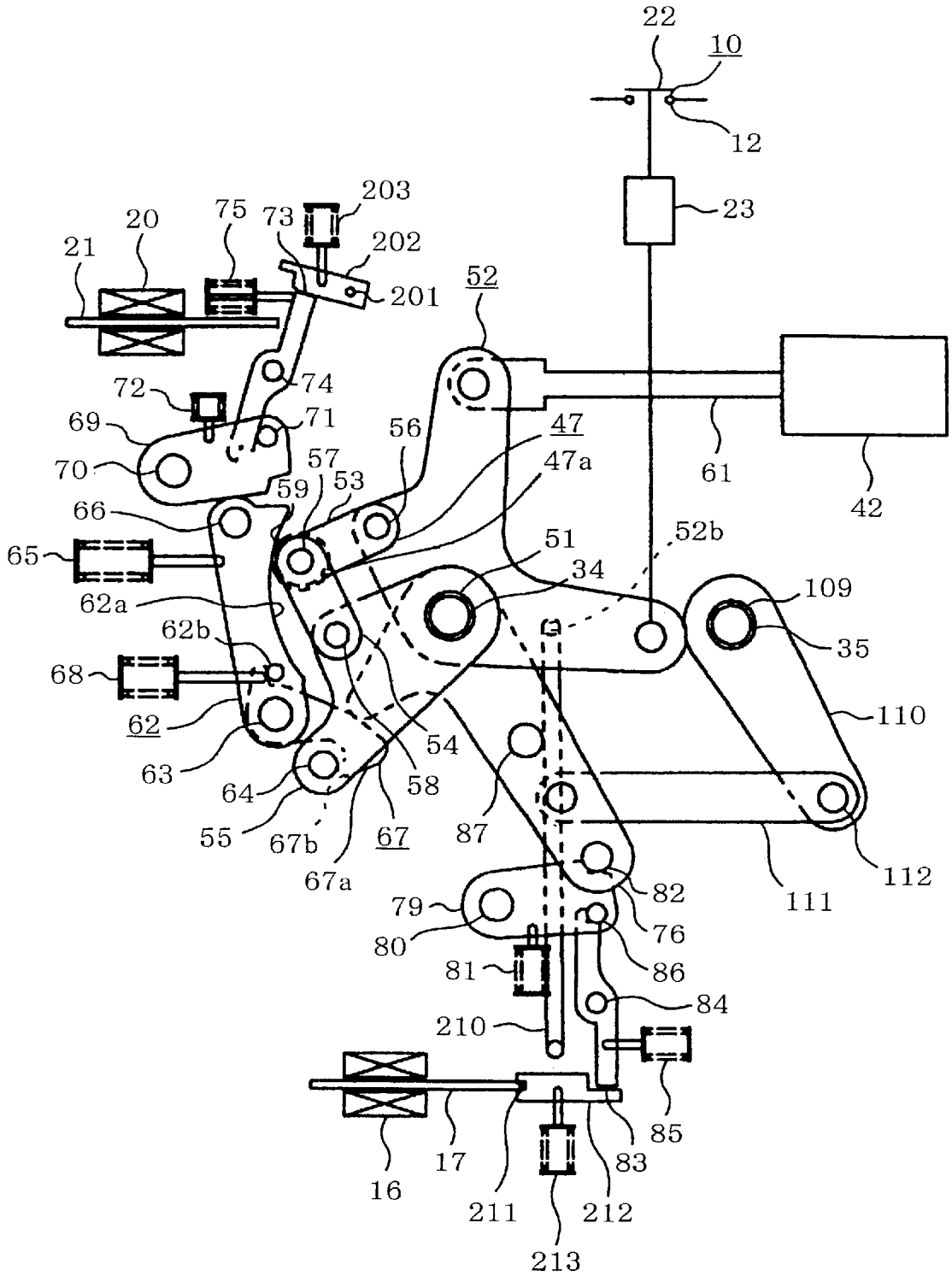
FIG. 44 illustrates a structure of the important portion of the control device for breaker according to Embodiment 8 of the present invention, wherein a state in course of an operation of opening the circuit from the state illustrated in FIG. 43 is shown.
Figure 45:
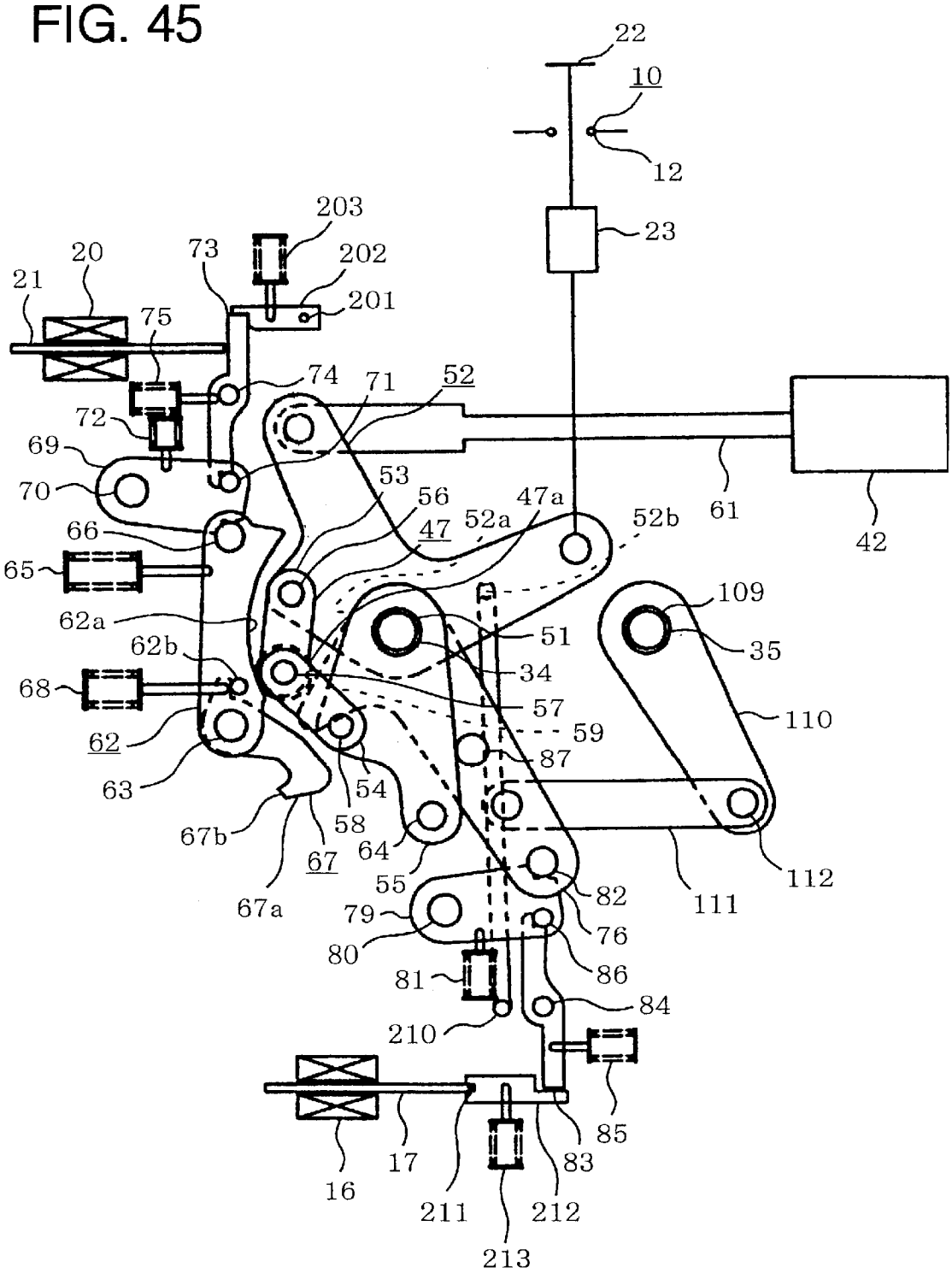
FIG. 45 illustrates a structure of the important portion of the control device for breaker according to Embodiment 8 of the present invention, wherein the breaker is in a state of opening the circuit, the closing torsion bars are prestressed, and the opening torsion bars are released.

A control device for a breaker according to Embodiment 8 of the present invention will be described in reference of figures. FIGS. 43 through 48 illustrate the control device for the breaker according to Embodiment 8 of the present invention, wherein FIG. 43 illustrates a structure of an important portion of the control device for breaker, wherein the breaker is in a state of closing the circuit, and both of closing torsion bars and opening torsion bars are prestressed. FIG. 44 illustrates a structure of the important portion of the control device for breaker, where a state that the circuit is being opened from the state illustrated in FIG. 43 is shown. FIG. 45 illustrates a structure of the important portion of the control device for breaker, wherein the breaker is in a state of opening the circuit, the closing torsion bars are prestressed, and the opening torsion bars are released.

Figure 46:
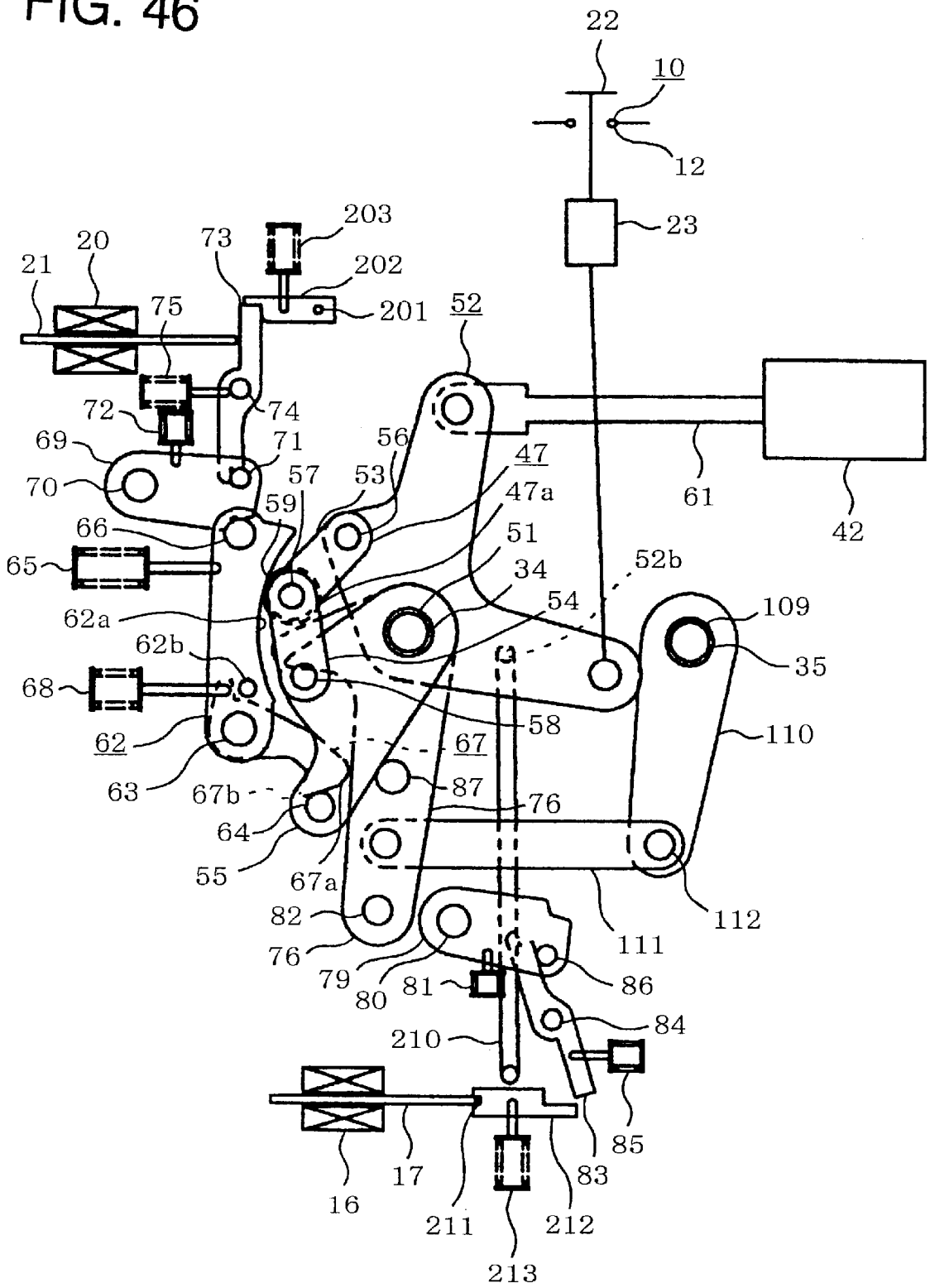
FIG. 46 illustrates a structure of the important portion of the control device for breaker according to Embodiment 8 of the present invention, wherein a state in course of an operation of closing the circuit from the state illustrated in FIG. 45 is shown.
Figure 47:
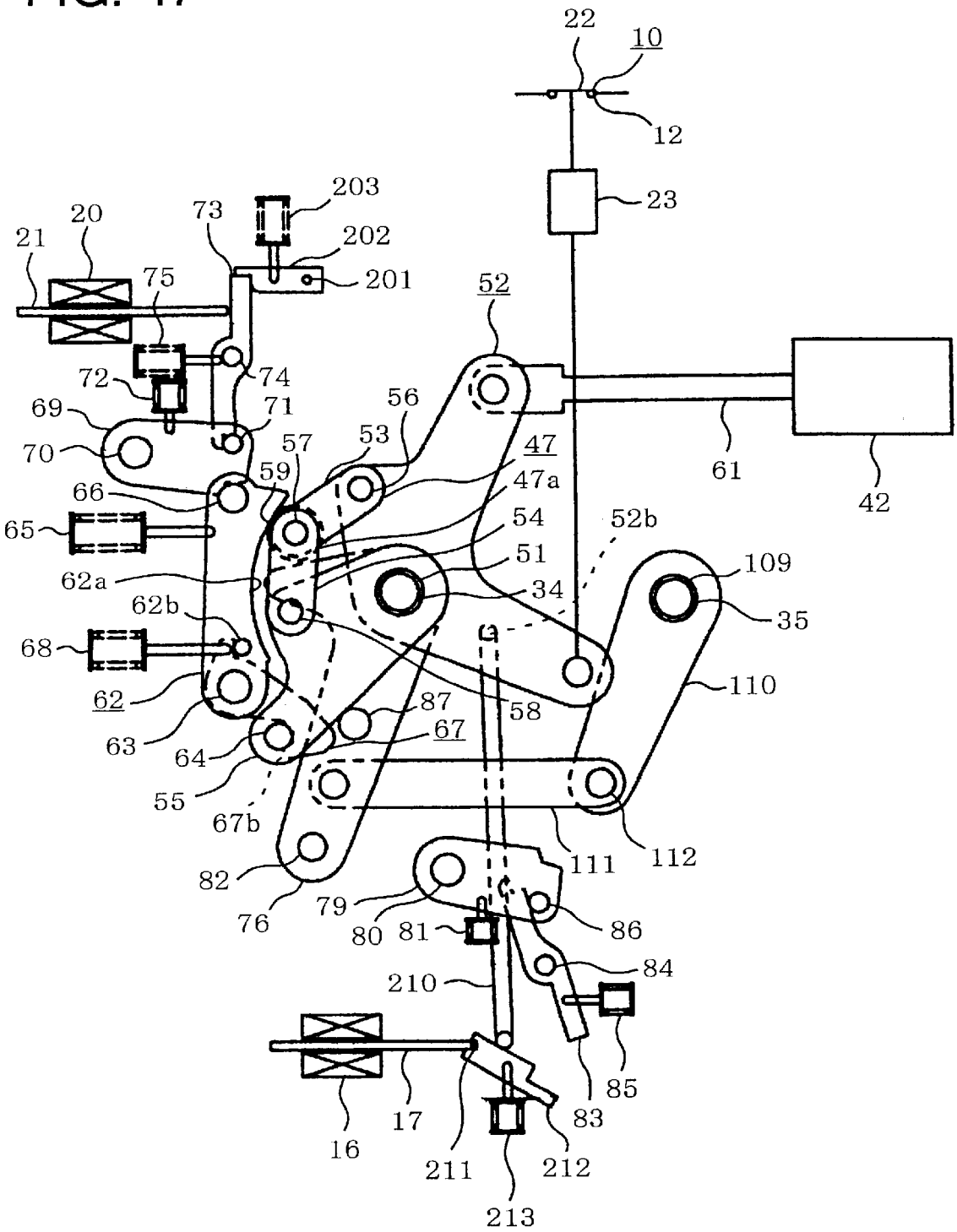
FIG. 47 illustrates a structure of the important portion of the control device for breaker according to Embodiment 8 of the present invention, wherein the operation of closing the circuit is completed, the closing torsion bars are released, and the opening torsion bars are prestressed.
Figure 48:
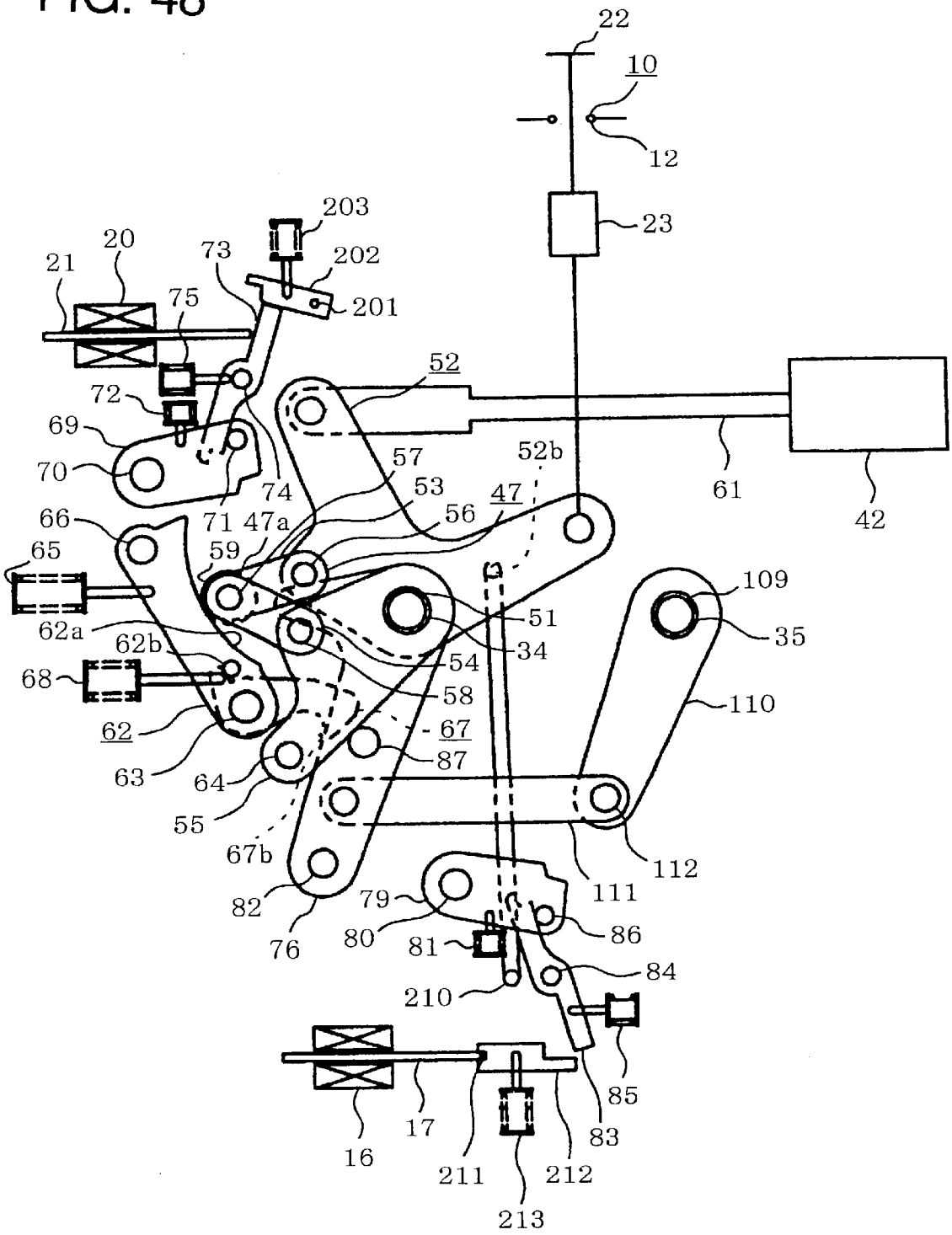
FIG. 48 illustrates a structure of the important portion of the control device for breaker according to Embodiment 8 of the present invention, which is a state that a second opening operation is completed immediately after an operation of rapidly reclosing the circuit, wherein the breaker is in a state of opening the circuit, and both of the closing torsion bars and the opening torsion bars are released.

FIG. 46 illustrates a structure of the important portion of the control device for breaker, where a state that the circuit is being closed from the state illustrated in FIG. 45 is shown. FIG. 47 illustrates a structure of the important portion of the control device for breaker, wherein the closing operation is completed, the closing torsion bars are released, and the opening torsion bars are prestressed. FIG. 48 illustrates a structure of the important portion of the control device for breaker, where a state that a second opening operation is completed immediately after an operation of rapidly reclosing the circuit, wherein the breaker is in the state of opening the circuit, and both of the closing torsion bars and the opening torsion bars are released.

In Embodiment 8, as the prestressing means described in Embodiment 1 is torsion bars. The control device for breaker using the torsion bars further have a second locking member 210, connected to a first breaking lever 52 described in Embodiment 7. It is possible to reduce a size and a weight of the control device for a breaker, in which the torsion bars are used as the prestressing means.

Hereinbelow, the invention is described in reference of figures. In FIGS. 43 through 48, an end of closing torsion bars is fixed to an inside of a making shaft 109. The torsion bars are not illustrated in FIGS. 43 through 48. Vide the torsion bar 35 in FIG. 4. A lever 110 fixed to a making shaft 109 receives a releasing force of rotating in a clockwise direction from the torsion bars. A making lever 76 is located around a main shaft 51 so as to be rotatable, connected to the lever 110 through a linkage 111 and a pin 112, and receives a releasing force of rotating in a clockwise direction from the torsion bars.

Because the other structure is similar to that in Embodiment 2 in reference of FIG. 10 and that in Embodiment 7 in reference of FIG. 37. The same numerical references are used for corresponding portions, and description of these portions is omitted. In FIGS. 43 through 48, the case 1 and the stopper 104 illustrated in FIG. 37 are omitted.

Further, since an operation is similar to that in Embodiment 7, a description is omitted.

Embodiment 9

A control device for a breaker according to Embodiment 9 of the present invention will be described in reference of figures. FIGS. 49 through 55 illustrate the control device for breaker according to Embodiment 9 of the present invention.

Figure 49:
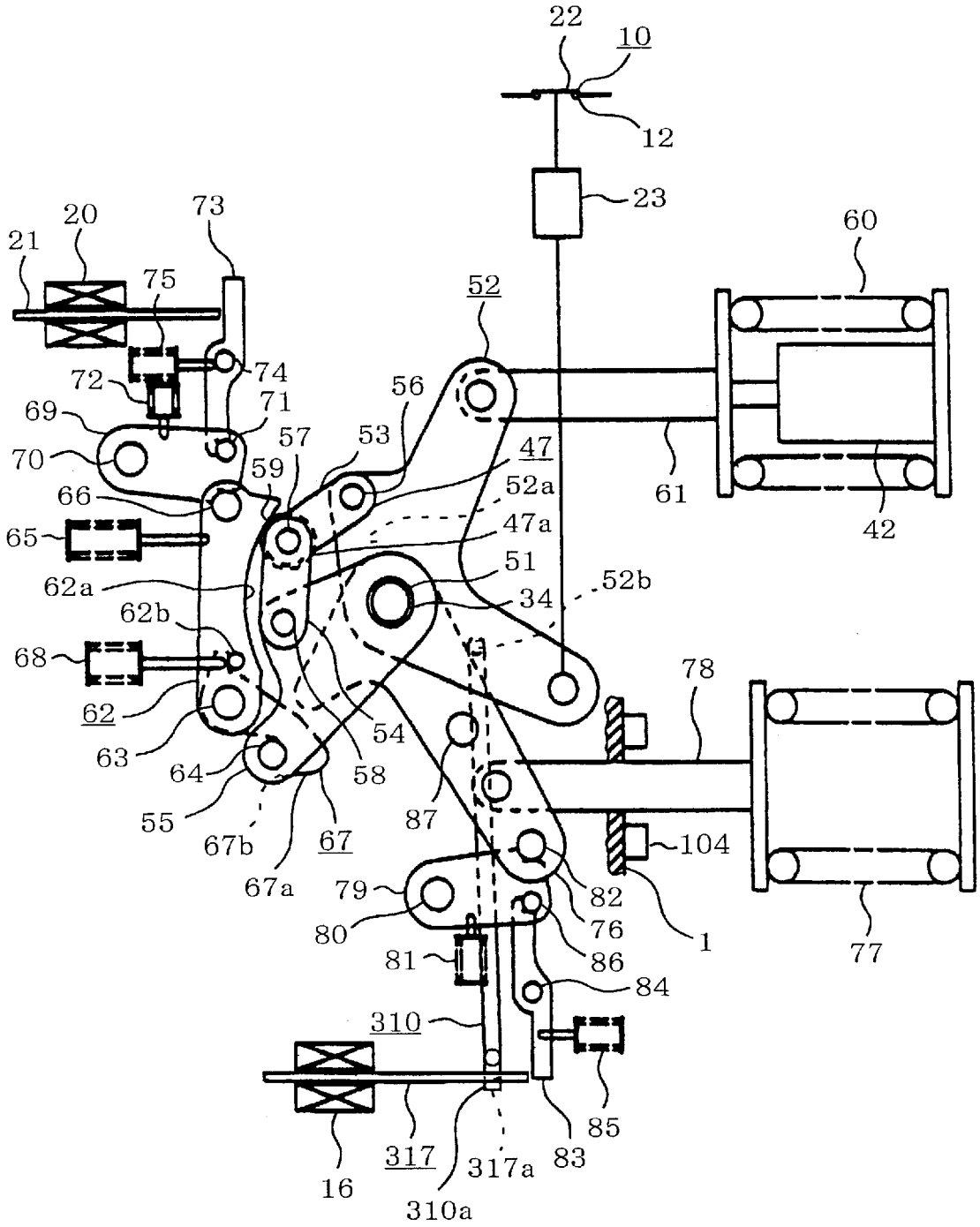
FIG. 49 illustrates a structure of an important portion of a control device for a breaker according to Embodiment 9 of the present invention, wherein the breaker is in a state of closing a circuit, and both of a closing coil spring and an opening coil spring are prestressed.
Figure 50:
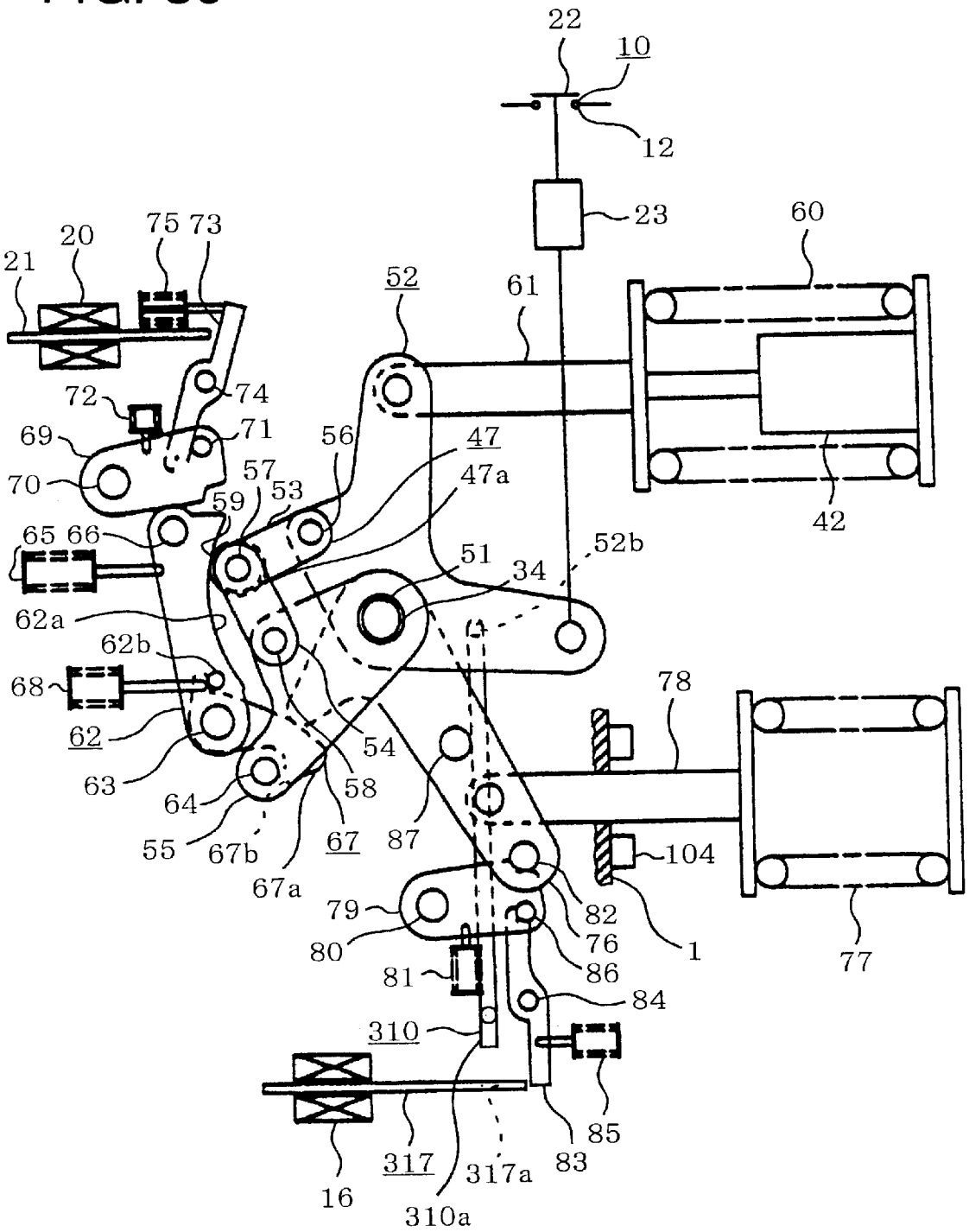
FIG. 50 illustrates a structure of the important portion of the control device for breaker according to Embodiment 9 of the present invention, wherein a state in course of an operation of opening the circuit from the state illustrated in FIG. 49 is shown.
Figure 51:
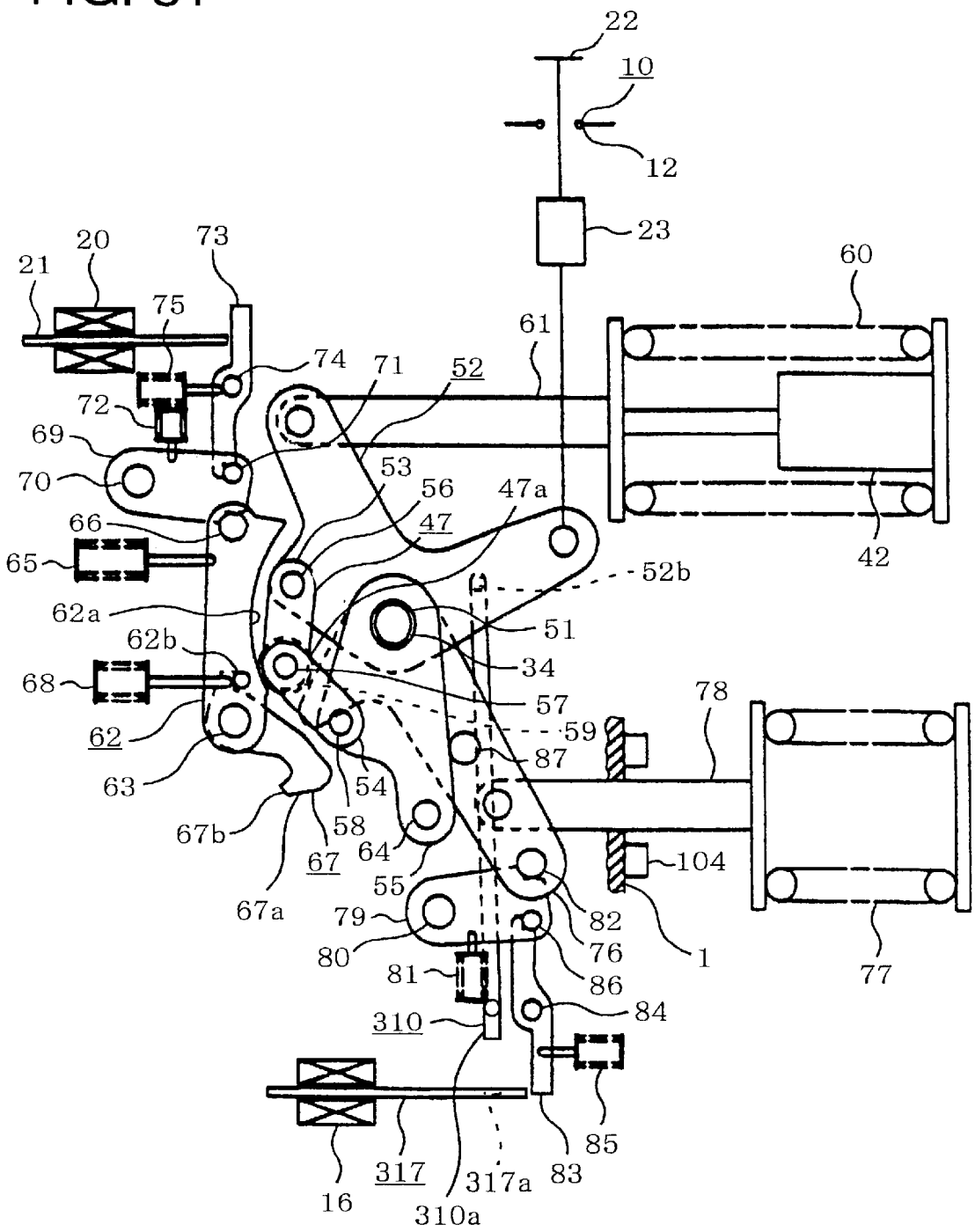
FIG. 51 illustrates a structure of the important portion of the control device for breaker according to Embodiment 9 of the present invention, wherein the breaker is in a state of opening the circuit, the closing coil spring is prestressed, and the opening coil spring is released.

FIG. 49 illustrates a structure of an important portion of the control device for breaker, wherein the breaker is in a state of opening the circuit, and both of a closing coil spring and an opening coil spring are prestressed. FIG. 50 illustrates a structure of the important portion of the control device for breaker, wherein a state that the circuit is being closed from the state illustrated in FIG. 49 is shown. FIG. 51 illustrates a structure of the important portion of the control device for breaker, wherein the breaker is in a state of opening the circuit, the closing coil spring is prestressed, and the opening coil spring is released.

Figure 52:
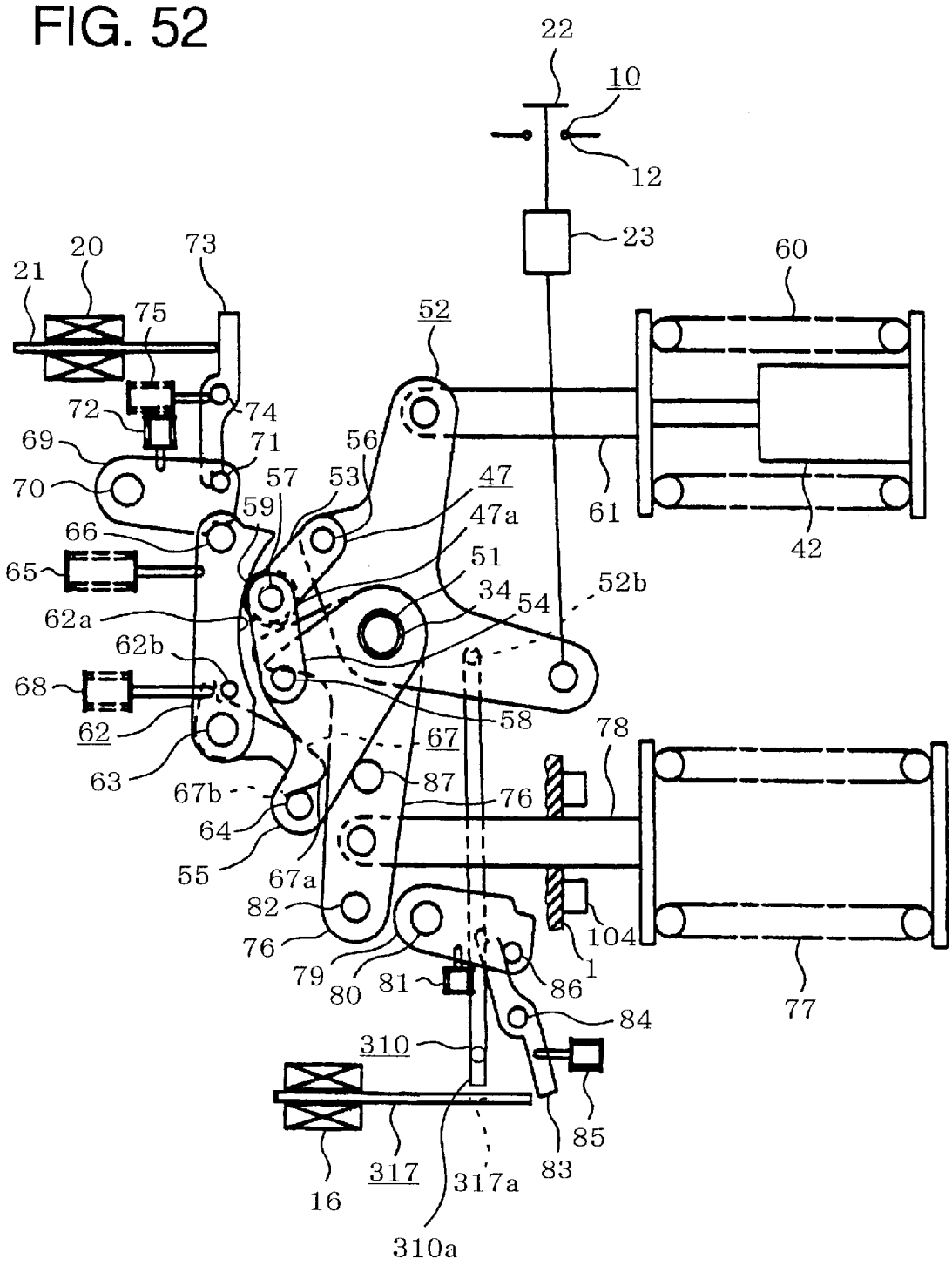
FIG. 52 illustrates a structure of the important portion of the control device for breaker according to Embodiment 9 of the present invention, wherein a state in course of an operation of closing the circuit from the state illustrated in FIG. 51 is shown.
Figure 53:
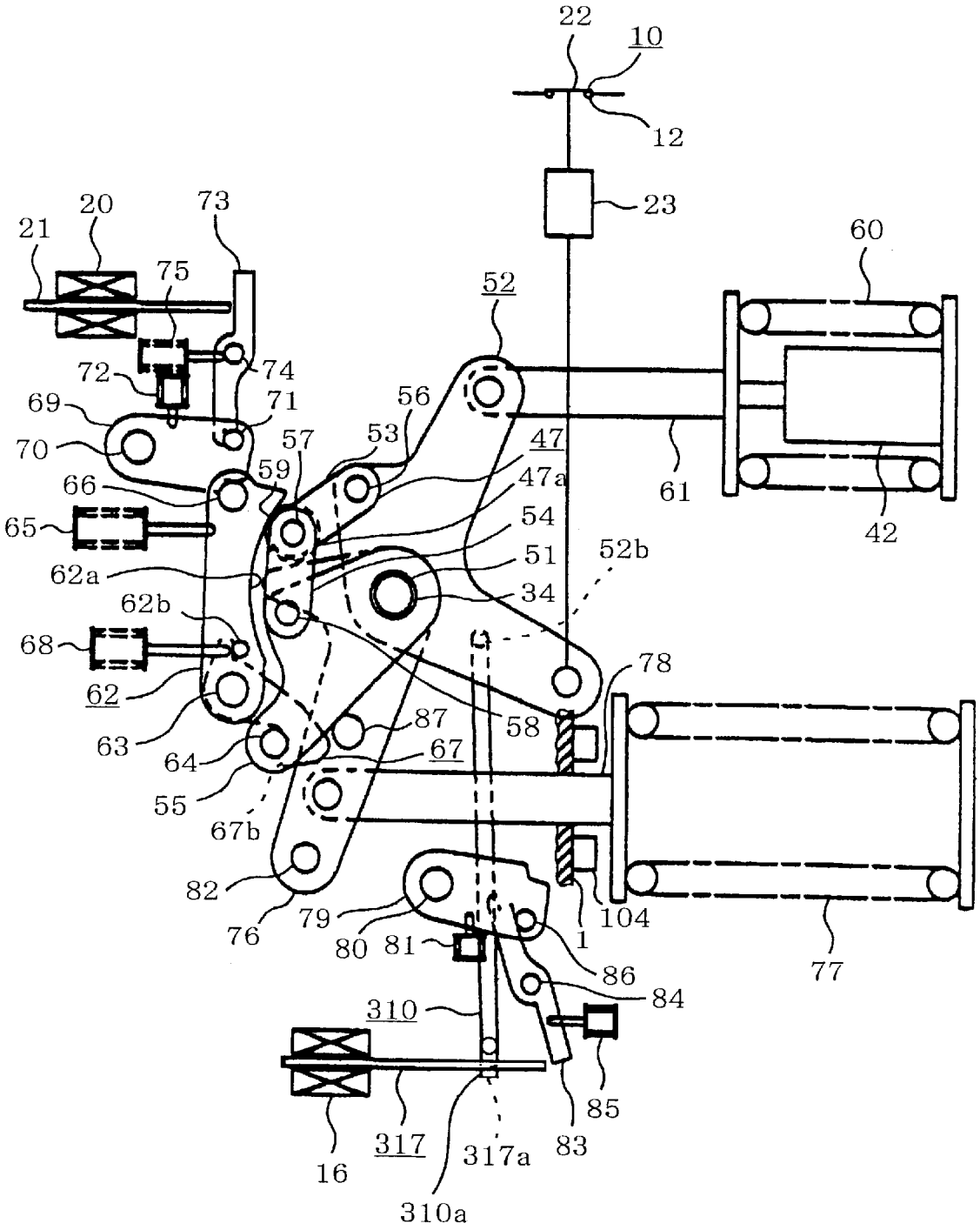
FIG. 53 illustrates a structure of the important portion of the control device for breaker according to Embodiment 9 of the present invention, wherein the operation of closing the circuit is completed, the closing coil spring is released, and the opening coil spring is prestressed.
Figure 54:
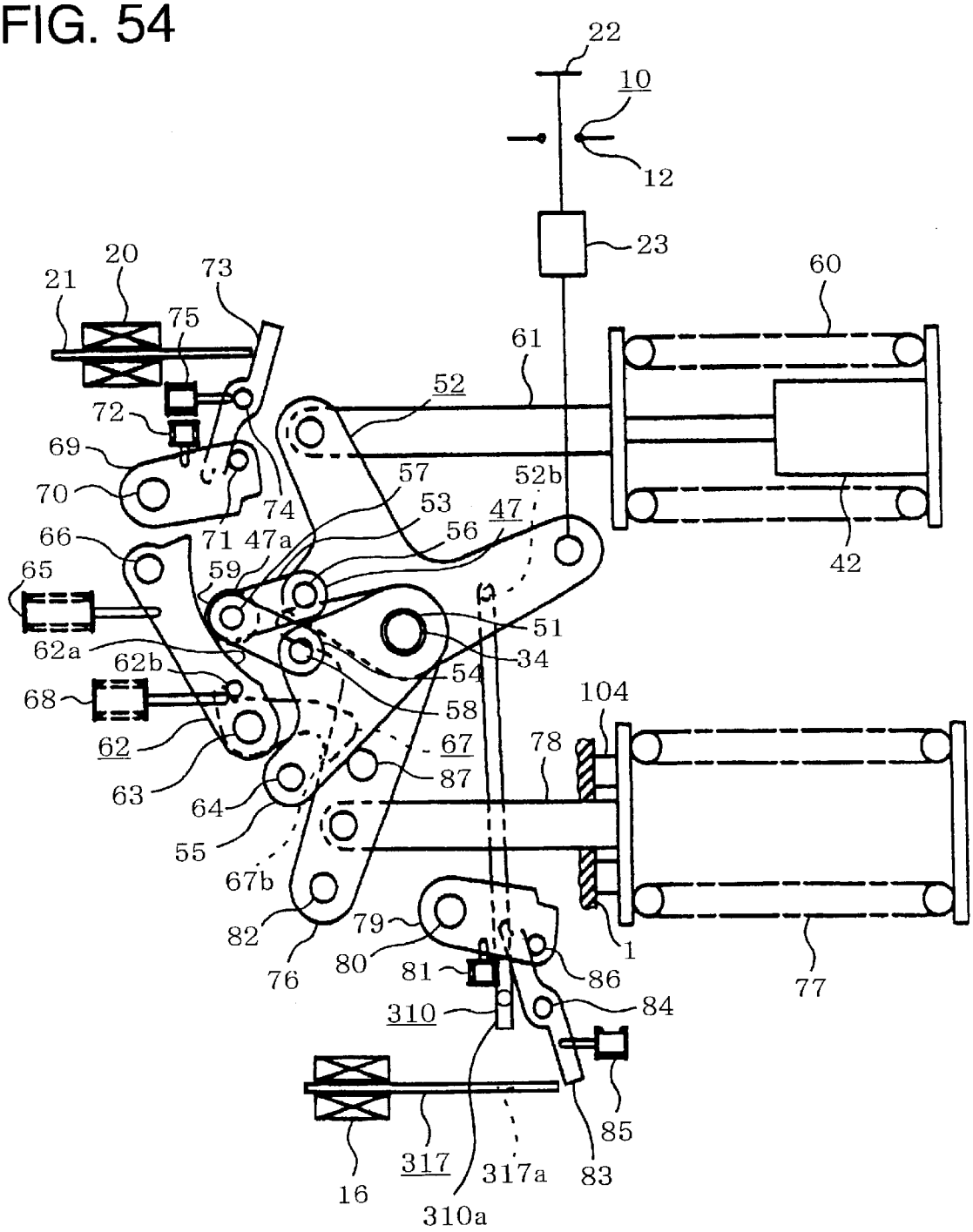
FIG. 54 illustrates a structure of the important portion of the control device for breaker according to Embodiment 9 of the present invention, which is a state that a second opening operation is completed immediately after an operation of rapidly reclosing the circuit, wherein the breaker is in a state of opening the circuit, and both of the closing coil spring and the opening coil spring are released.
Figure 55:
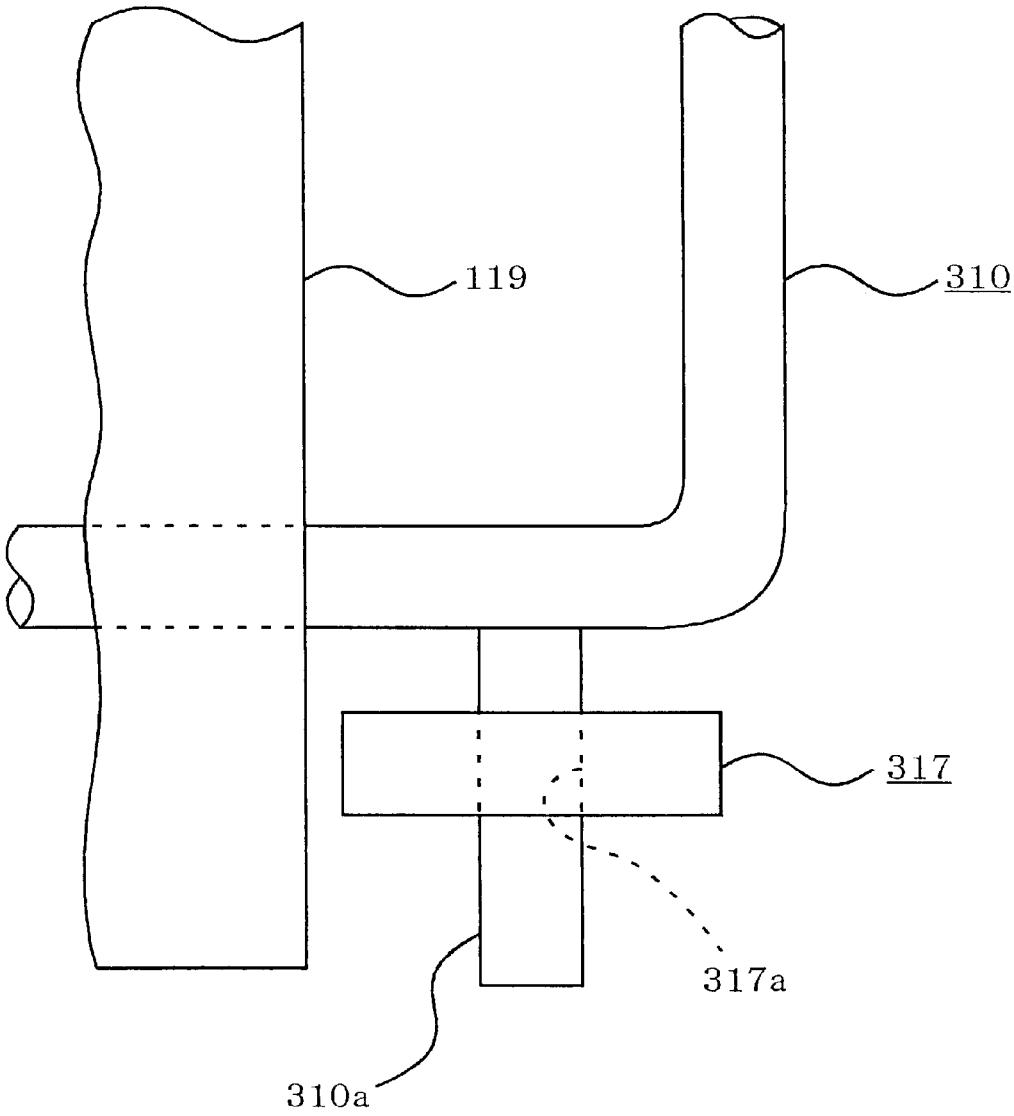
FIG. 55 is an enlarged view of a part of a second locking member illustrated in FIG. 49 to explain its detailed structure.

FIG. 52 illustrates a structure of the important portion of the control device for breaker, wherein a state in course of a closing operation from the state illustrated in FIG. 51 is shown. FIG. 53 illustrates a structure of the important portion of the control device for breaker, wherein the closing operation is completed, the closing coil spring is released, and the opening coil spring is prestressed. FIG. 54 illustrates a structure of the important portion of the control device for breaker, where a state that a second opening operation is completed immediately after an operation of rapidly reclosing the circuit, wherein the breaker is in the state of opening the circuit, and both of the closing coil spring and the opening coil spring are released. FIG. 55 is an enlarged view of a part of a second locking member to show its detailed structure.

In Embodiment 7 in reference of FIG. 37, a second locking member 210 is vertically moved to rotate the trigger lever 212, a plunger 17 stops to drive a making trigger 83 and an engagement of the making lever 76 by a making latch 79 is prevented from being released. Meanwhile, in Embodiment 9, a movement of a plunger 317 is bound by a second locking member 310, whereby the plunger 317 does not drive the making trigger 83, and a release of the engagement of the making lever 76 by the making latch 79 is prevented.

Hereinbelow, a detailed explanation will be given in reference of figures. In FIGS. 49 through 55, numerical reference 310 designates a second locking member shaped like a rod, both end of which having a circular cross-sectional shape are bent at right angles, and one of the bent ends is inserted in a hole 52*b*, formed in a first breaking lever 52 so as to be rotatable. To the other bent end of the second locking member 310, an insertion pin 310*a* having a circular cross-sectional shape is fixed at a right angle as illustrated in FIG. 55, and the end thereof is inserted inside a guide groove of a supporting plate 119 having tip end portions to those illustrated in FIG. 21, and the tip end portion vertically moves within the guide groove along with a rotation of the first breaking lever.

Numerical reference 16 designates a making electromagnet, and numerical reference 317 designates a plunger, wherein a hole 317*a* forming a circular hole is formed on a right side of the plunger 317. An insertion pin 310*a* of the second locking member 310 moving in the vertical directions can be inserted in the hole 317*a*.

Because the other structure is similar to that in Embodiment 7 in reference of FIG. 37, the same numerical references are used for corresponding portions, and a description of these portions is omitted.

In the next, an operation will be described. FIG. 49 illustrates a state that the breaker is in the state of closing the circuit, and the closing coil spring 77 and the opening coil spring 60 are prestressed. In this state, the second locking member 310, connected to the second breaking lever 52 through the hole 52*b* so as to be rotatable, is guided by the supporting plate 119 and moves downward, wherein the insertion pin 310*a* is inserted in the hole 317*a* of the plunger 317.

Accordingly, when the making electromagnet 16 is excited or moved by a hand, the plunger 17 does not move, and the making trigger 83 can not be rotated. Accordingly, the engagement of the making latch 79 by the making trigger 83 is not released, and the closing coil spring 77 is not released. In other words, when the plunger 17 is erroneously operated in this state, it is impossible to operate, whereby the pin 87, located in the making lever 76, does not collide with a second breaking lever 55 by a release of the closing coil spring 77.

FIG. 50 illustrates a state that the breaker is being opened from a state illustrated in FIG. 49. When a releasing electromagnet 20 is excited by an instruction of opening the circuit from the state illustrated in FIG. 49, a plunger 21 is rightward driven, a releasing trigger 73 is rotated in a clockwise direction, an engagement of a guide 62 by a first releasing latch 69 is released, and the first breaking lever 52 is rotated in a counterclockwise direction. Along with the counterclockwise rotation of the first breaking lever 52, the second locking member 310 upward moves by being guided by the supporting plate 119 illustrated in FIG. 55.

When the second locking member 310 upward moves, the insertion pin 310*a* also upward moves and is escaped from a hole 317*a*, whereby the second locking member 310 further upward moves. Then the breaker finishes the opening operation. Then a state that the closing coil spring 77 is prestressed and the opening coil spring 60 is released illustrated in FIG. 51 is established. In this state, a bind of the plunger 317 by the insertion pin 310*a* is released, whereby it is possible to close the circuit by counterclockwise rotate the making trigger 83 around a rotational shaft 84 by rightward driving the plunger 317. In the next, a state in course of the operation of closing the circuit from the state illustrated in FIG. 51 is shown in FIG. 52. When the making electromagnet 16 is excited, the plunger 317 is rightward driven, and the making trigger 83 is counterclockwise rotated. When the making trigger 83 is counterclockwise rotated, the engagement of the making latch 79 by the making trigger 83 is released, and the making lever 76 is clockwise rotated around the rotational shaft 51 by a releasing force of the closing coil spring 77.

When a pin 87, fixed to the making lever 76, pushes the second breaking lever 55, the second breaking lever 55 is clockwise rotated around the rotational shaft 51 together with a linkage 47 and the first breaking lever 52, whereby a rotor 59 of the linkage 47 moves while being in contact with an arch surface 62*a* of a guide 62.

Along with the clockwise rotation of the first breaking lever 52, the second locking member 310 downward moves again to complete the operation of closing the circuit. At this time, the insertion pin 310*a* of the second locking member 310 is inserted in the hole 317*a* of the plunger 317, it is impossible to move the plunger 317 even it is intended to rightward move, whereby there is no danger that the operation of closing the circuit is performed. This state that the operation of closing the circuit is completed is illustrated in FIG. 53.

In the next, when an instruction of opening the circuit is emitted from the state of closing the circuit illustrated in FIG. 53, the plunger 21 of the releasing electromagnet rightward pushes the releasing trigger 73, and the releasing trigger 73 is rotated in a counterclockwise direction around a rotational shaft 74. By the rotation of the releasing trigger 73, the engagement of the guide 62 by the first releasing latch 69 is released, and the guide 62 is rotated in a counterclockwise direction around a rotational shaft 63 while being pushed by the rotor 59, receiving a force from the opening coil spring 60.

Because the second breaking lever 55 is pushed by the pin 87 located in the making lever 76, applied with a rotational force in the clockwise direction by the closing coil spring 77, the second breaking lever 55 can not move. However, the first breaking lever 52, receiving a force from the opening coil spring 60, rotates in a counterclockwise direction around the rotational shaft 51 when the linkage 47 is buckled. When the first breaking lever 52 is rotated in the counterclockwise direction, the second locking member 310 connected to the first breaking lever 52 is guided by the supporting plate 119 and is upward moved again. In accordance therewith, the insertion pin 310*a* of the first locking member 310 escapes from the hole 317*a* of the plunger 317. This state is illustrated in FIG. 54.

An operation of prestressing the closing coil spring 77 is similar to that in Embodiment 7 in reference of FIG. 37. A brief additional explanation will be given. The closing coil spring 77 is prestressed from a state that the closing coil spring 77 is released as in FIG. 53 or 54. At first, a case that the closing coil spring 77 is prestressed from a state in FIG. 53 will be described. A lever 88 illustrated in FIG. 2 is counterclockwise rotated around a main shaft 51 by the prestressing device illustrated in FIG. 2. Then, the making lever 76 integrally formed with the lever 88 is counterclockwise rotated around the main shaft 51.

The pin 82 located in the making lever 76 is in contact with and slides on an end surface of the making latch 79 in course of a counterclockwise rotation thereof. When the making lever 76 reaches a predetermined position, the making latch 79 is rotated in a counterclockwise direction by a spring 81, and is engaged with the pin 82 located in the making lever 76. Simultaneously, the making trigger 83 is rotated in a clockwise direction by a spring 85, and is engaged with the pin 86, whereby the making lever 76 is held, and the closing coil spring 77 is maintained to be in the prestressed state as illustrated in FIG. 49.

Further, in the state illustrated in FIG. 53, the guide 62 returns and is engaged by the first releasing latch 69, and the second breaking lever 55 is engaged with the second releasing latch 67. Accordingly, even though the making lever 76 is counterclockwise rotated, the second breaking lever 55 and the first breaking lever 52 do not move. Accordingly, the second locking member 310 connected to the first breaking lever 52 maintains the state illustrated in FIG. 53. In other words, the insertion pin 310*a* is inserted in the hole 317*a* of the plunger, whereby the plunger 317 can not be moved even though it is intended. Therefore, the engagement of the making lever 76 by the making latch 79 is not released, and a state that the closing coil spring 77 is not released is maintained. This state is illustrated in FIG. 49.

Further, when the closing coil spring 77 is prestressed from the state illustrated in FIG. 54, along with the counterclockwise rotation of the making lever 76, a spring 65 pushes the rotor 59 toward the main shaft 51 through the guide 62, whereby the second breaking lever 55 is in contact with the pin 87 located in the making lever 76 and rotated in the counterclockwise direction. The guide 62 pushes the rotor 59 by a force of the spring 65 and rotated in the clockwise direction to return. Thereafter, the guide 62 is engaged by the first releasing latch 69 and the releasing trigger 73.

A pin 82 of the making lever 76 is in contact with and slides on an end surface of the making latch 79 in course of the counterclockwise rotation thereof. When the making lever 76 reaches a predetermined position, the making latch 79 is rotated in a counterclockwise direction by the spring 81 and engaged with the pin located in the making lever 76. Further, the making trigger 83 is rotated in a clockwise direction by the spring 85 so as to be engaged with the pin 86, whereby the making lever 76 is held, and the closing coil spring 77 is maintained to be in the prestressed state. Further, in accordance with the engagement of the making trigger 83 with the pin 86 after rotating in the clockwise direction, the making trigger 83 returns to a position where it can be driven by the plunger 317. This state is illustrated in FIG. 51.

The other operation is similar to that in Embodiment 7.

According to Embodiment 9, in use of a simple structure that the second locking member 310 is connected to the first breaking lever 52, and the second locking member 310 is mechanically interlocked with a rotation of the first breaking lever 52, it is possible to bind the plunger 317 so as not to move, and it is possible to prevent the engagement of the making latch 79 by the first making trigger 83 from being released as a result of a drive of the making trigger 83. Accordingly, when the breaker is in the state of closing the circuit, and both of the opening coil spring 60 and the closing coil spring 77 are prestressed as in FIG. 49, it is impossible to erroneously move the plunger 317 of the making electromagnet 16 even though it is intended, wherein the rotation of the making lever 76 can be prevented.

Accordingly, the pin 87 does not generate an impact by a collision with the second breaking lever 55, wherein it is possible to reduce a mechanical strength of components such as the making lever 76, the pin 87, and the second breaking lever 55, whereby a reduction of size and a weight is enabled.

Embodiment 10

Figure 56:
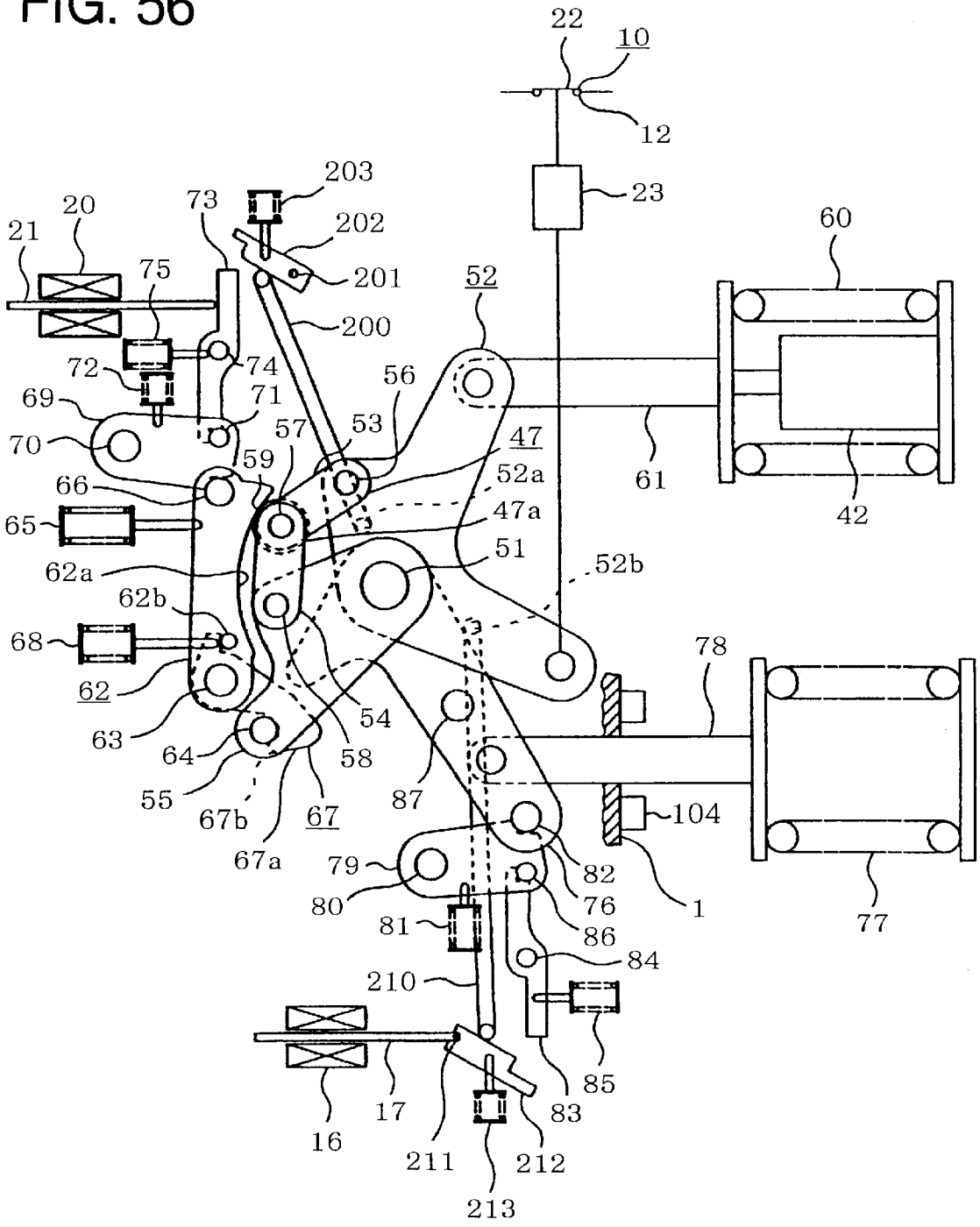
FIG. 56 illustrates a structure of an important portion of a control device for a breaker according to Embodiment 10 of the present invention, wherein the breaker is in a state of closing a circuit, and both of a closing coil spring and an opening coil spring are prestressed.
Figure 57:
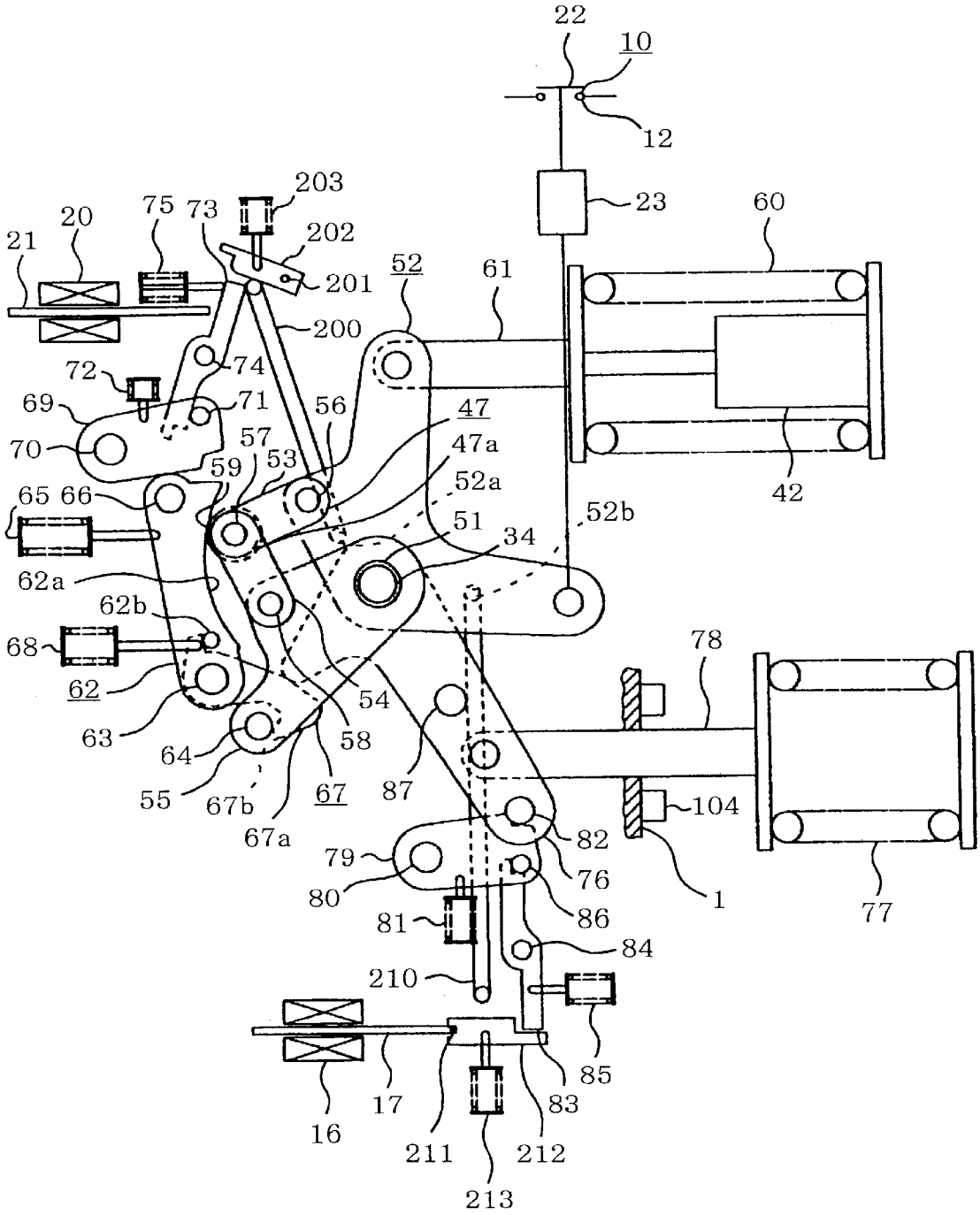
FIG. 57 illustrates a structure of the important portion of the control device for breaker according to Embodiment 10 of the present invention, wherein a state in course of an operation of opening the circuit from the state illustrated in FIG. 56 is shown.
Figure 58:
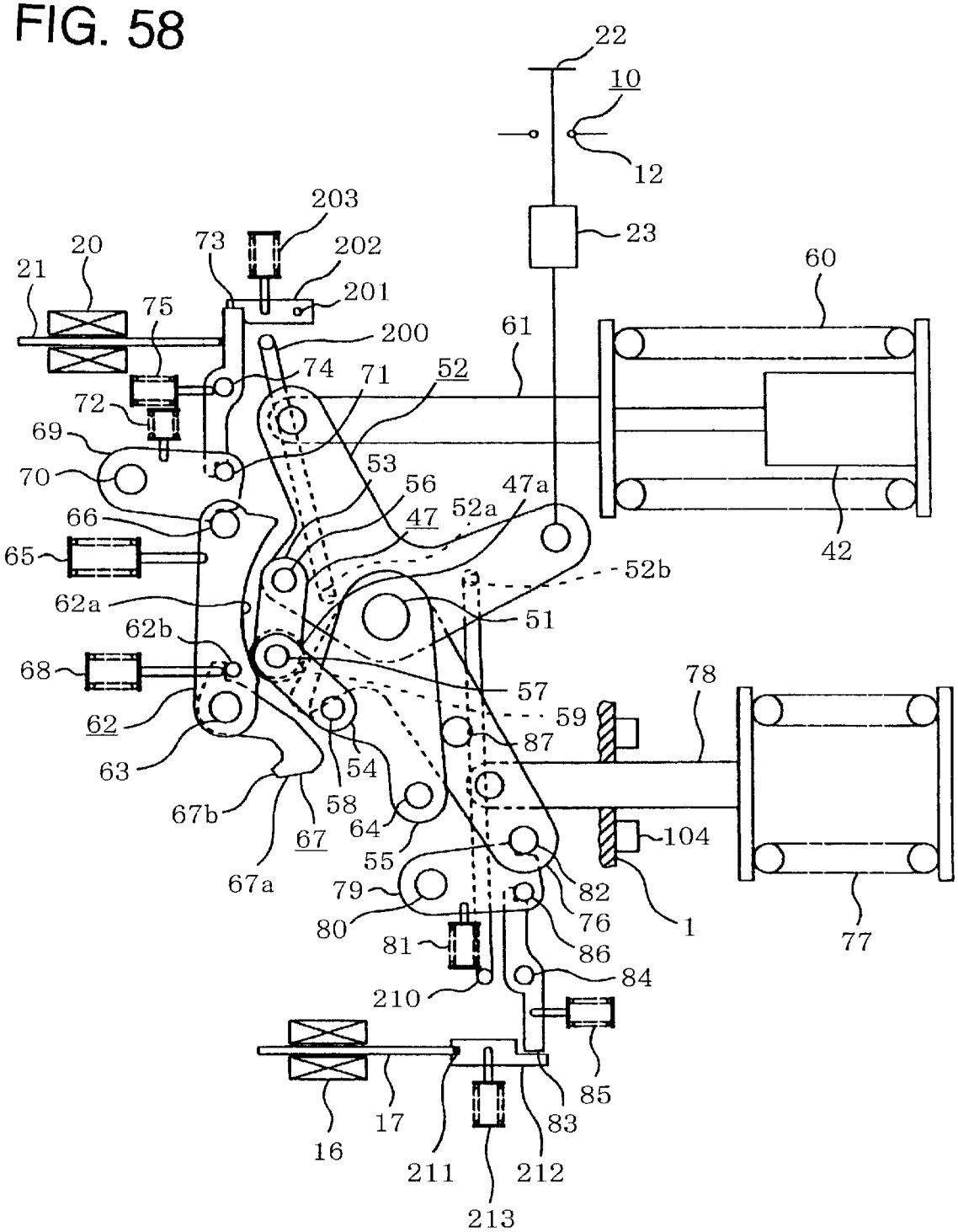
FIG. 58 illustrates a structure of the important portion of the control device for breaker according to Embodiment 10 of the present invention, wherein the breaker is in a state of opening the circuit, the closing coil spring is prestressed, and the opening coil spring is released.

A control device for a breaker according to Embodiment 10 of the present invention will be described in reference of figures. FIGS. 56 through 61 illustrate the control device for breaker according to Embodiment 10 of the present invention. FIG. 56 illustrates a structure of an important portion of the control device for breaker, wherein the breaker is in a state of closing a circuit, and both of a closing coil spring and opening coil spring are prestressed. FIG. 57 illustrates a structure of the important portion of the control device for breaker, wherein a state in course of an operation of opening the circuit from a state illustrated in FIG. 56 is shown. FIG. 58 illustrates a structure of the important portion of the control device for breaker, wherein the breaker is in a state of opening the circuit, the closing coil spring is prestressed, and the opening coil spring is released.

Figure 59:
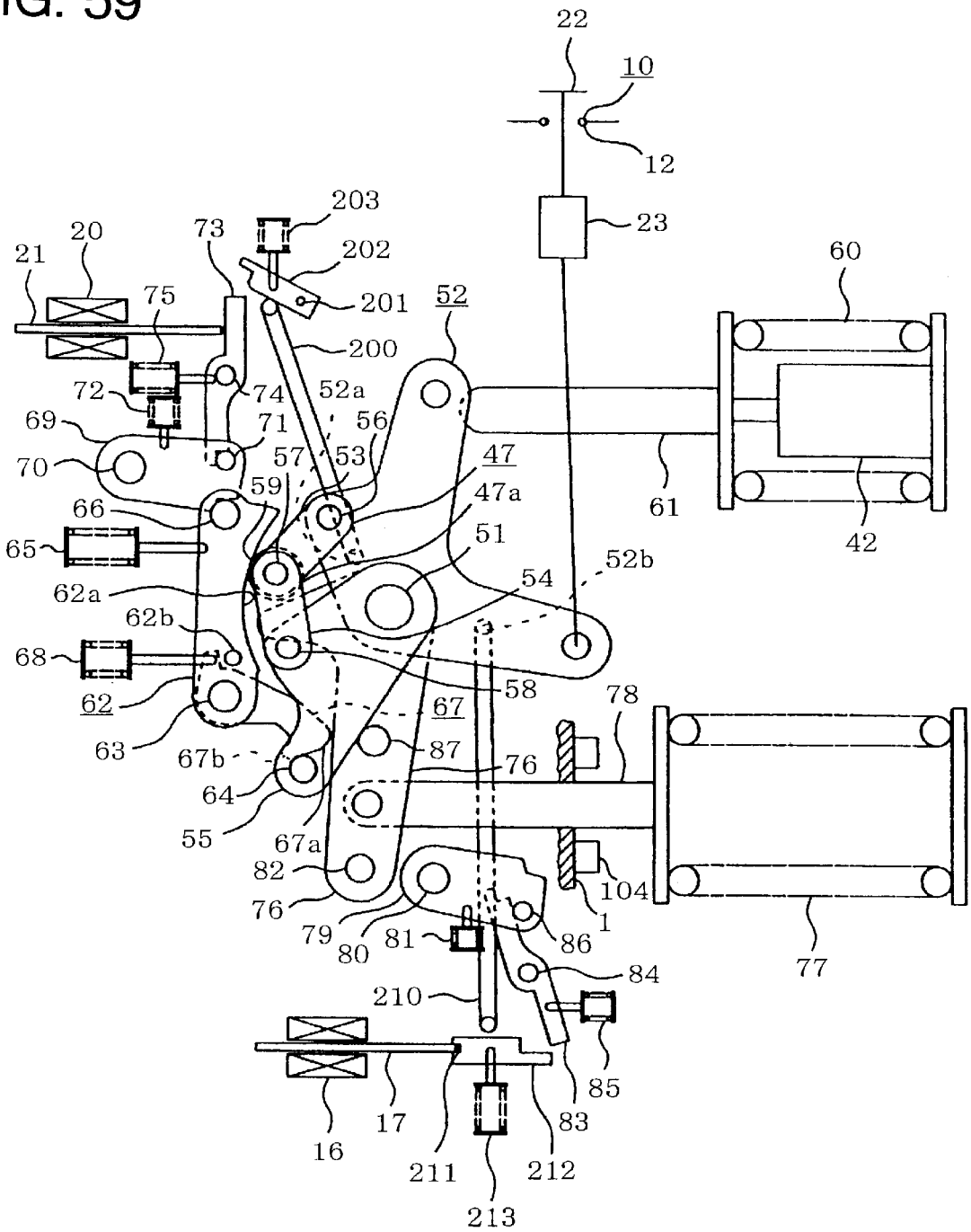
FIG. 59 illustrates a structure of the important portion of the control device for breaker according to Embodiment 10 of the present invention, wherein a state in course of closing operation from the state illustrated in FIG. 58 is shown.
Figure 60:
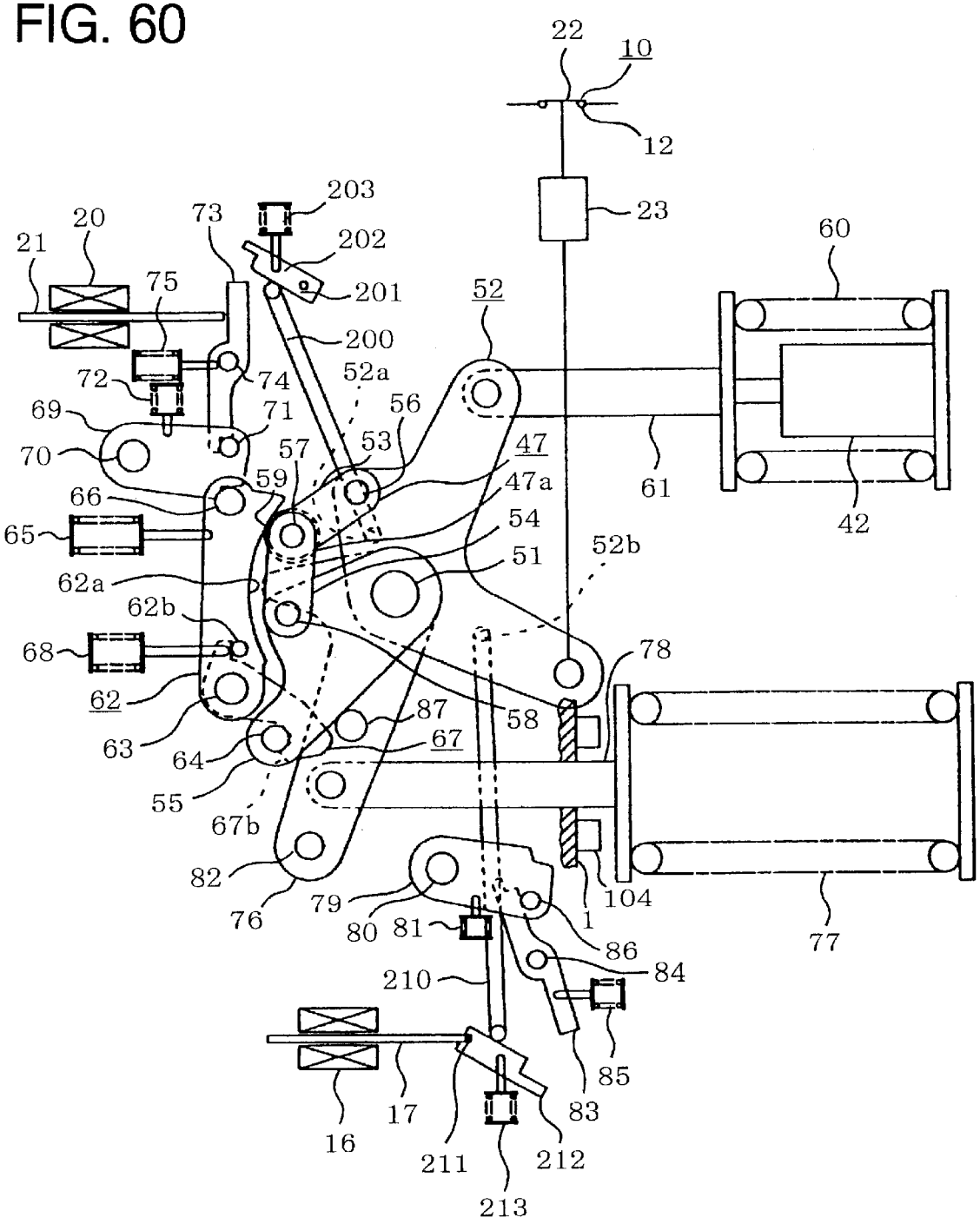
FIG. 60 illustrates a structure of the important portion of the control device for breaker according to Embodiment 10 of the present invention, wherein an operation of closing the circuit is completed, the closing coil spring is released, and the opening coil spring is prestressed.

FIG. 59 illustrates a structure of the important portion of the control device for breaker, wherein a state in course of an operation of closing the circuit from the state illustrated in FIG. 58 is shown. FIG. 60 illustrates a structure of the important portion of the control device for breaker, wherein the operation of closing the circuit is completed, the closing coil spring is released, and the opening coil spring is prestressed.

Figure 61:
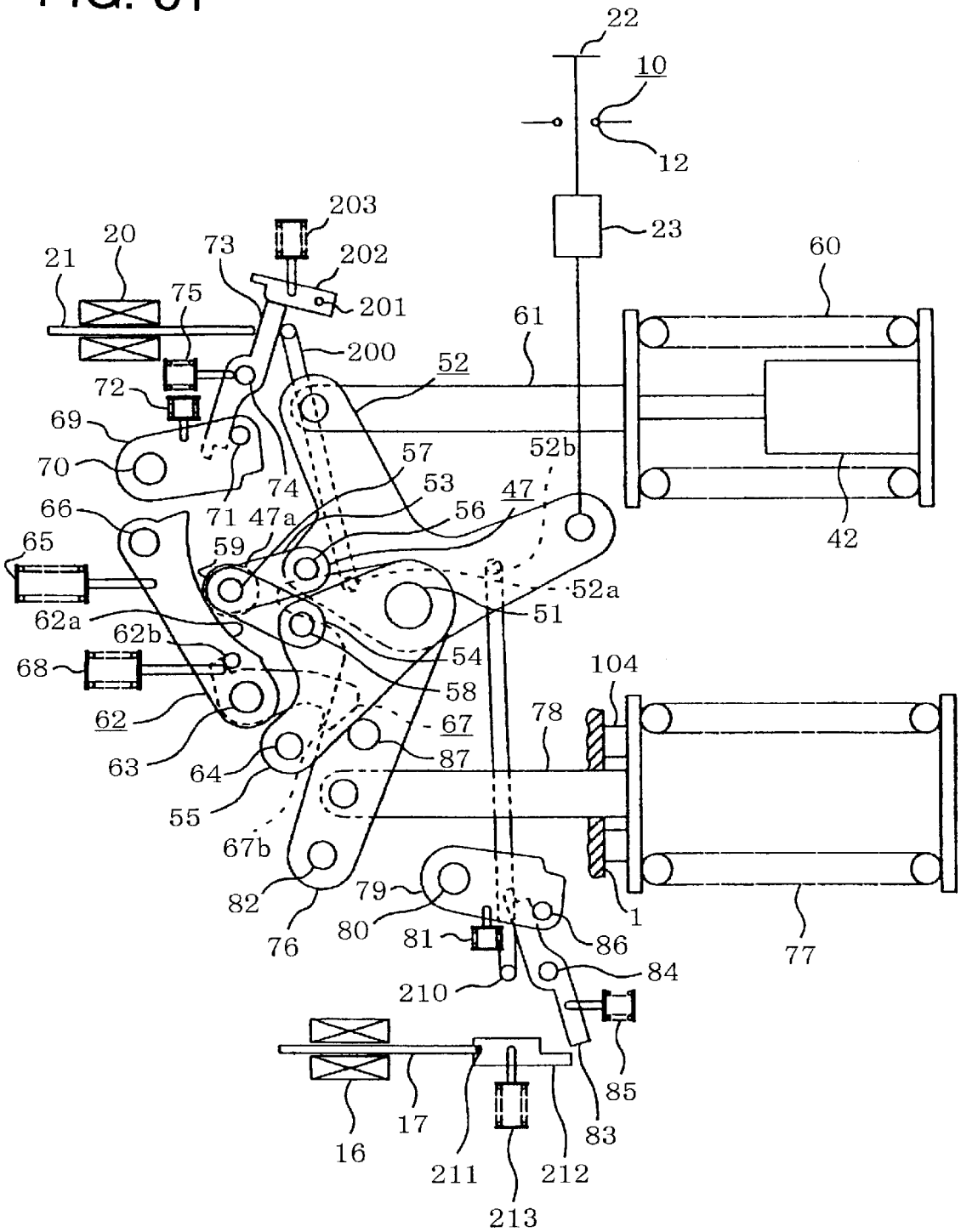
FIG. 61 illustrates a structure of the important portion of the control device for breaker according to Embodiment 10 of the present invention, which is a state that a second opening operation is completed immediately after an operation of rapidly reclosing the circuit, wherein the breaker is in a state of opening the circuit, and both of the closing coil spring and the opening coil spring are released.

FIG. 61 illustrates a structure of the important portion of the control device for breaker, where a state that a second operation of opening the circuit is completed immediately after an operation of rapidly reclosing the circuit, wherein the breaker is in the state of opening the circuit, and both of the closing coil spring and the opening coil spring are released. In Embodiment 10, both of the first locking member 200, connected to the first breaking lever 52 described in Embodiment 6, and the second locking member 210, connected to the first breaking lever 52 described in Embodiment 7 are located, wherein further reductions of the size and the weight of the control device are enabled.

Hereinbelow, an explanation will be given in reference of figures. In FIGS. 56 through 61, numerical reference 200 designates a first locking member shaped like a rod, wherein both ends of a rod material having a circular cross-sectional shape are bent at right angles, and one of the bent ends is inserted in a hole 52*a* formed in a first breaking lever 52 so as to be rotatable. The other end of the first locking member 200 is inserted inside a guide groove of a supporting plate (not shown), similar to the supporting plate 119 illustrated in FIG. 21, wherein the other end vertically moves inside the guide groove along with a rotation of the first breaking lever 52.

Numerical reference 201 designates a rotational shaft, and numerical reference 202 designates a locking plate, which is supported around the rotational shaft 201 so as to be rotatable. Numerical reference 203 designates a spring for urging the locking plate 202 around the rotational shaft 201 in a counterclockwise direction.

Numerical reference 210 designates a second locking member shaped like a rod, wherein both ends of a rod material having a circular cross-sectional shape are bent at right angles, and one of the bent ends is inserted in a hole 52*b* formed in the first breaking lever 52 so as to be rotatable. The other end of the second locking member 210 is inserted inside a guide groove of the supporting plate (not shown), similar to the supporting plate 119 illustrated in FIG. 21, wherein the other end vertically moves inside the guide groove along with a rotation of the first breaking lever 52.

Numerical reference 212 designates a trigger lever, and numerical reference 211 designates a connecting pin, wherein the trigger lever 212 is connected to a plunger 17 through the connecting pin 211 so as to be rotatable. Numerical reference 213 designates a spring for urging the trigger lever 212 around the connecting pin 211 in a counterclockwise direction.

The other structure is similar to those in embodiment 6 in reference of FIG. 31 and Embodiment 7 in reference of FIG. 37, the same numerical references are used for the corresponding portions, and description of these portions is omitted.

In the next, an operation will be described. In FIG. 56, the breaker is in a state of closing the circuit, and a closing coil spring 77 and an opening coil spring 60 are prestressed. In this state, the first locking member 200, connected to the first breaking lever 52 through the hole 52*a* so as to be rotatable, is guided by the supporting plate (not shown) and is upward moved to upward push the locking plate 202.

The upward pushed locking plate 202 is rotated in a clockwise direction around the rotational shaft 201, and stopped in a state that the engagement with the releasing trigger 73 is released. Because an engagement of a releasing trigger 73 by the locking plate 202 is released, it is possible to move a plunger 21 of a releasing electromagnet 20 to rotate a releasing trigger 73 in a clockwise direction, whereby an engagement of a guide 62 by a first releasing latch 69 can be released. In other words, in FIG. 56, the breaker is in a state that the circuit can be opened.

Further, in the state illustrated in FIG. 56, the second locking member 210, connected to the second breaking lever 52 through the hole 52*b* so as to be rotatable is guided by the supporting plate (not shown) so as to downward move, whereby the trigger lever 212 is downward pushed. The downward pushed trigger lever 212 is stopped in a state of rotating in a clockwise direction around the connecting pin 211.

Accordingly, even though a plunger 17 of a making electromagnet 16 moves, the trigger lever 212 is not in contact with a making trigger 83, an engagement of a making latch 79 by the making trigger 83 is not released, and the closing coil spring 77 is not released. In other words, even though the plunger 17 is erroneously operated from this state, a pin 87 located in a making lever 76, does not collide with a second breaking lever 55 by a release of the closing coil spring 77.

FIG. 57 illustrates a state that the breaker is being opened from a state illustrated in FIG. 56. When the releasing electromagnet 20 is excited by an instruction of opening the circuit from the state in FIG. 56, a plunger 21 is rightward driven to rotate the releasing trigger 73 in a clockwise direction, whereby an engagement of the guide 62 by the first releasing latch 69 is released, and the first breaking lever 52 is rotated in a counterclockwise direction.

Along with a rotation of the first breaking lever 52 in the counterclockwise direction, the first locking member 200 is downward moved by being guided by the supporting plate (not shown). Along with the downward movement of the first locking member 200, the locking plate 202 is pushed by the spring 203 so as to be rotated in a counterclockwise direction around the rotational shaft 201, whereby the locking plate 202 is engaged with the releasing trigger 73. Thereafter, the first locking member 200 is further downward moved, and is separated from the locking plate 200. Thus, the breaker finishes the operation of opening the circuit, and a state that the closing coil spring 77 is prestressed and the opening coil spring 60 is released as illustrated in FIG. 58 is established. In this state, the locking plate 202 is engaged with the releasing trigger 73. The releasing trigger 73 can not rotate in a clockwise direction around the rotational shaft 74 by this engagement, and the engagement of the guide 62 by the releasing latch 69 can not be released.

Further, along with the counterclockwise rotation of the first breaking lever 52, the second locking member 210 is upward moved by being guided by the supporting plate (not shown). In accordance with the upward movement of the second locking member 210, the trigger lever 212 is rotated around the connecting pin 211 in a counterclockwise direction by the spring 213, wherein the trigger lever 212 and the plunger 17 are aligned in a line. Thereafter, the second locking member 210 is further upward moved and separated from the trigger lever 212.

Then, the operation of opening the circuit by the breaker is completed, the closing coil spring 77 is prestressed, and the opening coil spring 60 is released as illustrated in FIG. 58. In this state, the trigger lever 212 and the plunger 17 are arranged in a line. By rightward driving the plunger 17, the making trigger 83 is rotated in the counterclockwise direction around a rotational shaft 84 to enable the operation of closing the circuit.

When the making electromagnet 16 is excited, the trigger lever 212 rotates the making trigger 83 in the counterclockwise direction. When the making trigger 83 is counterclockwise rotated, the engagement of the making latch 79 by the making trigger 83 is released, the making lever 76 is clockwise rotated around the rotational shaft 51 by a releasing force of the closing coil spring 77.

Then the pin 87, fixed to the making lever 76, pushes the second breaking lever 55, whereby the second breaking lever 55 is rotated in a clockwise direction around a rotational shaft 51 along with a linkage 47 and the first breaking lever 52, and a rotor 59 of the linkage 47 is moved while being in contact with an arch surface 62*a* of the guide 62.

Along with the clockwise rotation of the first breaking lever 52, the first locking member is upward moved again, and upward pushes the locking plate 202 when the operation of closing the circuit is completed to clockwise rotate the locking plate 202 in a clockwise direction, whereby the engagement of the releasing trigger 73 by the locking plate 202 is released. A state that the closing operation is completed is illustrated in FIG. 60. In this state, because the engagement of the releasing trigger 73 by the locking plate 202 is released, a next opening operation is enabled.

Further, along with the clockwise rotation of the first breaking lever 52, the second locking plate 210 is downward moved again and downward pushes the trigger lever 212 when the operation of closing the circuit is completed to clockwise rotate the trigger lever 212 in a clockwise direction, whereby even though the plunger 17 is rightward moved, the trigger lever 212 is not in contact with the making trigger 83 to avoid the operation of closing the circuit. A state that the operation of closing the circuit is completed is illustrated in FIG. 60.

In the next, when an instruction of opening the circuit is emitted from a state of closing the circuit illustrated in FIG. 60, the plunger 21 of the releasing electromagnet 20 rightward pushes the releasing trigger 73 to clockwise rotate the releasing trigger 73 around a rotational shaft 74. By the rotational movement of the releasing trigger 73, the engagement of the guide 62 by the first releasing latch 69 is released, and the guide 62 is counterclockwise rotated around a rotational shaft 63 by being pushed by the rotor 59, receiving a force from the coil spring 60 for opening the circuit.

Although the second breaking lever 55 can not move because it is pushed by the pin 87 located in the making lever 76, applied with a clockwise rotational force by the coil spring for closing the circuit 77, the first breaking lever 52 receiving a force from the coil spring for opening the circuit 60 is counterclockwise rotated around the rotational shaft 51 when the linkage 47 is buckled, whereby a state illustrated in FIG. 61 is established.

Further, when the first breaking lever 52 is rotated in a counterclockwise direction, the second locking member 210 connected to the first breaking lever 52 upward moves again by being guided by the supporting plate. The trigger lever 212 clockwise rotates around the connecting pin 211 by being pushed by the spring 213, wherein the trigger lever 212 and the plunger 17 are aligned in a line. The second locking member 210 further upward moves so as to be separated from the trigger lever 212. This state is illustrated in FIG. 61.

The prestressing operation of the coil spring for closing the circuit 77 is similar to that in Embodiment 5 in reference of FIG. 23. A brief explanation will be added. The coil spring for closing the circuit 77 is performed from a state that the coil spring for closing the circuit 77 is released as in FIG. 60 or 61. At first, a case that the coil spring for closing the circuit 77 is prestressed from the state illustrated in FIG. 60 will be described. The lever 88 illustrated in FIG. 2 is counterclockwise rotated around the main shaft 51 by the prestressing device illustrated in FIG. 2. Then the making lever 76 integrally formed with the lever 88 is counterclockwise rotated around the main shaft 51.

A pin 82, located in the making lever 76, is in contact with and slides on an end surface of the making latch 79 in a course of the counterclockwise rotation of the making lever 76. When the making lever 76 reaches a predetermined position, the making latch 76 is counterclockwise rotated by a spring 81 and engaged with the pin 82. Simultaneously, the making trigger 83 is clockwise rotated by a spring 85, engaged with a pin 86, whereby the making lever 76 is held, and the closing coil spring 77 is maintained in the prestressed state as illustrated in FIG. 56.

Further, in the state illustrated in FIG. 60, the guide 62 returns so as to be engaged with the first releasing latch 69, and the second breaking lever 55 is engaged with a second releasing latch 67. Accordingly, even though the making lever 76 is counterclockwise rotated, the second breaking lever 55 and the first breaking lever 52 do not move. Accordingly, the first locking member 200, connected to the first breaking lever 52, maintains the state illustrated in FIG. 60, the engagement between the locking plate 202 and the releasing trigger 73 is released as in FIG. 56.

Further, the second locking member 210, connected to the first breaking lever 52, maintains the state illustrated in FIG. 60. In other words, the trigger lever 212 is downward pushed by the second locking member 210, and the trigger lever 212 is not in contact with the making trigger 83 even though the plunger 17 is moved, whereby the engagement of the making latch 79 is not released, and a state that the closing coil spring 77 is not released is maintained. This state is illustrated in FIG. 56.

Further, when the closing coil spring 77 is prestressed from a state illustrated in FIG. 61, in accordance with a counterclockwise rotation of the making lever 76 by the prestressing device, the spring 65 pushes the rotor 59 toward the main shaft 51 through the guide 62, whereby the second breaking lever 55 is rotated in the counterclockwise direction while being in contact with the pin located in the making lever 76. The guide 62 returns by rotating in a clockwise direction while pushing the rotor 59 by a force of a spring 65, and is engaged with the first releasing latch 69 and the releasing trigger 73.

The pin 82 of the making lever 76 is in contact with and slides on an end surface of the making latch 79 in course of the counterclockwise rotation of the making lever 76. When the making lever 76 reaches a predetermined position, the making latch 79 is rotated in the counterclockwise direction by the spring 81 and is engaged with the pin located in the making lever 76. Further, the making trigger 83 is rotated in the clockwise direction by the spring 85 so as to be engaged with the pin 86, whereby the making lever 76 is held and the closing coil spring 77 is maintained in a prestressed state as illustrated in FIG. 58.

When the making trigger 83 is rotated in the clockwise direction and is engaged with the pin 86, the making trigger returns to a position where it can be driven by the trigger lever 212, which is linearly arranged with respect to the plunger 17. When the second breaking lever 55 and the making lever 76 are counterclockwise rotated, since the opening coil spring 60 is in a released state, the first breaking lever 52 and the first locking member 200 do not move from the position illustrated in FIG. 61, and a state illustrated in FIG. 58 is established.

The other portions is similar to that in Embodiment 6 illustrated in FIG. 31, and description thereof is omitted.

According to Embodiment 10, since the first locking member 200 connected to the first breaking lever 52 and the second locking member 210 are located, in use of a simple structure, there is no danger that the engagement of the guide 62 by the first releasing latch 69 is not released even thought the releasing electromagnet is excited upon an input of an instruction of opening the circuit by an erroneous operation in course of the operation of closing the circuit or the plunger 21 is erroneously moved by a manual operation, and it is possible to prevent a large impact, caused by a collision between the pin 58 and the first breaking lever 52 as a result of a release of the engagement of the guide 52 in course of closing the circuit, from being generated.

Further, in the state that the breaker in FIG. 58 is in the opening state, the closing coil spring 77 is prestressed, and the opening coil spring 60 is released, even though the closing operation is started to make the making lever 76 move to excite the releasing electromagnet 20 by a coincidently inputted instruction of opening the circuit and to erroneously push the plunger 21, it is possible to prevent a release of the engagement of the guide 62 by the first releasing latch 69, whereby there is no danger that the linkage 47 loses its support and the circuit can not be closed.

Further, in use of a simple structure that the second locking member 210 is connected to the first breaking lever 52, and the second locking member 210 is mechanically interlocked with a rotation of the first breaking lever 52, it is possible to prevent the making trigger 83 from being driven by the trigger lever 212 and the engagement of the making latch 79 by the making trigger 83 from being released.

Accordingly, when the breaker is in the closed state as in FIG. 56 and both of the opening coil spring 60 and the closing coil spring 77 are prestressed, even though the plunger 17 of the making electromagnet 16 is erroneously moved, a rotation of the making lever 76 can be prevented.

Accordingly, the pin 87 does not collide with the second breaking lever 55, and an impact is not generated.

Further, even though the plunger 17 of the making electgromagnet 16 is erroneously moved, it is possible to prevent the making lever 76 from rotating and a generation of an impact can be prevented. Accordingly, a mechanical strength of components such as the making lever 76, the pin 87, the second breaking lever 55 can be reduced, and further reductions of a size and a weight of the control device are enabled.

Embodiment 11

Figure 62:
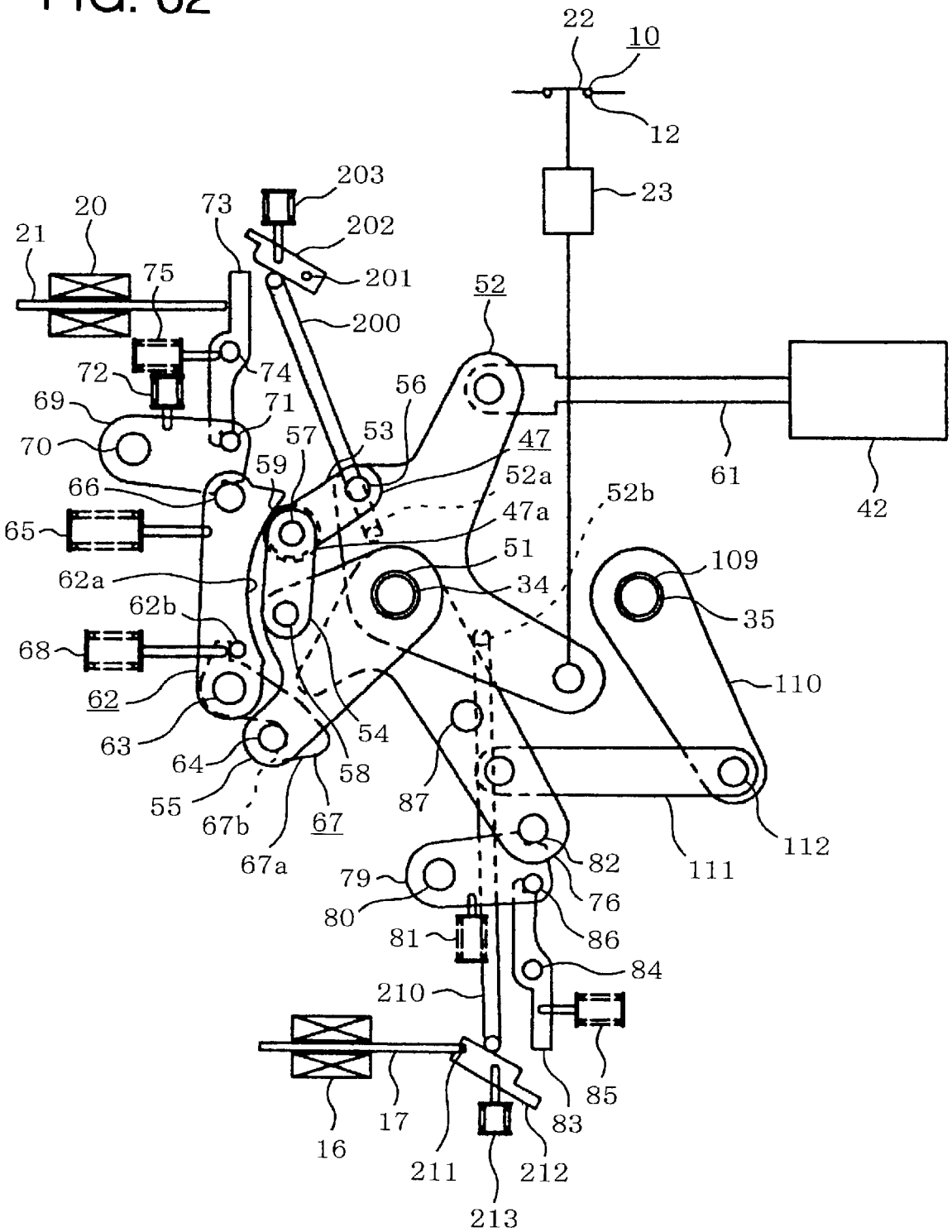
FIG. 62 illustrates a structure of an important portion of a control device for a breaker according to Embodiment 11 of the present invention, wherein the breaker is in a state of closing the circuit, and both of a closing torsion bar and an opening torsion bar are prestressed.
Figure 63:
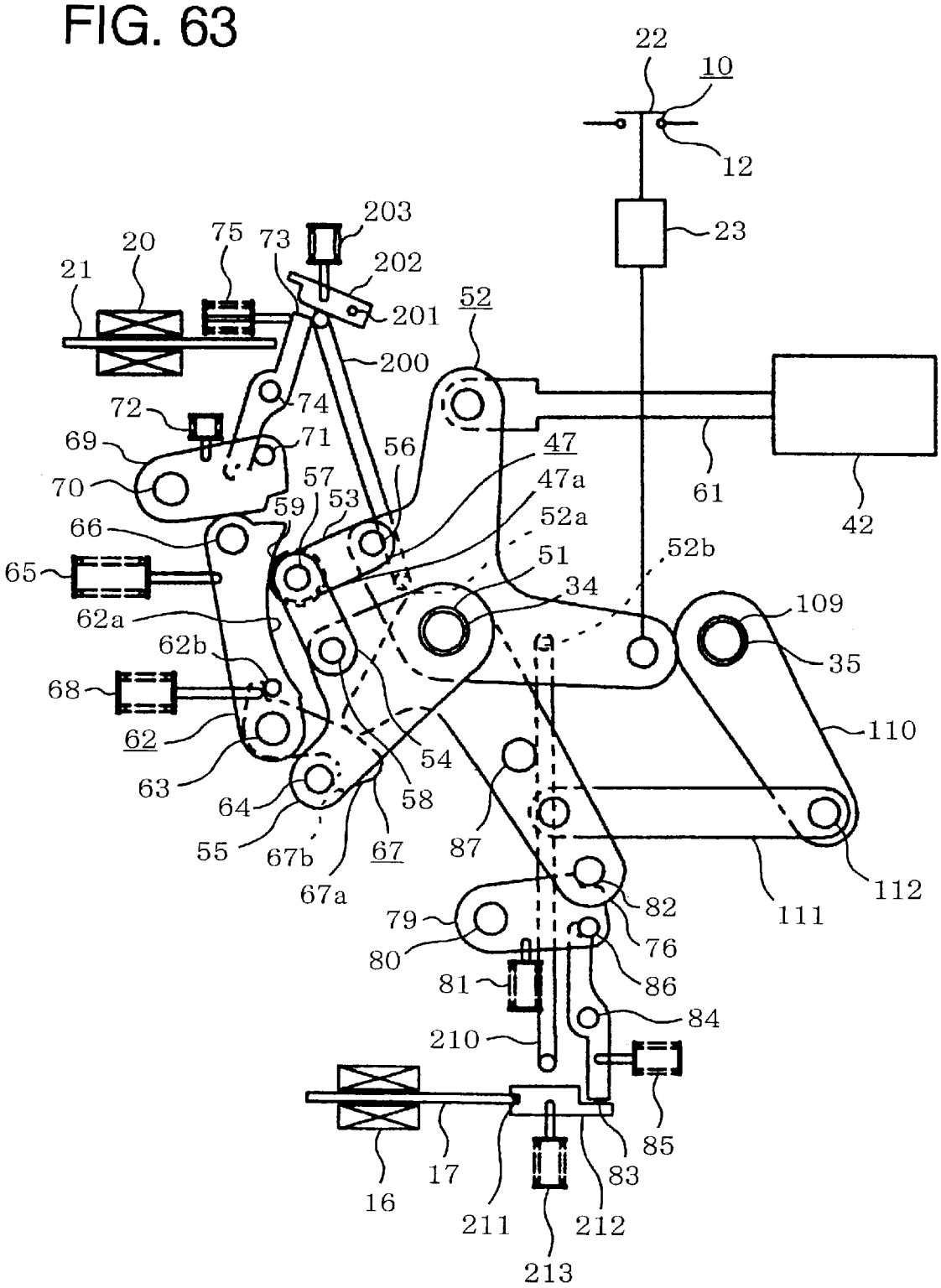
FIG. 63 illustrates a structure of the important portion of the control device for breaker according to Embodiment 11 of the present invention, wherein a state in course of an operation of opening the circuit from the state illustrated in FIG. 62 is shown.
Figure 64:
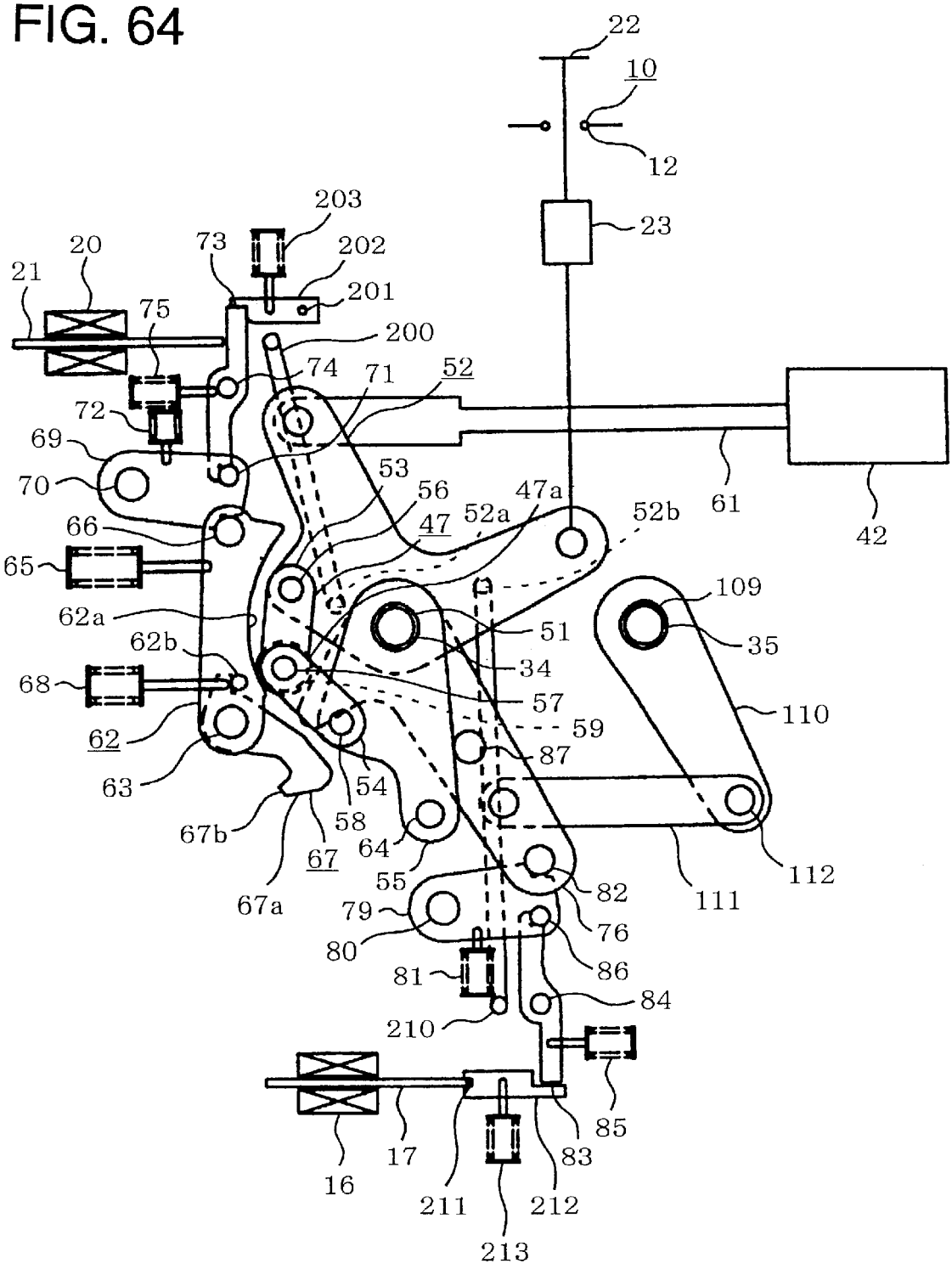
FIG. 64 illustrates a structure of the important portion of the control device for breaker according to Embodiment 11 of the present invention, wherein the breaker is in a state of opening the circuit, the closing torsion bar is prestressed, and the opening torsion bar is released.

A control device for a breaker according to Embodiment 11 of the present invention will be described in reference of figures. FIGS. 62 through 67 illustrate the control device for the breaker according to Embodiment 11 of the present invention. FIG. 62 illustrates a structure of an important portion of the control device for breaker, wherein the breaker is in a state of closing the circuit, and both of torsion bars for closing the circuit and torsion bars for opening the circuit are prestressed. FIG. 63 illustrates a structure of the important portion of the control device for breaker, wherein a state in course of an operation of opening the circuit from the state illustrated in FIG. 62 is shown. FIG. 64 illustrates a structure of the important portion of the control device for breaker, wherein the breaker is in a state of opening the circuit, the torsion bars for closing the circuit are prestressed and the torsion bars for opening the circuit are released.

Figure 65:
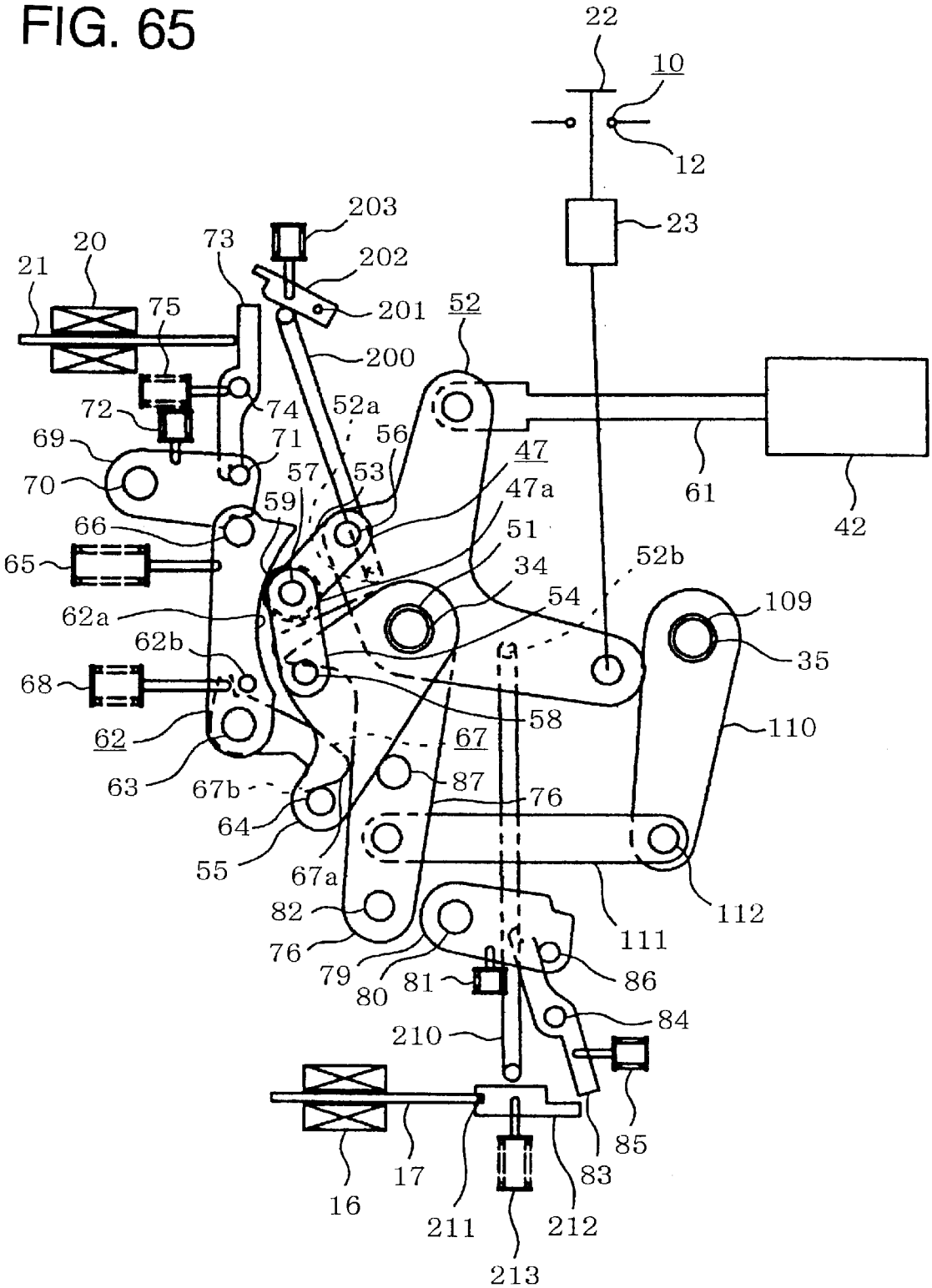
FIG. 65 illustrates a structure of the important portion of the control device for breaker according to Embodiment 11 of the present invention, wherein a state in course of an operation of closing the circuit from the state illustrated in FIG. 64 is shown.
Figure 66:
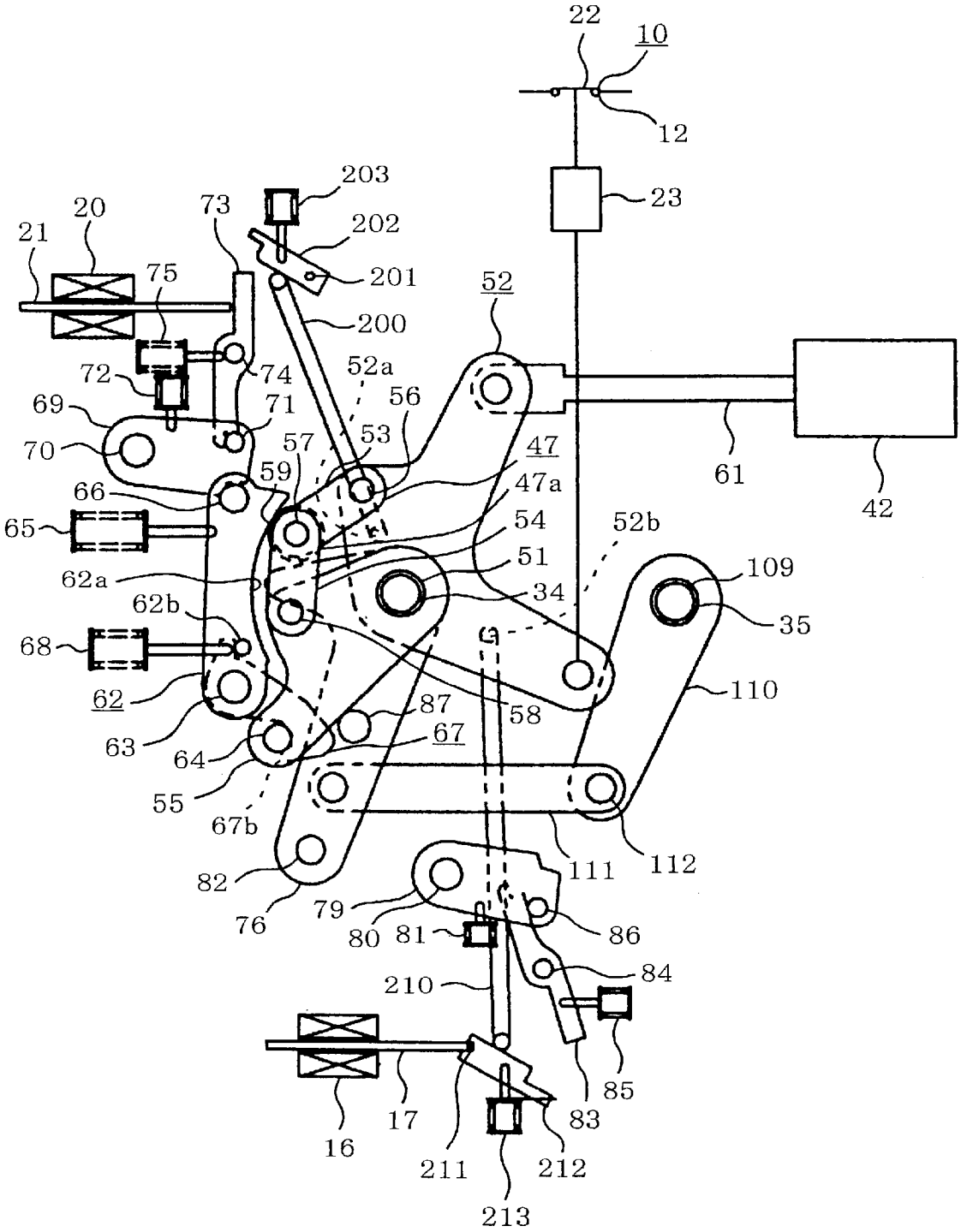
FIG. 66 illustrates a structure of the important portion of the control device for breaker according to Embodiment 11 of the present invention, wherein an operation of closing the circuit is completed, the closing torsion bar is released, and the opening torsion bar is prestressed.
Figure 67:
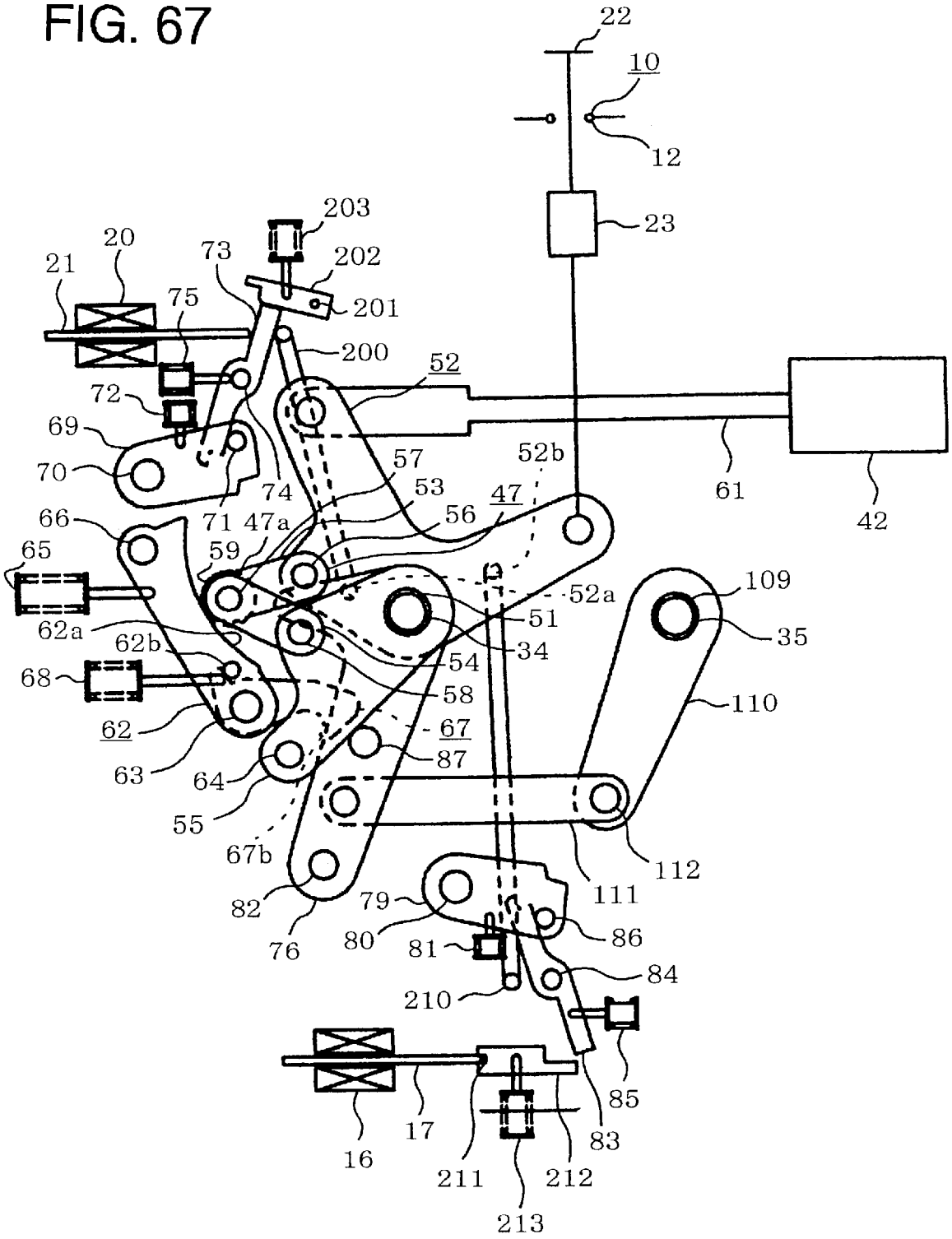
FIG. 67 illustrates a structure of the important portion of the control device for breaker according to Embodiment 11 of the present invention, which is a state that a second opening operation is completed immediately after an operation of rapidly reclosing the circuit, wherein the breaker is in a state of opening the circuit, and both of the closing torsion bar and the opening torsion bar are released.

FIG. 65 illustrates a structure of the important portion of the control device for breaker, wherein a state in course of an operation of closing the circuit from a state illustrated in FIG. 64 is shown. FIG. 66 illustrates a structure of the important portion of the control device for breaker, wherein the operation of closing the circuit is completed, the torsion bars for closing the circuit are released, and the torsion bars for opening the circuit are prestressed. FIG. 67 illustrates a structure of the important portion of the control device for breaker, where a state that a second operation of opening the circuit is completed immediately after an operation of rapidly reclosing the circuit, wherein the breaker is in the state of opening the circuit, and both of the torsion bars for closing the circuit and the torsion bars for opening the circuit are released.

In Embodiment 11, the first locking member 200, connected to the first breaking lever 52 described in Embodiment 6, and the second locking member 210, connected to the first breaking lever 52 described in Embodiment 7, are located in the control device for breaker using the torsion bars as the prestressing means described in Embodiment 1, wherein a size and a weight of the control device for breaker using the torsion bars as the prestressing means can be further reduced.

Hereinbelow, an explanation will be given in reference of figures. In FIGS. 62 through 67, an end of torsion bars for closing the circuit is fixed to an inside of a making shaft 109. The torsion bars are not illustrated in FIGS. 62 through 67 (vide the torsion bar 35 in FIG. 4). A lever 110, fixed to the making shaft 109, receives a releasing force of clockwise rotating from the torsion bars. A making lever 76 is located around a main shaft 51 so as to be rotatable, connected to the lever 110 through a linkage 111 and a pin 112, and receives the releasing force of clockwise rotating from the torsion bars.

The other structure is similar to that in Embodiment 10 in reference of FIG. 56, and the same numerical references are used for corresponding portions and description of these portions is omitted.

In FIGS. 62 through 67, the case 1 and the stopper 104 illustrated in FIG. 56 is omitted.

Further, because the operation is the same as that in Embodiment 10, a description thereof is omitted.

Embodiment 12

Figure 68:
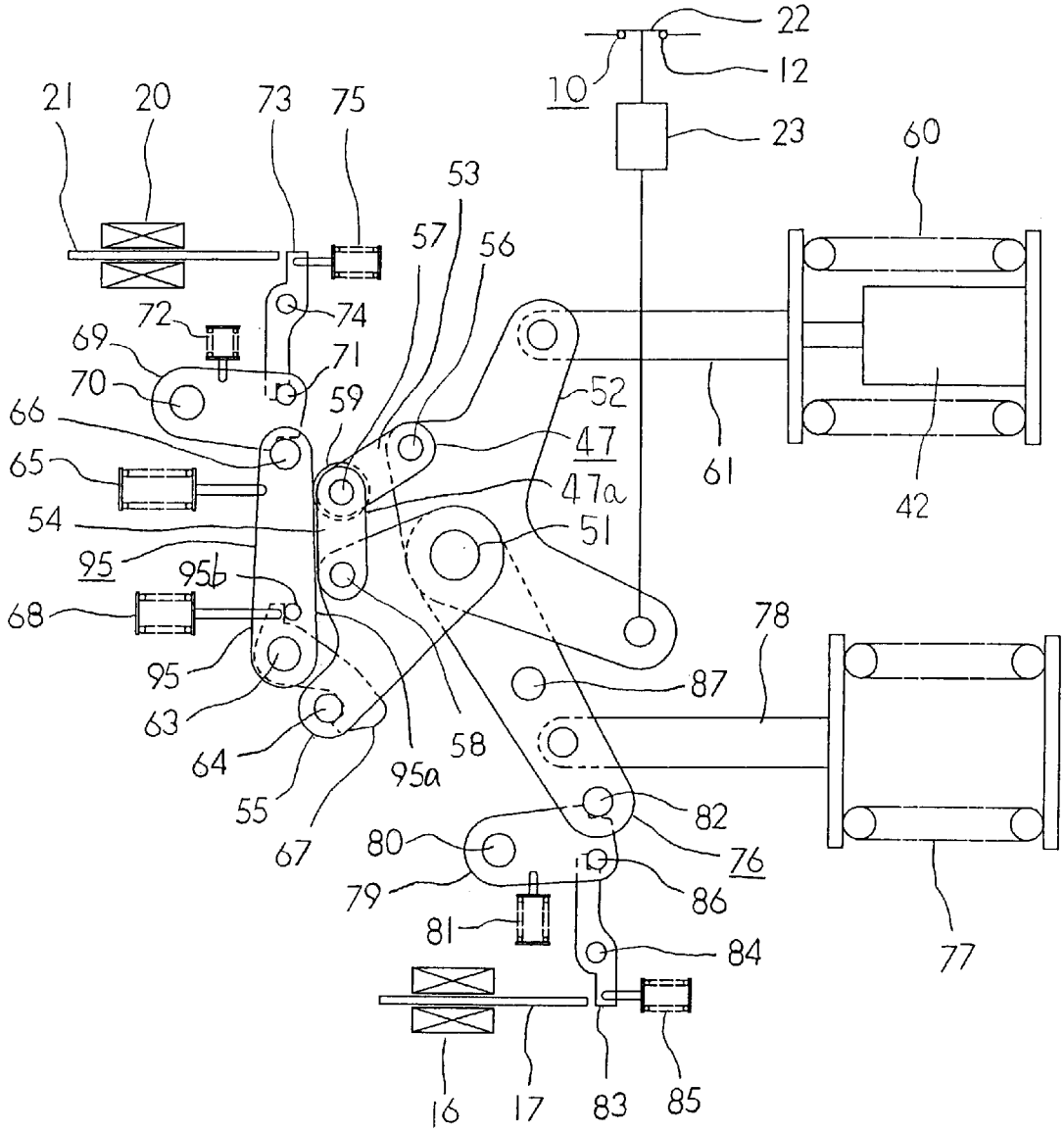
FIG. 68 illustrates a structure of an important portion of a control device for a breaker according to Embodiment 12 of the present invention, wherein the breaker is in a state of closing a circuit, and a closing coil spring and an opening coil spring are prestressed.

A control device according to Embodiment 12 of the present invention will be described in reference of figures. FIG. 68 illustrates a structure of an important portion of the control device in a state that a breaker is in a state of closing a circuit according to Embodiment 12 of the present invention, wherein the breaker is in the state of closing the circuit, and a coil spring 77 for closing the circuit and a coil spring 60 for opening the circuit are prestressed. In this embodiment, a structure of the guide 62 described in Embodiment 3 is changed.

Numerical reference 95 designates a guide, located around a rotational shaft 63 so as to be rotatable. Numerical reference 65 designates a spring for urging the guide 95 so as to rotate in a clockwise direction around the rotational shaft 63. The guide 95 has a plane 95*a* and a pin 95*b*, fixed to a main body of the guide 95, wherein the pin 95*b* is similar to the pin 62*b*, illustrated in FIG. 15, and is engaged with a second releasing latch 67.

Because the structure is similar to that in Embodiment 3, the same numerical references are used for corresponding portions, and description of these portions is omitted.

Although an operation of opening the circuit, an operation of closing the circuit, and an operation of prestressing the coil spring for closing the circuit are similar to those described in Embodiment 3, a supplementary explanation of the operation of closing the circuit will be given below.

In a similar manner to that in Embodiment 3, a making latch 79 releases an engagement of a making lever 76, the making lever 76 starts to rotate in a clockwise direction around a main shaft 51, and further a second breaking lever 55 is pushed by a pin 87 of a making lever 76 and rotated in a clockwise direction. Because the guide 95 is engaged with a first releasing latch 69, a rotor 59 is in contact with the plane 95*a* of the guide 95 and rotated so as to be guided.

In association with the rotation of the second breaking lever 55 in the clockwise direction, the second linkage 54, the rotor 59, the first linkage 53, and the first breaking lever 52 are rotated in a clockwise direction around the main shaft 51 at the same time, and a movable contact 22 is driven in a direction of closing the circuit, and simultaneously the coil spring 60 for opening the circuit is prestressed. When the second breaking lever 55 is rotated in the clockwise direction by a predetermined angle, the second releasing latch 67 is engaged with a pin 64, located in the second breaking lever 55, whereby the operation of closing the circuit and an operation of prestressing the coil spring 60 for opening the circuit are completed. FIG. 68 illustrates a state that the coil spring 77 for closing the circuit is further prestressed from this state.

Meanwhile, because a surface, on which the rotor 59 is rotated and guided, is the plane 95*a*, as the operation for closing the circuit progresses so as to be completed, in other words, as the second breaking lever 55 is rotated in the clockwise direction, a distance between the rotor 59 and the main shaft 51 is increased, and a rotational angle of a first breaking lever 52 with respect to a rotational angle of the second breaking lever 55 becomes relatively small, whereby a torque of the first breaking lever 52 becomes larger than a torque of the second breaking lever 55. In other words, when the operation of closing the circuit is almost completed, it is possible to increase a torque of the first breaking lever 52.

Although a force, generated by the spring, is generally decreased along with a release thereof. In use of the above structure, it is possible to compensate a property of the coil spring 77 for closing the circuit, of which releasing force is decreased in a final stage of the release. Further, by controlling an angle of the plane 95*a*, it is possible to relatively increase or decrease a torque of the first breaking lever 52 with respect to a torque of the making lever 76 at a time of starting the operation of closing the circuit or of finishing the operation of closing the circuit.

Additionally, by forming an arbitrary guiding surface for rotating the rotor instead of the plane 95*a* of the guide 95, it is possible to further freely control the torque of the first breaking lever 52.

The guide 95 is also applicable to the other embodiments beside Embodiment 3, and effects similar to those in the other embodiments are demonstrated.

Embodiment 13

Figure 69:
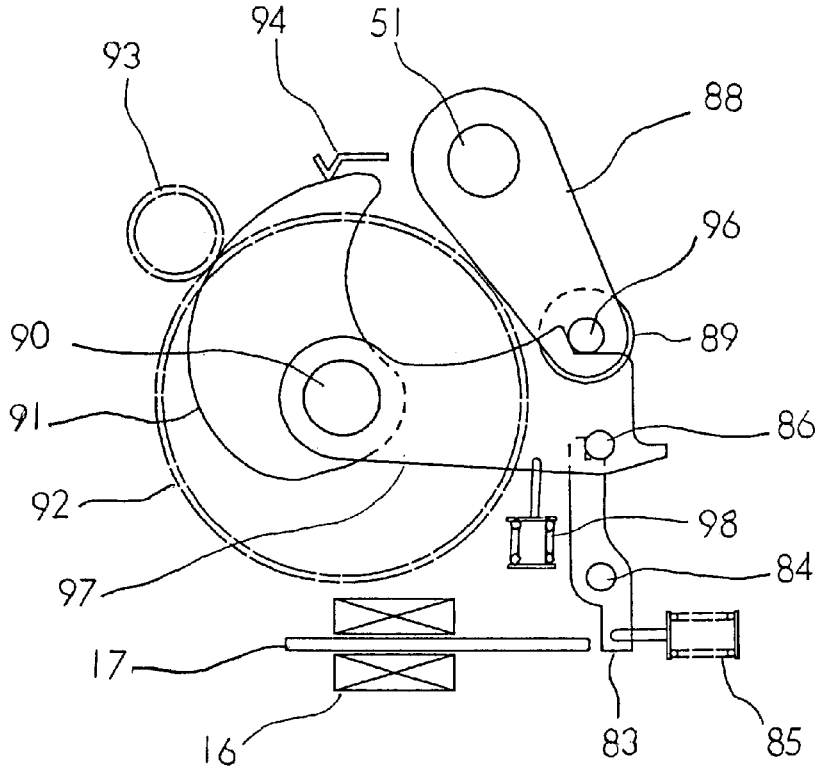
FIG. 69 illustrates a structure of an important portion of a prestressing device for a control device for a breaker according to Embodiment 13 of the present invention.

A control device for a breaker according to Embodiment 13 of the present invention will be described in reference of figures. FIG. 69 illustrates a structure of an important portion of a prestressing device for a coil spring 77 for closing the circuit according to Embodiment 13 of the present invention. In FIG. 69, numerical reference 96 designates a rotational shaft for supporting a second rotor 89, located in a lever 88 so as to be freely rotatable; and numerical reference 97 designates a making latch, located in a camshaft 90 so as to be rotatable, which is substituted by the making latch 79 described in Embodiment 3, wherein the making latch 97 is engaged with a rotational shaft 96 to secure and retain the lever 88, illustrated in FIG. 69, and a making lever 76, integrally fixed to the lever 88 as in FIG. 1.

Numerical reference 98 designates a spring for urging the making latch 97 in a counterclockwise direction. In a manner similar to that in Embodiment 1, a pin 86 is located in the making latch 97, and the pin 86 is engaged with a trigger 83.

Because the other structure is similar to that in Embodiment 1, the same numerical references are used for corresponding portions, and descriptions of these portions is omitted.

Because the making latch 97 and a cam 91 are commonly located in the camshaft 90 as a rotational shaft, it is possible to omit the rotational shaft 80 described in Embodiment 1, whereby the device can be miniaturized.

The prestressing device may be applicable to the other embodiments besides Embodiment 1, and similar effects are demonstrated.

Further, the prestressing means is not limited to the above-mentioned torsion bars and the above-mentioned coil springs, and may be the other elastic members, e.g. an air spring, a rubber, a combination of a tank for storing a compressed air and an air cylinder, connected to the tank, and so on. Further, effects similar to those in the make break switch are demonstrated if the make break switch is substituted by an isolator, a load-break switch, or the like.

The first advantage of the device according to the present invention is that the operation of opening the circuit can be immediately started without waiting for the engagement between the first releasing latch and the guide when the circuit is completely closed.

The second advantage of the device according to the present invention is that mechanical strengths of the making lever, the first breaking lever, the second breaking lever, and so on can be decreased, and the device can be miniaturized.

The third advantage of the device according to the present invention is that the first releasing latch rotated in course of the close of the circuit so as not to release the engagement of the guide by the first releasing latch, whereby the device is miniaturized.

The fourth advantage of the device according to the present invention is that it is possible to prevent an excessive impact, caused by a collision, from occurring by receiving a releasing force of the prestressing means for closing the circuit, left after the operation of closing the circuit, by the stopper.

The fifth advantage of the device according to the present invention is that the prestressing means having good energy efficiency without a concentration of a stress can be realized.

The sixth advantage of the device according to the present invention is that the prestressing means becomes compact.

The seventh advantage of the device according to the present invention is that the number of the components are reduced and the structure is simplified.

The eighth advantage of the device according to the present invention is that the number of the components are decreased, the structure is simplified, and the device is miniaturized.

The ninth advantage of the device according to the present invention is that the locus of the connecting portion can be controlled in use of a simple structure.

The tenth advantage of the device according to the present invention is that the guiding surface can be easily processed, and a torque of the prestressing means for closing the circuit, which is transmitted to the first breaking lever at a time of starting or finishing an operation of closing the circuit, can be increased.

The eleventh advantage of the device according to the present invention is that a prestressing energy of the prestressing means for closing the circuit can be efficiently transmitted to the first breaking lever.

The twelfth advantage of the device according to the present invention is that a torque of a load, applied to the motor when the prestressing means for closing the circuit is prestressed, can be controlled by adjusting a shape of the cam, and a maximum torque, applied to parts of the prestressing device, can be reduced.

The thirteenth advantage of the device according to the present invention is that the cam, rotating by inertia, can be broken so as to be rapidly stopped.

The fourteenth advantage of the device according to the present invention is that it is unnecessary to separately locate the shaft for supporting the making latch, whereby the number of the components are reduced.

The fifteenth advantage of the device according to the present invention is that the control device, preferable for controlling a breaker, is obtainable.

Obviously, numerous modifications and variations of the present invention are possible in light of the above teachings. It is therefore to be understood that within the scope of the appended claims, the invention may be practiced otherwise than as specifically described herein.

The entire disclosures of Japanese Patent Application No. 2000-177671 filed on Jun. 14, 2000 and Japanese Patent Application No. 2000-347371 filed on Nov. 15, 2000 including specifications, claims, drawings and summaries are incorporated herein by reference in their entireties.

What is claimed is:

1. A control device for a make break switch comprising:

a first breaking lever rotatably supported by a supporting structural member and connected to a make break contact;

prestressing means for opening a circuit, urging the first breaking lever to rotate in a first direction;

a linkage having a first link connected to the first breaking lever, a second link, and a collapsible connecting portion connecting the first linkage to the second linkage;

a second breaking lever rotatably supported by the supporting structural member and connected to the second link;

a making lever rotatably supported by the supporting structural member and in contact with or separated from the second breaking lever;

prestressing means for closing the circuit, urging the making lever to rotate in a second direction opposite to the first direction;

a making latch for securing the making lever;

a guide having a guiding surface for guiding the connecting portion, while in contact with the connecting portion, and movably supported by the supporting structural member;

a first releasing latch for securing the guide; and a second releasing latch for securing the second breaking lever in association with movement of the guide, wherein by releasing engagement between the first releasing latch and the guide, the guide is pushed and moved by the connecting portion, engagement between the second releasing latch, moving in association with the guide, and the second breaking lever is released, and the first breaking lever is rotated in the first direction when the prestressing means for opening the circuit is released to open the make break contact, by rotating the first breaking lever in the first direction by a first angle, the guide is engaged again with the first releasing latch, by releasing engagement of the making lever by the making latch, the prestressing means for closing the circuit is released, the second breaking lever is rotated by the making lever in the second direction, and the first breaking lever is rotated in the second direction by the linkage while the connecting portion is guided by the guiding surface of the guide, which is engaged with the first releasing latch, to close the make break contact and to prestress the prestressing means for opening the circuit, and by engaging the second breaking lever with the second releasing latch, a prestressing state of the prestressing means for opening the circuit and a closed state of the make break contact are maintained.

2. The control device for the make break switch according to claim 1, further comprising a member preventing opening of the circuit, preventing operation of the first releasing latch when the make break contact is closing the circuit, in association with rotation of the making lever or of the first breaking lever.

3. The control device for the make break switch according to claim 2, including a rotatable releasing trigger located in the supporting structural member, wherein engagement of the guide by the first releasing latch is released by rotating the releasing trigger, and the member preventing opening of the circuit moves in association with rotation of the making lever or of the first breaking lever to stop rotation of the releasing trigger when the make break contact is closing the circuit.

4. The control device for the make break switch according to claim 2, further comprising a stopper for receiving a releasing force of the prestressing means for closing the circuit when the prestressing means for closing the circuit is being released or has been released, and the guide is disengaged from the first releasing latch.

5. The control device for the make break switch according to claim 1, further comprising a member preventing closing of the circuit which stops the making latch when the make break contact is closed, in association with rotation of the first breaking lever.

6. The control device for the make break switch according to claim 5, including a rotatable making trigger located in the supporting structural member, wherein engagement of the making lever with the making latch is released by rotating the making trigger, and the member preventing closing of the circuit prevents rotation of the making trigger when the make break contact is closing the circuit by moving in association with rotation of the first breaking lever.

7. The control device for the make break switch according to claim 1, further comprising:

a member preventing opening of the circuit, which prevents operation of the first releasing latch when the make break contact is opened, in association with rotation of the making lever or of the first breaking lever, and a member preventing closing of the circuit, which prevents operation of the making latch when the make break contact is closed, in association with rotation of the first breaking lever.

8. The control device for the make break switch according to claim 6, including a rotatable releasing trigger and a rotatable making trigger located in the supporting structural member, wherein engagement of the guide with the first releasing latch is released by rotating the releasing trigger, and engagement of the making lever with the making latch is released by rotating the making trigger, and the member preventing opening of the circuit stops rotation of the releasing trigger when the make break contact is closing the circuit, in association with the rotation of the making lever or of the first breaking lever.

9. The control device for the make break switch according to claim 1, wherein the prestressing means for opening the circuit and the prestressing means for closing the circuit are torsion bars.

10. The control device for the make break switch according to claim 1, wherein the prestressing means for opening the circuit and the prestressing means for closing the circuit are coil springs.

11. The control device for the make break switch according to claim 1, wherein the first breaking lever and the second breaking lever are commonly supported by a rotatable supporting shaft located in the supporting structural member.

12. The control device for the make break switch according to claim 1, wherein the second breaking lever and the making lever are commonly supported by a rotating supporting shaft located in the supporting structural member.

13. The control device for the make break switch according to claim 1, wherein the first breaking lever, the second breaking lever, and the making lever are commonly supported by a rotatable supporting shaft located in the supporting structural member.

14. The control device for the make break switch according to claim 1, wherein the guide and the second releasing latch are commonly supported by a rotatable supporting shaft located in the supporting structural member.

15. The control device for the make break switch according to claim 1, wherein the first breaking lever and the second breaking lever are commonly supported by a rotatable supporting shaft, located in the supporting structural member, and the guiding surface of the guide is an arched surface, having center of curvature positioned at a center of the supporting shaft when the guide is engaged with the first releasing latch.

16. The control device for the make break switch according to claim 15, wherein the connecting portion of the linkage includes a rotor in contact with the guiding surface of the guide and guided by rotating.

17. The control device for the make break switch according to claim 1, wherein the first breaking lever and the second breaking lever are commonly supported by a rotatable supporting shaft located in the supporting structural member, and the guiding surface of the guide is a plane.

18. The control device for the make break switch according to claim 17, wherein the connecting portion of the linkage includes a rotor in contact with the guiding surface of the guide and guided by rotating.

19. The control device for the make break switch according to claim 1, wherein the prestressing means for closing the circuit is prestressed by a prestressing device which drives the making lever with a cam driven by a motor.

20. The control device for the make break switch according to claim 19, wherein the prestressing device has a breaking member which slides on the cam and is elastically deformed to break the cam.

21. The control device for the make break switch according to claim 19, wherein making latch is rotatably located around a shaft for the cam, by engaging the making lever with the making latch, the prestressing means for closing the circuit is retained in a prestressing state, and by releasing engagement between the making latch and the making lever, the prestressing means for closing the circuit is released.

22. The control device for the make break switch according to claim 1, wherein the make break switch is a breaker.

* * * * *